US010538810B2

(12) United States Patent
Ziesche

(10) Patent No.: US 10,538,810 B2
(45) Date of Patent: *Jan. 21, 2020

(54) METHODS OF DIAGNOSING CHRONIC OBSTRUCTIVE PULMONARY DISEASE (COPD) USING NOVEL MOLECULAR BIOMARKERS

(71) Applicant: Transgenion—International Institute for Regenerative Translational Medicine GmbH, Vienna (AT)

(72) Inventor: Rolf Ziesche, Neusiedl am See (AT)

(73) Assignee: Transgenion—International Institute for Regenerative Translational Medicine GmbH, Vienna (AT)

( * ) Notice: Subject to any disclaimer, the term of this patent is extended or adjusted under 35 U.S.C. 154(b) by 0 days.

This patent is subject to a terminal disclaimer.

(21) Appl. No.: 15/316,258

(22) PCT Filed: Jun. 3, 2015

(86) PCT No.: PCT/EP2015/062440

§ 371 (c)(1),
(2) Date: Dec. 5, 2016

(87) PCT Pub. No.: WO2015/185658

PCT Pub. Date: Dec. 10, 2015

(65) Prior Publication Data

US 2017/0335393 A1 Nov. 23, 2017

(30) Foreign Application Priority Data

Jun. 5, 2014 (EP) ..... 14171385

(51) Int. Cl.
*C12Q 1/6883* (2018.01)
*A61K 31/44* (2006.01)

(52) U.S. Cl.
CPC ..... *C12Q 1/6883* (2013.01); *A61K 31/44* (2013.01); *C12Q 2600/106* (2013.01); *C12Q 2600/118* (2013.01); *C12Q 2600/158* (2013.01)

(58) Field of Classification Search
None
See application file for complete search history.

(56) References Cited

U.S. PATENT DOCUMENTS

2005/0208496 A1* 9/2005 Ohtani ..... C12Q 1/6809 435/6.18
2013/0165343 A1 6/2013 Robinson et al.
2013/0324428 A1* 12/2013 Ryu ..... C12Q 1/6876 506/9
2017/0107574 A1 4/2017 Ziesche
2017/0349947 A1 12/2017 Ziesche

FOREIGN PATENT DOCUMENTS

JP 2013-35871 2/2013
WO WO 2008/003701 1/2008
WO WO 2010/064702 6/2010
WO WO 2013/104990 7/2013

(Continued)

OTHER PUBLICATIONS

Bhattacharya et al. American J Respir Cell and Molec Biology. 2009. 40: 359-367.*
Liu et al Clinical Immunology. 2004. 112: 225-230.*
Coleman, R. Drug Discovery Today. 2003. 8: 233-235.*
Palmer et al. BMC Genomics. 2006. 7:115.*
Min et al BMC Genomics. 2010. 11:96.*
Haynes et al Electrophoresis. 1998. 19: 1862-1871.*
Chen et al. Molecular & Cellular Proteomics. 2002. 1: 304-313.*
Vogel et al Nature Review Genet. Mar. 2012. 13(4): 227-232.*
Affymetrix NetAffx. Expression Probeset Details for Human Genome U95 Sets for the KIA1199, TMSB15A, and DMBT1 genes, available via URL: <affynnetrix.com/analysis/netaffx/xmlquery.affx?netaffx=netaffx4_annot>, printed on Jan. 8, 2019, 14 pages.*

(Continued)

*Primary Examiner* — Carla J Myers
(74) *Attorney, Agent, or Firm* — Parker Highlander PLLC

(57) ABSTRACT

The present invention relates to in vitro methods for the diagnosis of chronic obstructive pulmonary disease (COPD), wherein the expression of the marker gene KIAA1199 is determined. In particular, the invention relates to an in vitro diagnostic method of assessing the susceptibility of a subject to develop progressive COPD involving the appearance of irreversible lung damage, wherein the expression of the marker gene KIAA1199 and optionally one or more further marker genes selected from DMBT1, TMSB15A, DPP6, SLC51B, NUDT11, ELF5, AZGP1, PRRX1, AQP3, SFN, GPR110, GDF15, RASGRF2, RND1, PLA1A, FGG, CEACAMS, HYAL2, AHRR, CXCL3, CYP1A1, CYP1B1, CYP1A2, CST6, NTRK2, COMP, ITGA10, CTHRC1, TAL1, FIBIN, BEX5, BEX1, ESM1 and GHRL is determined. The invention also relates to an in vitro method of diagnosing stable COPD or assessing the susceptibility of a subject to develop stable COPD, wherein the expression of KIAA1199 and optionally one or more further marker genes selected from DMBT1, TMSB15A, DPP6, SLC51B, NUDT11, ELFS, AZGP1, PRRX1, AQP3, SFN, GPR110, GDF15, RASGRF2, RND1, PLA1A, FGG, CEACAMS, HYAL2, AHRR, CXCL3, CYP1A1, CYP1B1, CYP1A2, CST6, NTRK2, COMP, ITGA10, CTHRC1, TAL1, FIBIN, BEX5, BEX1, ESM1 and GHRL is determined. Furthermore, the invention relates to the use of primers for transcripts of the aforementioned marker genes, the use of nucleic acid probes to transcripts of these marker genes, the use of microarrays comprising nucleic acid probes to transcripts of these marker genes, and the use of antibodies against the proteins expressed from these marker genes in corresponding in vitro methods. In vitro methods of monitoring the progression of COPD are also provided, in which the expression of marker genes according to the invention is determined.

20 Claims, 30 Drawing Sheets

Figure 1:
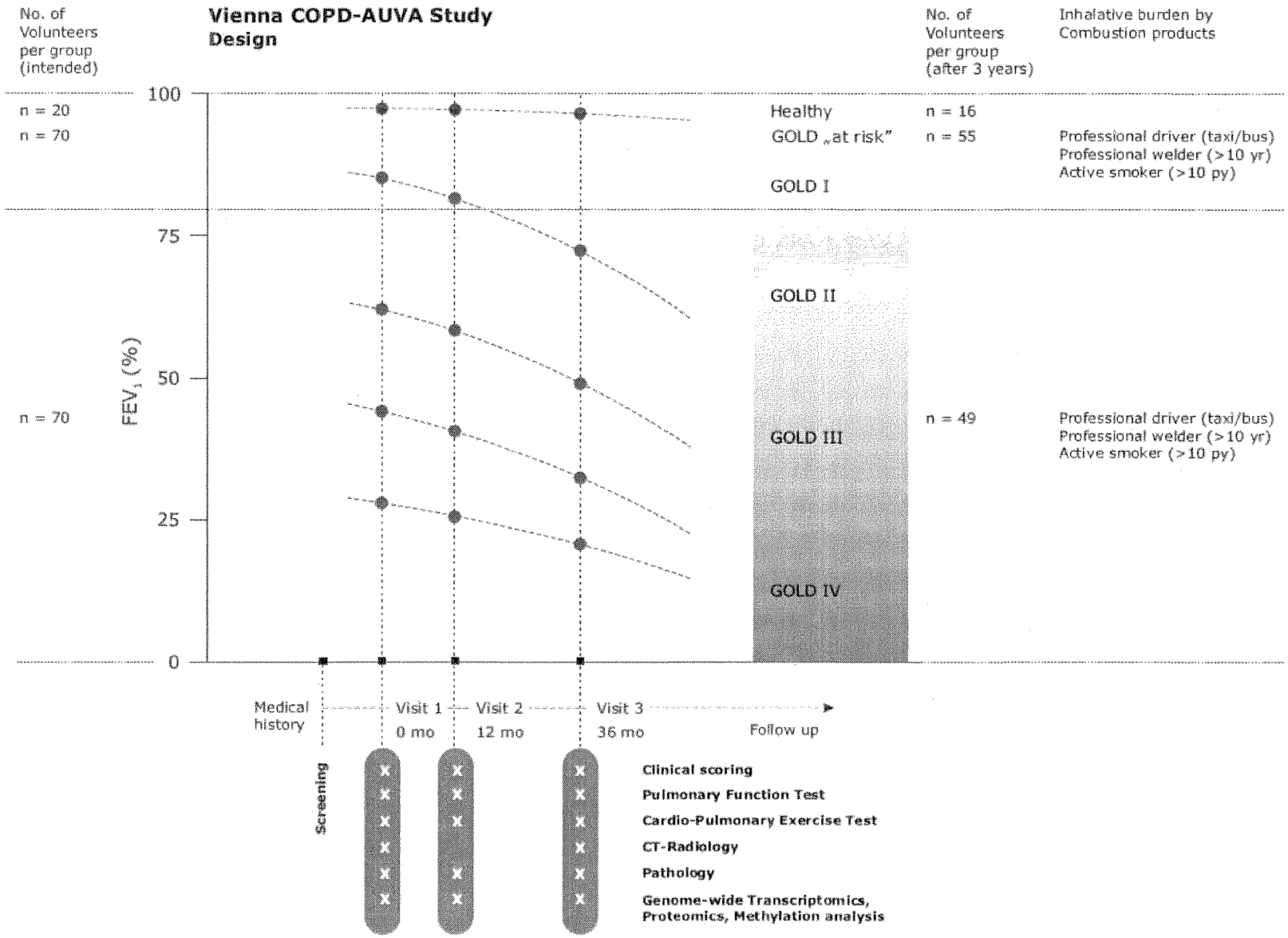

Specification includes a Sequence Listing.

(56) References Cited

FOREIGN PATENT DOCUMENTS

| | | |
|---|---|---|
| WO | WO 2013/177060 | 11/2013 |
| WO | WO 2013/190092 | 12/2013 |
| WO | WO 2015/185653 | 12/2015 |
| WO | WO 2015/185656 | 12/2015 |

OTHER PUBLICATIONS

Affymetrix Inc. Human Genome U95 Set. GeneChip® Human Genome U95 Set, available via URL: < tools.thermofisher.com/content/sfs/brochures/hgu95_datasheet.pdf>, 2001-2003, printed on Jan. 8, 2019, pp. 1-2.*

Bhattacharya et al., "Molecular biomarkers for quantitative and discrete COPD phenotypes," *American Journal of Respiratory and Cell and Molecular Biology*, 40(3):359-367, 2009.

Gosselink et al., "Differential expression of tissue repair genes in the pathogenesis of chronic obstructive pulmonary disease," *American Journal of Respiratory and Critical Care Medicine*, 181(12):1329-1335, 2010.

PCT International Preliminary Report on Patentability issued in International Application No. PCT/EP2015/062440, dated Dec. 15, 2016.

PCT International Search Report and Written Opinion issued in International Application No. PCT/EP2015/062440, dated Dec. 18, 2015.

Savarimuthu Francis et al., "Genes and gene ontologies common to airflow obstruction and emphysema in the lungs of patients with COPD," *PLOS ONE*, 6(3):e17442, 2011.

Steiling et al., "A dynamic bronchial airway gene expression signature of chronic.obstructive pulmonary disease and lung function impairment," *American Journal of Respiratory and Critical Care Medicine*, 187(9):933-942, 2013.

Bahr et al., "Peripheral blood mononuclear cell gene expression in chronic obstructive pulmonary disease", *Am. J. Respir. Cell Mol. Biol.*, 49:316-323, 2013.

Banyard et al., "Differential regulation of human thymosin beta 15 isoforms by transforming growth factor beta 1", *Genes Chromosomes Cancer*, 48(6):502-509, 2009.

Baye et al., "Roflumilast (Daliresp) A Novel Phosphodiesterase-4 Inhibitor for the Treatment of Severe Chronic Obstructive Pulmonary Disease", *Pharm. Ther.*, 37(3):149-150, 157-161, 2012.

Calverley et al., "Effect of 1-year treatment with roflumilast in severe chronic obstructive pulmonary disease", *Am. J. Respir. Crit. Care Med.*, 176:154-161, 2007.

Calverley et al., "Roflumilast in symptomatic chronic obstructive pulmonary disease: two randomised clinical trials", *Lancet*, 374:685-694, 2009.

Chan et al., "Integrating transcriptomics and proteomics", *G&P Magazine*, 6(3):20-26, 2006.

Hoshikawa et al., "Hypoxia induces different genes in the lungs of rats when compared with mice", *Phys. Genomics*, 12:209-219, 2003.

Kendrick et al., "A gene's mRNA level does not usually predict its protein level", Kendrick Labs, Inc., Sep. 25, 2014.

Llinas et al., "Similar gene expression profiles in smokers and patients with moderate COPD", *Pulm. Pharmacol. Ther.*, 24:32-41, 2011.

Maier et al., "Correlation of mRNA and protein in complex biological samples", *FEBS Lett.*, 583:3966-3973, 2009.

Pascal et al., "Correlation of mRNA and protein levels: cell type-specific gene expression of cluster designation antigens in the prostate", *BMC Genomics*, 9:246, 2008.

Rabe et al., "Roflumilast—an oral anti-inflammatory treatment for chronic obstructive pulmonary disease: a randomised controlled trial", *Lancet*, 366:563-571, 2005.

Renner et al., "DMBT1 confers mucosal protection in vivo and a deletion variant is associated with Crohn's disease", *Gastroenterol.*, 133:1499-1509, 2007.

Richens et al., "Systems biology coupled with label-free high-throughput detection as a novel approach for diagnosis of chronic obstructive pulmonary disease," *Respiratory Research*, 10(1):29, 2009.

Saito-Hisaminato et al., "Genome-wide profiling of gene expression in 29 normal human tissues with a cDNA microarray", *DNA Res.*, 9:35-45, 2002.

Spira et al., "Gene expression profiling of human lung tissue from smokers with severe emphysema", *Am. J. Respir. Care Mol. Biol.*, 31:601-610, 2004.

Steiling et al., "Personalized Management of Chronic Obstructive Pulmonary Disease via Transcriptomic Profiling of the Airway and Lung", *Ann. Am. Thorac.*, 10(Suppl.):S190-S196, 2013.

Van den Berge et al., "Airway gene expression in COPD is dynamic with inhaled corticosteroid treatment and reflects biological pathways associated with disease activity", *Thorax*, 69:14-23, 2014.

Whitehead et al., "Variation in tissue-specific gene expression among natural populations", *Genome Biol.*, 6:R13, 2005.

Office Action issued in Japanese Application No. 2017-516196, dated Jun. 4, 2019.

Office Action issued in Japanese Application No. 2017-516198, dated Jun. 4, 2019.

* cited by examiner

FIG. 3A

Healthy participants

| | | | Clinical strata | Age | GOLD | | | Bronchitis & Phlegm | | | Pack Years | Smoking habits | | |
|---|---|---|---|---|---|---|---|---|---|---|---|---|---|---|
| **Initials** | **Gender** | **ID** | **Healthy controls** | | **V1** | **V2** | **V3** | **V1** | **V2** | **V3** | **Total** | **V1** | **V2** | **V3** |
| AC | F | 145 | Healthy | 40.2 | 0 | 0 | 0 | n.a. | n.a. | n.a. | n.a. | -1 | -1 | -1 |
| BR | M | 24 | Healthy | 48.3 | 0 | 0 | 0 | n.a. | n.a. | n.a. | n.a. | -1 | -1 | -1 |
| GI | F | 159 | Healthy | 24.2 | 0 | 0 | 0 | n.a. | n.a. | n.a. | n.a. | -1 | -1 | -1 |
| HD | F | 44 | Healthy | 33.0 | 0 | 0 | 0 | n.a. | n.a. | n.a. | n.a. | -1 | -1 | -1 |
| KH | M | 35 | Healthy | 62.7 | 0 | 0 | 0 | n.a. | n.a. | n.a. | n.a. | -1 | -1 | -1 |
| LH | F | 161 | Healthy | 33.3 | 0 | 0 | 0 | n.a. | n.a. | n.a. | n.a. | -1 | -1 | -1 |
| MA | F | 158 | Healthy | 24.2 | 0 | 0 | 0 | n.a. | n.a. | n.a. | n.a. | -1 | -1 | -1 |
| MO | F | 31 | Healthy | 41.5 | 0 | 0 | 0 | n.a. | n.a. | n.a. | n.a. | -1 | -1 | -1 |
| SE | M | 57 | Healthy | 35.6 | 0 | 0 | 0 | n.a. | n.a. | n.a. | n.a. | -1 | -1 | -1 |
| SH | M | 23 | Healthy | 45.2 | 0 | 0 | 0 | n.a. | n.a. | n.a. | n.a. | -1 | -1 | -1 |
| SS | M | 34 | Healthy | 27.2 | 0 | 0 | 0 | n.a. | n.a. | n.a. | n.a. | -1 | -1 | -1 |
| TK | F | 163 | Healthy | 24.6 | 0 | 0 | 0 | n.a. | n.a. | n.a. | n.a. | -1 | -1 | -1 |
| TT | M | 50 | Healthy | 58.9 | 0 | 0 | 0 | n.a. | n.a. | n.a. | n.a. | -1 | -1 | -1 |
| WH | M | 123 | Healthy | 27.0 | 0 | 0 | 0 | n.a. | n.a. | n.a. | n.a. | -1 | -1 | -1 |
| WW | M | 155 | Healthy | 28.2 | 0 | 0 | 0 | n.a. | n.a. | n.a. | n.a. | -1 | -1 | -1 |
| ZB | M | 128 | Healthy | 28.0 | 0 | 0 | 0 | n.a. | n.a. | n.a. | n.a. | -1 | -1 | -1 |
| | | | | | | | | | | | | | | |
| | | n **16** | Age (yrs, mean) | **36.4** | | | | | | | | | | |

FIG. 3B

COPD "at risk" at Visit 1 (Gold 0)

| | | | Clinical strata | Age | GOLD | | | Intensity of Bronchitis | | | Pack Years | Smoking habits | | |
|---|---|---|---|---|---|---|---|---|---|---|---|---|---|---|
| Initials | Gender | ID | COPD "at risk" | | V1 | V2 | V3 | V1 | V2 | V3 | Total | V1 | V2 | V3 |
| AA | M | 1 | Car/Bus driver COPD °0 | 42.0 | 0 | 0 | 0 | 2 | 2 | 2 | 30 | 4 | 4 | 4 |
| BH | M | 140 | Welder COPD °0 | 31.2 | 0 | 0 | 0 | 1 | 2 | 3 | 16 | 5 | 5 | 5 |
| BM | M | 106 | Welder COPD °0 | 40.2 | 0 | 0 | 0 | 3 | 0 | 0 | 10 | 3 | 0 | 0 |
| BR | M | 166 | Welder COPD °0 | 37.7 | 0 | 0 | 0 | 3 | 1 | 1 | 15 | 3 | 3 | 2 |
| DA | M | 84 | Welder COPD °0 | 46.4 | 0 | 2 | 0 | 0 | 0 | 0 | 13 | 2 | 2 | 1 |
| DM | F | 88 | Car/Bus driver COPD °0 | 50.2 | 0 | 1 | 1 | 0 | 0 | 1 | 70 | 3 | 2 | 2 |
| DE | M | 103 | Welder COPD °0 | 33.0 | 0 | 0 | n.d. | 3 | 1 | n.d. | 6 | 1 | 2 | n.d. |
| ER | M | 165 | Welder COPD °0 | 40.7 | 0 | 0 | n.d. | 0 | -1 | n.d. | 30 | 2 | 2 | n.d. |
| EF | M | 25 | Car/Bus driver COPD °0 | 53.0 | 0 | 0 | 0 | 1 | 1 | 0 | 25 | 0 | 0 | 0 |
| ES | M | 39 | Car/Bus driver COPD °0 | 67.7 | 0 | 0 | 0 | 0 | 2 | 2 | 150 | 6 | 5 | 5 |
| FE | F | 131 | Car/Bus driver COPD °0 | 64.7 | 0 | 0 | 0 | 1 | 1 | 0 | 8 | 0 | 0 | 0 |
| GT | M | 134 | Car/Bus driver COPD °0 | 47.5 | 0 | 2 | 1 | 2 | 2 | 0 | 45 | 5 | 4 | 4 |
| HJ | M | 20 | Car/Bus driver COPD °0 | 50.4 | 0 | 0 | 0 | 3 | 3 | 3 | 15 | 2 | 2 | 2 |
| HA | F | 72 | Car/Bus driver COPD °0 | 49.2 | 0 | 0 | 0 | 0 | 0 | 0 | 14 | 2 | 2 | 2 |
| HK | M | 97 | Car/Bus driver COPD °0 | 52.1 | 0 | 0 | 0 | 3 | 3 | 2 | 40 | 2 | n.d. | n.d. |
| JW | M | 40 | Car/Bus driver COPD °0 | 68.8 | 0 | 0 | 0 | 1 | 1 | 1 | 20 | 5 | 5 | 5 |
| JS | F | 32 | Car/Bus driver COPD °0 | 46.5 | 0 | 0 | 0 | 0 | 0 | 1 | 10 | 1 | 1 | 1 |
| KR | M | 86 | Car/Bus driver COPD °0 | 49.5 | 0 | 0 | 0 | 0 | 0 | 0 | 30 | 3 | 3 | 3 |
| KE | M | 176 | Welder COPD °0 | 50.7 | 0 | 2 | n.d. | 2 | 2 | n.d. | 55 | 5 | 3 | n.d. |
| KJ | M | 168 | Welder COPD °0 | 32.1 | 0 | 0 | 0 | 2 | 2 | 1 | 10 | 3 | 0 | 1 |
| KG | M | 16 | Car/Bus driver COPD °0 | 43.8 | 0 | 0 | 0 | 0 | 0 | 0 | 20 | 3 | 3 | 3 |
| KEM | F | 101 | Car/Bus driver COPD °0 | 65.2 | 0 | 0 | 0 | 2 | 2 | 3 | 40 | 3 | 4 | 4 |
| KJ | M | 13 | Car/Bus driver COPD °0 | 54.2 | 0 | 0 | 0 | 0 | 0 | -1 | 35 | 5 | 0 | 0 |
| KH | M | 47 | Car/Bus driver COPD °0 | 65.5 | 0 | 0 | 0 | 0 | -1 | -1 | 50 | 3 | 5 | 3 |
| LJ | M | 4 | Car/Bus driver COPD °0 | 56.3 | 0 | 1 | n.d. | 0 | 0 | n.d. | 40 | 0 | 0 | n.d. |
| MT | M | 154 | Welder COPD °0 | 37.6 | 0 | 0 | 2 | 2 | 3 | 1 | 20 | 3 | 2 | 2 |
| MW | M | 58 | Car/Bus driver COPD °0 | 58.4 | 0 | 0 | 0 | 1 | 1 | 1 | 30 | 0 | 0 | 0 |
| MP | M | 79 | Welder COPD °0 | 53.2 | 0 | 0 | 0 | 0 | 0 | 1 | 32 | 3 | 4 | 3 |

FIG. 3B Cont.

| | | | Clinical strata | Age | GOLD | | | Intensity of Bronchitis | | | Pack Years | Smoking habits | | |
|---|---|---|---|---|---|---|---|---|---|---|---|---|---|---|
| Initials | Gender | ID | COPD "at risk" | | V1 | V2 | V3 | V1 | V2 | V3 | Total | V1 | V2 | V3 |
| MS | M | 10 | Car/Bus driver COPD °0 | 36.3 | 0 | 0 | 0 | 1 | 1 | 0 | 18 | 3 | 3 | 3 |
| OI | M | 167 | Welder COPD °0 | 52.7 | 0 | 0 | n.d. | 1 | 0 | n.d. | 10 | 0 | 0 | n.d. |
| PC | M | 139 | Car/Bus driver COPD °0 | 61.8 | 0 | 2 | n.d. | 1 | 1 | n.d. | 30 | 0 | 0 | n.d. |
| PEM | M | 90 | Welder COPD °0 | 46.1 | 0 | 0 | 0 | 2 | 2 | 3 | 17 | 1 | 1 | 0 |
| PEM | M | 74 | Welder COPD °0 | 47.0 | 0 | 0 | 0 | -1 | -1 | 1 | 0 | -1 | -1 | -1 |
| PRM | M | 5 | Car/Bus driver COPD °0 | 57.2 | 0 | 0 | 0 | 1 | 1 | 1 | 60 | 6 | 6 | 5 |
| RM | M | 115 | Welder COPD °0 | 45.8 | 0 | 2 | 2 | 2 | 2 | 1 | 35 | 0 | 3 | 1 |
| RR | M | 36 | Car/Bus driver COPD °0 | 55.2 | 0 | 0 | 0 | 1 | 1 | 1 | 38 | 0 | 0 | 0 |
| RH | M | 91 | Welder COPD °0 | 61.1 | 0 | 0 | 0 | 1 | 1 | 0 | 85 | 5 | 3 | 3 |
| SB | F | 67 | Car/Bus driver COPD °0 | 49.3 | 0 | 0 | 0 | 0 | 0 | 0 | 15 | 2 | 2 | 2 |
| SW | M | 117 | Car/Bus driver COPD °0 | 52.2 | 0 | 0 | 0 | 0 | 0 | 1 | 40 | 0 | 2 | 2 |
| SIW | M | 118 | Welder COPD °0 | 49.7 | 0 | 0 | 0 | 0 | 0 | 2 | 27 | 3 | 3 | 2 |
| SR | M | 152 | Car/Bus driver COPD °0 | 38.6 | 0 | 0 | 0 | 0 | 0 | -1 | 10 | 0 | 0 | 0 |
| STJ | M | 21 | Car/Bus driver COPD °0 | 60.8 | 0 | 0 | 0 | 1 | 1 | 0 | 50 | 4 | 3 | 0 |
| STB | F | 56 | Car/Bus driver COPD °0 | 61.3 | 0 | 0 | n.d. | 0 | 0 | 0 | 25 | 0 | 0 | 0 |
| STS | M | 83 | Welder COPD °0 | 48.2 | 0 | 0 | 0 | 2 | 2 | 3 | 60 | 5 | 5 | 5 |
| STP | M | 156 | Welder COPD °0 | 47.0 | 0 | 0 | 0 | 0 | 0 | 0 | 15 | 0 | 0 | 0 |
| STA | M | 17 | Car/Bus driver COPD °0 | 45.4 | 0 | 0 | 0 | 0 | 0 | 2 | 20 | 4 | 4 | 4 |
| TJ | M | 19 | Car/Bus driver COPD °0 | 53.9 | 0 | 0 | 0 | 1 | 1 | 1 | 40 | 4 | 4 | 2 |
| TA | F | 46 | Car/Bus driver COPD °0 | 58.1 | 0 | 2 | 2 | 0 | 1 | -1 | 100 | 5 | 4 | 6 |
| WC | M | 172 | Welder COPD °0 | 42.9 | 0 | 0 | 0 | 0 | 2 | 0 | 36 | 4 | 4 | 3 |
| WW | M | 124 | Welder COPD °0 | 44.0 | 0 | 2 | 2 | 1 | 1 | 2 | 30 | 0 | 0 | 0 |
| WS | M | 65 | Welder COPD °0 | 30.5 | 0 | 0 | 1 | 0 | -1 | -1 | 10 | 0 | 0 | 0 |
| WR | M | 160 | Welder COPD °0 | 56.9 | 0 | 2 | 0 | 1 | 1 | 1 | 30 | 0 | 0 | 0 |
| WIR | M | 125 | Welder COPD °0 | 63.4 | 0 | 0 | 0 | 1 | 1 | 2 | 45 | 2 | 3 | 2 |
| ZAE | M | 93 | Welder COPD °0 | 51.7 | 0 | 0 | 0 | 2 | 2 | 2 | 10 | 1 | 1 | 0 |
| ZE | M | 6 | Car/Bus driver COPD °0 | 45.7 | 0 | 0 | 0 | 1 | 1 | 1 | 35 | 4 | 4 | 4 |
| | | | | | | | | | | | | | | |
| | n **55** | | Age (yrs, mean) **50.0** | | | | | PY (mean) **32.2** | | | | | | |

FIG. 3C

Manifest COPD at Visit 1

| | | | Clinical strata | Age | GOLD | | | Intensity of Bronchitis | | | Pack Years | Smoking habits | | |
|---|---|---|---|---|---|---|---|---|---|---|---|---|---|---|
| Initials | Gender | ID | COPD (manifest) | | V1 | V2 | V3 | V1 | V2 | V3 | Total | V1 | V2 | V3 |
| CW | M | 45 | Driver COPD °I-III | 59.0 | 1 | 0 | 0 | 1 | 0 | 1 | 10 | 0 | 0 | 0 |
| DJ | M | 85 | Driver COPD °I-III | 41.6 | 1 | 0 | 0 | 1 | 1 | 1 | 8 | 1 | 2 | 2 |
| GW | M | 102 | Driver COPD °I-III | 55.9 | 1 | 0 | 0 | -1 | -1 | -1 | 30 | 0 | 0 | 0 |
| HP | M | 98 | Driver COPD °I-III | 70.2 | 1 | 1 | 2 | 1 | 1 | 1 | 20 | 0 | 0 | 0 |
| KA | M | 107 | Welder COPD °I-III | 48.8 | 1 | 0 | 1 | 2 | 2 | 1 | 30 | 3 | 3 | 3 |
| KW | M | 55 | Driver COPD °I-III | 54.1 | 1 | 0 | 0 | 1 | 1 | 1 | 50 | 2 | 2 | 2 |
| MM | F | 114 | Driver COPD °I-III | 57.3 | 1 | 0 | 0 | 1 | 1 | 4 | 35 | 5 | 5 | 5 |
| RH | M | 116 | Driver COPD °I-III | 71.6 | 1 | 1 | n.d. | 2 | 2 | n.d. | 45 | 0 | 0 | 0 |
| WH | M | 92 | Welder COPD °I-III | 44.2 | 1 | 2 | 1 | 0 | 2 | 1 | 35 | 4 | 3 | 3 |
| DK | M | 87 | Welder COPD °I-III | 50.8 | 2 | 2 | 2 | -1 | -1 | -1 | 5 | 1 | 1 | 1 |
| GG | M | 133 | Driver COPD °I-III | 52.5 | 2 | 2 | n.d. | 0 | 0 | n.d. | 30 | 0 | 0 | 0 |
| AG | M | 71 | Welder COPD °I-III | 56.5 | 2 | 2 | 2 | 1 | 1 | -1 | 20 | 0 | 0 | 0 |
| BD | M | 148 | Driver COPD °I-III | 43.2 | 2 | 2 | 1 | 2 | 3 | 3 | 25 | 0 | 0 | 0 |
| CA | M | 37 | Driver COPD °I-III | 65.8 | 2 | 3 | 4 | 1 | 1 | -1 | 40 | 5 | 2 | 5 |
| GG | M | 136 | Welder COPD °I-III | 51.8 | 2 | 0 | 2 | 1 | 1 | 2 | 30 | 3 | 3 | 3 |
| HAH | M | 96 | Driver COPD °I-III | 46.2 | 2 | 2 | 1 | 1 | 0 | 0 | 40 | 4 | 4 | 4 |
| HE | M | 99 | Driver COPD °I-III | 48.9 | 2 | 3 | 2 | 1 | 1 | 2 | 25 | 0 | 0 | 0 |
| HF | M | 147 | Driver COPD °I-III | 63.3 | 2 | 2 | 2 | 1 | 1 | 1 | 30 | 3 | 3 | 3 |
| HH | M | 151 | Driver COPD °I-III | 56.2 | 2 | 2 | 2 | 3 | 3 | 2 | 30 | 3 | 3 | 3 |
| KT | M | 94 | Driver COPD °I-III | 50.8 | 2 | 2 | 2 | 1 | 1 | 1 | 30 | 5 | 0 | 1 |
| LG | M | 109 | Driver COPD °I-III | 60.0 | 2 | 2 | 2 | 1 | 1 | 2 | 40 | 4 | 3 | 3 |
| MB | F | 113 | Driver COPD °I-III | 69.7 | 2 | 2 | 2 | 1 | 1 | 2 | 35 | 3 | 3 | 3 |
| MJ | M | 112 | Welder COPD °I-III | 68.2 | 2 | 2 | 2 | 0 | 0 | 1 | 80 | 5 | 5 | 5 |
| MJ | M | 68 | Welder COPD °I-III | 47.5 | 2 | 2 | 2 | 1 | 2 | 3 | 50 | 0 | 0 | 0 |
| MT | M | 171 | Welder COPD °I-III | 48.8 | 2 | 1 | 2 | 1 | 2 | 2 | 35 | 2 | 3 | 3 |
| RJ | M | 75 | Driver COPD °I-III | 49.8 | 2 | 2 | 2 | 1 | 1 | 1 | 40 | 3 | 3 | 3 |
| SCHR | M | 76 | Driver COPD °I-III | 51.1 | 2 | 2 | 2 | 1 | 1 | 1 | 30 | 3 | 1 | 1 |

FIG. 3C Cont.

| | | | Clinical strata | Age | GOLD | | | Intensity of Bronchitis | | | Pack Years | Smoking habits | | |
|---|---|---|---|---|---|---|---|---|---|---|---|---|---|---|
| Initials | Gender | ID | COPD "at risk" | | V1 | V2 | V3 | V1 | V2 | V3 | Total | V1 | V2 | V3 |
| SCHS | F | 130 | Driver COPD °I-III | 53.0 | 2 | 2 | 3 | 1 | 2 | 2 | 30 | 4 | 4 | 3 |
| SE | F | 119 | Driver COPD °I-III | 52.5 | 2 | 2 | 2 | 1 | 1 | 0 | 40 | 0 | 0 | 0 |
| SS | M | 104 | Welder COPD °I-III | 39.9 | 2 | 0 | 0 | 2 | 2 | 2 | 15 | 2 | 2 | 2 |
| VA | M | 121 | Welder COPD °I-III | 49.8 | 2 | 2 | 3 | 1 | 1 | 1 | 30 | 4 | 3 | 3 |
| WM | M | 9 | Driver COPD °I-III | 48.2 | 2 | 2 | 2 | -1 | 0 | -1 | 25 | 3 | 3 | 3 |
| WT | M | 69 | Welder COPD °I-III | 47.5 | 2 | 2 | 0 | 1 | 1 | 1 | 60 | 2 | 2 | 1 |
| ZJ | M | 78 | Welder COPD °I-III | 60.2 | 2 | 2 | 2 | 1 | 1 | 2 | 35 | 0 | 0 | 2 |
| ZS | M | 127 | Driver COPD °I-III | 27.4 | 2 | 2 | 0 | 2 | 4 | 4 | 9 | 3 | 5 | 4 |
| BH | M | 2 | Driver COPD °I-III | 46.4 | 3 | 2 | 2 | 0 | 0 | -1 | 25 | 3 | 0 | 0 |
| CP | M | 100 | Welder COPD °I-III | 70.8 | 3 | 3 | 3 | 0 | 1 | 0 | 70 | 0 | 0 | 0 |
| FW | M | 132 | Driver COPD °I-III | 65.3 | 3 | 3 | 3 | 0 | 0 | 1 | 40 | 3 | 3 | 3 |
| BW | M | 38 | Driver COPD °I-III | 68.5 | 3 | 3 | 3 | 1 | 1 | 1 | 60 | 4 | 4 | 3 |
| KE | M | 108 | Welder COPD °I-III | 51.5 | 3 | 4 | 4 | 1 | 2 | 1 | 45 | 4 | 5 | 4 |
| KK | M | 73 | Welder COPD °I-III | 55.5 | 3 | 3 | 3 | 1 | 1 | 3 | 25 | 1 | 1 | 1 |
| LH | M | 80 | Welder COPD °I-III | 69.8 | 3 | 3 | n.d. | 1 | 1 | n.d. | 70 | 3 | 3 | 3 |
| MC | F | 111 | Driver COPD °I-III | 62.2 | 3 | 3 | 4 | 0 | 0 | 0 | 40 | 0 | 0 | 0 |
| NP | M | 70 | Driver COPD °I-III | 64.2 | 3 | 3 | 4 | 1 | 1 | 2 | 100 | 0 | 0 | 0 |
| SCHB | M | 146 | Driver COPD °I-III | 57.8 | 3 | 3 | 3 | 2 | 2 | 2 | 60 | 3 | 4 | 3 |
| TG | M | 129 | Driver COPD °I-III | 62.5 | 3 | 2 | 2 | 1 | 2 | 2 | 60 | 2 | 2 | 2 |
| WJ | M | 63 | Driver COPD °I-III | 55.8 | 3 | 3 | 3 | 1 | 1 | 1 | 40 | 0 | 0 | 0 |
| HOH | M | 48 | Driver COPD °I-III | 70.8 | 4 | 3 | 3 | -1 | 0 | 2 | 100 | 0 | 0 | 0 |
| JR | M | 110 | Driver COPD °I-III | 55.3 | 4 | 3 | n.d. | 1 | 1 | n.d. | 40 | 4 | 1 | n.d. |
| | | | | | | | | | | | | | | |
| | n **49** | | Age (yrs, mean) **55.5** | | | | | PY (mean) **38.7** | | | | | | |

Fig. 3 (cont.)

D)

| | | Healthy | GOLD at risk | GOLD I | | GOLD II | | GOLD III | | GOLD IV | | | Total |
|---|---|---|---|---|---|---|---|---|---|---|---|---|---|
| **No. of participants** | | **16** | **55** | **9** | | **26** | | **12** | | **2** | | | **120** |
| Age | | 36 ± 12.2 | 50 ± 9.5 | 56 ± 10.4 | *p=0.083* | 52 ± 9.0 | *p=0.304* | 61 ± 7.6 | *p= 0.0004* | 63 ± 11.0 | *p=0.054* | | |
| Packyears | | 0 | 32 ± 26 | 29 ± 15 | *p=0.729* | 33 ± 15 | *p=0.815* | 53 ± 21 | *p=0.004* | 70 ± 42 | *p=0.022* | | |
| Gender | F | 7 (44%) | 8 (15%) | 1 (11%) | | 3 (12%) | | 1 (88%) | | 0 | | *p=0.931* | 20 (17%) |
| | M | 9 (56%) | 47 (85%) | 8 (89%) | | 23 (88%) | | 11 (92%) | | 2 (100%) | | | 100 (83%) |
| Occupation | Control (healthy) | 16 | 0 | 0 | | 0 | | 0 | | 0 | | *p=0.594* | 16 (13%) |
| | Taxi/Bus driver | 0 | 31 (56%) | 7 (78%) | | 16 (62%) | | 8 (67%) | | 2 (100%) | | | 64 (53%) |
| | Welder | 0 | 24 (44%) | 2 (22%) | | 10 (38%) | | 4 (33%) | | 0 | | | 40 (33%) |
| Symptoms of chronic bronchitis (Cough & Phlegm) | No symptoms | 16 (100%) | 0 | 0 | | 0 | | 0 | | 0 | | *p=0.054* | 16 (13%) |
| | frequently dry | 0 | 24 (44%) | 2 (22%) | | 4 (15%) | | 4 (33%) | | 1 (50%) | | | 35 (29%) |
| | productive | 0 | 16 (29%) | 5 (56%) | | 18 (69%) | | 7 (58%) | | 1 (50%) | | | 47 (39%) |
| | discolored | 0 | 15 (27%) | 2 (22%) | | 4 (15%) | | 1 (8%) | | 0 | | | 22 (18%) |
| **Changes between baseline and visit 3** | | | | | | | | | | | | | |
| GOLD stage | deterioration | 0 | 7 (13%) | 1 (11%) | | 3 (12%) | | 3 (25%) | | 0 | | *p=0.001* | 14 (12%) |
| | stable | 16 (100%) | 48 (87%) | 3 (33%) | | 18 (69%) | | 7 (58%) | | 1 (50%) | | | 93 (78%) |
| | improvement | 0 | 0 | 5 (56%) | | 5 (19%) | | 2 (17%) | | 1 (50%) | | | 13 (11%) |
| Cough & Phlegm | deterioration | 0 | 11 (20%) | 2 (22%) | | 9 (35%) | | 4 (33%) | | 1 (50%) | | *p=0.058* | 27 (23%) |
| | stable | 16 (100%) | 26 (47%) | 5 (56%) | | 12 (46%) | | 7 (58%) | | 0 | | | 66 (55%) |
| | improvement | 0 | 18 (33%) | 2 (22%) | | 5 (19%) | | 1 (8%) | | 1 (50%) | | | 27 (23%) |
| Exacerbations (month 1-12) | yes | 0 | 12 (22%) | 3 (33%) | | 4 (15%) | | 5 (42%) | | 1 (50%) | | *p=0.308* | 25 (21%) |
| | no | 16 (100%) | 43 (78%) | 6 (67%) | | 22 (85%) | | 7 (58%) | | 1 (50%) | | | 95 (79%) |
| Exacerbations (month 12-36) | yes | 0 | 10 (18%) | 3 (33%) | | 14 (54%) | | 5 (42%) | | 0 | | *p=0.008* | 32 (27%) |
| | no | 16 (100%) | 45 (82%) | 6 (67%) | | 12 (46%) | | 7 (58%) | | 2 (100%) | | | 88 (73%) |

A)

B)

C)

D)

A)

B)

C)

D)

E)

F)

G)

H)

A)

B)

C)

D)

E)

A)

B)

C)

D)

Gene expression during progression of COPD (GOLD criteria)

Decrease of angiogenic mediators

METHODS OF DIAGNOSING CHRONIC OBSTRUCTIVE PULMONARY DISEASE (COPD) USING NOVEL MOLECULAR BIOMARKERS

This application is a national phase application under 35 U.S.C. § 371 of International Application No. PCT/EP2015/062440, filed Jun. 3, 2015, which claims benefit of European Application No. 14171385.9, filed Jun. 5, 2014, the entire contents of each of which are hereby incorporated by reference.

The present invention relates to in vitro methods for the diagnosis of chronic obstructive pulmonary disease (COPD), wherein the expression of the marker gene KIAA1199 is determined. In particular, the invention relates to an in vitro diagnostic method of assessing the susceptibility of a subject to develop progressive COPD involving the appearance of irreversible lung damage, wherein the expression of the marker gene KIAA1199 and optionally one or more further marker genes selected from DMBT1, TMSB15A, DPP6, SLC51B, NUDT11, ELF5, AZGP1, PRRX1, AQP3, SFN, GPR110, GDF15, RASGRF2, RND1, PLA1A, FGG, CEACAM5, HYAL2, AHRR, CXCL3, CYP1A1, CYP1B1, CYP1A2, CST6, NTRK2, COMP, ITGA10, CTHRC1, TAL1, FIBIN, BEXS, BEX1, ESM1 and GHRL is determined. The invention also relates to an in vitro method of diagnosing stable COPD or assessing the susceptibility of a subject to develop stable COPD, wherein the expression of KIAA1199 and optionally one or more further marker genes selected from DMBT1, TMSB15A, DPP6, SLC51B, NUDT11, ELF5, AZGP1, PRRX1, AQP3, SFN, GPR110, GDF15, RASGRF2, RND1, PLA1A, FGG, CEACAM5, HYAL2, AHRR, CXCL3, CYP1A1, CYP1B1, CYP1A2, CST6, NTRK2, COMP, ITGA10, CTHRC1, TAL1, FIBIN, BEX5, BEX1, ESM1 and GHRL is determined. Furthermore, the invention relates to the use of primers for transcripts of the aforementioned marker genes, the use of nucleic acid probes to transcripts of these marker genes, the use of microarrays comprising nucleic acid probes to transcripts of these marker genes, and the use of antibodies against the proteins expressed from these marker genes in corresponding in vitro methods. In vitro methods of monitoring the progression of COPD are also provided, in which the expression of marker genes according to the invention is determined.

COPD represents one of the leading pathologies of the world's elderly population. Triggered by long-term exposure to combustion products, climatic conditions and repeated infections, COPD has become the fourth-leading cause of mortality in aged individuals. During the last decades, the worldwide prevalence of COPD has risen by more than 10%, particularly in active smokers beyond the age of 55 (Murray et al., 1997). Given the increasing number of elderly people in the world's population and the world-wide increase of inhalative hazards, both occupational and personal, COPD must be regarded as one of the most challenging threats to the world's health systems (Halbert et al., 2006; US Burden of Disease Collaborators, 2013). However, although the impact of COPD on health conditions is increasingly understood, the mechanisms that cause and maintain the progression of the disease are largely unknown. Based on clinical experience and results of controlled studies, COPD is regarded as a largely inflammatory disease. However, while long-term anti-inflammatory treatment may improve the outcome in COPD, its impact on the overall pathology of the disease is less clear. The TORCH (TOwards a Revolution in COPD Health) study has clearly shown that this unilateral view upon the pathophysiology of COPD is not entirely correct as patients who were under continuous treatment with inhaled corticosteroids did not have a better outcome than those without. In line with this, several well-defined clinical trials have tried to stratify patients according to relevant clinical phenotypes, the ECLIPSE (Evaluation of COPD Longitudinally to Identify Predictive Surrogate Endpoints) study being the latest and most important attempt thus far (Vestbo et al., 2011). While these attempts have proven the remarkable heterogeneity of the clinical manifestations of COPD, they unfortunately failed to improve the understanding of the disease's central driving forces, their mediators, and their hierarchy in evoking the clinical phenotypes of COPD.

Until recently, COPD has been largely defined by the limitation of the maximum volume of air exhaled in one second during forced expiration ($FEV_1$), as well as by the total amount of air exhaled (forced [expiratory] vital capacity, FVC), and their respective relationship (Wedzicha JA, 2000). However, the variability of the clinical presentation of COPD regardless of any individual degree of airflow limitation suggested that the disease comprises different mechanisms related to bronchial and peribronchial pathologies (Hurst et al., 2010; Han et al., 2010). As a consequence, further clinical measures have been added to the diagnostic process in COPD, such as the intensity of bronchial inflammation, the frequency of disease exacerbations or the presence of comorbidities (Vestbo et al., 2013).

Not surprisingly, $FEV_1$ does not correlate well with symptom development. However, many studies have clearly demonstrated that $FEV_1$ is a strong predictor of mortality and morbidity in COPD, suggesting a relevant correlation between the (morphologically fixed) obstruction of the peripheral airways and the pathophysiology of the disease. Given the probability that the morphology of the small airways is going to reflect the pathologic net result of all metabolic events within this lung compartment, including chronic inflammatory and regenerative activities, this is more than plausible. Based on these facts, it still seems appropriate to apply the symptoms of the most established clinical manifestations of COPD, i.e. fixed bronchial obstruction and intensity of bronchitis as the main clinical indicators for a first attempt to delineate mechanisms and mediators capable of driving the pathology of COPD. In view of the well-documented long-term history of COPD often covering periods of more than two decades, any attempt to delineate the pathology of the disease ought to a) cover the earliest phase of pathologic development, the establishment of chronic bronchitis (COPD "at risk" according to the GOLD (Global Initiative on Obstructive Lung Disease) criteria) likely to precede the first manifestation of "irreversible" bronchial obstruction, b) to include both long-term development of the disease preceding the controlled phase of clinical assessment and c) to span a period long enough to allow for the identification of important short-range effects on COPD pathology. Lastly, as the pathology of COPD is focused in the small airways (Hogg JC, et al., 2004 (a)), the initial biological assessment ought to be performed in this compartment, regardless of the fact that some characteristic symptoms, such as the production of phlegm as a sign of intensified bronchitis, will also reflect the metabolic activity of the more central airways.

COPD progressively debilitates patients, resulting in an increasing disability and worsening impact of exacerbations. In particular, the development of irreversible damage to the lungs commences and then gradually worsens when a patient suffering from COPD advances from the stable early disease stage into the progressive stage of COPD. Unfortunately, many patients with COPD remain undiagnosed and potentially unknown to healthcare providers until the more advanced stages of the disease. In such cases, the delayed diagnosis of COPD results in patients suffering from symptoms and limitations that could otherwise be alleviated by treatment (Price et al., 2011). It would therefore be highly desirable to be able to diagnose COPD at an early disease stage and, in particular, to identify patients who are at risk of developing progressive COPD in order to be able to prevent these patients from suffering significant irreversible damage.

It is therefore an object of the present invention to provide novel and/or improved methods that allow to diagnose COPD at an early disease stage or to assess the risk or susceptibility of a subject to develop COPD. It is furthermore an object of the invention to provide novel and/or improved methods that allow to assess the susceptibility of a subject to develop progressive COPD).

The present invention is based on the unexpected finding that the gene KIAA1199 as well as the genes DMBT1, TMSB15A, DPP6, SLC51B, NUDT11, ELFS, AZGP1, PRRX1, AQP3, SFN, GPR110, GDF15, RASGRF2, RND1, PLA1A, FGG, CEACAM5, HYAL2, AHRR, CXCL3, CYP1A1, CYP1B1, CYP1A2, CST6, NTRK2, COMP, ITGA10, CTHRC1, TAL1, FIBIN, BEX5, BEX1, ESM1 and GHRL are differentially expressed in samples from subjects suffering from progressive COPD or subjects at risk/prone to develop progressive COPD on the one hand, and in control samples from healthy subjects on the other hand. In particular, and as also described in Example 1, it has been found that the expression of the genes KIAA1199, DMBT1, ELF5, AZGP1, PRRX1, AQP3, SFN, GPR110, GDF15, RASGRF2, RND1, FGG, CEACAM5, AHRR, CXCL3, CYP1A1, CYP1B1, CYP1A2, NTRK2 and COMP is upregulated in samples from patients suffering from progressive COPD or at risk of developing progressive COPD, while the expression of the genes TMSB15A, DPP6, SLC51B, NUDT11, PLA1A, HYAL2, CST6, ITGA10, CTHRC1, TAL1, FIBIN, BEX5, BEX1, ESM1 and GHRL is downregulated in samples from patients suffering from progressive COPD or at risk of developing progressive COPD, as compared to the expression of the corresponding genes in control samples from healthy patients. Therefore, in accordance with the present invention, these novel molecular biomarkers can advantageously be used for assessing the susceptibility/proneness of a subject to develop progressive COPD. It has further been surprisingly found that the genes KIAA1199, DMBT1, TMSB15A, DPP6, SLC51B, NUDT11, ELF5, AZGP1, PRRX1, AQP3, SFN, GPR110, GDF15, RASGRF2, RND1, PLA1A, FGG, CEACAM5, HYAL2, AHRR, CXCL3, CYP1A1, CYP1B1, CYP1A2, CST6, NTRK2, COMP, ITGA10, CTHRC1, TAL1, FIBIN, BEX5, BEX1, ESM1 and GHRL are differentially expressed in samples from subjects suffering from stable COPD or subjects at risk/prone to develop stable COPD on the one hand, and in control samples from healthy subjects on the other hand. In this connection, it has particularly been found that the expression of the genes KIAA1199, TMSB15A, DPP6, SLC51B, NUDT11, PLA1A, HYAL2, CST6, ITGA10, CTHRC1, TAL1, FIBIN, BEX5, BEX1, ESM1 and GHRL is downregulated in samples from patients having stable COPD or at risk of developing stable COPD, while the expression of the genes DMBT1, ELF5, AZGP1, PRRX1, AQP3, SFN, GPR110, GDF15, RASGRF2, RND1, FGG, CEACAM5, AHRR, CXCL3, CYP1A1, CYP1B1, CYP1A2, NTRK2 and COMP is upregulated in samples from patients having stable COPD or at risk of developing stable COPD, as compared to the expression of the corresponding genes in control samples from healthy patients. In accordance with the present invention, these novel molecular biomarkers can thus be used for diagnosing stable COPD and/or assessing the susceptibility/proneness of a subject to develop stable COPD. Moreover, the biomarkers provided herein have excellent sensitivity and/or specificity.

Accordingly, in a first aspect the present invention provides an in vitro method for the diagnosis of COPD, the method comprising determining the level of expression of the gene KIAA1199 in a sample obtained from a subject.

In accordance with this first aspect, the invention also relates to the use of KIAA1199 as a marker for the in vitro diagnosis of COPD.

In a second aspect, the present invention provides an in vitro diagnostic method of assessing the susceptibility of a subject to develop progressive COPD involving the appearance of irreversible lung damage, the method comprising:

- determining the level of expression of the gene KIAA1199 in a sample obtained from the subject;
- comparing the level of expression of KIAA1199 in the sample from the subject to a control expression level of KIAA1199 in a healthy subject; and
- determining whether or not the subject is prone to develop progressive COPD involving the appearance of irreversible lung damage, wherein an increase in the level of expression of KIAA1199 in the sample from the subject as compared to the control expression level of KIAA1199 is indicative of a proneness to develop progressive COPD.

It is preferred that in this second aspect the method further comprises:

- determining the level of expression of one or more further genes selected from DMBT1, TMSB15A, DPP6, SLC51B, NUDT11, ELF5, AZGP1, PRRX1, AQP3, SFN, GPR110, GDF15, RASGRF2, RND1, PLA1A, FGG, CEACAM5, HYAL2, AHRR, CXCL3, CYP1A1, CYP1B1, CYP1A2, CST6, NTRK2, COMP, ITGA10, CTHRC1, TAL1, FIBIN, BEX5, BEX1, ESM1 and GHRL in the sample obtained from the subject;
- comparing the level of expression of the one or more further genes to a control expression level of the corresponding gene(s) in a healthy subject; and
- determining whether or not the subject is prone to develop progressive COPD involving the appearance of irreversible lung damage, wherein an increase in the level of expression of KIAA1199, DMBT1, ELF5, AZGP1, PRRX1, AQP3, SFN, GPR110, GDF15, RASGRF2, RND1, FGG, CEACAM5, AHRR, CXCL3, CYP1A1, CYP1B1, CYP1A2, NTRK2 and/or COMP in the sample from the subject as compared to the control expression level of the corresponding gene(s) is indicative of a proneness to develop progressive COPD, and wherein a decrease in the level of expression of TMSB15A, DPP6, SLC51B, NUDT11, PLA1A, HYAL2, CST6, ITGA10, CTHRC1, TAL1, FIBIN, BEX5, BEX1, ESM1 and/or GHRL in the sample from the subject as compared to the control expression level of the corresponding gene(s) is indicative of a proneness to develop progressive COPD.

In a third aspect, the invention provides an in vitro method of diagnosing stable COPD in a subject or assessing the susceptibility of a subject to develop stable COPD, the method comprising:

- determining the level of expression of the gene KIAA1199 in a sample obtained from the subject;

comparing the level of expression of KIAA1199 in the sample from the subject to a control expression level of KIAA1199 in a healthy subject; and determining whether or not the subject suffers from stable COPD or is prone to suffer from stable COPD, wherein a decrease in the level of expression of KIAA1199 in the sample from the subject as compared to the control expression level of KIAA1199 is indicative of stable COPD or a proneness to stable COPD.

The method according to this third aspect preferably further comprises:

determining the level of expression of one or more further genes selected from DMBT1, TMSB15A, DPP6, SLC51B, NUDT11, ELF5, AZGP1, PRRX1, AQP3, SFN, GPR110, GDF15, RASGRF2, RND1, PLA1A, FGG, CEACAM5, HYAL2, AHRR, CXCL3, CYP1A1, CYP1B1, CYP1A2, CST6, NTRK2, COMP, ITGA10, CTHRC1, TAL1, FIB1N, BEX5, BEX1, ESM1 and GHRL in the sample obtained from the subject;

comparing the level of expression of the one or more further genes to a control expression level of the corresponding gene(s) in a healthy subject; and determining whether or not the subject suffers from stable COPD or is prone to suffer from stable COPD, wherein an increase in the level of expression of DMBT1, ELF5, AZGP1, PRRX1, AQP3, SFN, GPR110, GDF15, RASGRF2, RND1, FGG, CEACAM5, AHRR, CXCL3, CYP1A1, CYP1B1, CYP1A2, NTRK2 and/or. COMP in the sample from the subject as compared to the control expression level of the corresponding gene(s) is indicative of stable COPD or a proneness to stable COPD, and wherein a decrease in the level of expression of KIAA1199, TMSB15A, DPP6, SLC51B, NUDT11, PLA1A, HYAL2, CST6, ITGA10, CTHRC1, TAL1, FIBIN, BEX5, BEX1, ESM1 and/or GHRL in the sample from the subject as compared to the control expression level of the corresponding gene(s) is indicative of stable COPD or a proneness to stable COPD.

In a fourth aspect, the invention relates to an in vitro diagnostic method of assessing the susceptibility of a subject suffering from stable COPD to develop progressive COPD involving the appearance of irreversible lung damage, the method comprising:

determining the level of expression of the gene KIAA1199 in a sample obtained from the subject;

comparing the level of expression of KIAA1199 in the sample from the subject to a control expression level of KIAA1199 in a subject suffering from stable COPD; and determining whether or not the subject is prone to develop progressive COPD involving the appearance of irreversible lung damage, wherein an increase in the level of expression of KIAA1199 in the sample from the subject as compared to the control expression level of KIAA1199 is indicative of a proneness to develop progressive COPD.

It is preferred that the method of this fourth aspect further comprises:

determining the level of expression of one or more further genes selected from DMBT1, ELF5, AZGP1, PRRX1, AQP3, GPR110, GDF15, RASGRF2, RND1, FGG, CEACAM5, HYAL2, AHRR, CXCL3, CYP1A1, CYP1B1, CYP1A2, CST6, NTRK2, COMP, ITGA10, CTHRC1, TAL1, BEX1 and GHRL in the sample obtained from the subject;

comparing the level of expression of the one or more further genes to a control expression level of the corresponding gene(s) in a subject suffering from stable COPD; and determining whether or not the subject is prone to develop progressive COPD involving the appearance of irreversible lung damage, wherein an increase in the level of expression of KIAA1199, GPR110, GDF15, RASGRF2, RND1, FGG, CEACAM5, HYAL2, AHRR, CXCL3, CYP1A1, CYP1B1, CYP1A2, CST6, NTRK2 and/or TAU in the sample from the subject as compared to the control expression level of the corresponding gene(s) is indicative of a proneness to develop progressive COPD, and wherein a decrease in the level of expression of DMBT1, ELF5, AZGP1, PRRX1, AQP3, COMP, ITGA10, CTHRC1, BEX1 and/or GHRL in the sample from the subject as compared to the control expression level of the corresponding gene(s) is indicative of a proneness to develop progressive COPD.

In a fifth aspect, the invention relates to the use of (i) a pair of primers for a transcript of the gene KIAA1199, (ii) a nucleic acid probe to a transcript of the gene KIAA1199, (iii) a microarray comprising a nucleic acid probe to the transcript of KIAA1199 and optionally comprising nucleic acid probes to the transcripts of one or more further genes selected from DMBT1, TMSB15A, DPP6, SLC51B, NUDT11, ELF5, AZGP1, PRRX1, AQP3, SFN, GPR110, GDF15, RASGRF2, RND1, PLA1A, FGG, CEACAM5, HYAL2, AHRR, CXCL3, CYP1A1, CYP1B1, CYP1A2, CST6, NTRK2, COMP, ITGA10, CTHRC1, TAL1, FIBIN, BEX5, BEX1, ESM1 and GHRL, or (iv) an antibody against the protein KIAA1199, in an in vitro diagnostic method of assessing the susceptibility of a subject to develop progressive COPD involving the appearance of irreversible lung damage.

In a sixth aspect, the invention relates to a drug against COPD for use in treating COPD in a subject that has been identified in a method according to the second aspect of the invention as being prone to develop progressive COPD involving the appearance of irreversible lung damage.

The invention further relates to the use of a drug against COPD in the preparation of a pharmaceutical composition for treating COPD in a subject that has been identified in a method according to the second aspect of the invention as being prone to develop progressive COPD involving the appearance of irreversible lung damage.

Moreover, in accordance with this sixth aspect, the invention also provides a method of treating COPD, the method comprising administering a drug against COPD to a subject that has been identified in a method according to the second aspect of the invention as being prone to develop progressive COPD involving the appearance of irreversible lung damage.

In a seventh aspect, the invention relates to the use of (i) a pair of primers for a transcript of the gene KIAA1199, (ii) a nucleic acid probe to a transcript of the gene KIAA1199, (iii) a microarray comprising a nucleic acid probe to the transcript of KIAA1199 and optionally comprising nucleic acid probes to the transcripts of one or more further genes selected from DMBT1, TMSB15A, DPP6, SLC51B, NUDT11, ELF5, AZGP1, PRRX1, AQP3, SFN, GPR110, GDF15, RASGRF2, RND1, PLA1A, FGG, CEACAM5, HYAL2, AHRR, CXCL3, CYP1A1, CYP1B1, CYP1A2, CST6, NTRK2, COMP, ITGA10, CTHRC1, TAL1, FIBIN, BEX5, BEX1, ESM1 and GHRL, or (iv) an antibody against the protein KIAA1199, in an in vitro method of diagnosing stable COPD in a subject or assessing the susceptibility of a subject to develop stable COPD.

In an eighth the invention relates to a drug against COPD for use in treating or preventing COPD in a subject that has been identified in a method according to the third aspect of the invention as suffering from stable COPD or as being prone to suffer from stable COPD.

The invention also relates to the use of a drug against COPD in the preparation of a pharmaceutical composition for treating or preventing COPD in a subject that .has been identified in a method according to the third aspect of the invention as suffering from stable COPD or as being prone to suffer from stable COPD.

In this aspect, the invention likewise relates to a method of treating or preventing COPD, the method comprising administering a drug against COPD to a subject that has been identified in a method according to the third aspect of the invention as suffering from stable COPD or as being prone to suffer from stable COPD.

In a ninth aspect, the invention relates to the use of (i) a pair of primers for a transcript of the gene KIAA1199, (ii) a nucleic acid probe to a transcript of the gene KIAA1199, (iii) a microarray comprising a nucleic acid probe to the transcript of KIAA1199 and optionally comprising nucleic acid probes to the transcripts of one or more further genes selected from DMBT1, ELF5, AZGP1, PRRX1, AQP3, GPR110, GDF15, RASGRF2, RND1, FGG, CEACAMS, HYAL2, AHRR, CXCL3, CYP1A1, CYP1B1, CYP1A2, CST6, NTRK2, COMP, ITGA10, CTHRC1, TAL1, BEX1 and GHRL, or (iv) an antibody against the protein KIAA1199, in an in vitro diagnostic method of assessing the susceptibility of a subject suffering from stable COPD to develop progressive COPD involving the appearance of irreversible lung damage.

In a tenth aspect, the invention relates to a drug against COPD for use in treating COPD in a subject suffering from stable COPD, wherein the subject has been identified in a method according to the fourth aspect of the invention as being prone to develop progressive COPD involving the appearance of irreversible lung damage.

The invention further refers to the use of a drug against COPD in the preparation of a pharmaceutical composition for treating COPD in a subject suffering from stable COPD, wherein the subject has been identified in a method according to the fourth aspect of the invention as being prone to develop progressive COPD involving the appearance of irreversible lung damage.

The invention according to this tenth aspect also relates to a method of treating COPD, the method comprising administering a drug against COPD to a subject suffering from stable COPD, wherein the subject has been identified in a method according to the fourth aspect of the invention as being prone to develop progressive COPD involving the appearance of irreversible lung damage.

In an eleventh aspect, the present invention provides an in vitro method of monitoring the progression of COPD in a subject, the method comprising:

determining the level of expression of one or more genes selected from NTRK2 and RASGRF2 in a first sample obtained from the subject;

determining the level of expression of the one or more genes in a second sample obtained from the subject at a later point in time than the first sample;

comparing the level of expression of the one or more genes in the second sample to the level of expression of the corresponding gene(s) in the first sample; and assessing the progression of COPD in the subject, wherein a decrease in the level of expression of NTRK2 and/or RASGRF2 in the second sample as compared to the level of expression of the corresponding gene(s) in the first sample is indicative of an amelioration of COPD in the subject, and wherein an increase in the level of expression of NTRK2 and/or RASGRF2 in the second sample as compared to the level of expression of the corresponding gene(s) in the first sample is indicative of a worsening of COPD in the subject.

The following description of general and preferred features and embodiments relates to each one of the methods, uses and drugs against COPD provided in the present specification, including in particular those according to the above-described first, second, third, fourth, fifth, sixth, seventh, eighth, ninth, tenth and eleventh aspects of the invention, unless explicitly indicated otherwise.

Chronic obstructive pulmonary disease (COPD) is a lung disease characterized by persistent airflow limitation that is usually progressive and associated with an enhanced chronic inflammatory response in the airways and the lung to noxious particles or gases. COPD is typically classified into four different stages based on the extent of non-reversible pulmonary obstruction to be determined by spirometry, as specified by the Global Initiative for Obstructive Lung Disease (GOLD) (see, e.g., Vestbo et al., 2013; and Pauwels et al., 2001). COPD stage I ("mild COPD") is characterized by an $FEV_1$/FVC ratio of <70% and an FEV, of ≥80%. At stage I, the patient may not be aware that his/her lung function is abnormal. COPD stage II ("moderate COPD") is characterized by an $FEV_1$/FVC ratio of <70% and an FEV, of ≥50% and <80%. This is the stage at which patients typically seek medical attention because of chronic respiratory symptoms or an exacerbation of their disease. COPD stage III ("severe COPD") is characterized by an $FEV_1$/FVC ratio of <70% and an FEV, of ≥30% and <50%. COPD stage IV ("very severe COPD") is characterized by an $FEV_1$/FVC ratio of <70% and an $FEV_1$ of <30%, or chronic respiratory failure and an $FEV_1$ of <50%. The pathological development of COPD may be preceded by chronic respiratory symptoms (particularly chronic bronchitis) without airways obstruction ($FEV_1$/FVC ratio of ≥70%), which is also referred to as "stage 0" or "at risk for COPD". The terms "stage I", "stage II", stage "III", "stage IV", and "stage 0" as used in the present specification refer to the corresponding GOLD stages, i.e., the corresponding COPD stages according to the above-described GOLD criteria.

As used herein, the term "stable COPD" (used synonymously with "stable early-stage COPD") refers to the initial stages of COPD that precede the development of irreversible lung damage. In particular, "stable COPD" refers to the initial COPD stages from the earliest signs for the onset of the disease through to mild airflow limitation characterized by an $FEV_1$/FVC ratio of <70% and an $FEV_1$ of ≥80%. "Stable COPD" thus preferably refers to COPD stage 0 (i.e., the COPD "at risk" stage) and COPD stage I (according to GOLD criteria), and more preferably refers to COPD stage I.

The terms "progressive COPD" and "progressive COPD involving the appearance of irreversible lung damage" are used herein synonymously/interchangeably, and refer to the disease stage of COPD in which irreversible damage to the lungs occurs and progressively worsens. In particular, "progressive COPD" refers to the COPD disease stage characterized by moderate airflow limitation, i.e., an $FEV_1$/FVC ratio of <70% and an FEV, of ≥50% and <80%. Accordingly, it is particularly preferred that "progressive COPD" refers to COPD stage II (according to GOLD criteria).

As used herein, the terms "KIAA1199", "DMBT1", "TMSB15A", "DPP6", "SLC51B", "NUDT11", "ITGA10", "CST6", "TALI", "FIBIN", "BEXS", "BEX1", "ESM1", "GHRL", "NTRK2", "SFN", "GPR110", "FGG", "CEACAMS", "AZGP1", "COMP", "PRRX1", "AHRR", "CYPIA1", "CYP1A2", "CYP1B1", "GDF15", "ELF5", "AQP3", "RASGRF2", "PLA1A", "HYAL2", "CTHRC1", "RND1" and "CXCL3" each refer to the respective human gene, the corresponding mRNA (including all possible transcripts/splice variants), and the corresponding protein (including all possible isoforms). These terms also refer to homologs and/or orthologs of the corresponding human genes that are found in other (non-human) species, particularly other mammalian species, as well as their corresponding mRNAs and their corresponding proteins. It is to be understood that, if the subject to be tested in the methods of the present invention is a non-human (particularly a non-human mammal), then the one or more marker genes (the level of expression of which is to be determined) will be the homologs/orthologs of the indicated human genes that are found in the non-human animal to be tested. Preferably, the subject is a human and, accordingly, the above-mentioned terms preferably refer to the respective human genes and the corresponding mRNAs and proteins.

The full names of the human forms of the above-mentioned marker genes, their Entrez Gene ID, and NCBI reference sequences of their mRNAs and proteins are listed in the following Table 1:

TABLE 1

Overview of the marker genes provided herein (human forms), including their full names, their Entrez Gene ID, and NCBI reference sequences of their mRNAs and their proteins (where applicable, different mRNA transcripts/splice variants and the corresponding protein isoforms are indicated; further possible mRNA variants and protein isoforms of the indicated genes may also be used to determine the corresponding levels of marker gene expression in accordance with the invention).

| Marker gene | Full name | Gene ID | mRNA (NCBI ref. seq.) | Protein (NCBI ref. seq.) |
|---|---|---|---|---|
| KIAA1199 | KIAA1199 | 57214 | NM_018689.1 (preferably as indicated in SEQ ID NO: 38) | NP_061159.1 |
| DMBT1 | deleted in malignant brain tumors 1 | 1755 | NM_004406.2 (preferably as indicated in SEQ ID NO: 26) NM_007329.2 (preferably as indicated in SEQ ID NO: 32) NM_017579.2 (preferably as indicated in SEQ ID NO: 35) | NP_004397.2 NP_015568.2 NP_060049.2 |
| TMSB15A | thymosin beta 15a | 11013 | NM_021992.2 (preferably as indicated in SEQ ID NO: 41) | NP_068832.1 |
| DPP6 | dipeptidyl-peptidase 6 | 1804 | NM_001039350.1 (preferably as indicated in SEQ ID NO: 45) NM_001936.3 (preferably as indicated in SEQ ID NO: 46) NM_130797.2 (preferably as indicated in SEQ ID NO: 47) | NP_001034439.1 NP_001927.3 NP_570629.2 |
| SLC51B | solute carrier family 51, beta subunit | 123264 | NM_178859.3 (preferably as indicated in SEQ ID NO: 48) | NP_849190.2 |
| NUDT11 | nudix (nucleoside diphosphate linked moiety X)-type motif 11 | 55190 | NM_018159.3 (preferably as indicated in SEQ ID NO: 36) | NP_060629 |
| ITGA10 | integrin, alpha 10 | 8515 | NM_003637.3 (preferably as indicated in SEQ ID NO: 24) | NP_003628.2 |
| CST6 | cystatin E/M | 1474 | NM_001323.3 (preferably as indicated in SEQ ID NO: 21) | NP_001314.1 |
| TAL1 | T-cell acute lymphocytic leukemia 1 | 6886 | NM_003189.2 (preferably as indicated in SEQ ID NO: 49) | NP_003180.1 |

TABLE 1-continued

Overview of the marker genes provided herein (human forms), including their full names, their Entrez Gene ID, and NCBI reference sequences of their mRNAs and their proteins (where applicable, different mRNA transcripts/splice variants and the corresponding protein isoforms are indicated; further possible mRNA variants and protein isoforms of the indicated genes may also be used to determine the corresponding levels of marker gene expression in accordance with the invention).

| Marker gene | Full name | Gene ID | mRNA (NCBI ref. seq.) | Protein (NCBI ref. seq.) |
|---|---|---|---|---|
| FIBIN | fin bud initiation factor homolog (zebrafish) | 387758 | NM_203371.1 (preferably as indicated in SEQ ID NO: 50) | NP_976249.1 |
| BEX5 | brain expressed, X-linked 5 | 340542 | NM_001012978.2 (preferably as indicated in SEQ ID NO: 5) NM_001159560.1 (preferably as indicated in SEQ ID NO: 13) | NP_001012996.1 NP_001153032.1 |
| BEX1 | brain expressed, X-linked 1 | 55859 | NM_018476.3 (preferably as indicated in SEQ ID NO: 37) | NP_060946.3 |
| ESM1 | endothelial cell-specific molecule 1 | 11082 | NM_001135604.1 (preferably as indicated in SEQ ID NO: 12) NM_007036.4 (preferably as indicated in SEQ ID NO: 31) | NP_001129076.1 NP_008967.1 |
| GHRL | ghrelin/obestatin prepropeptide | 51738 | NM_001134941.1 (preferably as indicated in SEQ ID NO: 8) NM_001134944.1 (preferably as indicated in SEQ ID NO: 9) NM_001134945.1 (preferably as indicated in SEQ ID NO: 10) NM_001134946.1 (preferably as indicated in SEQ ID NO: 11) | NP_001128413.1 NP_001128416.1 NP_001128417.1 NP_001128418.1 NP_001128418.1 |
| NTRK2 | neurotrophic tyrosine kinase, receptor, type 2 | 4915 | NM_001007097.1 (preferably as indicated in SEQ ID NO: 51) NM_001018064.1 (preferably as indicated in SEQ ID NO: 52) NM_001018065.2 (preferably as indicated in SEQ ID NO: 6) NM_001018066.2 (preferably as indicated in SEQ ID NO: 7) NM_006180.3 (preferably as indicated in SEQ ID NO: 53) | NP_001007098.1 NP_001018074.1 NP_001018075.1 NP_001018076.1 NP_006171.2 |
| SFN | stratifin | 2810 | NM_006142.3 (preferably as indicated in SEQ ID NO: 29) | NP_006133.1 |
| GPR110 | G protein-coupled receptor 110 | 266977 | NM_025048.2 (preferably as indicated in SEQ ID NO: 42) | NP_079324.2 NP_722582.2 |

TABLE 1-continued

Overview of the marker genes provided herein (human forms), including their full names, their Entrez Gene ID, and NCBI reference sequences of their mRNAs and their proteins (where applicable, different mRNA transcripts/splice variants and the corresponding protein isoforms are indicated; further possible mRNA variants and protein isoforms of the indicated genes may also be used to determine the corresponding levels of marker gene expression in accordance with the invention).

| Marker gene | Full name | Gene ID | mRNA (NCBI ref. seq.) | Protein (NCBI ref. seq.) |
|---|---|---|---|---|
| | | | NM_153840.2 (preferably as indicated in SEQ ID NO: 55) | |
| CYP1B1 | cytochrome P450, family 1, subfamily B, polypeptide 1 | 1545 | NM_000104.3 (preferably as indicated in SEQ ID NO: 2) | NP_000095.2 |
| FGG | fibrinogen gamma chain | 2266 | NM_000509.4 (preferably as indicated in SEQ ID NO: 4) NM_021870.2 (preferably as indicated in SEQ ID NO: 40) | NP_000500.2 NP_068656.2 |
| CEACAM5 | carcinoembryonic antigen-related cell adhesion molecule 5 | 1048 | NM_004363.2 (preferably as indicated in SEQ ID NO: 54) | NP_004354.2 |
| AZGP1 | alpha-2-glycoprotein 1, zinc-binding | 563 | NM_001185.3 (preferably as indicated in SEQ ID NO: 14) | NP_001176.1 |
| COMP | cartilage oligomeric matrix protein | 1311 | NM_000095.2 (preferably as indicated in SEQ ID NO: 1) | NP_000086.2 |
| PRRX1 | paired related homeobox 1 | 5396 | NM_006902.3 (preferably as indicated in SEQ ID NO: 56) NM_022716.2 (preferably as indicated in SEQ ID NO: 57) | NP_008833.1 NP_073207.1 |
| AHRR | aryl-hydrocarbon receptor repressor | 57491 | NM_001242412.1 (preferably as indicated in SEQ ID NO: 17) NM_020731.4 (preferably as indicated in SEQ ID NO: 39) | NP_001229341.1 NP_065782.2 |
| GDF15 | growth differentiation factor 15 | 9518 | NM_004864.2 (preferably as indicated in SEQ ID NO: 27) | NP_004855.2 |
| ELF5 | E74-like factor 5 (ets domain transcription factor) | 2001 | NM_001243080.1 (preferably as indicated in SEQ ID NO: 18) NM_001243081.1 (preferably as indicated in SEQ ID NO: 19) NM_001422.3 (preferably as indicated in SEQ ID NO: 22) NM_198381.1 (preferably as indicated in SEQ ID NO: 58) | NP_001230009.1 NP_001230010.1 NP_001413.1 NP_938195.1 |
| AQP3 | aquaporin 3 (Gill blood group) | 360 | NM_004925.4 (preferably as indicated in SEQ ID NO: 28) | NP_004916.1 |

TABLE 1-continued

Overview of the marker genes provided herein (human forms), including their full names, their Entrez Gene ID, and NCBI reference sequences of their mRNAs and their proteins (where applicable, different mRNA transcripts/splice variants and the corresponding protein isoforms are indicated; further possible mRNA variants and protein isoforms of the indicated genes may also be used to determine the corresponding levels of marker gene expression in accordance with the invention).

| Marker gene | Full name | Gene ID | mRNA (NCBI ref. seq.) | Protein (NCBI ref. seq.) |
|---|---|---|---|---|
| RASGRF2 | Ras protein-specific guanine nucleotide-releasing factor 2 | 5924 | NM_006909.2 (preferably as indicated in SEQ ID NO: 30) | NP_008840.1 |
| PLA1A | phospholipase A1 member A | 51365 | NM_001206960.1 (preferably as indicated in SEQ ID NO: 15) NM_001206961.1 (preferably as indicated in SEQ ID NO: 16) NM_015900.3 (preferably as indicated in SEQ ID NO: 34) | NP_001193889.1 NP_001193890.1 NP_056984.1 |
| HYAL2 | hyaluronoglucosaminidase 2 | 8692 | NM_003773.4 (preferably as indicated in SEQ ID NO: 25) NM_033158.4 (preferably as indicated in SEQ ID NO: 43) | NP_003764.3 NP_149348.2 |
| CTHRC1 | collagen triple helix repeat containing 1 | 115908 | NM_001256099.1 (preferably as indicated in SEQ ID NO: 20) NM_138455.3 (preferably as indicated in SEQ ID NO: 44) | NP_001243028.1 NP_612464.1 |
| RND1 | Rho family GTPase 1 | 27289 | NM_014470.3 (preferably as indicated in SEQ ID NO: 33) | NP_055285.1 |
| CXCL3 | chemokine (C—X—C motif) ligand 3 | 2921 | NM_002090.2 (preferably as indicated in SEQ ID NO: 23) | NP_002081.2 |
| CYP1A1 | cytochrome P450, family 1, subfamily A, polypeptide 1 | 1543 | NM_000499.3 (preferably as indicated in SEQ ID NO: 3) | NP_000490.1 |
| CYP1A2 | cytochrome P450, family 1, subfamily A, polypeptide 2 | 1544 | NM_000761.4 (preferably as indicated in SEQ ID NO: 59) | NP_000752.2 |

In the methods according to the present invention, including in particular the methods according to the first, second, third, fourth and eleventh aspect of the invention, the level of expression of one or more genes is determined in a sample obtained from the subject to be tested.

The level of expression can be determined, e.g., by determining the level of transcription or the level of translation of the corresponding marker gene(s). Thus, the amount of mRNA of these gene(s) in the sample can be measured or the amount of the corresponding protein(s) can be measured in order to determine the level of expression of the respective genes. This can be accomplished using methods known in the art, as described, e.g., in Green et al., 2012. The level of transcription of these gene(s) can, for example, be determined using a quantitative (real-time) reverse transcriptase polymerase chain reaction ("qRT-PCR") or using a microarray (see, e.g., Ding et al., 2004). The use of a microarray can be advantageous, e.g., if the level of transcription of a number of different marker genes is to be determined. Using a microarray can also be advantageous if various different diseases/disorders or the susceptibility to various diseases/disorders is to be tested or diagnosed simultaneously. If the level of transcription is to be determined, it may further be advantageous to include one or more RNase inhibitors in the sample from the subject. The level of translation of the corresponding marker gene(s) can, for example, be determined using antibody-based assays, such as an enzyme-linked immunosorbent assay (ELISA) or a radioimmunoassay (RIA), wherein antibodies directed specifically against the protein(s) to be quantified are employed, or mass spectrometry, a gel-based or blot-based assay, or flow cytometry (e.g., FACS). If the level of translation is to be determined, it may be advantageous to include one or more protease inhibitors in the sample from the subject. Since mRNA can be isolated and quantified more easily and in a more cost-effective manner than proteins, it is preferred in the methods of the present invention that the level of expression of the one or more genes is determined by determining the level of transcription of the corresponding gene(s). The level of transcription is preferably determined using qRT-PCR or a microarray.

The subject to be tested in accordance with the present invention may be an animal and is preferably a mammal. The mammal to be tested in accordance with the invention may be, e.g., a rodent (such as, e.g., a guinea pig, a hamster, a rat or a mouse), a murine (such as, e.g., a mouse), a canine (such as, e.g., a dog), a feline (such as, e.g., a cat), a porcine (such as, e.g., a pig), an equine (such as, e.g., a horse), a primate, a simian (such as, e.g., a monkey or an ape), a monkey (such as, e.g., a marmoset or a baboon), an ape (such as, e.g., a gorilla, a chimpanzee, an orang-utan or a gibbon), or a human. It is particularly envisaged that non-human mammals are to be tested, which are economically, agronomically or scientifically important. Scientifically important mammals include, e.g., mice, rats and rabbits. Non-limiting examples of agronomically important mammals are sheep, cattle and pigs. Economically important mammals include, e.g., cats and dogs. Most preferably, the subject to be tested in accordance with the present invention is a human.

In the second and the fourth aspect of the invention, it is furthermore preferred that the subject to be tested is a subject (preferably a human) that has been diagnosed as suffering from stable COPD or is suspected of suffering from stable COPD.

In accordance with the third aspect of the invention, it is preferred that the subject to be tested is a subject (preferably a human) that is suspected to suffer from stable COPD or a subject (preferably a human) suspected to be prone to suffer from stable COPD.

The sample obtained from the subject to be tested can, in principle, be any tissue sample or serum from the subject. Preferably, the sample is a lung tissue sample. More preferably, the sample is a transbronchial lung biopsy sample or a bronchoalveolar lavage (BAL) sample.

In some of the methods provided herein, including in particular the methods according to the second and the third aspect of the invention, the level of expression of one or more specific genes is compared to a control expression level of the corresponding gene(s) in a healthy subject. Such control expression levels can be established as part of the respective methods of the invention, which may thus include a further step of determining the level of expression of the corresponding gene(s) in a sample obtained from a healthy subject (i.e., a subject that does not suffer from COPD and does not have an increased risk of developing COPD) or in a mixture of samples from several healthy subjects (e.g., about 10, about 20, about 50, about 100, or about 500 healthy subjects). It is to be understood that the healthy subject(s) will be of the same species as the subject to be tested and should preferably have the same age, gender and ethnicity as the subject to be tested. Alternatively, these control expression levels can also be derived from the medical literature or from experiments conducted before carrying out the methods of the invention. It will be understood that the conditions under which the control expression levels are or were obtained (regardless of whether they are derived from the literature or earlier experiments or whether they are determined in the course of carrying out the methods of the invention), including also the type/origin of the sample (or mixture of samples) from the healthy subject, should be identical or at least similar/comparable to the conditions used for determining the level of expression of the one or more genes in the sample obtained from the subject to be tested.

In the method according to the fourth aspect, the level of expression of one or more specific genes is compared to a control expression level of the corresponding gene(s) in a subject suffering from stable COPD. Such control expression levels can be established as part of the method according to the fourth aspect of the invention, which may thus include a further step of determining the level of expression of the corresponding gene(s) in a sample obtained from a subject suffering from stable COPD (particularly a subject that has been diagnosed as suffering from stable COPD) or in a mixture of samples from several subjects (e.g., about 10, about 20, about 50, about 100, or about 500 subjects) suffering from stable COPD. It is to be understood that these control subject(s) will be of the same species as the subject to be tested and should preferably have the same age, gender and ethnicity as the subject to be tested. Alternatively, the corresponding control expression levels can also be derived from experiments conducted before carrying out the method of the fourth aspect of the invention. It will be understood that the conditions under which the control expression levels are or were obtained (regardless of whether they are derived from earlier experiments or whether they are determined in the course of carrying out the method of the fourth aspect), including also the type/origin of the sample (or mixture of samples) from the control subject, should be identical or at least similar/comparable to the conditions used for determining the level of expression of the one or more genes in the sample obtained from the subject to be tested. The control subject suffering from stable COPD in accordance with the fourth aspect of the invention is preferably a subject suffering from stage I COPD (particularly a subject that has been diagnosed as suffering from stage I COPD).

In the methods according to the second, third and fourth aspect of the present invention, the level of expression of KIAA1199 and optionally of one or more further marker genes is determined. Preferably, the level of expression of KIAA1199 and at least one of the corresponding further marker genes is determined, more preferably the level of expression of KIAA1199 and at least two of these further marker genes is determined, and even more preferably the level of expression of KIAA1199 and at least three of the corresponding further marker genes is determined, whereby the reliability of the diagnosis or assessment can be further improved. In general, the greater the number of marker genes the expression of which is altered (as defined in the corresponding aspect of the invention), and also the more pronounced the upregulation or downregulation of the expression of each of these marker genes, the more likely it will be that the subject tested is prone to develop progressive CORD (in the methods of the second and the fourth aspect) or that the subject tested suffers from stable CORD or is prone to suffer from stable COPD (in the method of the third aspect of the invention).

Thus, both (i) the number of tested marker genes showing an altered expression level as described above and (ii) the extent of alteration of the expression level of each one of the marker genes tested can be taken into consideration when determining whether or not the subject is prone to develop progressive COPD (in accordance with the second or the fourth aspect) or whether or not the subject suffers from stable COPD or is prone to suffer from stable COPD (in accordance with the third aspect of the invention). Further factors, signs and symptoms indicative of COPD, such as, e.g., airflow limitation (as determined, e.g., by spirometry), coughing, expiratory wheezing, further respiratory symptoms, the subject's smoking history, bronchial inflammation and/or further biomarkers (including molecular biomarkers), can additionally be taken into account in order to further improve the accuracy of the determination whether or not the subject is prone to develop progressive COPD (in accordance with the second or the fourth aspect) or whether or not the subject suffers from stable COPD or is prone to suffer from stable COPD (in accordance with the third aspect).

In one embodiment of the method according to the second aspect of the invention, it is preferred that the level of expression of KIAA1199 and at least one further gene selected from FGG, CYP1A1, CEACAM5, CTHRC1, NTRK2 and RASGRF2 is determined in the sample obtained from the subject. In this embodiment, it is furthermore preferred that the level of expression of at least two of the aforementioned further genes is determined. For example, the level of expression of KIAA1199, FGG and CYP1A1 may be determined, or the level of expression of KIAA1199, FGG and CEACAM5 may be determined, or the level of expression of KIAA1199, FGG and CTHRC1 may be determined, or the level of expression of KIAA1199, FGG and NTRK2 may be determined, or the level of expression of KIAA1199, FGG and RASGRF2 may be determined, or the level of expression of KIAA1199, CYP1A1 and CEACAM5 may be determined, or the level of expression of KIAA1199, CYP1A1 and CTHRC1 may be determined, or the level of expression of KIAA1199, CYP1A1 and NTRK2 may be determined, or the level of expression of KIAA1199, CYP1A1 and RASGRF2 may be determined, or the level of expression of KIAA1199, CEACAM5 and CTHRC1 may be determined, or the level of expression of KIAA1199, CEACAM5 and NTRK2 may be determined, or the level of expression of KIAA1199, CEACAM5 and RASGRF2 may be determined, or the level of expression of KIAA1199, CTHRC1 and NTRK2 may be determined, or the level of expression of KIAA1199, CTHRC1 and RASGRF2 may be determined, or the level of expression of KIAA1199, NTRK2 and RASGRF2 may be determined. In addition thereto, the level of expression of at least one further gene selected from ELF5, AZGP1, PRRX1, AQP3, SFN, GPR110, GDF15, RASGRF2 and RNDI and/or the level of expression of at least one further gene selected from DMBT1, TMSB15A, DPP6, SLC51B and NUDT11 (particularly DMBT1 and/or TMSB15A) may also be determined.

In a further embodiment of the method according to the second aspect of the invention, it is preferred that the level of expression of KIAA1199 and at least one further gene selected from ELF5, AZGP1, PRRX1, AQP3, SFN, GPR110, GDF15, RASGRF2 and RND1 is determined in the sample obtained from the subject. In this embodiment, it is furthermore preferred that the level of expression of at least two of the aforementioned further genes is determined. For example, the level of expression of KIAA1199, ELF5 and AZGP1 may be determined, or the level of expression of KIAA1199, ELF5 and PRRX1 may be determined, or the level of expression of KIAA1199, ELF5 and AQP3 may be determined, or the level of expression of KIAA1199, ELF5 and SFN may be determined, or the level of expression of KIAA1199, ELF5 and GPR110 may be determined, or the level of expression of KIAA1199, ELF5 and GDF15 may be determined, or the level of expression of KIAA1199, ELF5 and RASGRF2 may be determined, or the level of expression of KlAA1199, ELF5 and RND1 may be determined, or the level of expression of KlAA1199, AZGP1 and PRRX1 may be determined, or the level of expression of KIAA1199, AZGP1 and AQP3 may be determined, or the level of expression of KIAA1199, AZGP1 and SFN may be determined, or the level of expression of KIAA1199, AZGP1 and GPR110 may be determined, or the level of expression of KIAA1199, AZGP1 and GDF15 may be determined, or the level of expression of KIAA1199, AZGP1 and RASGRF2 may be determined, or the level of expression of KlAA1199, AZGP1 and RND1 may be determined, or the level of expression of KIAA1199, PRRX1 and AQP3 may be determined, or the level of expression of KIAA1199, PRRX1 and SFN may be determined, or the level of expression of KIAA1199, PRRX1 and GPR110 may be determined, or the level of expression of KIAA1199, PRRX1 and GDF15 may be determined, or the level of expression of KIAA1199, PRRX1 and RASGRF2 may be determined, or the level of expression of KIAA1 199, PRRX1 and RND1 may be determined, or the level of expression of KIAA1199, AQP3 and SFN may be determined, or the level of expression of KIAA1199, AQP3 and GPR110 may be determined, or the level of expression of KIAA1199, AQP3 and GDF15 may be determined, or the level of expression of KIAA1199, AQP3 and RASGRF2 may be determined, or the level of expression of KIAA1199, AQP3 and RND1 may be determined, or the level of expression of KIAA1199, SFN and GPR110 may be determined, or the level of expression of KIAA1199, SFN and GDF15 may be determined, or the level of expression of KIAA1199, SFN and RASGRF2 may be determined, or the level of expression of KIAA1199, SFN and RND1 may be determined, or the level of expression of KIAA1199, GPR110 and GDF15 may be determined, or the level of expression of KIAA1199, GPR110 and RASGRF2 may be determined, or the level of expression of KIAA1199, GPR110 and RND1 may be determined, or the level of expression of KIAA1199, GDF15 and RASGRF2 may be determined, or the level of expression of KIAA1199, GDF15 and RND1 may be determined, or the level of expression of KIAA1199, RASGRF2 and RND1 may be determined. In addition thereto, the level of expression of at least one further gene selected from FGG, CYP1A1, CEACAM5, CTHRC1, NTRK2 and RASGRF2 and/or the level of expression of at least one further gene selected from DMBT1, TMSB15A, DPP6, SLC51B and NUDT11 (particularly DMBT1 and/or TMSB15A) may also be determined.

In a further embodiment of the method according to the second aspect of the invention, it is preferred that the level of expression of KIAA1199 and at least one further gene selected from DMBT1, TMSB15A, DPP6, SLC51B and NUDT11 is determined in the sample obtained from the subject. In this embodiment, it is furthermore preferred that the level of expression of at least two of the aforementioned further genes is determined. For example, the level of expression of KIAA1199, DMBT1 and TMSB15A may be determined, or the level of expression of KIAA1199, DMBT1 and DPP6 may be determined, or the level of expression of KIAA1199, DMBT1 and SLC51B may be determined, or the level of expression of KIAA1199, DMBT1 and NUDT11 may be determined, or the level of expression of KIAA1199, TMSB15A and DPP6 may be determined, or the level of expression of KIAA1199, TMSB15A and SLC51B may be determined, or the level of expression of KIAA1199, TMSB15A and NUDT11 may be determined, or the level of expression of KIAA1199, DPP6 and SLC51B may be determined, or the level of expression of KIAA1199, DPP6 and NUDT11 may be determined, or the level of expression of KIAA1199, SLC51B and NUDT11 may be determined. In addition thereto, the level of expression of at least one further gene selected from FGG, CYP1A1, CEACAM5, CTHRC1, NTRK2 and RASGRF2 and/or the level of expression of at least one further gene selected from ELF5, AZGP1, PRRX1, AQP3, SFN, GPR110, GDF15, RASGRF2 and RND1 may also be determined.

In the method according to the second aspect of the invention, it is particularly preferred that the level of expression of KIAA1199 and at least one further gene selected from DMBT1 and TMSB15A is determined in the sample obtained from the subject. Accordingly, it is preferred that the level of expression of KIAA1199 and DMBT1 is determined, or that the level of expression of KIAA1199 and TMSB15A is determined. Most preferably, the level of expression of KIAA1199, DMBT1 and TMSB15A is determined in the sample obtained from the subject. For example, the level of expression of KIAA1199, DMBT1, TMSB15A and at least one further gene selected from FGG, CYP1A1, CEACAM5, CTHRC1, NTRK2, RASGRF2, ELF5, AZGP1, PRRX1, AQP3, SFN, GPR110, GDF15, RASGRF2, RND1, DPP6, SLC51B and NUDT11 may be determined.

In one embodiment of the method according to the third aspect of the invention, it is preferred that the level of expression of KIAA1199 and at least one further gene selected from FGG, CYP1A1, CEACAM5, CTHRC1, NTRK2 and RASGRF2 is determined in the sample obtained from the subject. In this embodiment, it is furthermore preferred that the level of expression of at least two of the aforementioned further genes is determined. For example, the level of expression of KIAA1199, FGG and CYP1A1 may be determined, or the level of expression of KIAA1199, FGG and CEACAM5 may be determined, or the level of expression of KIAA1199, FGG and CTHRC1 may be determined, or the level of expression of KIAA1199, FGG and NTRK2 may be determined, or the level of expression of KIAA1199, FGG and RASGRF2 may be determined, or the level of expression of KIAA1199, CYP1A1 and CEACAM5 may be determined, or the level of expression of KIAA1199, CYP1A1 and CTHRC1 may be determined, or the level of expression of KIAA1199, CYP1A1 and NTRK2 may be determined, or the level of expression of KIAA1199, CYP1A1 and RASGRF2 may be determined, or the level of expression of KIAA1199, CEACAM5 and CTHRC1 may be determined, or the level of expression of KIAA1199, CEACAM5 and NTRK2 may be determined, or the level of expression of KIAA1199, CEACAM5 and RASGRF2 may be determined, or the level of expression of KIAA1199, CTHRC1 and NTRK2 may be determined, or the level of expression of KIAA1199, CTHRC1 and RASGRF2 may be determined, or the level of expression of KIAA1199, NTRK2 and RASGRF2 may be determined. In addition thereto, the level of expression of at least one further gene selected from ELF5, AZGP1, PRRX1, AQP3, GPR110, GDF15, RASGRF2 and RND1 and/or the level of expression of at least one further gene selected from DMBT1, TMSB15A, DPP6, SLC51B and NUDT11 (particularly DMBT1 and/or TMSB15A) may also be determined.

In a further embodiment of the method according to the third aspect of the invention, it is preferred that the level of expression of KIAA1199 and at least one further gene selected from ELF5, AZGP1, PRRX1, AQP3, SFN, GPR110, GDF15, RASGRF2 and RND1 is determined in the sample obtained from the subject. In this embodiment, it is furthermore preferred that the level of expression of at least two of the aforementioned further genes is determined. For example, the level of expression of KIAA1199, ELF5 and AZGP1 may be determined, or the level of expression of KIAA1199, ELF5 and PRRX1 may be determined, or the level of expression of KIAA1199, ELF5 and AQP3 may be determined, or the level of expression of KIAA1199, ELF5 and SFN may be determined, or the level of expression of KIAA1199, ELF5 and GPR110 may be determined, or the level of expression of KIAA1199, ELF5 and GDF15 may be determined, or the level of expression of KIAA1199, ELF5 and RASGRF2 may be determined, or the level of expression of KIAA1199, ELF5 and RND1 may be determined, or the level of expression of KIAA1199, AZGP1 and PRRX1 may be determined, or the level of expression of KIAA1199, AZGP1 and AQP3 may be determined, or the level of expression of KIAA1199, AZGP1 and SFN may be determined, or the level of expression of KIAA1199, AZGP1 and GPR110 may be determined, or the level of expression of KIAA1199, AZGP1 and GDF15 may be determined, or the level of expression of KIAA1199, AZGP1 and RASGRF2 may be determined, or the level of expression of KIAA1199, AZGP1 and RND1 may be determined, or the level of expression of KIAA1199, PRRX1 and AQP3 may be determined, or the level of expression of KIAA1199, PRRX1 and SFN may be determined, or the level of expression of KIAA1199, PRRX1 and GPR110 may be determined, or the level of expression of KIAA1199, PRRX1 and GDF15 may be determined, or the level of expression of KIAA1199, PRRX1 and RASGRF2 may be determined, or the level of expression of KIAA1199, PRRX1 and RND1 may be determined, or the level of expression of KIAA1199, AQP3 and SFN may be determined, or the level of expression of KIAA1199, AQP3 and GPR110 may be determined, or the level of expression of KIAA1199, AQP3 and GDF15 may be determined, or the level of expression of KIAA1199, AQP3 and RASGRF2 may be determined, or the level of expression of KIAA1199, AQP3 and RND1 may be determined, or the level of expression of KIAA1199, SFN and GPR110 may be determined, or the level of expression of KIAA1199, SFN and GDF15 may be determined, or the level of expression of KIAA1199, SFN and RASGRF2 may be determined, or the level of expression of KIAA1199, SFN and RND1 may be determined, or the level of expression of KIAA1199, GPR110 and GDF15 may be determined, or the level of expression of KIAA1199, GPR110 and RASGRF2 may be determined, or the level of expression of KIAA1199, GPR110 and RND1 may be determined, or the level of expression of KIAA1199, GDF15 and RASGRF2 may be determined, or the level of expression of KIAA1199, GDF15 and RND1 may be determined, or the level of expression of KIAA1199, RASGRF2 and RND1 may be determined. In addition thereto, the level of expression of at least one further gene selected from FGG, CYP1A1, CEACAM5, CTHRC1, NTRK2 and RASGRF2 and/or the level of expression of at least one further gene selected from DMBT1, TMSB15A, DPP6, SLC51B and NUDT11 (particularly DMBT1 and/or TMSB15A) may also be determined.

In a further embodiment of the method according to the third aspect of the invention, it is preferred that the level of expression of KIAA1199 and at least one further gene selected from DMBT1, TMSB15A, DPP6, SLC51B and NUDT11 is determined in the sample obtained from the subject. In this embodiment, it is furthermore preferred that the level of expression of at least two of the aforementioned further genes is determined. For example, the level of expression of KIAA1199, DMBT1 and TMSB15A may be determined, or the level of expression of KIAA1199, DMBT1 and DPP6 may be determined, or the level of expression of KIAA1199, DMBT1 and SLC51B may be determined, or the level of expression of KIAA1199, DMBT1 and NUDT11 may be determined, or the level of expression of KIAA1199, TMSB15A and DPP6 may be determined, or the level of expression of K1AA1199, TMSB15A and SLC51B may be determined, or the level of expression of KIAA1199, TMSB15A and NUDT11 may be determined, or the level of expression of KIAA1199, DPP6 and SLC51B may be determined, or the level of expression of KIAA1199, DPP6 and NUDT11 may be determined, or the level of expression of KIAA1199, SLC51B and NUDT11 may be determined. In addition thereto, the level of expression of at least one further gene selected from FGG, CYP1A1, CEACAM5, CTHRC1, NTRK2 and RASGRF2 and/or the level of expression of at least one further gene selected from ELF5, AZGP1, PRRX1, AQP3, SFN, GPR110, GDF15, RASGRF2 and RND1 may also be determined.

In the method according to the third aspect of the invention, it is particularly preferred that the level of expression of KIAA1199 and at least one further gene selected from DMBT1 and TMSB15A is determined in the sample obtained from the subject. AccOrdingly, it is preferred that the level of expression of K1AA1199 and DMBT1 is determined, or that the level of expression of KIAA1199 and TMSB15A is determined. Most preferably, the level of expression of KIAA1199, DMBT1 and TMSB15A is determined in the sample obtained from the subject.

In one embodiment of the method according to the fourth aspect of the invention, it is preferred that the level of expression of KIAA1199 and at least one further gene selected from FGG, CYP1A1, CEACAM5, CTHRC1, NTRK2 and RASGRF2 is determined in the sample obtained from the subject. In this embodiment, it is furthermore preferred that the level of expression of at least two of the aforementioned further genes is determined. For example, the level of expression of KIAA1199, FGG and CYP1A1 may be determined, or the level of expression of KIAA1199, FGG and CEACAM5 may be determined, or the level of expression of KIAA1199, FGG and CTHRC1 may be determined, or the level of expression of K1AA1199, FGG and NTRK2 may be determined, or the level of expression of KIAA1199, FGG and RASGRF2 may be determined, or the level of expression of KIAA1199, CYP1A1 and CEACAM5 may be determined, or the level of expression of KIAA1199, CYP1A1 and CTHRC1 may be determined, or the level of expression of KIAA1199, CYP1A1 and NTRK2 may be determined, or the level of expression of KIAA1199, CYP1A1 and RASGRF2 may be determined, or the level of expression of KIAA1199, CEACAM5 and CTHRC1 may be determined, or the level of expression of KIAA1199, CEACAM5 and NTRK2 may be determined, or the level of expression of KIAA1199, CEACAM5 and RASGRF2 may be determined, or the level of expression of KIAA1199, CTHRC1 and NTRK2 may be determined, or the level of expression of KIAA1199, CTHRC1 and RASGRF2 may be determined, or the level of expression of KIAA1199, NTRK2 and RASGRF2 may be determined. In addition thereto, the level of expression of at least one further gene selected from ELF5, AZGP1, PRRX1, AQP3, GPR110, GDF15, RASGRF2 and RND1 and/or the level of expression of at least one further gene selected from DMBT1 and TMSB15A may also be determined.

In a further embodiment of the method according to the fourth aspect of the invention, it is preferred that the level of expression of KIAA1199 and at least one further gene selected from ELF5, AZGP1, PRRX1, AQP3, GPR110, GDF15, RASGRF2 and RND1 is determined in the sample obtained from the subject. In this embodiment, it is furthermore preferred that the level of expression of at least two of the aforementioned further genes is determined. For example, the level of expression of KIAA1199, ELF5 and AZGP1 may be determined, or the level of expression of KIAA1199, ELF5 and PRRX1 may be determined, or the level of expression of KIAA1199, ELF5 and AQP3 may be determined, or the level of expression of KIAA1199, ELF5 and GPR110 may be determined, or the level of expression of KIAA1199, ELF5 and GDF15 may be determined, or the level of expression of KIAA1199, ELF5 and RASGRF2 may be determined, or the level of expression of KIAA1199. ELF5 and RND1 may be determined, or the level of expression of KIAA1199, AZGP1 and PRRX1 may be determined, or the level of expression of KIAA1199, AZGP1 and AQP3 may be determined, or the level of expression of KIAA1199, AZGP1 and GPR110 may be determined, or the level of expression of KIAA1199, AZGP1 and GDF15 may be determined, or the level of expression of KIAA1199, AZGP1 and RASGRF2 may be determined, or the level of expression of KIAA1199, AZGP1 and RND1 may be determined, or the level of expression of KIAA1199, PRRX1 and AQP3 may be determined, or the level of expression of KIAA1199, PRRX1 and GPR110 may be determined, or the level of expression of KIAA1199, PRRX1 and GDF15 may be determined, or the level of expression of KIAA1199, PRRX1 and RASGRF2 may be determined, or the level of expression of KIAA1199, PRRX1 and RND1 may be determined, or the level of expression of KIAA1199, AQP3 and GPR110 may be determined, or the level of expression of KIAA1199, AQP3 and GDF15 may be determined, or the level of expression of KIAA1199, AQP3 and RASGRF2 may be determined, or the level of expression of KIAA1199, AQP3 and RND1 may be determined, or the level of expression of KIAA1199, GPR110 and GDF15 may be determined, or the level of expression of KIAA1199, GPR110 and RASGRF2 may be determined, or the level of expression of KIAA1199, GPR110 and RND1 may be determined, or the level of expression of KIAA1199, GDF15 and RASGRF2 may be determined, or the level of expression of KIAA1199, GDF15 and RND1 may be determined, or the level of expression of KIAA1199, RASGRF2 and RND1 may be determined. In addition thereto, the level of expression of at least one further gene selected from FGG, CYP1A1, CEACAM5, CTHRC1, NTRK2 and RASGRF2 and/or the level of expression of at least one further gene selected from DMBT1 and TMSB15A may also be determined.

In the method according to the fourth aspect of the invention, it is particularly preferred that the level of expression of KIAA1199 and at least one further gene selected from DMBT1 and TMSB15A is determined in the sample obtained from the subject. Accordingly, it is preferred that the level of expression of KIAA1199 and DMBT1 is determined, or that the level of expression of KIAA1199 and TMSB15A is determined. Most preferably, the level of expression of KIAA1199, DMBT1 and TMSB15A is determined in the sample obtained from the subject.

In the method according to the second aspect of the invention, preferably, it is determined that the subject is prone to develop progressive COPD if the level of expression of a majority of the number of genes tested (i.e., of the number of genes, the expression of which has been tested) is altered in the sense that (i) the level of expression of KIAA1199, DMBT1, ELF5, AZGP1, PRRX1, AQP3, SFN, GPR110, GDF15, RASGRF2, RND1, FGG, CEACAMS, AHRR, CXCL3, CYP1A1, CYP1B1, CYP1A2, NTRK2 and/or COMP in the sample from the subject is increased as compared to the control expression level of the corresponding gene(s) and (ii) the level of expression of TMSB15A, DPP6, SLC51B, NUDT11, PLA1A, HYAL2, CST6, ITGA10, CTHRC1, TAL1, FIBIN, BEXS, BEX1, ESM1 and/or GHRL in the sample from the subject is decreased as compared to the control expression level of the corresponding gene(s). If only one marker gene (i.e., KIAA1199) is tested, then the alteration of the level of expression of this marker gene is decisive for determining whether or not the subject is prone to develop progressive COPD. If two or more marker genes are tested, then a decrease or increase in the level of expression of a majority of the number of these marker genes is required for determining that the subject is prone to develop progressive COPD. The term "majority" (as in the expression "majority of the number of genes tested") means more than 50% of the number of the marker genes tested.

In accordance with the second aspect, it is furthermore preferred that an alteration in the level of expression of at least 60%, more preferably at least 70%, even more preferably at least 80%, and still more preferably at least 90% of the number of genes tested—i.e., an alteration in the sense that (i) the level of expression of KIAA1199, DMBT1, ELF5, AZGP1, PRRX1, AQP3, SFN, GPR110, GDF15, RASGRF2, RND1, FGG, CEACAM5, AHRR, CXCL3, CYP1A1, CYP1B1, CYP1A2, NTRK2 and/or COMP in the sample from the subject is increased as compared to the control expression level of the corresponding gene(s) and (ii) the level of expression of TMSB15A, DPP6, SLC51B, NUDT11, PLA1A, HYAL2, CST6, ITGA10, CTHRC1, TAL1, FIBIN, BEX5, BEX1, ESM1 and/or GHRL in the sample from the subject is decreased as compared to the control expression level of the corresponding gene(s)—is required for determining that the subject is prone to develop progressive COPD.

The decrease or increase in the level of expression of the marker gene(s) tested which is required for determining that the subject is prone to develop progressive COPD in accordance with the second aspect is preferably at least a 1.5-fold decrease or increase, more preferably at least a 2-fold decrease or increase, even more preferably at least a 3-fold decrease or increase, even more preferably at least a 5-fold decrease or increase, and yet even more preferably at least a 10-fold decrease or increase.

In a preferred embodiment of the method according to the second aspect of the invention, it is determined that the subject to be tested is prone to develop progressive COPD if the level of expression of a majority of the number of genes tested is altered in the sense that (i) the level of expression of KIAA1199, DMBT1, ELF5, AZGP1, PRRX1, AQP3, SFN, GPR110, GDF15, RASGRF2, RND1, FGG, CEACAM5, AHRR, CXCL3, CYP1A1, CYP1B1, CYP1A2, NTRK2 and/or COMP in the sample from the subject is at least 3-fold (more preferably at least 5-fold, even more preferably at least 10-fold) increased as compared to the control expression level of the corresponding gene(s) and (ii) the level of expression of TMSB15A, DPP6, SLC51B, NUDT11, PLA1A, HYAL2, CST6, ITGA10, CTHRC1, TAL1, FIBIN, BEX5, BEX1, ESM1 and/or GHRL in the sample from the subject is at least 3-fold (more preferably at least 5-fold, even more preferably at least 10-fold) decreased as compared to the control expression level of the corresponding gene(s).

In a further preferred embodiment of the method according to the second aspect of the invention, it is determined that the subject to be tested is prone to develop progressive COPD if the level of expression of at least 70% (more preferably at least 80%, and even more preferably at least 90%) of the number of genes tested is altered in the sense that (i) the level of expression of KIAA1199, DMBT1, ELFS, AZGP1, PRRX1, AQP3, SFN, GPR110, GDF15, RASGRF2, RND1, FGG, CEACAM5, AHRR, CXCL3, CYP1A1, CYP1B1, CYP1A2, NTRK2 and/or COMP in the sample from the subject is increased as compared to the control expression level of the corresponding gene(s) and (ii) the level of expression of TMSB15A, DPP6, SLC51B, NUDT11, PLA1A, HYAL2, CST6, ITGA10, CTHRC1, TAL1, FIBIN, BEX5, BEX1, ESM1 and/or GHRL in the sample from the subject is decreased as compared to the control expression level of the corresponding gene(s).

In a further preferred embodiment of the method according to the second aspect of the invention, it is determined that the subject to be tested is prone to develop progressive COPD if the level of expression of at least 70% (more preferably at least 80%, and even more preferably at least 90%) of the number of genes tested is altered in the sense that (i) the level of expression of KIAA1199, DMBT1, ELF5, AZGP1, PRRX1, AQP3, SFN, GPR110, GDF15, RASGRF2, RND1, FGG, CEACAM5, AHRR, CXCL3, CYP1A1, CYP1B1, CYP1A2, NTRK2 and/or COMP in the sample from the subject is at least 3-fold (more preferably at least 5-fold, even more preferably at least 10-fold) increased as compared to the control expression level of the corresponding gene(s) and (ii) the level of expression of TMSB15A, DPP6, SLC51B, NUDT11, PLA1A, HYAL2, CST6, ITGA10, CTHRC1, TAL1, FIBIN, BEXS, BEX1, ESM1 and/or GHRL in the sample from the subject is at least 3-fold (more preferably at least 5-fold, even more preferably at least 10-fold) decreased as compared to the control expression level of the corresponding gene(s).

In the method according to the second aspect of the invention, it is particularly preferred to determine the level of expression of KIAA1199 and DMBT1 since the disease stage of COPD is particularly well reflected by the expression patterns of these marker genes. While an initial decrease in the expression of KIAA1199 and a simultaneous increase in the expression of DMBT1 is observed when a subject develops stable COPD, the ratio between the expression levels of KIAA1199 and DMBT1 changes upon entering the progressive stage of COPD, i.e., the expression of KIAA1199 increases while the expression of DMBT1 decreases. Therefore, in a particularly preferred embodiment of the method according to the second aspect, if the difference between the expression levels of DMBT1 and KIAA1199 (i.e., the expression level of DMBT1 minus the expression level of KIAA1199) in the sample from the subject is increased as compared to the difference between the control expression levels of DMBT1 and KIAA1199 (i.e., as compared to the value obtained when subtracting the control expression level of KIAA1199 from the control expression level of DMBT1) by a factor of more than $2^{3.63}$ (i.e., by a factor of more than 12.38; preferably by a factor of more than $2^{3.8}$, i.e., more than 13.93; and more preferably by a factor of more than $2^4$, i.e., more than 16), then it is determined that the subject is prone to develop progressive COPD. This procedure allows to particularly reliably distinguish between progressive COPD and stable COPD (see also FIG. 6E) and, thus, further improves the accurateness of the method of assessing the susceptibility of a subject to develop progressive COPD in accordance with the second aspect of the invention.

In the method according to the third aspect of the invention, preferably, it is determined that the subject suffers from stable COPD or is prone to suffer from stable COPD if the level of expression of a majority (i.e., more than 50%) of the number of genes tested is altered in the sense that (i) the level of expression of DMBT1, ELF5, AZGP1, PRRX1, AQP3, SFN, GPR110, GDF15, RASGRF2, RND1, FGG, CEACAMS, AHRR, CXCL3, CYP1A1, CYP1B1, CYP1A2, NTRK2 and/or COMP in the sample from the subject is increased as compared to the control expression level of the corresponding gene(s) and (ii) the level of expression of KIAA1199, TMSB15A, DPP6, SLC51B, NUDT11, PLA1A, HYAL2, CST6, ITGA10, CTHRC1, TAL1, FIBIN, BEX5, BEX1, ESM1 and/or GHRL in the sample from the subject is decreased as compared to the control expression level of the corresponding gene(s).

In accordance with the third aspect, it is furthermore preferred that an alteration in the level of expression of at least 60%, more preferably at least 70%, even more preferably at least 80%, and still more preferably at least 90% of the number of genes tested—i.e., an alteration in the sense that (i) the level of expression of DMBT1, ELF5, AZGP1, PRRX1, AQP3, SFN, GPR110, GDF15, RASGRF2, RND1, FGG, CEACAMS, AHRR, CXCL3, CYP1A1, CYP1B1, CYP1A2, NTRK2 and/or COMP in the sample from the subject is increased as compared to the control expression level of the corresponding gene(s) and (ii) the level of expression of KIAA1199, TMSB15A, DPP6, SLC51B, NUDT11, PLA1A, HYAL2, CST6, ITGA10, CTHRC1, TAL1, FIBIN, BEX5, BEX1, ESM1 and/or GHRL in the sample from the subject is decreased as compared to the control expression level of the corresponding gene(s)—is required for determining that the subject suffers from stable COPD or is prone to suffer from stable COPD.

The decrease or increase in the level of expression of the marker gene(s) tested which is required for determining that the subject suffers from stable COPD or is prone to suffer from stable COPD in accordance with the third aspect is preferably at least a 1.5-fold decrease or increase, more preferably at least a 2-fold decrease or increase, even more preferably at least a 3-fold decrease or increase, even more preferably at least a 5-fold decrease or increase, and yet even more preferably at least a 10-fold decrease or increase.

In a preferred embodiment of the method according to the third aspect of the invention, it is determined that the subject to be tested suffers from stable COPD or is prone to suffer from stable COPD if the level of expression of a majority of the number of genes tested is altered in the sense that (i) the level of expression of DMBT1, ELF5, AZGP1, PRRX1, AQP3, SFN, GPR110, GDF15, RASGRF2, RND1, FGG, CEACAMS, AHRR, CXCL3, CYP1A1, CYP1B1, CYP1A2, NTRK2 and/or COMP in the sample from the subject is at least 3-fold (more preferably at least 5-fold, even more preferably at least 10-fold) increased as compared to the control expression level of the corresponding gene(s) and (ii) the level of expression of KIAA1199, TMSB15A, DPP6, SLC51B, NUDT11, PLA1A, HYAL2, CST6, ITGA10, CTHRC1, TAL1, FIBIN, BEX5, BEX1, ESM1 and/or GHRL in the sample from the subject is at least 3-fold (more preferably at least 5-fold, even more preferably at least 10-fold) decreased as compared to the control expression level of the corresponding gene(s).

In a further preferred embodiment of the method according to the third aspect of the invention, it is determined that the subject to be tested suffers from stable COPD or is prone to suffer from stable COPD if the level of expression of at least 70% (more preferably at least 80%, and even more preferably at least 90%) of the number of genes tested is altered in the sense that (i) the level of expression of DMBT1, ELFS, AZGP1, PRRX1, AQP3, SFN, GPR110, GDF15, RASGRF2, RND1, FGG, CEACAMS, AHRR, CXCL3, CYP1A1, CYP1B1, CYP1A2, NTRK2 and/or COMP in the sample from the subject is increased as compared to the control expression level of the corresponding gene(s) and (ii) the level of expression of KIAA1199, TIV1SB15A, DPP6, SL051B, NUDT11, PLA1A, HYAL2, CST6, ITGA10, CTHRC1, TAL1, FIBIN, BEX5, BEX1, ESM1 and/or GHRL in the sample from the subject is decreased as compared to the control expression level of the corresponding gene(s).

In a further preferred embodiment of the method according to the third aspect of the invention, it is determined that the subject to be tested suffers from stable COPD or is prone to suffer from stable COPD if the level of expression of at least 70% (more preferably at least 80%, and even more preferably at least 90%) of the number of genes tested is altered in the sense that (i) the level of expression of DMBT1, ELFS, AZGP1, PRRX1, AQP3, SFN, GPR110, GDF15, RASGRF2, RND1, FGG, CEACAMS, AHRR, CXCL3, CYP1A1, CYP1B1, CYP1A2, NTRK2 and/or COMP in the sample from the subject is at least 3-fold (more preferably at least 5-fold, even more preferably at least 10-fold) increased as compared to the control expression level of the corresponding gene(s) and (ii) the level of expression of KIAA1199, TMSB15A, DPP6, SLC51B, NUDT11, PLA1A, HYAL2, CST6, ITGA10, CTHRC1, TAL1, FIBIN, BEX5, BEX1, ESM1 and/or GHRL in the sample from the subject is at least 3-fold (more preferably at least 5-fold, even more preferably at least 10-fold) decreased as compared to the control expression level of the corresponding gene(s).

In the method according to the fourth aspect of the invention, preferably, it is determined that the subject is prone to develop progressive COPD if the level of expression of a majority (i.e., more than 50%) of the number of genes tested is altered in the sense that (i) the level of expression of KIAA1199, GPR110, GDF15, RASGRF2, RND1, FGG, CEACAMS, HYAL2, AHRR, CXCL3, CYP1A1, CYP1B1, CYP1A2, CST6, NTRK2 and/or TALI in the sample from the subject is increased as compared to the control expression level of the corresponding gene(s) and (ii) the level of expression of DMBT1, ELF5, AZGP1, PRRX1, AQP3, COMP, ITGA10, CTHRC1, BEX1 and/or GHRL in the sample from the subject is decreased as compared to the control expression level of the corresponding gene(s).

In accordance with the fourth aspect, it is furthermore preferred that an alteration in the level of expression of at least 60%, more preferably at least 70%, even more preferably at least 80%, and still more preferably at least 90% of the number of genes tested—i.e., an alteration in the sense that (i) the level of expression of KIAA1199, GPR110, GDF15, RASGRF2, RND1, FGG, CEACAM5, HYAL2, AHRR, CXCL3, CYP1A1, CYP1B1, CYP1A2, CST6, NTRK2 and/or TAU in the sample from the subject is increased as compared to the control expression level of the corresponding gene(s) and (ii) the level of expression of DMBT1, ELF5, AZGP1, PRRX1, AQP3, COMP, ITGA10, CTHRC1, BEX1 and/or GHRL in the sample from the subject is decreased as compared to the control expression level of the corresponding gene(s)—is required for determining that the subject is prone to develop progressive COPD.

The decrease or increase in the level of expression of the marker gene(s) tested which is required for determining that the subject is prone to develop progressive COPD in accordance with the fourth aspect is preferably at least a 1.5-fold decrease or increase, more preferably at least a 2-fold decrease or increase, even more preferably at least a 3-fold decrease or increase, even more preferably at least a 5-fold decrease or increase, and yet even more preferably at least a 10-fold decrease or increase.

In a preferred embodiment of the method according to the fourth aspect of the invention, it is determined that the subject to be tested is prone to develop progressive COPD if the level of expression of a majority of the number of genes tested is altered in the sense that (i) the level of expression of KIAA1199, GPR110, GDF15, RASGRF2, RND1, FGG, CEACAM5, HYAL2, AHRR, CXCL3, CYP1A1, CYP1B1, CYP1A2, CST6, NTRK2 and/or TAL1 in the sample from the subject is at least 3-fold (more preferably at least 5-fold, even more preferably at least 10-fold) increased as compared to the control expression level of the corresponding gene(s) and (ii) the level of expression of DMBT1, ELF5, AZGP1, PRRX1, AQP3, COMP, ITGA10, CTHRC1, BEX1 and/or GHRL in the sample from the subject is at least 3-fold (more preferably at least 5-fold, even more preferably at least 10-fold) decreased as compared to the control expression level of the corresponding gene(s).

In a further preferred embodiment of the method according to the fourth aspect of the invention, it is determined that the subject to be tested is prone to develop progressive COPD if the level of expression of at least 70% (more preferably at least 80%, and even more preferably at least 90%) of the number of genes tested is altered in the sense that (i) the level of expression of KIAA1199, GPR110, GDF15, RASGRF2, RND1, FGG, CEACAM5, HYAL2, AHRR, CXCL3, CYP1A1, CYP1B1, CYP1A2, CST6, NTRK2 and/or TAL1 in the sample from the subject is increased as compared to the control expression level of the corresponding gene(s) and (ii) the level of expression of DMBT1, ELF5, AZGP1, PRRX1, AQP3, COMP, ITGA10, CTHRC1, BEX1 and/or GHRL in the sample from the subject is decreased as compared to the control expression level of the corresponding gene(s).

In a further preferred embodiment of the method according to the fourth aspect of the invention, it is determined that the subject to be tested is prone to develop progressive COPD if the level of expression of at least 70% (more preferably at least 80%, and even more preferably at least 90%) of the number of genes tested is altered in the sense that (i) the level of expression of KIAA1199, GPR110, GDF15, RASGRF2, RND1, FGG, CEACAM5, HYAL2, AHRR, CXCL3, CYP1A1, CYP1B1, CYP1A2, CST6, NTRK2 and/or TAL1 in the sample from the subject is at least 3-fold (more preferably at least 5-fold, even more preferably at least 10-fold) increased as compared to the control expression level of the corresponding gene(s) and (ii) the level of expression of DMBT1, ELF5, AZGP1, PRRX1, AQP3, COMP, ITGA10, CTHRC1, BEX1 and/or GHRL in the sample from the subject is at least 3-fold (more preferably at least 5-fold, even more preferably at least 10-fold) decreased as compared to the control expression level of the corresponding gene(s).

The present invention furthermore relates to the use of the gene KIAA1199 as a marker in an in vitro diagnostic method of assessing the susceptibility of a subject to develop progressive COPD. In particular, in accordance with the fifth aspect, the invention relates to the use of a pair of primers for (i.e., binding to) a transcript of the gene KIAA1199 in an in vitro diagnostic method of assessing the susceptibility of a subject to develop progressive COPD. Non-limiting examples of such an in vitro method are the methods according to the second aspect of the present invention. The transcript is preferably an mRNA of the gene KIAA1199 (e.g., the specific mRNA of KIAA1199 listed in Table 1 above) or a cDNA synthesized from the mRNA of the gene KIAA1199 (e.g., a cDNA synthesized from the specific mRNA of KIAA1199 listed in Table 1 above). The primers can be designed using methods known in the art (as also described, e.g., in Green et al., 2012) so as to allow the specific amplification/quantification of the transcript of the gene KIAA1199. Furthermore, the primers are preferably DNA primers. The in vitro diagnostic method of assessing the susceptibility of a subject to develop progressive COPD, in which the pair of primers is to be used, preferably comprises a step of determining the expression level of the gene KIAA1199 in a sample obtained from the subject. The preferred features/embodiments of the method according to the second aspect of the present invention as described herein, including in particular the preferred embodiments of determining expression levels, the preferred embodiments of the sample, and the preferred embodiments of the subject, also apply to the method in which the pair of primers is to be used.

In accordance with the fifth aspect, the present invention also relates to the use of a nucleic acid probe to (i.e., binding to) a transcript of the gene KIAA1199 in an in vitro diagnostic method of assessing the susceptibility of a subject to develop progressive COPD. Non-limiting examples of such an in vitro method are the methods according to the second aspect of the present invention. The transcript is preferably an mRNA of the gene KIAA1199 (e.g., the specific mRNA of KIAA1199 listed in Table 1 above) or a cDNA synthesized from the mRNA of the gene KIAA1199 (e.g., a cDNA synthesized from the specific mRNA of KIAA1199 listed in Table 1 above). The nucleic acid probe comprises or consists of a nucleic acid capable of hybridizing with the above-mentioned transcript. The nucleic acid probe is preferably a single-stranded DNA probe or a single-stranded RNA probe, more preferably a single-stranded DNA probe. It is furthermore preferred that the nucleic acid probe (which may be, e.g., a single-stranded DNA or a single-stranded RNA, and is preferably a single-stranded DNA) is an oligonucleotide probe having, e.g., 10 to 80 nucleotides, preferably 15 to 60 nucleotides, more preferably 20 to 35 nucleotides, and even more preferably about 25 nucleotides. Such nucleic acid probes can be designed using methods known in the art (as also described, e.g., in Green et al., 2012) so as to allow the specific detection and quantification of the transcript of the corresponding gene. The in vitro diagnostic method of assessing the susceptibility of a subject to develop progressive COPD, in which the nucleic acid probe is to be used, preferably comprises a step of determining the expression level of the gene KIAA1199 in a sample obtained from the subject, The preferred features/embodiments of the method according to the second aspect of the invention as described herein, including in particular the preferred embodiments of determining expression levels, the preferred embodiments of the sample, and the preferred embodiments of the subject, also apply to the method in which the nucleic acid probe is to be used.

In the fifth aspect, the invention further relates to the use of a microarray comprising a nucleic acid probe to (i.e., binding to) a transcript of the gene KIAA1199 and optionally comprising nucleic acid probes to the transcripts of one or more further genes selected from DMBT1, TMSBI5A, DPP6, SLC51B, NUDT11, ELFS, AZGP1, PRRX1, AQP3, SFN, GPR110, GDF15, RASGRF2, RND1, PLA1A, FGG, CEACAMS, HYAL2, AHRR, CXCL3, CYP1A1, CYP1B1, CYP1A2, CST6, NTRK2, COMP, ITGA10, CTHRC1, TAL1, FIBIN, BEXS, BEX1, ESM1 and GHRL in an in vitro diagnostic method of assessing the susceptibility of a subject to develop progressive COPD. The microarray preferably comprises nucleic acid probes to the transcript of KIAA1199 and to the transcripts of at least one, more preferably at least two, even more preferably at least three of the above-mentioned further genes. Each of the transcripts is preferably an mRNA of the corresponding gene (including, e.g., any one of the corresponding specific mRNAs listed in Table 1 above) or a cDNA synthesized from the mRNA of the gene (including, e.g., a cDNA synthesized from any one of the corresponding specific mRNAs listed in Table 1 above). Each of the nucleic acid probes is preferably a single-stranded DNA probe or a single-stranded RNA probe, more preferably a single-stranded DNA probe. It is furthermore preferred that the nucleic acid probes (which may be, e.g., single-stranded DNA or single-stranded RNA, preferably single-stranded DNA) are oligonucleotide probes having, e.g., 10 to 80 nucleotides, preferably 15 to 60 nucleotides, more preferably 20 to 35 nucleotides, and even more preferably about 25 nucleotides. The in vitro diagnostic method of assessing the susceptibility of a subject to develop progressive COPD, in which the microarray is to be used, preferably comprises a step of determining the expression level of the gene KIAA1199 and optionally of the one or more further genes in a sample obtained from the subject. The preferred features/embodiments of the method according to the second aspect of the invention as described herein, including in particular the preferred embodiments of determining expression levels, the preferred embodiments of the sample, and the preferred embodiments of the subject, also apply to the method in which the microarray is to be used.

In accordance with the fifth aspect, the invention is also directed to the use of an antibody against (i.e., binding to) the protein KIAA1199 in an in vitro diagnostic method of assessing the susceptibility of a subject to develop progressive COPD. The antibody binds specifically to the protein KIAA1199 and may be, e.g., a polyclonal antibody or a monoclonal antibody. Preferably, the antibody is a monoclonal antibody. The antibody may further be a full/intact immunoglobulin molecule or a fragment/part thereof (such as, e.g., a separated light or heavy chain, an Fab fragment, an Fab/c fragment, an Fv fragment, an Fab' fragment, or an $F(ab')_2$ fragment), provided that the fragment/part substantially retains the binding specificity of the corresponding full immunoglobulin molecule. The antibody may also be a modified and/or altered antibody, such as a chimeric or humanized antibody, a bifunctional or trifunctional antibody, or an antibody construct (such as a single-chain variable fragment (scFv) or an antibody-fusion protein). The antibody can be prepared using methods known in the art, as also described, e.g., in Harlow et al., 1998. For example, monoclonal antibodies can be prepared by methods such as the hybridoma technique (see, e.g., Kohler et al., 1975), the trioma technique, the human B-cell hybridoma technique (see, e.g., Kozbor et al., 1983) or the EBV-hybridoma technique (see, e.g., Cole et al., 1985). The protein KIAA1199 may be, e.g., the specific KIAA1199 protein listed in Table 1 above. The in vitro diagnostic method of assessing the susceptibility of a subject to develop progressive COPD, in which the antibody is to be used, preferably comprises a step of determining the amount of the protein KIAA1199 in a sample obtained from the subject. The preferred features/embodiments of the method according to the second aspect of the invention as described herein, including in particular the preferred embodiments of determining the amount of a specific protein in a sample (as discussed in connection with the determination of translation levels), the preferred embodiments of the sample, and the preferred embodiments of the subject, also apply to the method in which the antibody is to be used.

Moreover, in accordance with the seventh aspect, the present invention relates to the use of a pair of primers for (i.e., binding to) a transcript of the gene KIAA1199 in an in vitro method of diagnosing stable COPD in a subject or assessing the susceptibility of a subject to develop stable COPD. Non-limiting examples of such an in vitro method are the methods according to the third aspect of the present invention. The transcript is preferably an mRNA of the gene KIAA1199 (e.g., the specific mRNA of KIAA1199 listed in Table 1 above) or a cDNA synthesized from the mRNA of the gene KIAA1 199 (e.g., a cDNA synthesized from the specific mRNA of KIAA1199 listed in Table 1 above). The primers can be designed using methods known in the art (as also described, e.g., in Green et al., 2012) so as to allow the specific amplification/quantification of the transcript of the gene KIAA1199. Furthermore, the primers are preferably DNA primers. The in vitro method of diagnosing stable COPD in a subject or assessing the susceptibility of a subject to develop stable COPD, in which the pair of primers is to be used, preferably comprises a step of determining the expression level of the gene KIAA1199 in a sample obtained from the subject. The preferred features/embodiments of the method according to the third aspect of the present invention as described herein, including in particular the preferred embodiments of determining expression levels, the preferred embodiments of the sample, and the preferred embodiments of the subject, also apply to the method in which the pair of primers is to be used.

In accordance with the seventh aspect, the present invention also relates to the use of a nucleic acid probe to (i.e., binding to) a transcript of the gene KIAA1199 in an in vitro method of diagnosing stable COPD in a subject or assessing the susceptibility of a subject to develop stable COPD. Non-limiting examples of such an in vitro method are the methods according to the third aspect of the present invention. The transcript is preferably an mRNA of the gene KIAA1199 (e.g., the specific mRNA of KIAA1199 listed in Table 1 above) or a cDNA synthesized from the mRNA of the gene KIAA1199 (e.g., a cDNA synthesized from the specific mRNA of KIAA1199 listed in Table 1 above). The nucleic acid probe comprises or consists of a nucleic acid capable of hybridizing with the above-mentioned transcript. The nucleic acid probe is preferably a single-stranded DNA probe or a single-stranded RNA probe, more preferably a single-stranded DNA probe. It is furthermore preferred that the nucleic acid probe (which may be, e.g., a single-stranded DNA or a single-stranded RNA, and is preferably a single-stranded DNA) is an oligonucleotide probe having, e.g., 10 to 80 nucleotides, preferably 15 to 60 nucleotides, more preferably 20 to 35 nucleotides, and even more preferably about 25 nucleotides. Such nucleic acid probes can be designed using methods known in the art (as also described, e.g., in Green et al., 2012) so as to allow the specific detection and quantification of the transcript of the corresponding gene. The in vitro method of diagnosing stable COPD in a subject or assessing the susceptibility of a subject to develop stable COPD, in which the nucleic acid probe is to be used, preferably comprises a step of determining the expression level of the gene KIAA1199 in a sample obtained from the subject. The preferred features/embodiments of the method according to the third aspect of the invention as described herein, including in particular the preferred embodiments of determining expression levels, the preferred embodiments of the sample, and the preferred embodiments of the subject, also apply to the method in which the nucleic acid probe is to be used.

In the seventh aspect, the invention further relates to the use of a microarray comprising a nucleic acid probe to (i.e., binding to) a transcript of the gene KIAA1199 and optionally comprising nucleic acid probes to the transcripts of one or more further genes selected from DMBT1, TMSB15A, DPP6, SLC51B, NUDT11, ELFS, AZGP1, PRRX1, AQP3, SFN, GPR110, GDF15, RASGRF2, RND1, PLA1A, FGG, CEACAMS, HYAL2, AHRR, CXCL3, CYP1A1, CYP1B1, CYP1A2, CST6, NTRK2, COMP, ITGA10, CTHRC1, TAL1, FIBIN, BEX5, BEX1, ESM1 and GHRL in an in vitro method of diagnosing stable COPD in a subject or assessing the susceptibility of a subject to develop stable COPD. The microarray preferably comprises nucleic acid probes to the transcript of KIAA1199 and to the transcripts of at least one, more preferably at least two, even more preferably at least three of the above-mentioned further genes. Each of the transcripts is preferably an mRNA of the corresponding gene (including, e.g., any one of the corresponding specific mRNAs listed in Table 1 above) or a cDNA synthesized from the mRNA of the gene (including, e.g., a cDNA synthesized from any one of the corresponding specific mRNAs listed in Table 1 above). Each of the nucleic acid probes is preferably a single-stranded DNA probe or a single-stranded RNA probe, more preferably a single-stranded DNA probe. It is furthermore preferred that the nucleic acid probes (which may be, e.g., single-stranded DNA or single-stranded RNA, preferably single-stranded DNA) are oligonucleotide probes having, e.g., 10 to 80 nucleotides, preferably 15 to 60 nucleotides, more preferably 20 to 35 nucleotides, and even more preferably about 25 nucleotides. The in vitro method of diagnosing stable COPD in a subject or assessing the susceptibility of a subject to develop stable COPD, in which the microarray is to be used, preferably comprises a step of determining the expression level of the gene KIAA1199 and optionally of the one or more further genes in a sample obtained from the subject. The preferred features/embodiments of the method according to the third aspect of the invention as described herein, including in particular the preferred embodiments of determining expression levels, the preferred embodiments of the sample, and the preferred embodiments of the subject, also apply to the method in which the microarray is to be used.

In accordance with the seventh aspect, the invention is also directed to the use of an antibody against (i.e., binding to) the protein KIAA1199 in an in vitro method of diagnosing stable COPD in a subject or assessing the susceptibility of a subject to develop stable COPD. The antibody binds specifically to the protein KIAA1199 and may be, e.g., a polyclonal antibody or a monoclonal antibody. Preferably, the antibody is a monoclonal antibody. The antibody may further be a full/intact immunoglobulin molecule or a fragment/part thereof (such as, e.g., a separated light or heavy chain, an Fab fragment, an Fab/c fragment, an Fv fragment, an Fab' fragment, or an $F(ab')_2$ fragment), provided that the fragment/part substantially retains the binding specificity of the corresponding full immunoglobulin molecule. The antibody may also be a modified and/or altered antibody, such as a chimeric or humanized antibody, a bifunctional or trifunctional antibody, or an antibody construct (such as a single-chain variable fragment (scFv) or an antibody-fusion protein). The antibody can be prepared using methods known in the art, as also described, e.g., in Harlow et al., 1998. For example, monoclonal antibodies can be prepared by methods such as the hybridoma technique (see, e.g., Köhler et al., 1975), the trioma technique, the human B-cell hybridoma technique (see, e.g., Kozbor et al., 1983) or the EBV-hybridoma technique (see, e.g., Cole et al., 1985). The protein KIAA1199 may be, e.g., the specific KIAA1199 protein listed in Table 1 above. The in vitro method of diagnosing stable COPD in a subject or assessing the susceptibility of a subject to develop stable COPD, in which the antibody is to be used, preferably comprises a step of determining the amount of the protein KIAA1199 in a sample obtained from the subject. The preferred features/embodiments of the method according to the third aspect of the invention as described herein, including in particular the preferred embodiments of determining the amount of a specific protein in a sample (as discussed in connection with the determination of translation levels), the preferred embodiments of the sample, and the preferred embodiments of the subject, also apply to the method in which the antibody is to be used.

Furthermore, in accordance with the ninth aspect, the present invention relates to the use of a pair of primers for (i.e., binding to) a transcript of the gene KIAA1199 in an in vitro diagnostic method of assessing the susceptibility of a subject suffering from stable COPD to develop progressive COPD involving the appearance of irreversible lung damage. Non-limiting examples of such an in vitro method are the methods according to the fourth aspect of the present invention. The transcript is preferably an mRNA of the gene KIAA1199 (e.g., the specific mRNA of KIAA1199 listed in Table 1 above) or a cDNA synthesized from the mRNA of the gene KIAA1199 (e.g., a cDNA synthesized from the specific mRNA of KIAA1199 listed in Table 1 above). The primers can be designed using methods known in the art (as also described, e.g., in Green et al., 2012) so as to allow the specific amplification/quantification of the transcript of the gene KIAA1199. Furthermore, the primers are preferably DNA primers. The in vitro diagnostic method of assessing the susceptibility of a subject suffering from stable COPD to develop progressive COPD involving the appearance of irreversible lung damage, in which the pair of primers is to be used, preferably comprises a step of determining the expression level of the gene KIAA1199 in a sample obtained from the subject. The preferred features/embodiments of the method according to the fourth aspect of the present invention as described herein, including in particular the preferred embodiments of determining expression levels, the preferred embodiments of the sample, and the preferred embodiments of the subject, also apply to the method in which the pair of primers is to be used.

In accordance with the ninth aspect, the present invention also relates to the use of a nucleic acid probe to (i.e., binding to) a transcript of the gene KIAA1199 in an in vitro diagnostic method of assessing the susceptibility of a subject suffering from stable COPD to develop progressive COPD involving the appearance of irreversible lung damage. Non-limiting examples of such an in vitro method are the methods according to the fourth aspect of the present invention. The transcript is preferably an mRNA of the gene KIAA1199 (e.g., the specific mRNA of KIAA1199 listed in Table 1 above) or a cDNA synthesized from the mRNA of the gene KIAA1199 (e.g., a cDNA synthesized from the specific mRNA of KIAA1199 listed in Table 1 above). The nucleic acid probe comprises or consists of a nucleic acid capable of hybridizing with the above-mentioned transcript. The nucleic acid probe is preferably a single-stranded DNA probe or a single-stranded RNA probe, more preferably a single-stranded DNA probe. It is furthermore preferred that the nucleic acid probe (which may be, e.g., a single-stranded DNA or a single-stranded RNA, and is preferably a single-stranded DNA) is an oligonucleotide probe having, e.g., 10 to 80 nucleotides, preferably 15 to 60 nucleotides, more preferably 20 to 35 nucleotides, and even more preferably about 25 nucleotides. Such nucleic acid probes can be designed using methods known in the art (as also described, e.g., in Green et al., 2012) so as to allow the specific detection and quantification of the transcript of the corresponding gene. The in vitro diagnostic method of assessing the susceptibility of a subject suffering from stable COPD to develop progressive COPD involving the appearance of irreversible lung damage, in which the nucleic acid probe is to be used, preferably comprises a step of determining the expression level of the gene KIAA1199 in a sample obtained from the subject. The preferred features/embodiments of the method according to the fourth aspect of the invention as described herein, including in particular the preferred embodiments of determining expression levels, the preferred embodiments of the sample, and the preferred embodiments of the subject, also apply to the method in which the nucleic acid probe is to be used.

In the ninth aspect, the invention further relates to the use of a microarray comprising a nucleic acid probe to (i.e., binding to) a transcript of the gene KIAA1199 and optionally comprising nucleic acid probes to the transcripts of one or more further genes selected from DMBT1, TMSB15A, DPP6, SLC51B, NUDT11, ELF5, AZGP1, PRRX1, AQP3, SFN, GPR110, GDF15, RASGRF2, RND1, PLA1A, FGG, CEACAM5, HYAL2, AHRR, CXCL3, CYP1A1, CYP1B1, CYP1A2, CST6, NTRK2, COMP, ITGA10, CTHRC1, TAL1, FIBIN, BEX5, BEX1, ESM1 and GHRL in an in vitro diagnostic method of assessing the susceptibility of a subject suffering from stable COPD to develop progressive COPD involving the appearance of irreversible lung damage. The microarray preferably comprises nucleic acid probes to the transcript of KIAA1199 and to the transcripts of at least one, more preferably at least two, even more preferably at least three of the above-mentioned further genes. Each of the transcripts is preferably an mRNA of the corresponding gene (including, e.g., any one of the corresponding specific mRNAs listed in Table 1 above) or a cDNA synthesized from the mRNA of the gene (including, e.g., a cDNA synthesized from any one of the corresponding specific mRNAs listed in Table 1 above). Each of the nucleic acid probes is preferably a single-stranded DNA probe or a single-stranded RNA probe, more preferably a single-stranded DNA probe. It is furthermore preferred that the nucleic acid probes (which may be, e.g., single-stranded DNA or single-stranded RNA, preferably single-stranded DNA) are oligonucleotide probes having, e.g., 10 to 80 nucleotides, preferably 15 to 60 nucleotides, more preferably 20 to 35 nucleotides, and even more preferably about 25 nucleotides. The in vitro diagnostic method of assessing the susceptibility of a subject suffering from stable COPD to develop progressive COPD involving the appearance of irreversible lung damage, in which the microarray is to be used, preferably comprises a step of determining the expression level of the gene KIAA1199 and optionally of the one or more further genes in a sample obtained from the subject. The preferred features/embodiments of the method according to the fourth aspect of the invention as described herein, including in particular the preferred embodiments of determining expression levels, the preferred embodiments of the sample, and the preferred embodiments of the subject, also apply to the method in which the microarray is to be used.

In accordance with the ninth aspect, the invention is also directed to the use of an antibody against (i.e., binding to) the protein KIAA1199 in an in vitro diagnostic method of assessing the susceptibility of a subject suffering from stable COPD to develop progressive COPD involving the appearance of irreversible lung damage. The antibody binds specifically to the protein KIAA1199 and may be, e.g., a polyclonal antibody or a monoclonal antibody. Preferably, the antibody is a monoclonal antibody. The antibody may further be a full/intact immunoglobulin molecule or a fragment/part thereof (such as, e.g., a separated light or heavy chain, an Fab fragment, an Fab/c fragment, an Fv fragment, an Fab' fragment, or an $F(ab')_2$ fragment), provided that the fragment/part substantially retains the binding specificity of the corresponding full immunoglobulin molecule. The antibody may also be a modified and/or altered antibody, such as a chimeric or humanized antibody, a bifunctional or trifunctional antibody, or an antibody construct (such as a single-chain variable fragment (scFv) or an antibody-fusion protein). The antibody can be prepared using methods known in the art, as also described, e.g., in Harlow et al., 1998. For example, monoclonal antibodies can be prepared by methods such as the hybridoma technique (see, e.g., Köhler et al., 1975), the trioma technique, the human B-cell hybridoma technique (see, e.g., Kozbor et al., 1983) or the EBV-hybridoma technique (see, e.g., Cole et al., 1985). The protein KIAA1199 may be, e.g., the specific KIAA1199 protein listed in Table 1 above. The in vitro diagnostic method of assessing the susceptibility of a subject suffering from stable COPD to develop progressive COPD involving the appearance of irreversible lung damage, in which the antibody is to be used, preferably comprises a step of determining the amount of the protein KIAA1199 in a sample obtained from the subject. The preferred features/embodiments of the method according to the fourth aspect of the invention as described herein, including in particular the preferred embodiments of determining the amount of a specific protein in a sample (as discussed in connection with the determination of translation levels), the preferred embodiments of the sample, and the preferred embodiments of the subject, also apply to the method in which the antibody is to be used, In accordance with the sixth aspect, the present invention provides a method of treating COPD, the method comprising administering a drug against COPD to a subject that has been identified in a method according to the second aspect of the invention as being prone to develop progressive COPD. The invention likewise provides a drug against COPD for use in treating COPD in a subject that has been identified in a method according to the second aspect as being prone to develop progressive COPD. The invention also relates to the use of a drug against COPD in the preparation of a pharmaceutical composition for treating COPD in a subject that has been identified in a method according to the second aspect as being prone to develop progressive COPD. The subject referred to above is as defined in the methods according to the second aspect of the invention and, accordingly, is preferably a human.

Moreover, in accordance with the eighth aspect, the present invention provides a method of treating or preventing COPD, the method comprising administering a drug against COPD to a subject that has been identified in a method according to the third aspect of the invention as suffering from stable COPD or as being prone to suffer from stable COPD. It will be understood that a subject that has been identified as suffering from stable COPD can be treated by administering a drug against COPD, while a subject that has been identified as being prone to suffer from stable COPD can be prevented from developing COPD by administering a drug against COPD. The invention likewise provides a drug against COPD for use in treating or preventing COPD in a subject that has been identified in a method according to the third aspect as suffering from stable COPD or as being prone to suffer from stable COPD. The invention also relates to the use of a drug against COPD in the preparation of a pharmaceutical composition for treating or preventing COPD in a subject that has been identified in a method according to the third aspect as suffering from stable COPD or as being prone to suffer from stable COPD. The subject referred to above is as defined in the methods according to the third aspect of the invention and, accordingly, is preferably a human.

In accordance with the tenth aspect, the present invention provides a method of treating COPD, the method comprising administering a drug against COPD to a subject suffering from stable COPD, wherein the subject has been identified in a method according to the fourth aspect of the invention as being prone to develop progressive COPD. The invention likewise provides a drug against COPD for use in treating COPD in a subject suffering from stable COPD, wherein the subject has been identified in a method according to the fourth aspect as being prone to develop progressive COPD. The invention also relates to the use of a drug against COPD in the preparation of a pharmaceutical composition for treating COPD in a subject suffering from stable COPD, wherein the subject has been identified in a method according to the fourth aspect as being prone to develop progressive COPD. The subject referred to above is as defined in the methods according to the fourth aspect of the invention and, accordingly, is preferably a human.

The drug against COPD to be administered to a subject in accordance with the sixth, eighth or tenth aspect of the invention is not particularly limited and may be, for example, a $\beta_2$-agonist (such as, e.g., bitolterol, carbuterol, fenoterol, pirbuterol, procaterol, reproterol, rimiterol, salbutamol, levosalbutamol, terbutaline, tulobuterol, arformoterol, bambuterol, clenbuterol, formoterol, olodaterol, salmeterol, indacaterol, or a pharmaceutically acceptable salt of any of the aforementioned agents), a glucocorticoid (such as, e.g., beclometasone, betamethasone, budesonide, ciclesonide, flunisolide, fluticasone, mometasone, triamcinolone, or a pharmaceutically acceptable salt of any of the aforementioned agents), an anticholinergic or a muscarinic antagonist (such as, e.g., aclidinium bromide, glycopyrronium bromide, ipratropium bromide, oxitropium bromide, tiotropium bromide, or a pharmaceutically acceptable salt of any of the aforementioned agents), a mast cell stabilizer (such as, e.g., cromoglicate, nedocromil, or a pharmaceutically acceptable salt of any of the aforementioned agents), a xanthine derivative (such as, e.g., acefylline, ambuphylline, bamifylline, doxofylline, enprofylline, etamiphyiline, proxyphylline, theobromine, theophylline, aminophylline, choline theophyllinate, or a pharmaceutically acceptable salt of any of the aforementioned agents), a leukotriene antagonist (such as, e.g., montelukast, pranlukast, zafirlukast, or a pharmaceutically acceptable salt of any of the aforementioned agents), a lipoxygenase inhibitor (such as, e.g., zileuton or a pharmaceutically acceptable salt thereof), a thromboxane receptor antagonist (such as, e.g., ramatroban, seratrodast, or a pharmaceutically acceptable salt of any of the aforementioned agents) a non-xanthine PDE4 inhibitor (such as, e.g., ibudilast, roflumilast, or a pharmaceutically acceptable salt of any of the aforementioned agents), or any other drug against COPD (such as, e.g., amlexanox, eprozinol, fenspiride, omalizumab, epinephrine, hexoprenaline, isoprenaline, isoproterenol, orciprenaline, metaproterenol, atropine, or a pharmaceutically acceptable salt of any of the aforementioned agents), or any combination thereof. A particularly preferred drug against COPD is roflumilast.

In the eleventh aspect, the present invention provides an in vitro method of monitoring the progression of COPD in a subject, the method comprising:

determining the level of expression of one or more genes selected from NTRK2 and RASGRF2 in a first sample obtained from the subject;

determining the level of expression of the one or more genes in a second sample obtained from the subject at a later point in time than the first sample;

comparing the level of expression of the one or more genes in the second sample to the level of expression of the corresponding gene(s) in the first sample; and assessing (or determining) the progression of COPD in the subject, wherein a decrease in the level of expression of NTRK2 and/or RASGRF2 in the second sample as compared to the level of expression of the corresponding gene(s) in the first sample is indicative of an amelioration (i.e., an improvement) of COPD in the subject, and wherein an increase in the level of expression of NTRK2 and/or RASGRF2 in the second sample as compared to the level of expression of the corresponding gene(s) in the first sample is indicative of a worsening of COPD in the subject.

Figure 4:
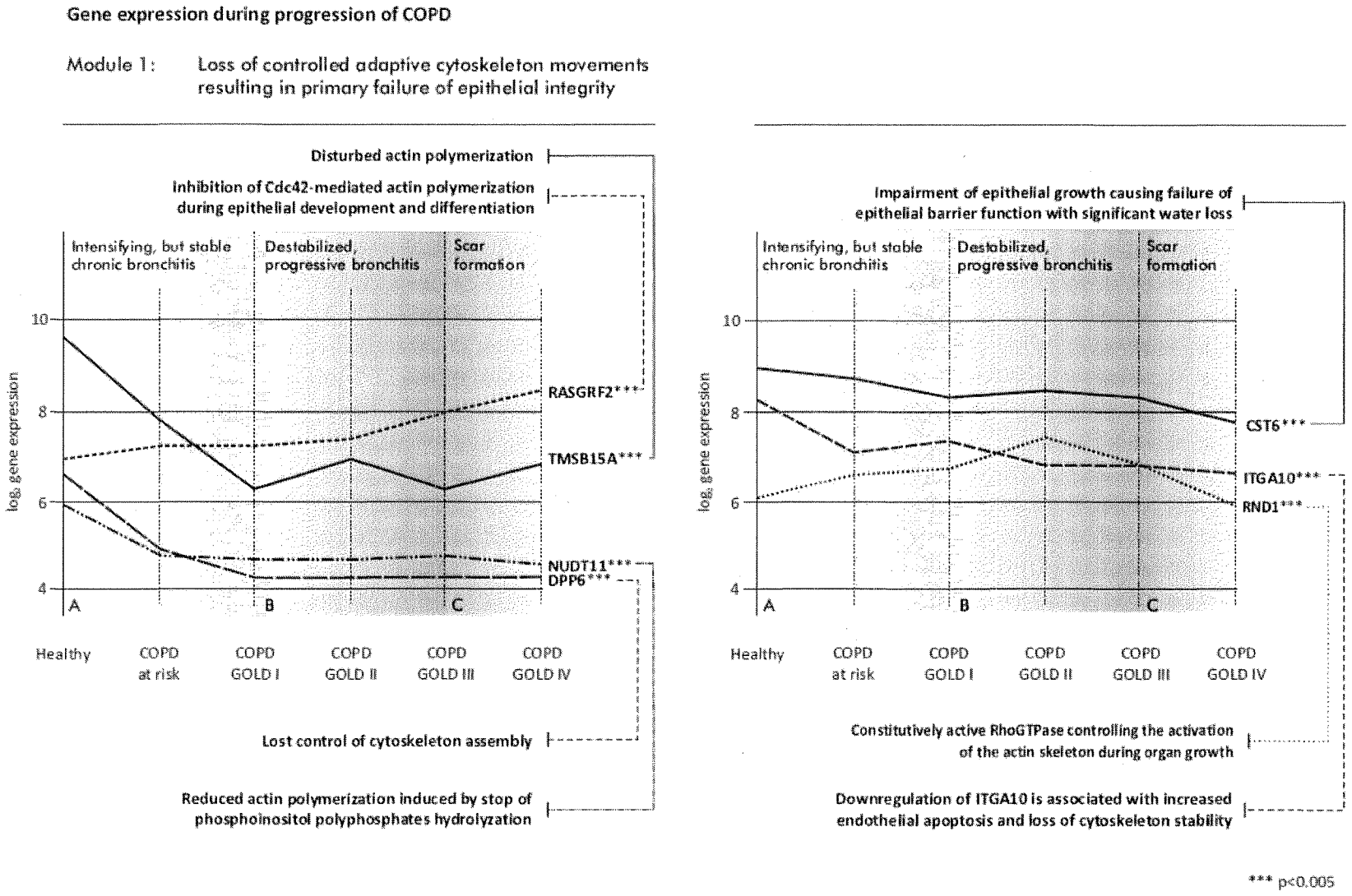
Figure 4:
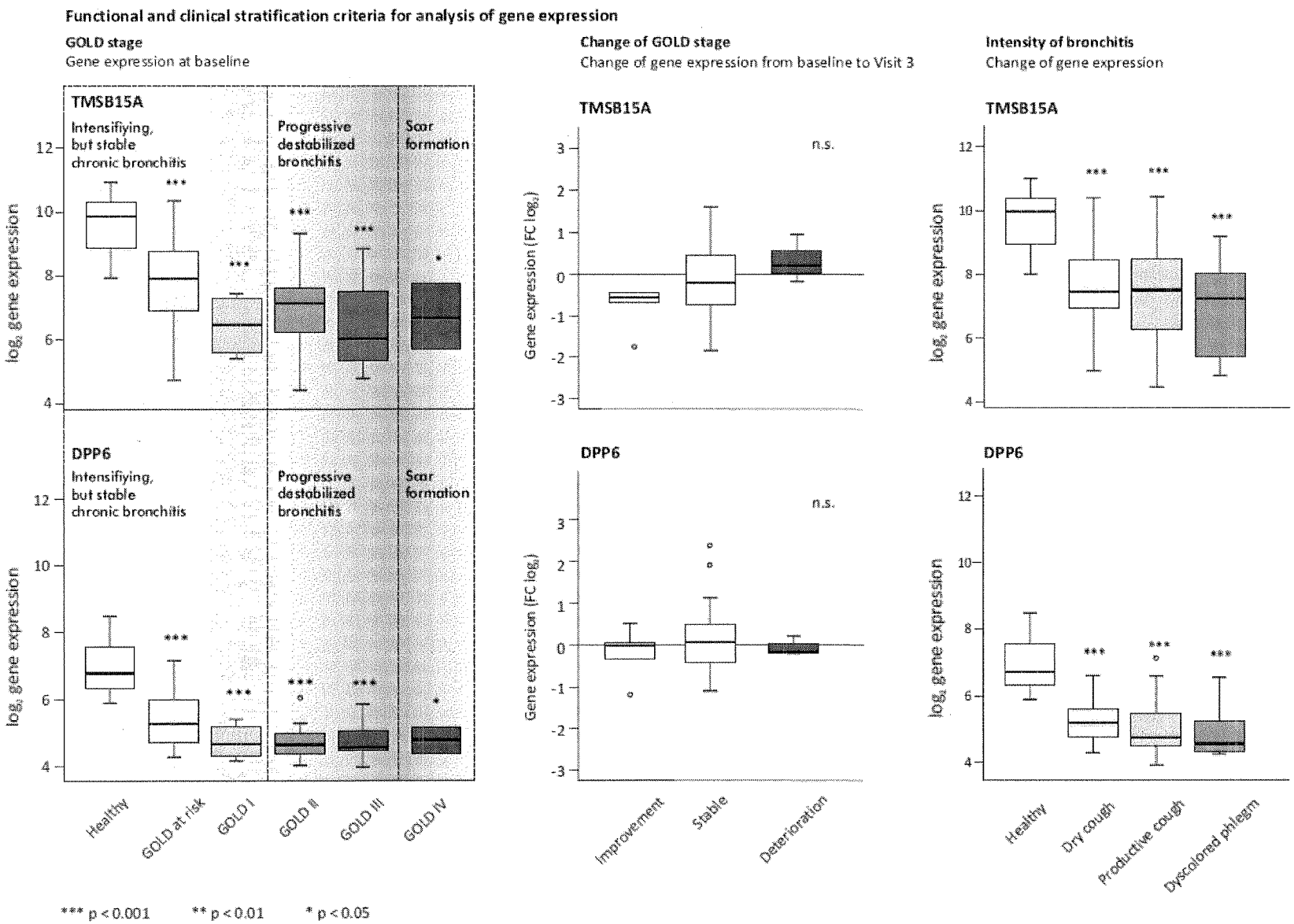
Figure 4:
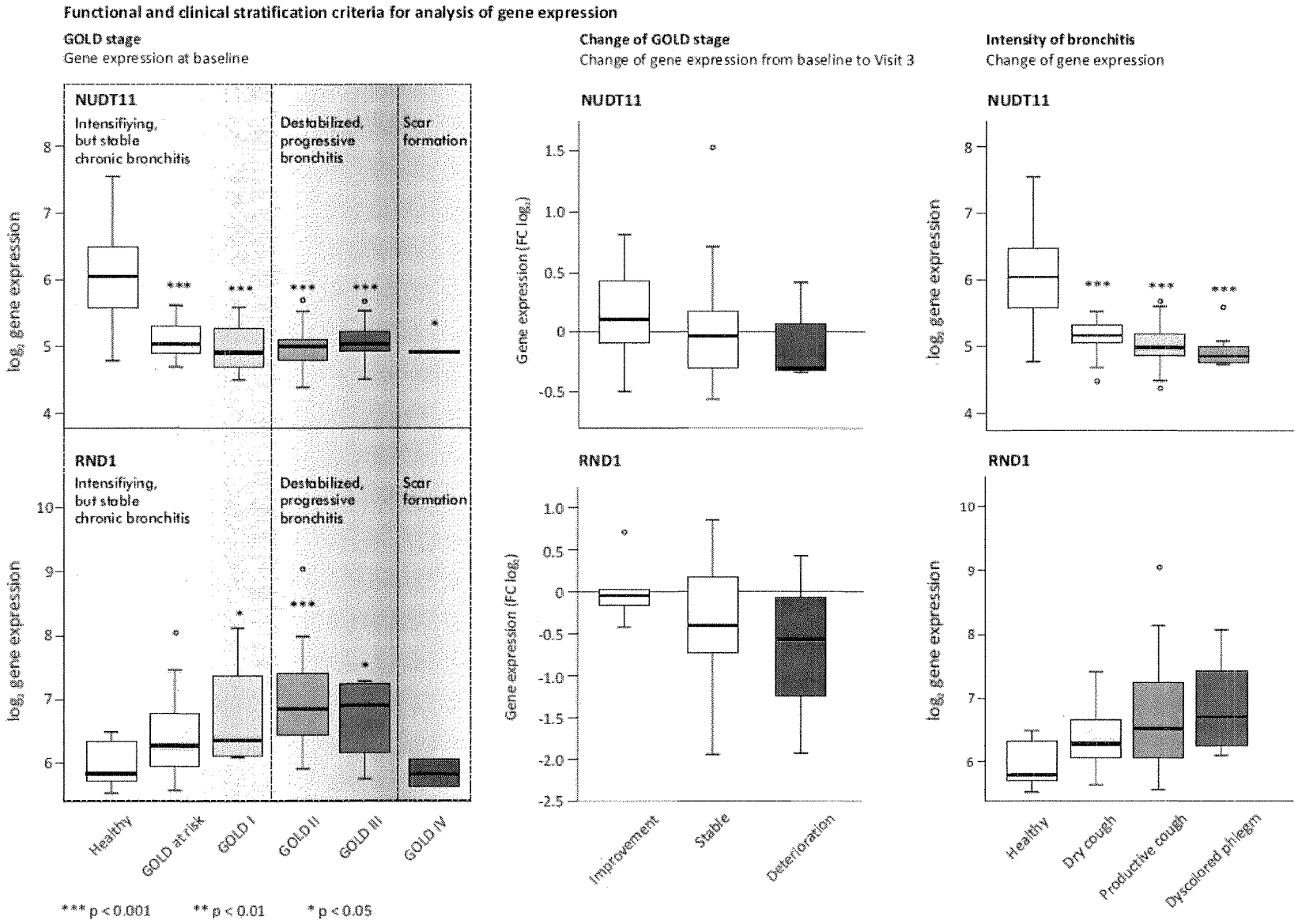
Figure 4:
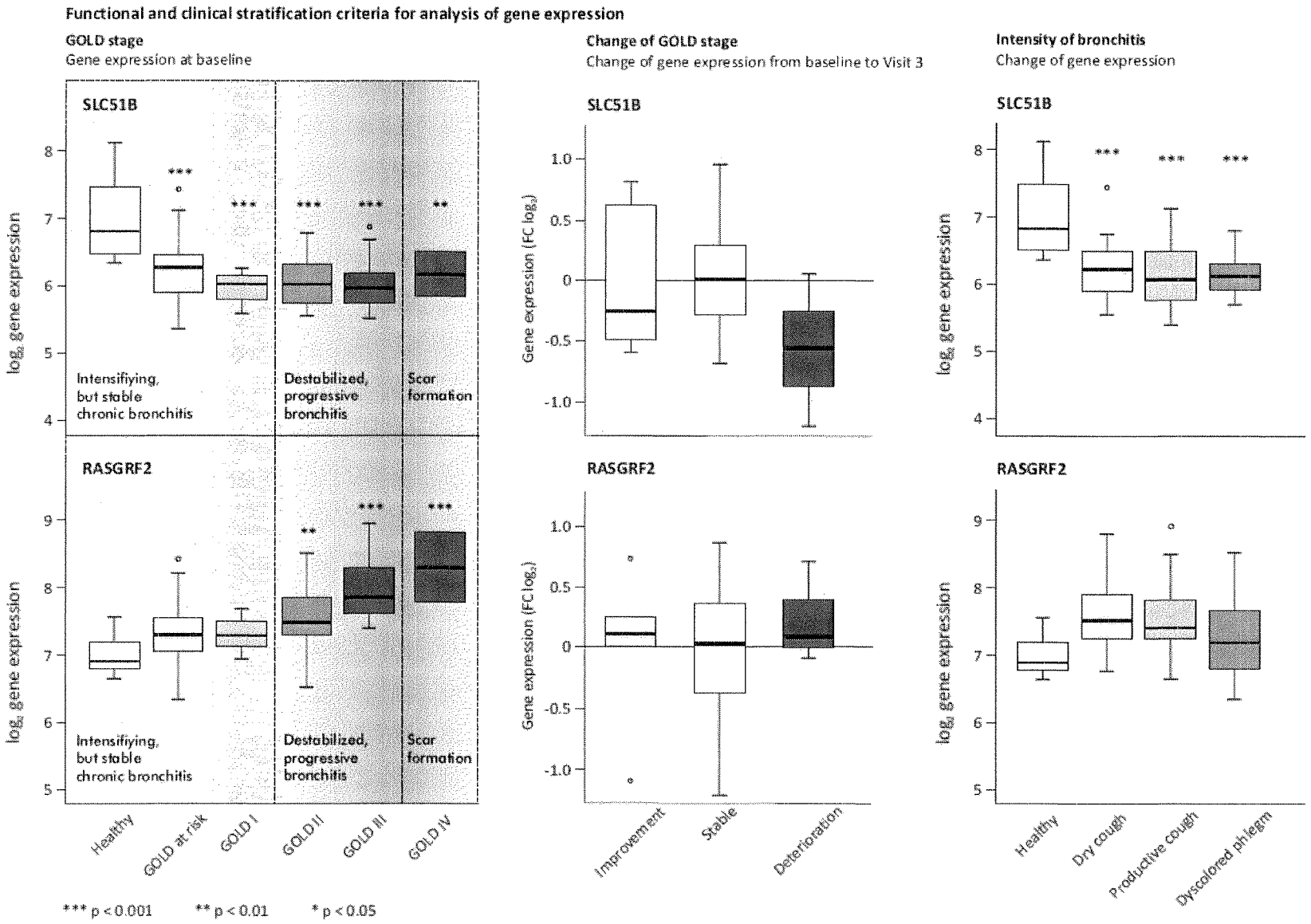
Figure 8:
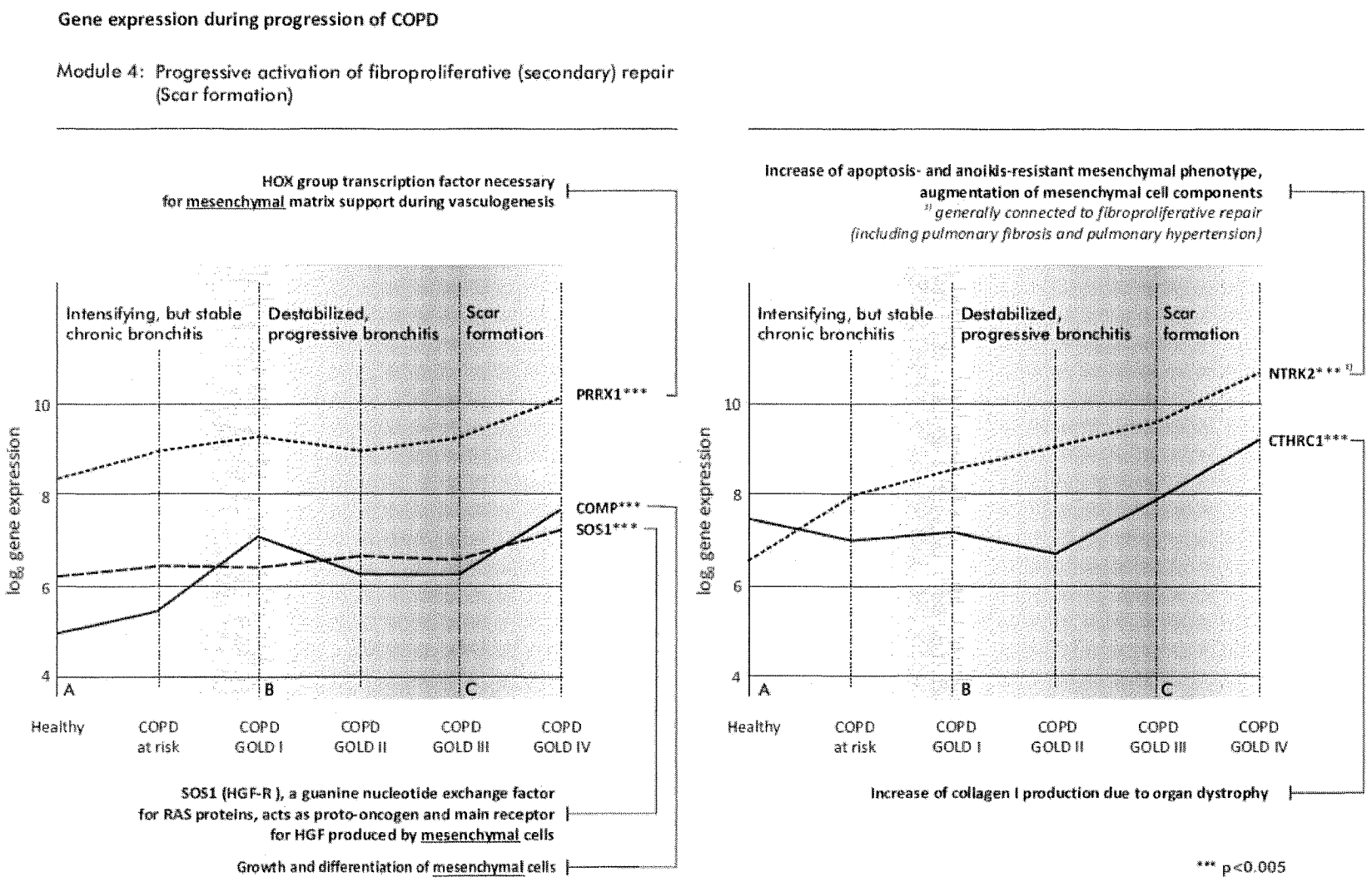
Figure 8:
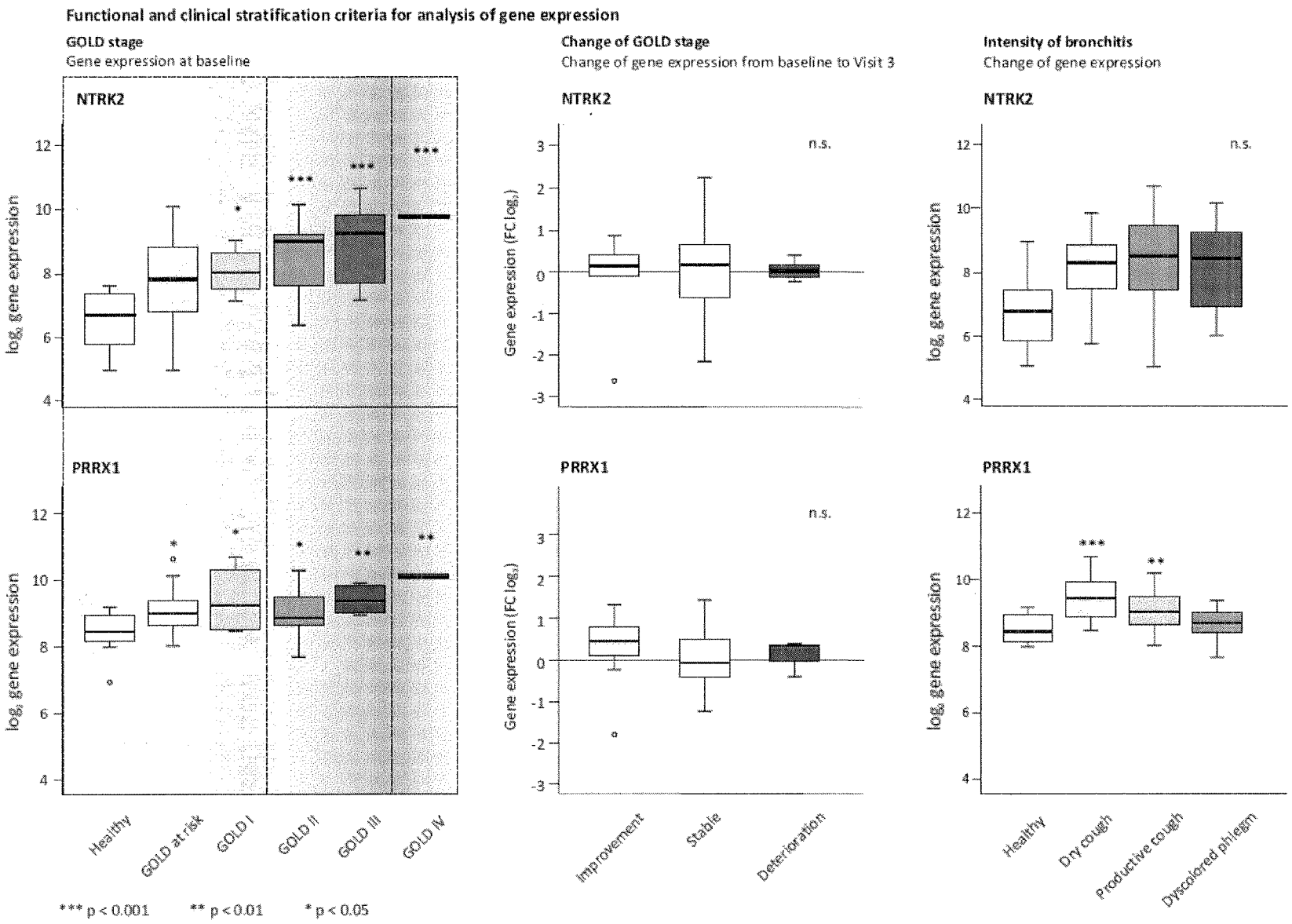
Figure 8:
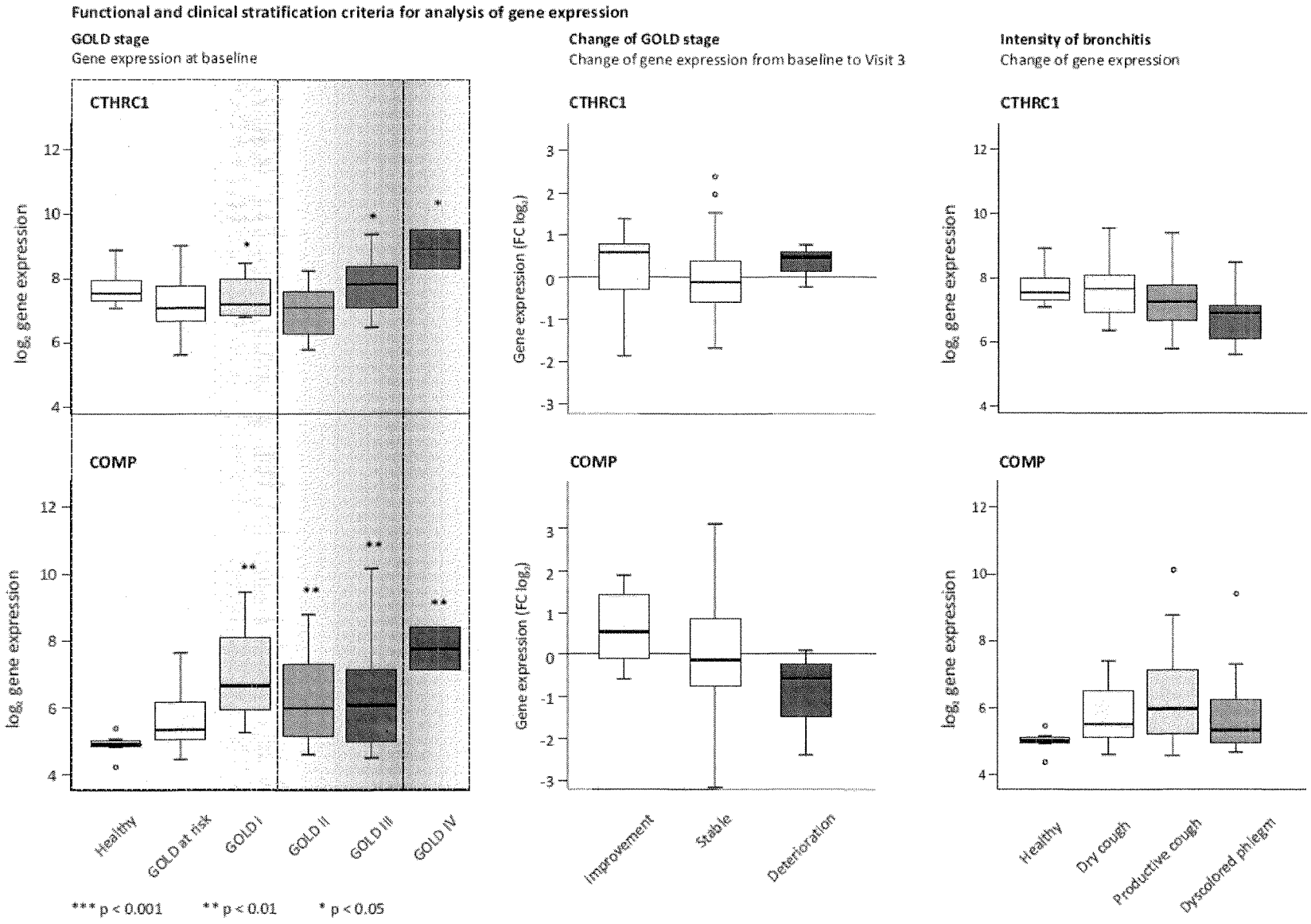
Figure 8:
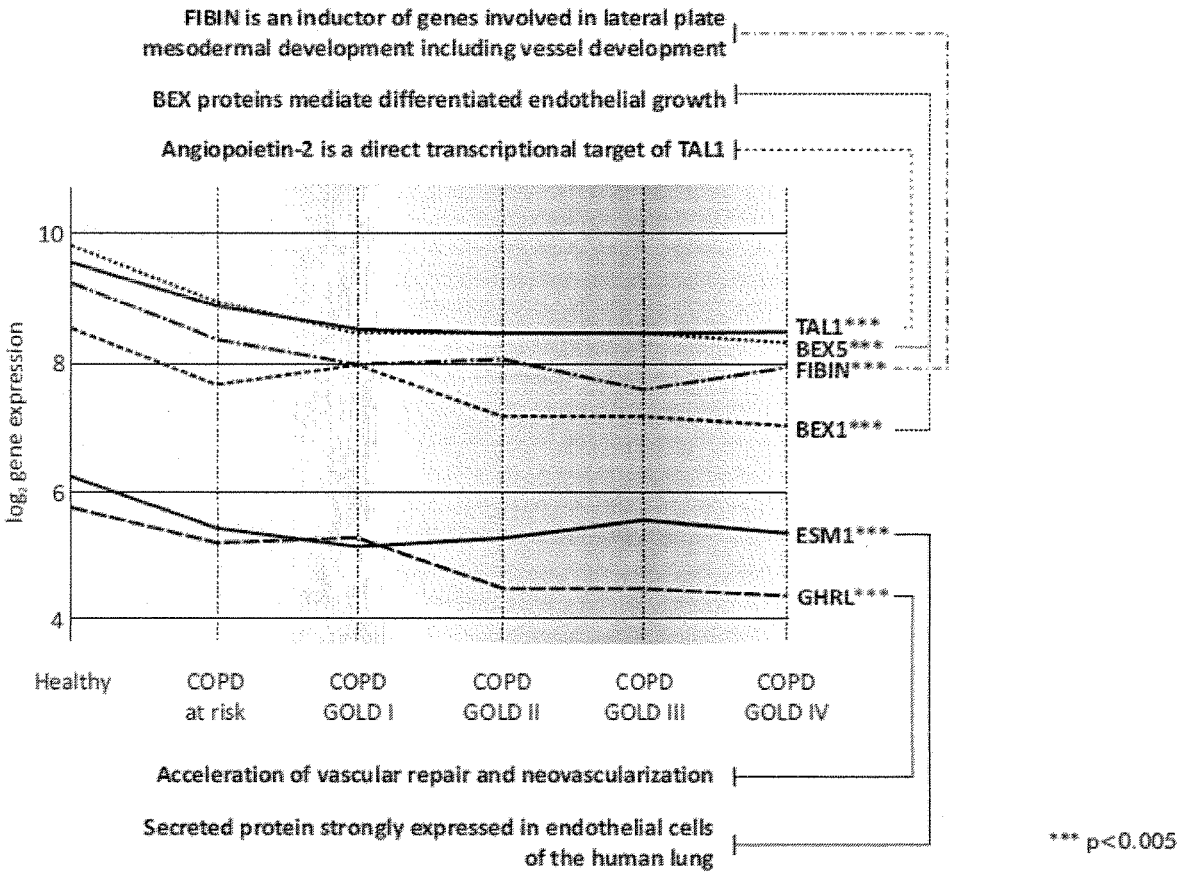

As demonstrated in Example 1 and shown in FIGS. 4A and 8A, a decrease in the level of expression of NTRK2 and/or RASGRF2 is indicative of an amelioration/improvement of COPD whereas an increase in the level of expression of these genes is indicative of a worsening of COPD. Monitoring the progression of COPD in a subject suffering from this disease can be useful, e.g., for assessing the prospects of success of a treatment, of a new medication, or of a new dosing regimen.

In the eleventh aspect, it is preferred that the level of expression of the gene NTRK2 and optionally of the gene RASGRF2 is determined. More preferably, the level of expression of the genes NTRK2 and RASGRF2 is determined.

The level of expression of the above-mentioned marker genes in the first sample and in the second sample according the eleventh aspect of the invention can be determined as described in connection with the methods of the second to fourth aspects of the invention. For example, the level of transcription or the level of translation of the marker gene(s) NTRK2 and/or RASGRF2 can be determined. It is preferred that the level of expression of the one or more genes selected from NTRK2 and RASGRF2 in the first sample and in the second sample is determined by determining the level of transcription of the corresponding gene(s). The level of transcription is preferably determined using qRT-PCT or a microarray.

The subject to be tested in the method according to the eleventh aspect of the invention is as defined in connection with the methods of the second to fourth aspects of the invention, and preferably is a human or a non-human mammal, more preferably a human. It is furthermore preferred that the subject to be tested/monitored in accordance with the eleventh aspect is a subject (preferably a human) that has been diagnosed as suffering from COPD (e.g., at the point in time when the first sample was obtained).

While the first sample and the second sample obtained from the subject can, in principle, be any tissue sample or serum from the subject, they should both originate from the same type of tissue of the subject (or should both be serum samples). Preferably, the first sample and the second sample are lung tissue samples. More preferably, the first sample and the second sample are transbronchial lung biopsy samples or they are bronchoalveolar lavage (BAL) samples.

The second sample has been obtained from the subject at a later point in time than the first sample. For instance, the second sample may have been obtained from the subject about 2 months to about 12 months, preferably about 3 months to about 9 months (e.g., about 3 months, or about 4 months, or about 5 months, or about 6 months, or about 7 months, or about 8 months, or about 9 months), and more preferably about 3 months to about 6 months after the first sample was obtained from the subject.

As used herein, the term "about" refers to ±10% of the indicated numerical value, and in particular to +5% of the indicated numerical value. Whenever the term "about" is used, a specific reference to the exact numerical value indicated is also included. If the term "about" is used in connection with a parameter that is quantified in integers, such as the number of nucleotides in a given nucleic acid, the numbers corresponding to ±10% or ±5% of the indicated numerical value are to be rounded to the nearest integer. For example, the expression "about 25 nucleotides" refers to the range of 23 to 28 nucleotides, in particular the range of 24 to 26 nucleotides, and preferably refers to the specific value of 25 nucleotides.

It is to be understood that the present invention specifically relates to each and every combination of features and embodiments described herein, including any combination of general and/or preferred features/embodiments. In particular, the invention specifically relates to all combinations of preferred features (including all degrees of preference) of the methods and uses provided herein.

In this specification, a number of documents including patent applications, scientific literature and manufacturers' manuals are cited. The disclosure of these documents, while not considered relevant for the patentability of this invention, is herewith incorporated by reference in its entirety. More specifically, all referenced documents are incorporated by reference to the same extent as if each individual document was specifically and individually indicated to be incorporated by reference.

The invention is also described by the following illustrative figures. The appended figures show:

FIG. 1: Study design of the COPD-AUVA study conducted at the Vienna Medical University (see Example 1).

Figure 2:
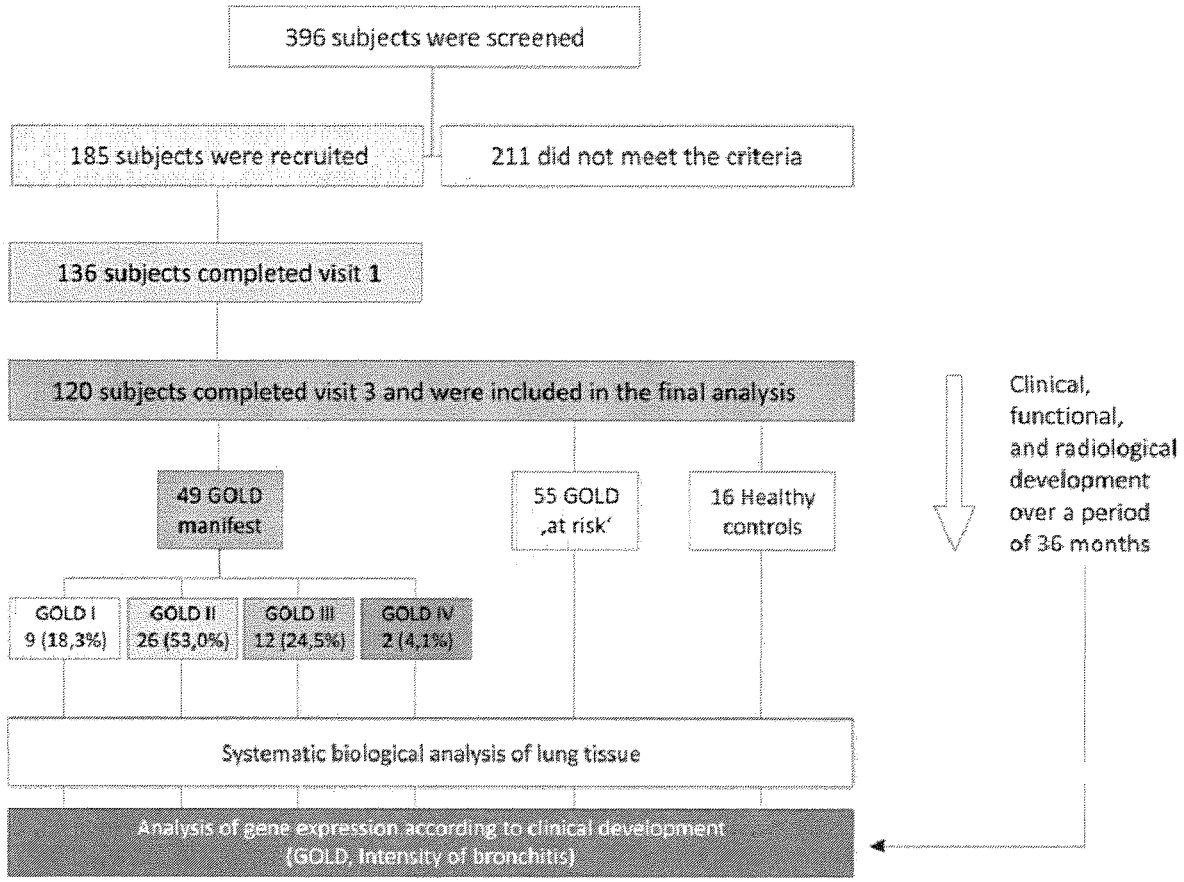

FIG. 2: Overview of the numbers of subjects of different disease states who underwent the COPD-AUVA study.

FIGS. 3A-D: Overview of healthy subjects (A) and of subjects with either chronic bronchitis but no signs of pulmonary obstruction (COPD "at risk"; "GOLD 0") at visit 1 (B) or with manifest COPD at visit 1 (C), as well as the development of COPD (severity according to GOLD criteria), bronchitis and smoking habits in these subjects over the period from visit 1 (day 0) to visit 2 (12 months) to visit 3 (36 months). The term "pack years" refers to a person's cigarette consumption calculated as the packs of cigarettes (each pack containing 20 cigarettes) smoked per day, multiplied by the length of cigarette consumption in years. (D) Clinical characteristics of participants in the COPD-AUVA study and changes between baseline and visit 3 (see Example 1).

FIGS. 4A-D: COPD Pathology module 1: Development of chronic bronchitis: Progressive inhibition of adaptive motility of mucosal cells caused by the inhibition of coordinated actin cytoskeleton movements.

Chronic bronchitis starts with the significant downregulation of genes that control assembly, polymerization, motility, stabilization and energy supply of F actin-mediated cytoskeleton movements (suppression of thymosin beta 15A (TMSB15A), dipeptidyl-peptidase 6 (DPP6), nudix (nucleoside diphosphate linked moiety X)-type motif 11 (NUDT11), and integrin alpha 10 (ITGA10)). At the same time, expression of the RASGRF2 gene known to inhibit Cdc42-mediated polymerization of actin during cellular movements is progressively increased during advancement of COPD (FIGS. 4A and 4D) indicating that the inhibition of cellular motility is not only a leading mechanism in early stages of COPD development, but also part of the progressive membrane destruction in later stages of COPD.

Of note, reduced expression of these genes is also connected to increasing intensity of bronchial inflammation. This characteristic expression pattern includes the SLC51B gene (FIG. 4D) which is as yet largely known for its capacity to transport steroid-precursor molecules in intestinal cells.

The compensatory activation of the GTPase RND1 (Rho family GTPase 1) best known for its ability to control the organization of the actin cytoskeleton in response to growth factor stimulation is just increased up to COPD GOLD stage II not only indicating a complete failure of actin-dependent cellular cytoskeleton organization in later stages of COPD, but also the loss of the regenerative capacity, as also demonstrated within Module 3 (see FIGS. 6A-6E). This in turn concurs rather well with the progressive downregulation of the cystatin M/E (CST6) gene being annotated with both functional differentiation of epithelial cells and maintenance of surface integrity.

As the coordinated action of these molecules is required for controlled movements of epithelial cells during pivotal processes, such as growth, intercalation and extrusion of cells within a cohesive cell layer system, the loss of these functions causes a profound disturbance of membrane integrity allowing for the development of non-specific bronchial inflammation that basically reflects all constituents of ventilated air including combustion products, such as cigarette smoke or welding fumes.

FIGS. 5A-H: COPD Pathology module 2: Bi-phasic activation of mucosal immunity.

Figure 5:
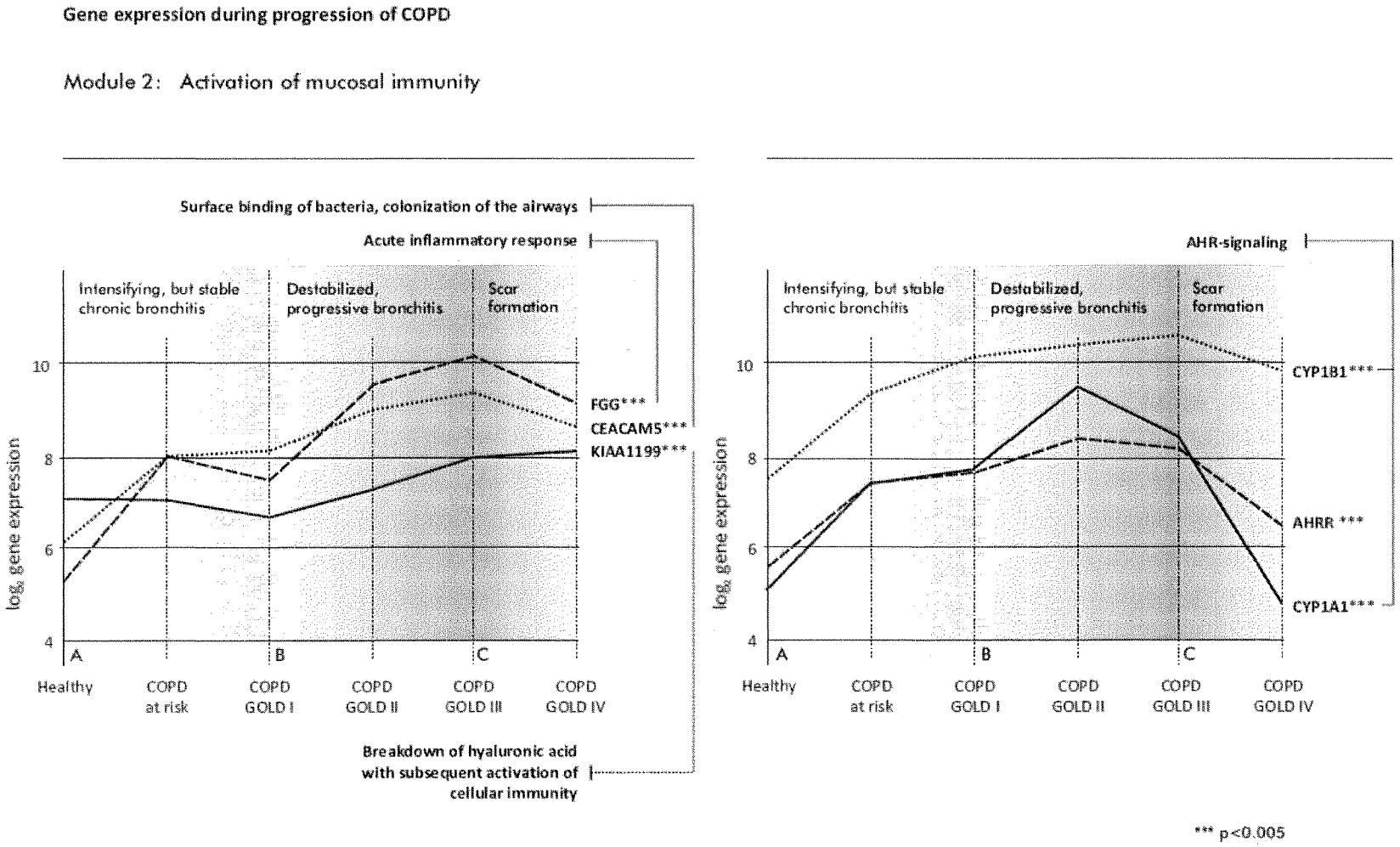
Figure 5:
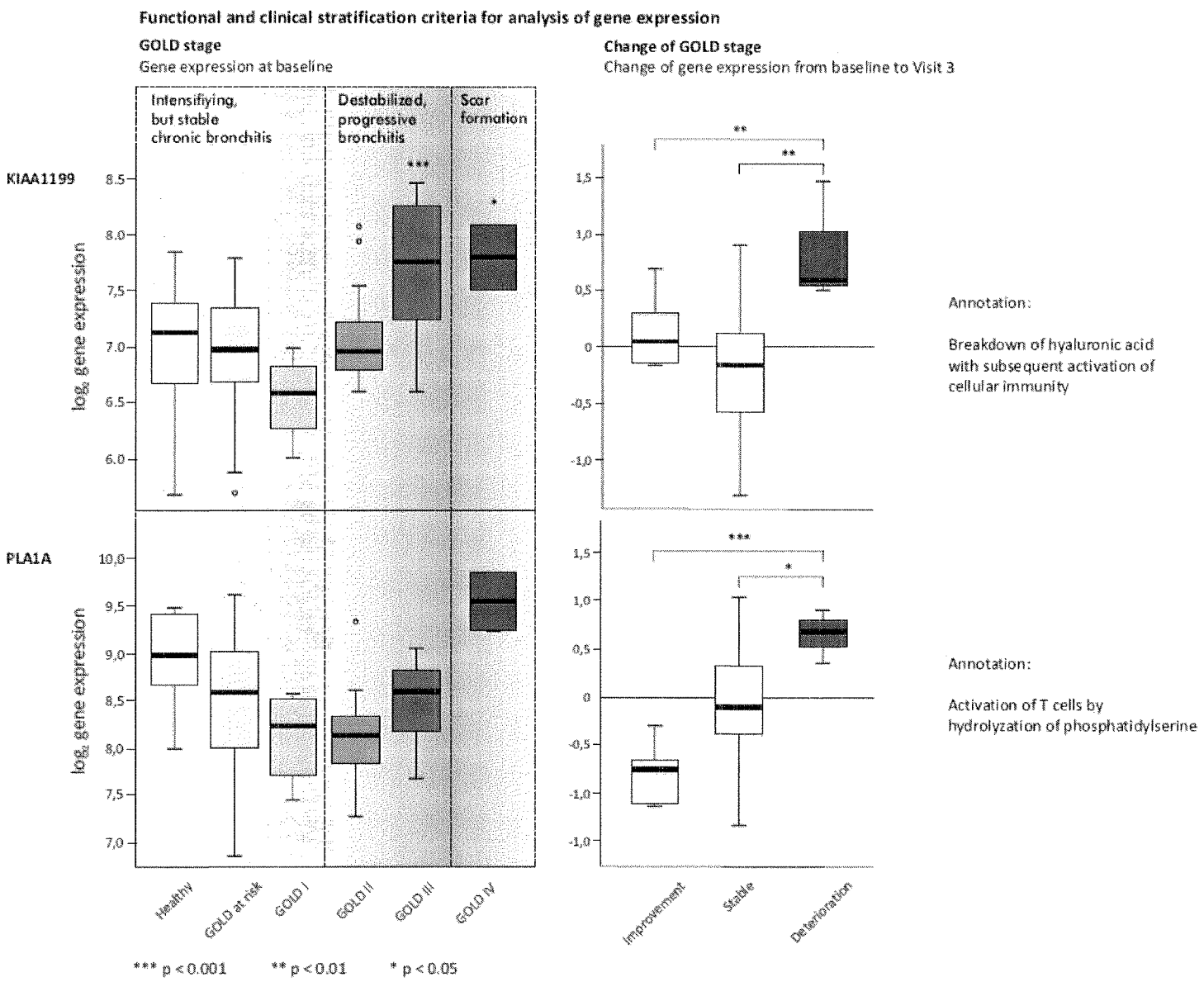
Figure 5:
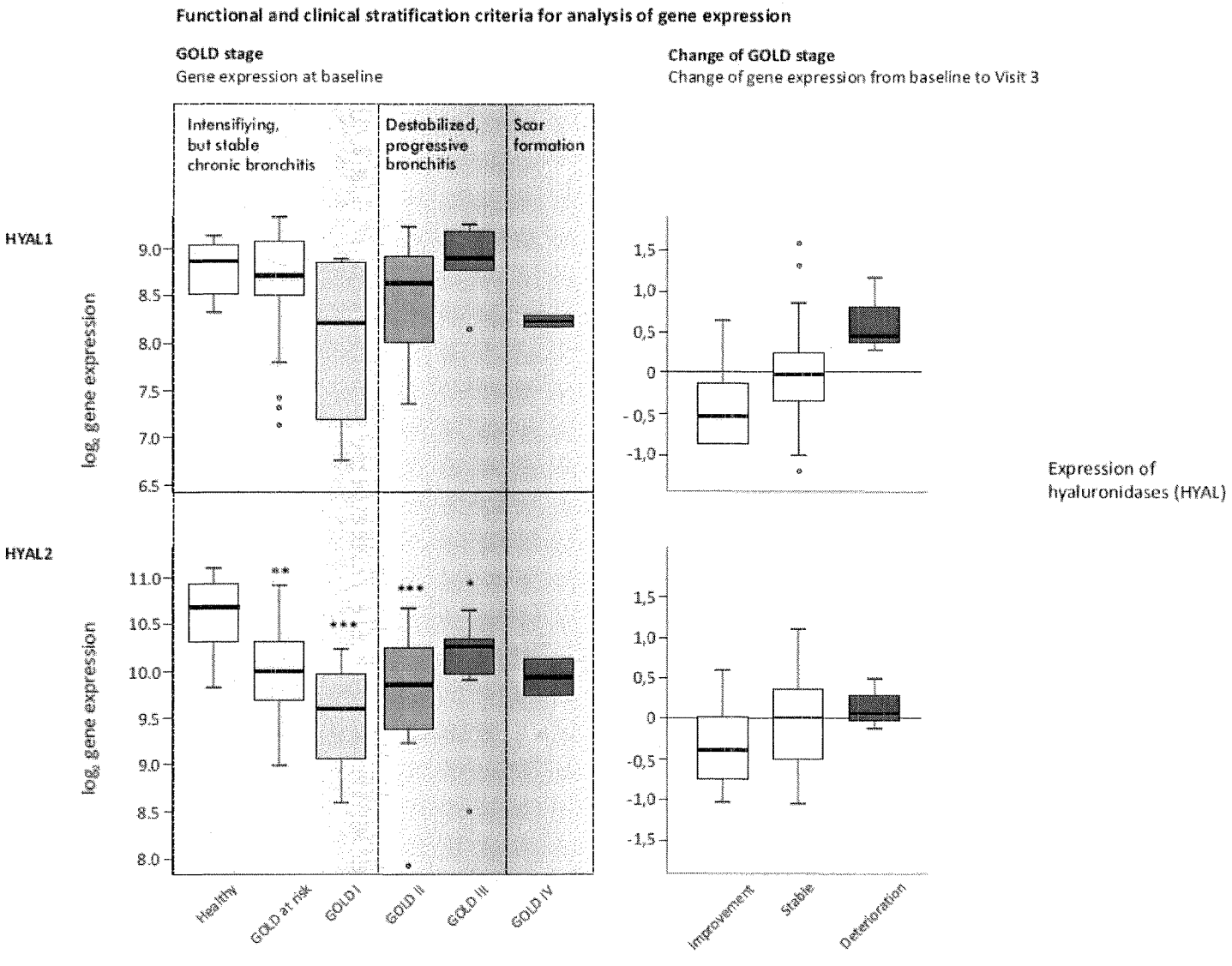
Figure 5:
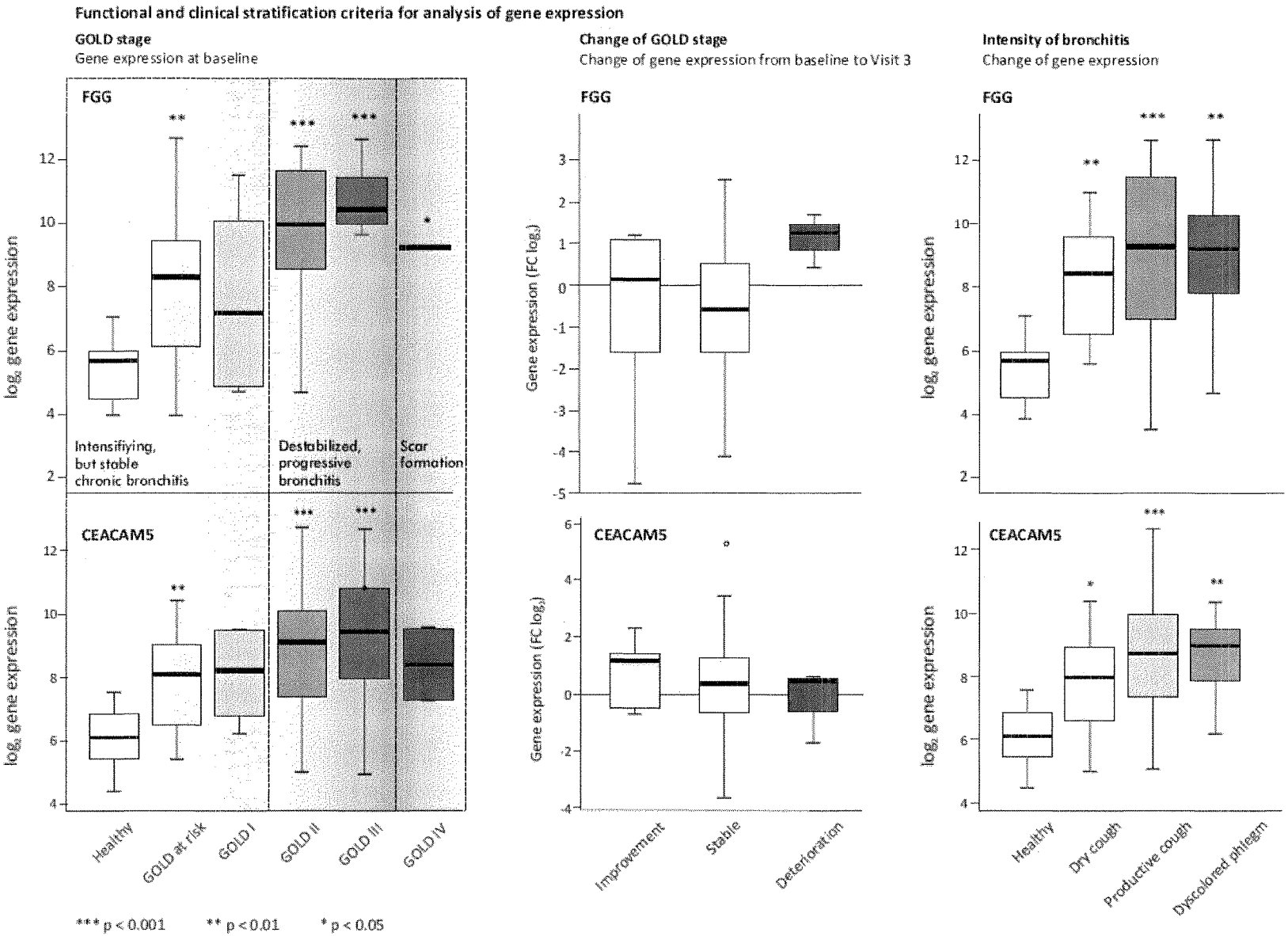
Figure 5:
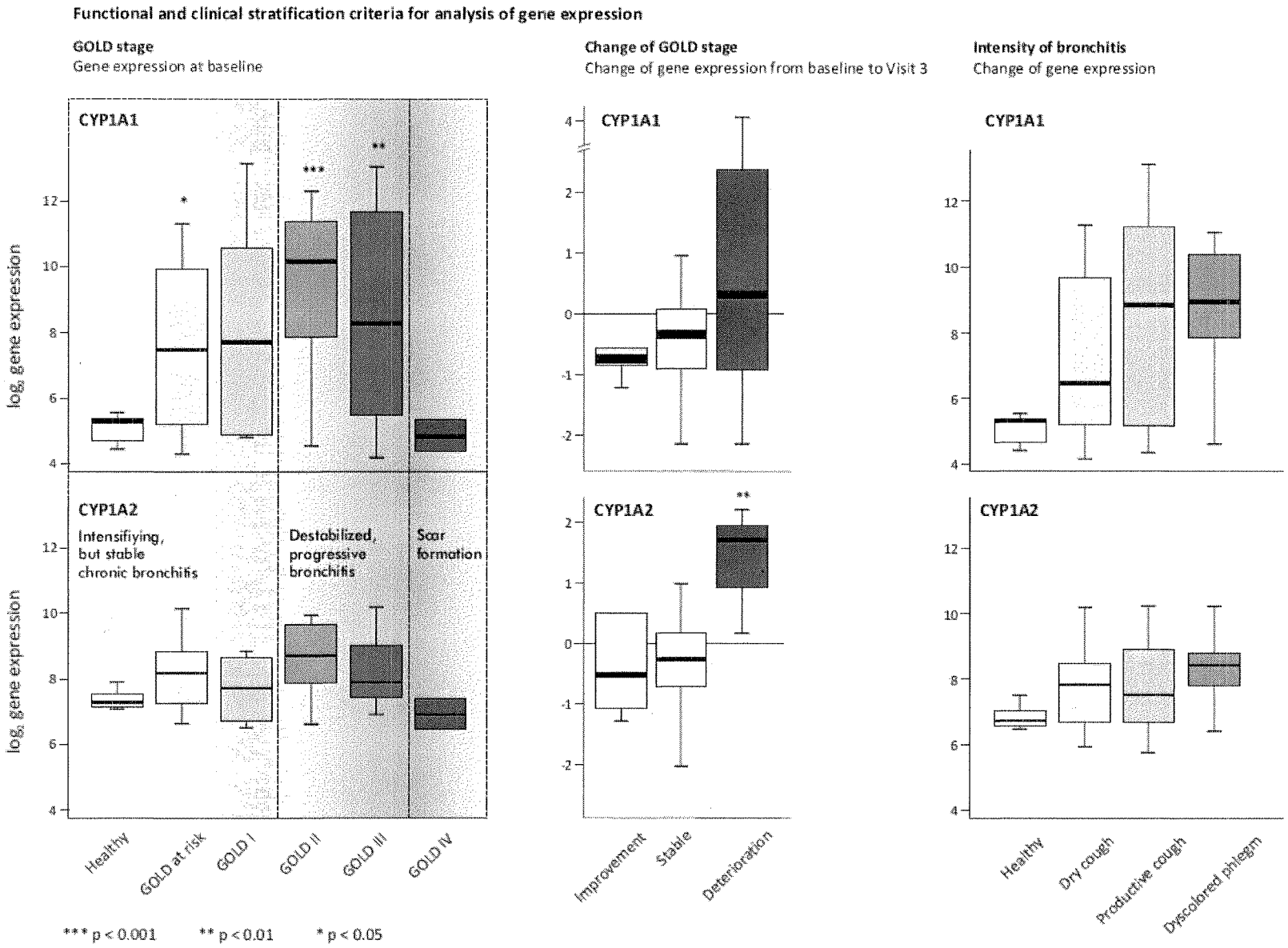
Figure 5:
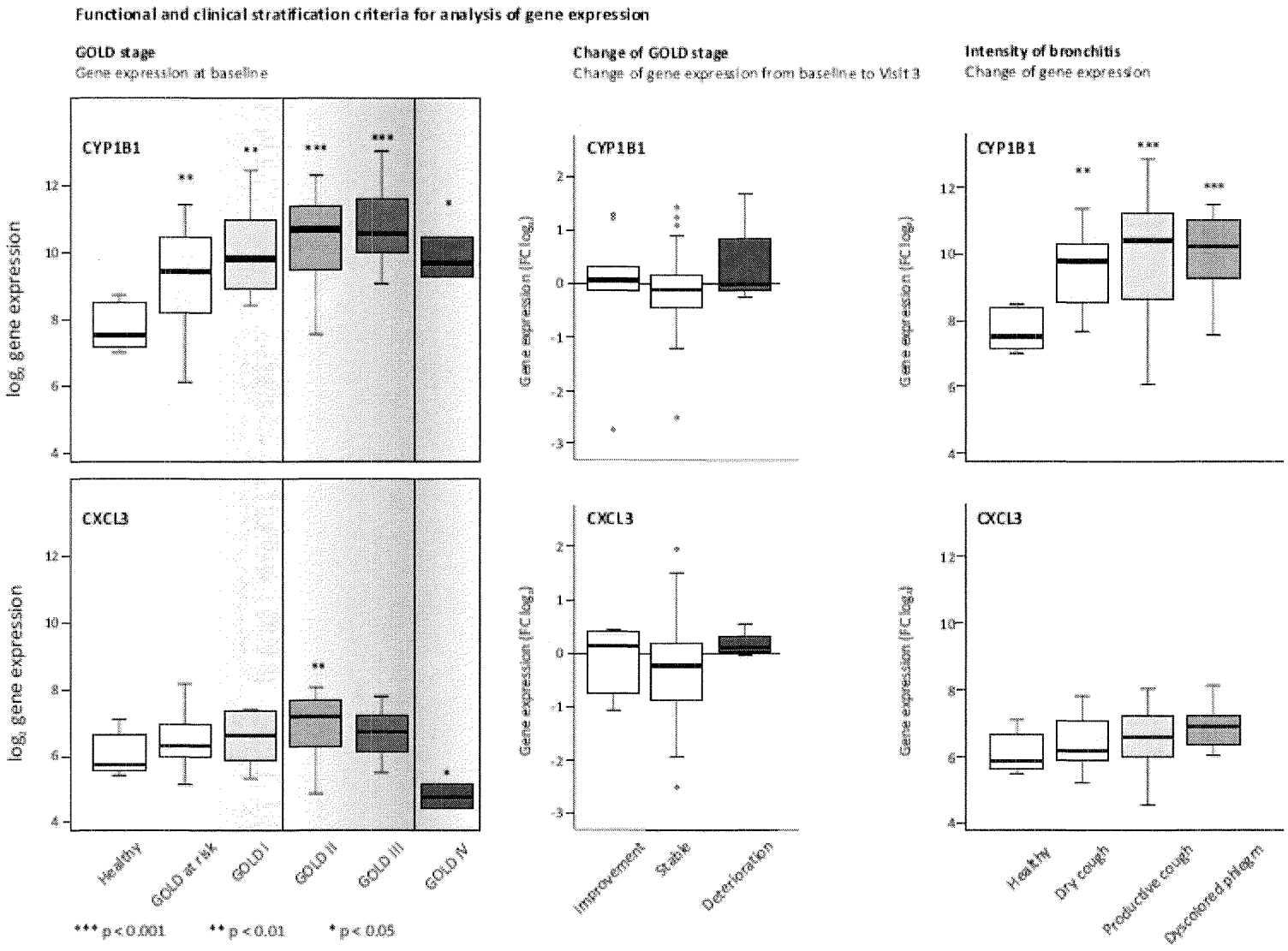
Figure 5:
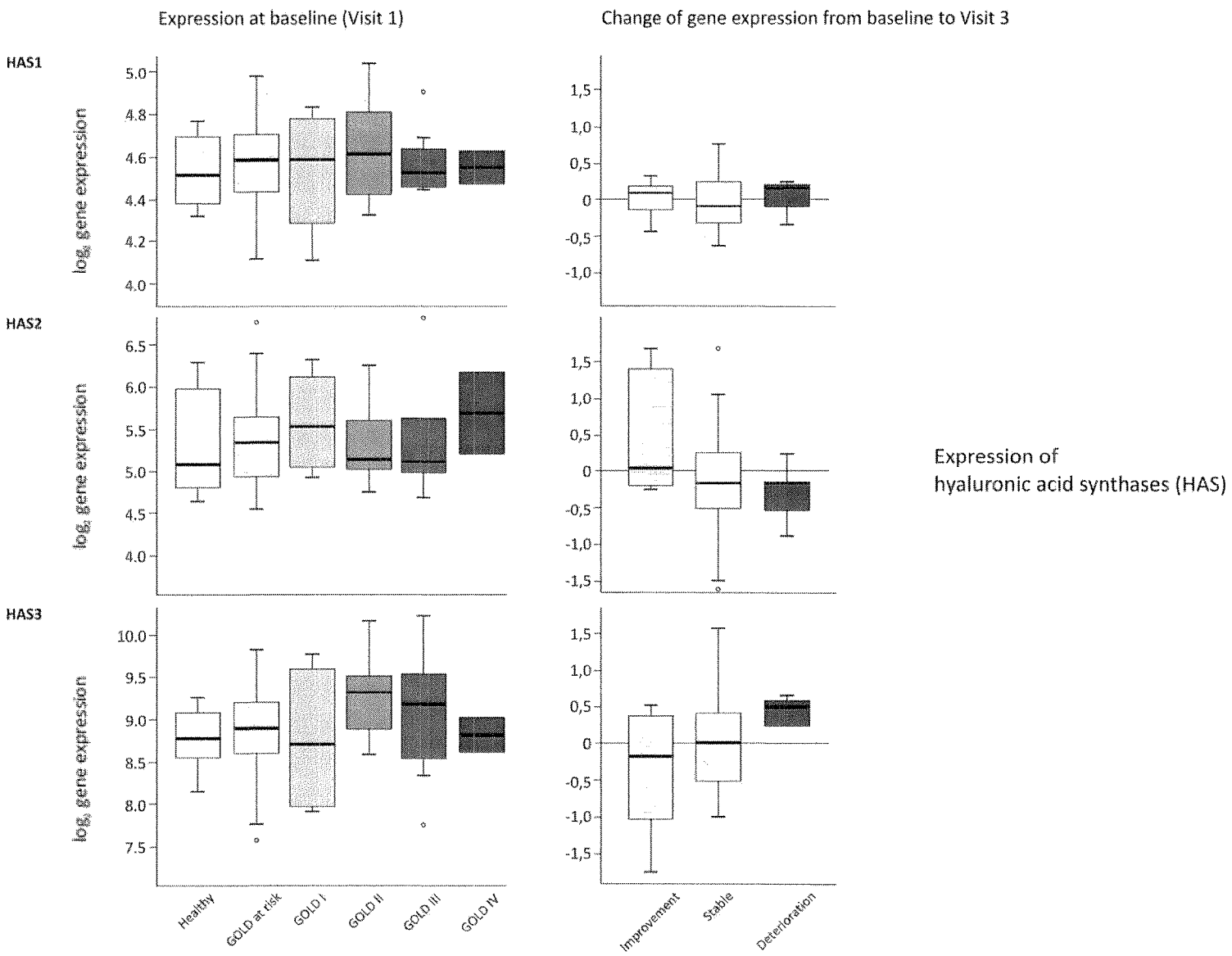
Figure 5:
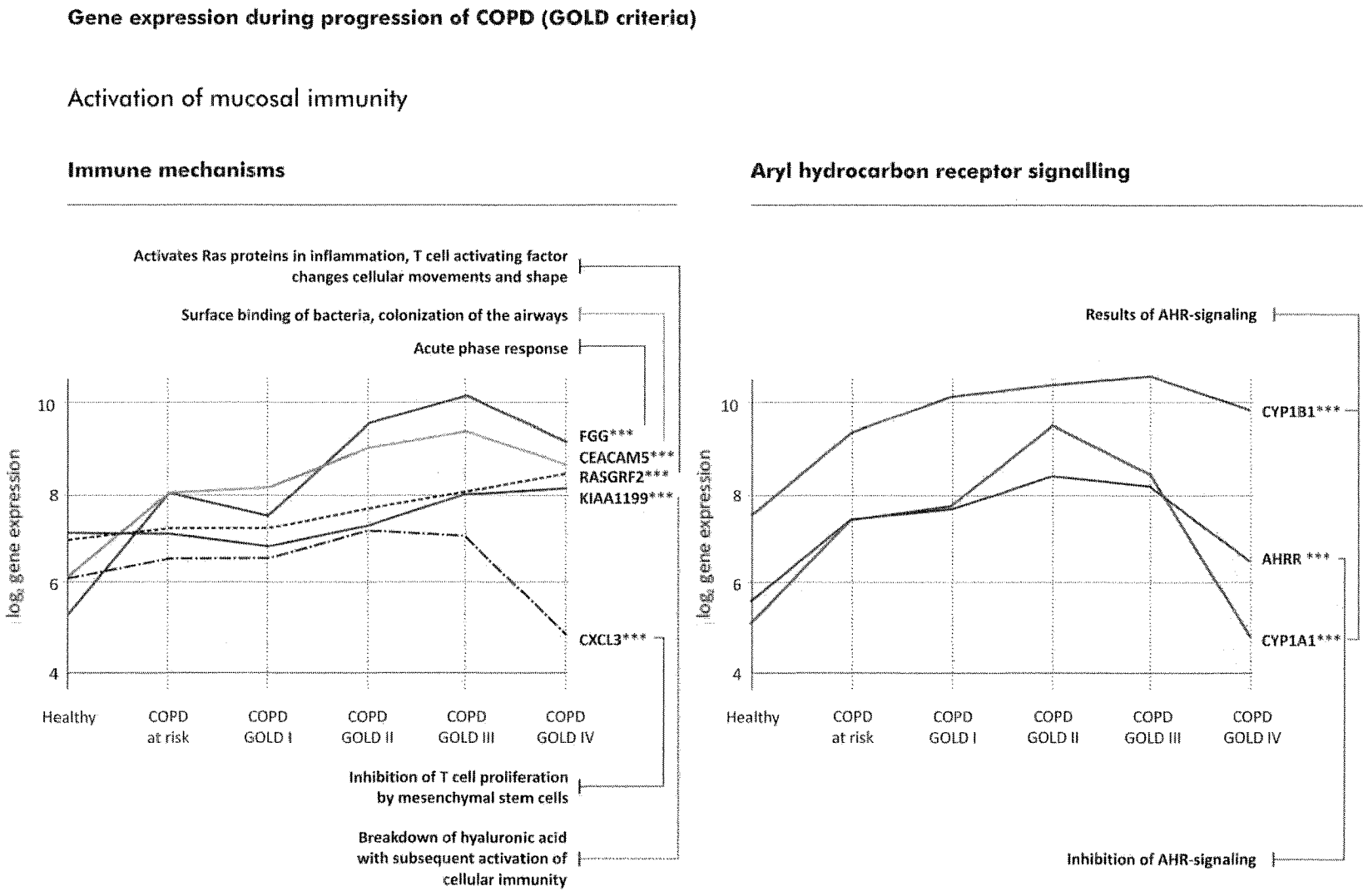

Driven by this loss of cellular cohesion, the bronchus develops a diverse mucosal immune response that combines mechanisms of acute inflammation, such as the expression of fibrinogen (FGG) (FIGS. 5A and 5D), the upregulation of carcinoembryonic antigen-related cell adhesion molecule 5 (CEACAM 5) (FIGS. 5A and 5D), and aryl hydrocarbon receptor (AHR) signaling, the latter characterized by increased expression of cytochrome P450, family 1, subfamily A polypeptide 1 (CYP1A1) and cytochrome P450, family 1, subfamily B polypeptide 1 (CYP1B1) (FIGS. 5A and 5E, 5F). Intensity of AHR signaling is significant, in spite of the increased compensatory expression of the aryl hydrocarbon receptor repressor gene (AHRR), most likely reflecting the continuous impact of smoke. As CEACAMs have recently been shown to act as surface receptors for gram-negative bacteria such as *Neisseria meningitidis, Haemophilus influenzae* and *Moraxella catarrhalis* being frequently found in progressive bronchitis, this mechanism is prone to contribute to episodes of intensified bronchial inflammation.

Nonetheless, neither FGG nor CEACAM5 expression causes short-term worsening of non-reversible pulmonary obstruction (FIG. 5D, middle panel), although the activation of both genes significantly contributes to the intensity of bronchial inflammation (FIG. 5D, right panel). This differs from CYP1A2, KIAA1199 and phospholipase Al member A (PLA1A) expression (FIG. 5B and 5E) that all correlate with a significant deterioration of pulmonary function. While CYP1A2 expression as part of a smoke-induced AHR signaling response fits well to the current perception of COPD development, the strong correlation of KIAA1199 and PLA1A expression with deterioration of pulmonary function according to GOLD criteria points towards another direction, the complete failure of the bronchial compartment system. KIAA1199 has recently been demonstrated to activate matrix hyaluronidases while phospholipase Al member A (PLA1A) is known to activate T cells in response to non-specific inflammatory stimulation. It has presently been found that the significant upregulation of KIAA1199 is characteristic for the second phase of increased bronchial inflammation in GOLD stages III and IV (FIG. 5B) which follows a phase of non-progressive bronchial inflammation characterizing GOLD stage I (FIG. 5A). Notably, during this stabilization phase both the expression of KIAA1199 and of PLA1A is reduced as well (FIG. 5B). Given the strong proinflammatory impact of a degradation of high molecular mass hyaluronan, these observations indicate that the final increase of inflammatory activity in COPD GOLD stage III and IV is the combined result of permanently disturbed epithelial integrity and a secondary destruction of the hyaluronan matrix within the bronchial wall by the activation of matrix hyaluronidases. This view is supported by the expression pattern of matrix hyaluronidase 2 (HYAL2) itself which represents the leading hyaluronan-degrading enzyme in humans (FIG. 5C).

FIGS. 6A-E: COPD Pathology module 3: The impact of intensified regenerative repair: temporary suspension of progressive bronchial inflammation.

Maintaining the structural integrity of the mucosa as well as upholding essential components of the bronchial wall is part of effective wound healing and as such an indispensable measure to prevent the intrusion of antigens, allergens and infectious agents into submucosal compartments. It is thus not surprising that various genes guiding functions of epithelial repair are upregulated in response to increased inflammation, as demonstrated in FIG. 6A. However, only a small group of these genes is significantly contributing to the temporary suspension of progressive bronchial inflammation in GOLD stage I, genes known to participate in epithelial regeneration and differentiation, bacterial defense and transepithelial water transport (FIGS. 6A-6C): a) deleted in malignant brain tumors 1 (DMBT1), b) zinc-binding alpha-2-glycoprotein 1 (AZGP1), and c) aquaporin 3 (AQP3). However, this regenerative impulse does not last long as expression of these genes decreases again once progression of inflammation resumes stressing the impact of KIAA1199 expression and matrix degradation on bronchial inflammation. Although further genes closely related to epithelial repair, such as stratifin (SFN), the G protein-coupled orphan receptor 110 (GPR110), the smoke-inducible growth differentiation factor 15 (GDF15), and E74-like factor 5 (ELFS) are expressed throughout a much longer period of COPD development (FIG. 6A), the effectiveness of this wound healing approach is evidently not sufficient to maintain bronchial integrity and to balance bronchial inflammation in the presence of epithelial disintegration and progressive hyaluronan breakdown.

Figure 6:
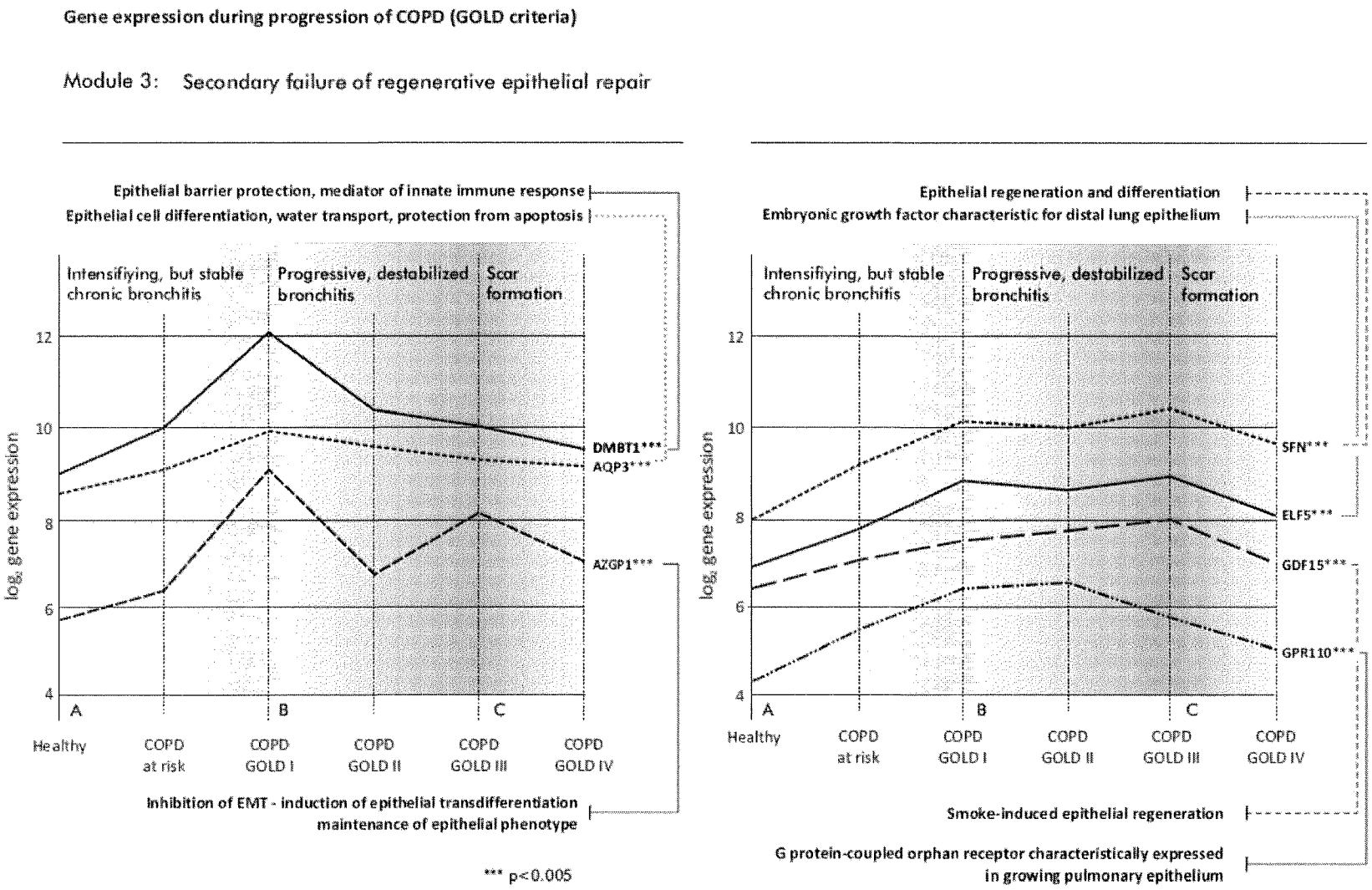
Figure 6:
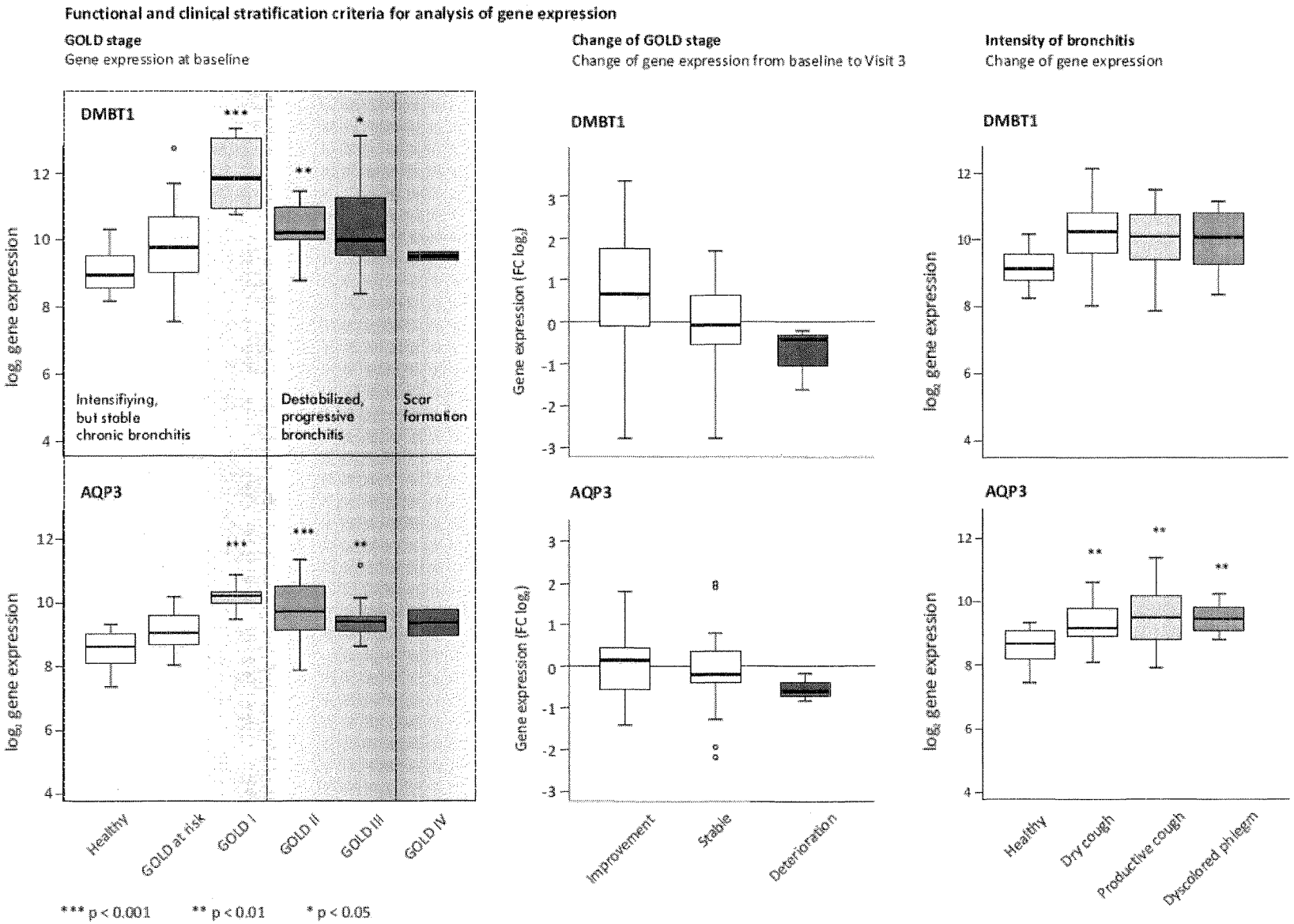
Figure 6:
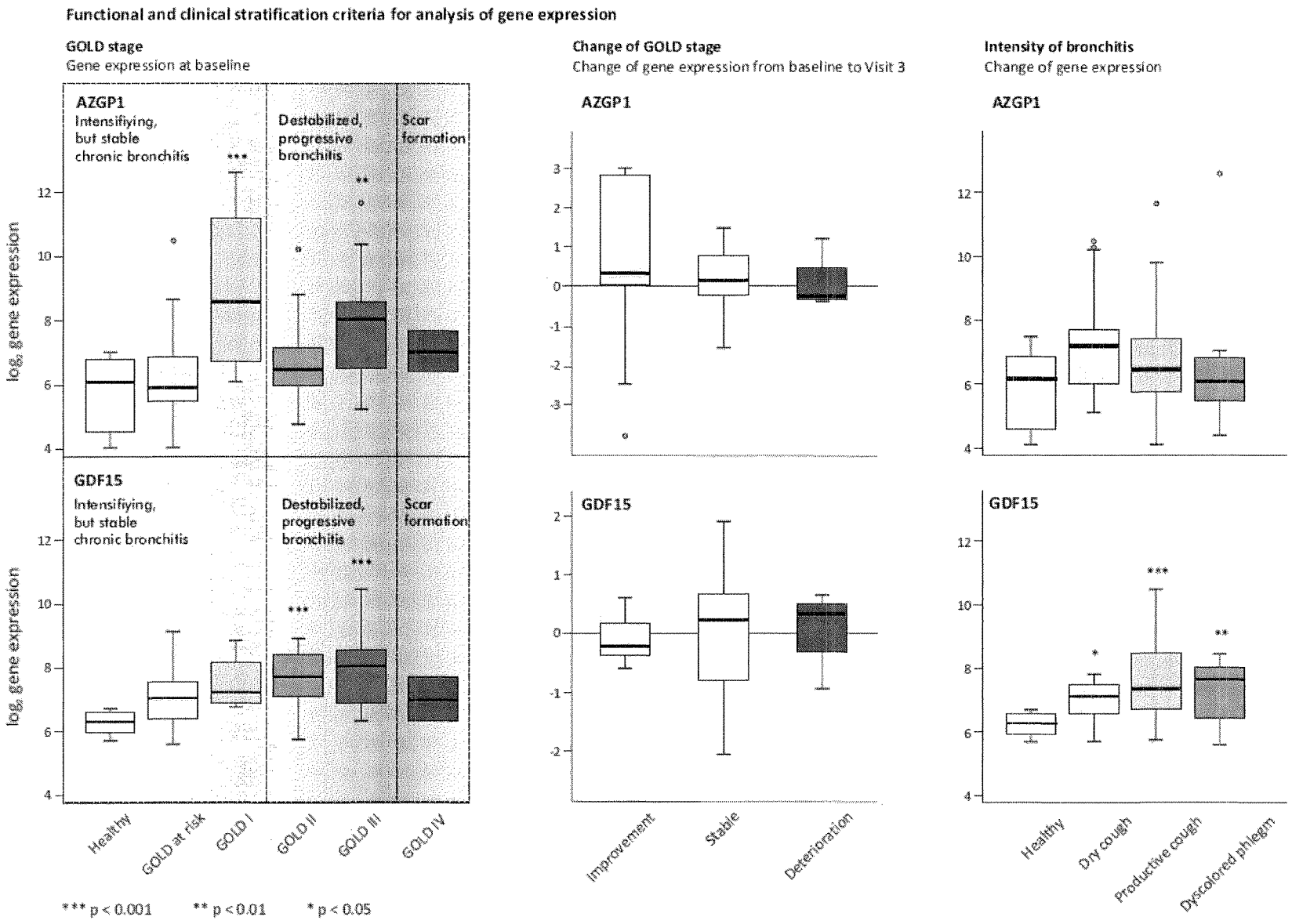
Figure 6:
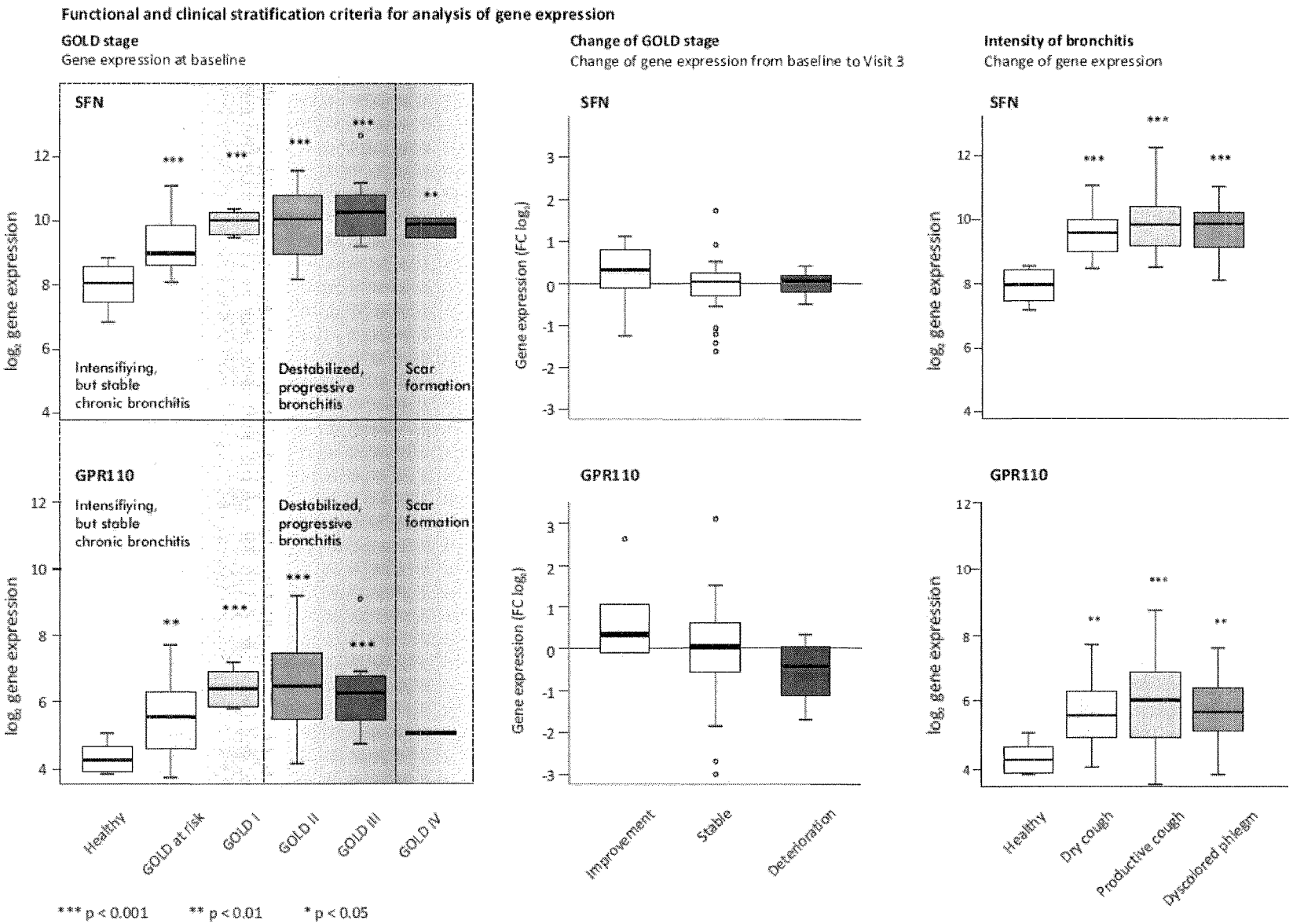
Figure 6:
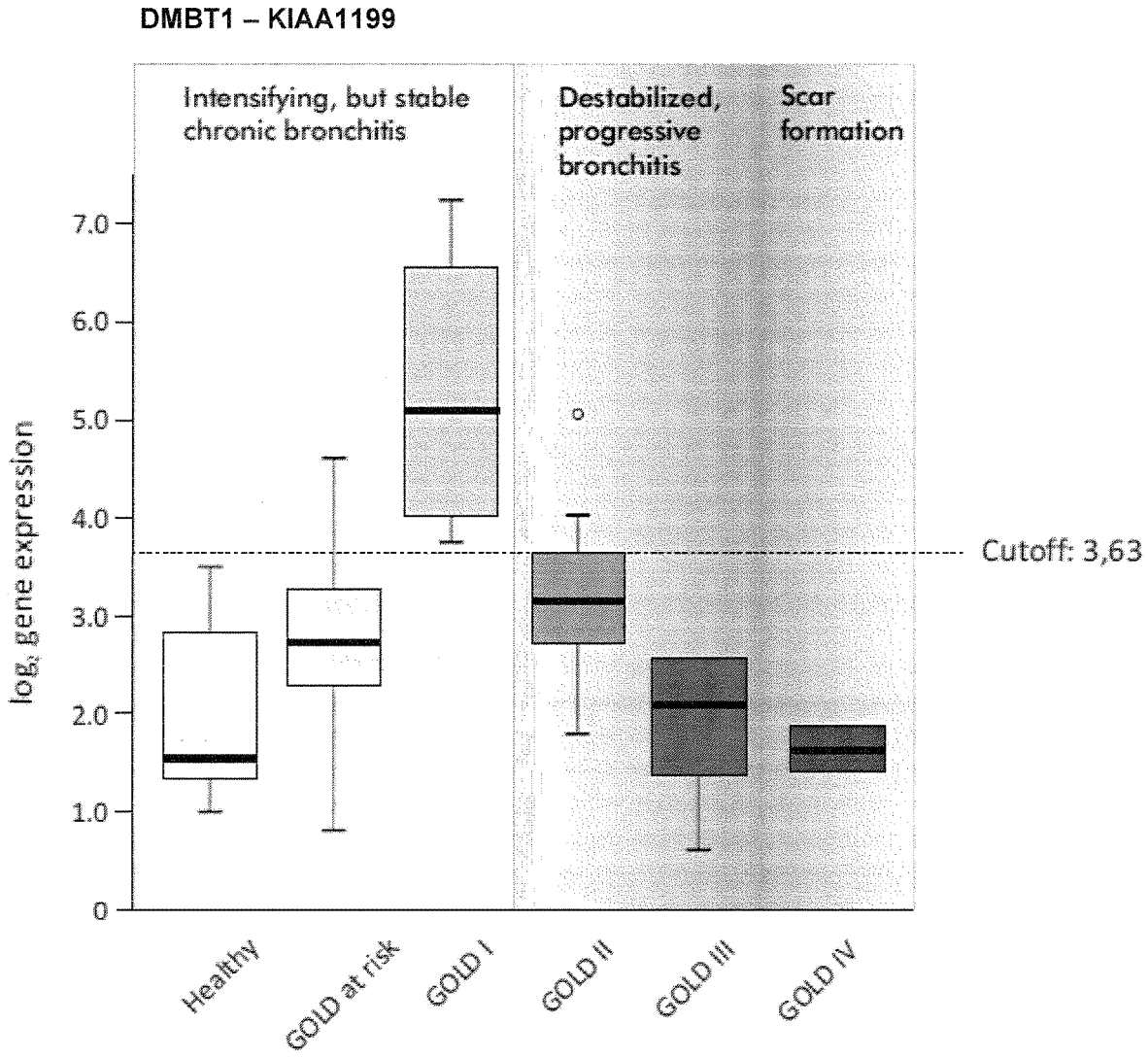

As a result, simultaneous measurement of DMBT1 and KIAA1199 gene expression is capable of discerning stable from progressive COPD (according to GOLD criteria), if the difference between DMBT1 and KIAA1199 expression exceeds a value of 3.63 (FIG. 6E). The importance of intensified KIAA1199 expression for progressive epithelial inflammation is further stressed by the fact that in chronic inflammatory wound healing of diabetic skin, expression of KIAA1199 is significantly upregulated, whereas in normal skin repair, KIAA1199 expression is reduced (see FIG. 8). It should also be noted that KIAA1199 expression in aged skin is in general significantly higher than in the skin from younger individuals ($p<0.01$).

Figure 7:
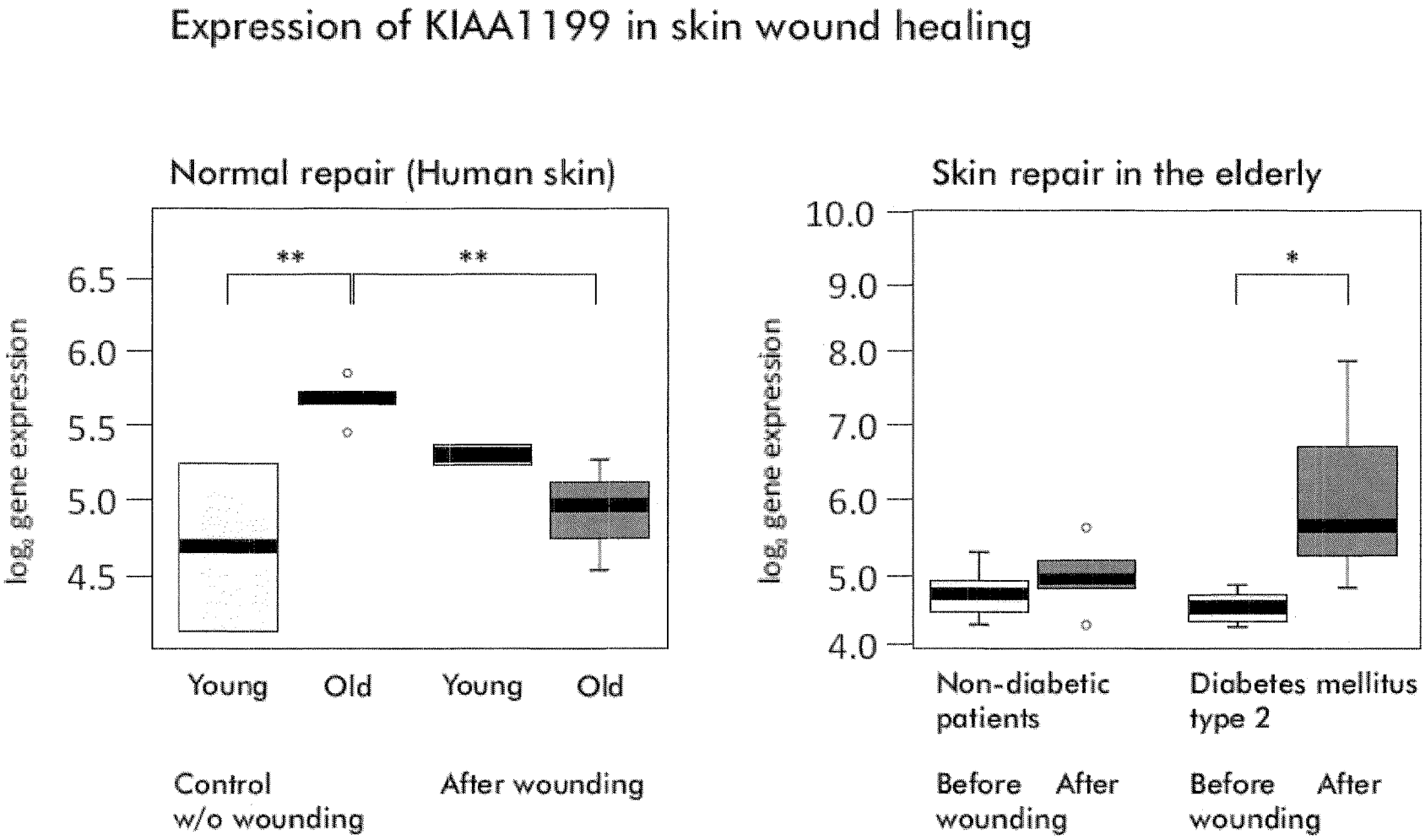

FIG. 7: Expression of KIAA1199 in skin wound healing.

FIGS. 8A-D: COPD Pathology module 4: Scar formation by predominant mesenchymal repair as the result of regenerative failure in the presence of a prevailing structural deficit.

As in any situation of prevailing unresolved repair that is not life-threatening, activation of "secondary" mesenchymal repair will serve as the exit strategy to remove the structural deficit and to terminate wound healing. During progression of COPD, coordinated gene activation in this regard can be divided into two categories: a) permanent support of mesenchymal repair (expression of NTRK2 and SOS1 genes) (FIGS. 8A and 8B), b) support of mesenchymal repair during both functional "primary" repair and non-functional "secondary" wound healing (expression of COMP, PRRX1 and CTHRC1 genes) (FIGS. 8A-8C).

As in any form of predominantly mesenchymal repair, expression of genes controlling vascular growth and differentiation is progressively diminished. FIG. 8D provides a synopsis of the expression pattern and relevant annotations for all genes related to vascular outgrowth and repair which are significantly regulated during progression of COPD.

The invention will now be described by reference to the following examples which are merely illustrative and are not to be construed as a limitation of the scope of the present invention.

EXAMPLES

Example 1

Controlled Prospective Pilot Trial Aimed at Identifying Symptom-Based Molecular Metabolic Markers for Progressive COPD (Vienna COPD-AUVA Study)

Introduction

In the context of the present invention, a controlled prospective pilot trial aimed at the identification of symptom-based molecular metabolic markers for progressive COPD was conducted at the Vienna Medical University between 2007 and 2012. The Vienna COPD-AUVA study combined the assessment of validated clinical measures for COPD following in part the overall strategy of the ECLIPSE trial (Vestbo et al., 2011), the largest and most elaborate study addressing progress and variability of COPD.

For stratification of patients, a three-year analysis (day 0, 12 months, and 36 months) of symptom scoring (St. George Respiratory questionnaire, activity and symptom score), assessment of pulmonary function, cardiopulmonary exercise testing, and radiological evaluation by computer-assisted tomography (high-resolution mode) were combined with whole genome transcription analysis plus quantitative RT-PCR assessment and mass spectrometry proteomics. As shown in FIG. 1, the patients were grouped into three strata, two of which presented at the start of the study with regular lung function, either without any sign of a cardiopulmonary disease (healthy volunteers) or with symptoms of chronic bronchitis (COPD "at risk"), and a group of volunteers having symptoms of chronic bronchitis together with deteriorated lung function (COPD at GOLD stages I-IV).

Study visits were performed at base line and after 12 and 36 months, respectively. Each visit was performed on an ambulatory basis and included medical history, physical examination, pulmonary function tests (PFT), cardiopulmonary exercise tests (CPET), radiological assessment by computer-assisted tomography (CAT) scans and a bronchoscopy. On each visit, both personal and occupational history was taken as well as smoking history which comprised onset and duration of symptoms related to COPD, production of phlegm (frequency, quantity, and color), intensity of symptoms measured by the St. George Respiratory Questionnaire (SGRQ; activity and symptom score index) and assessment of life quality using the SF-36 questionnaire. The rate of exacerbations (frequency, number of hospitalizations, use of antibiotics, corticosteroids or combined treatment) and the individual medication were also recorded.

Pulmonary function tests (PFT) were taken at each visit and included blood drawings, body plethysmography, spirometry and quantitative measurement of pulmonary gas exchange at rest and during symptom-limited cardiopulmonary exercise testing (CPET). PFT was performed with an Autobox DL 6200 (Sensor Medics, Vienna, Austria), and CPET on a treadmill using the Sensormedics 2900 Metabolic Measurement Cart. Formulas for calculation of reference values were taken from Harnoncourt et al., 1982. Predicted values were derived from the reference values of the Austrian Society of Pneumology following the recommendations of the European Respiratory Society (Rabe et al., 2007).

Serum samples were analyzed for complete cellular blood count, electrolytes, glucose, C-reactive protein, fibrinogen, and coagulation parameters.

Prior to bronchoscopy, CAT scans encompassing high resolution-computed tomography (HRCT) were performed. Following additional informed consent on each visit, bronchoscopy was performed. During bronchoscopy, both bronchoalveolar lavage (BAL) samples and transbronchial biopsy samples (five per segment in each middle lobe) were taken.

Biological analysis was performed in transbronchial lung biopsies taken during bronchoscopy from two pulmonary localizations (5 each) of the middle-lobe after radiological assessment by computer-assisted tomography (CAT) scans including high-resolution scanning. CAT scans were used for the assessment of emphysema formation as well as for the exclusion of tumor development and infection. During the controlled observational period, combined assessment of clinical and molecular development was finally possible in 120 volunteers. Biomarkers were identified in each case by means of the individual changes of pulmonary function and clinical symptoms characteristic for the progression of COPD. As a result, this approach makes use of the well-known variability of clinical phenotypes in COPD and their variable course of progression while at the same time identifying the very set of biomolecules responsible for this type of disease progression.

Clinical Analysis

The study protocol was approved by the ethical committee of the Medical University of Vienna (ClinicalTrials.gov Identifier: NCT00618137). Following informed consent during screening, individuals were stratified at visit 1 (day 0) if they fulfilled the following criteria:

TABLE 2

Stratification of subjects at visit 1 (day 0).

| | Inclusion criteria | Occupational history |
|---|---|---|
| Healthy Controls | Age 18-70 years<br>No history or clinical findings suggestive of any disease<br>Never Smoker<br>Normal pulmonary function test at study entry | No occupation with increased exposure towards combustion products, particularly no welding or professional car driving |
| COPD, at risk' | Age 18-70 years<br>Chronic bronchitis according to WHO with repeated episodes of phlegm production<br>No history or clinical findings suggestive of bronchial asthma<br>Normal PFT according to GOLD criteria at study entry<br>Smoking history of at least 10 years<br>No history or clinical findings suggestive of cardiovascular or malign disease | Professional car driver or welder with increased occupational exposure towards combustion products of at least 10 years |
| COPD manifest | Age 18-70 years<br>Chronic bronchitis according to WHO with repeated episodes of phlegm production<br>No history or clinical findings suggestive of bronchial asthma<br>Pathological PFT according to GOLD criteria at study entry<br>Smoking history of at least 10 years<br>No history or clinical findings suggestive of cardiovascular or malign disease | Professional car driver or welder with increased occupational exposure towards combustion products of at least 10 years |

396 individuals were screened, 185 of whom met the study criteria. 136 participants finished visit 2 after 12 months, and 120 completed the final visit after 36 months of controlled observation. Throughout the study, all participants were residing and occupied in the greater Vienna area in order to ensure comparable environmental conditions. The control group consisted of 16 healthy volunteers who had never smoked (7 females and 9 males; mean age 36±12.2 years), as also shown in Table 2 above. None of the healthy participants developed any symptom of pulmonary disease during the study period. At the start of the study, 104 participants presented with clinical symptoms of chronic bronchitis according to WHO definition, 55 of whom did not have signs of non-reversible bronchial obstruction (GOLD "at risk"), while the other 49 participants showed bronchial obstruction ranging from GOLD stage I to IV as determined by PFT (see FIG. 3D). All participants in the COPD and COPD "at risk" groups were active cigarette smokers with a smoking history of more than 10 pack years, except for one welder who in addition to a daily expectoration of phlegm reported about frequent episodes of bronchial infection (>2 per year) without radiological signs of bronchiectasis. 64 participants were working as taxi or bus drivers (53%) and 40 active welders (33%) with a previous exposure to welding fumes of more than 10 years.

At visit 1, the majority of participants with manifest COPD had bronchial obstruction GOLD stage II and III (n=38), while the remaining subjects were in COPD GOLD stage I (n=9) and IV (n=2) (see FIG. 3D). Mean age in GOLD stages I and II was 50±9.5 and 56±10.4 yrs. respectively, compared to 52±9.0 yrs. in GOLD stage III and 63±11 yrs. in GOLD stage IV. 29% of the participants in the GOLD "at risk" group were already presenting with a continuous daily expectoration of sputum, and sputum was frequently discolored (yellow, green, brown) in 27%.

During controlled observation (36 months), 14 participants (12%) had a progression of disease according to GOLD, 7 (13%) in the GOLD "at risk" group, 1 (11%) in GOLD I, 3 (12%) in GOLD II, and 3 (25%) in GOLD Ill. Improvement of bronchial obstruction according to GOLD was observed in 13 individuals (5 participants in both GOLD stage I and II, and 3 cases in GOLD stage Ill and IV), mostly connected to a cessation of cigarette smoking.

As part of the observational design of the study, participants were not specifically encouraged to stop smoking. Accordingly, smoking habits changed only slightly: only 5 participants of the "COPD at risk" group (9%) and 2 participants in the "manifest COPD" group (4%) stopped smoking during the observational period, while 31% reduced cigarette smoking (data not shown). These changes did not significantly alter both occurrence and intensity of chronic bronchitis symptoms, as 27 participants (23%) demonstrated improvement and deterioration of cough and sputum production.

Biological/Molecular Analysis (Gene Transcription in Pulmonary Tissue)

RNAlater (Ambion, lifetechnologies) was used for tissue asservation. The lung biopsy material was disrupted using Lysing Matrix D ceramic balls in a Fastprep 24 system (MP Biomedical, Eschwege). A chaotropic lysis buffer (RLT, RNeasy Kit, Qiagen, Hilden) was used, followed by a phenol/chloroform extraction and subsequent clean up using the spin column approach of the RNeasy Mini Kit (Qiagen, Hilden) according to the manufacturer's manual, including a DNase I digestion on the chromatography matrix. RNA quantification was done spectrophotometrically using a NanoDrop 1000 device (Thermo Scientific) and quality control was performed on the Agilent 2100 Bioanalyzer. A cut off for the amount of 1 microgram and a RNA integrity number of 7.0 was chosen.

Total RNA samples were hybridized to Human Genome U133plus 2.0 array (Affymetrix, St. Clara, CA), interrogating 47,000 transcripts with more than 54,000 probe sets.

Array hybridization was performed according to the supplier's instructions using the "GeneChip® Expression 3' Amplification One-Cycle Target Labeling and Control reagents" (Affymetrix, St. Clara, Calif.). Hybridization was carried out overnight (16h) at 45° C. in the GeneChip® Hybridization Oven 640 (Affymetrix, St. Clara, Calif.). Subsequent washing and staining protocols were performed with the Affymetrix Fluidics Station 450. For signal enhancement, antibody amplification was carried out using a biotinylated anti-streptavidin antibody (Vector Laboratories, U.K.), which was cross-linked by a goat IgG (Sigma, Germany) followed by a second staining with streptavidin-phycoerythrin conjugate (Molecular Probes, Invitrogen). The scanning of the microarray was done with the GeneChip® Scanner 3000 (Affymetrix, St. Clara, Calif.) at 1.56 micron resolution.

The data analysis was performed with the MAS 5.0 (Microarray Suite statistical algorithm, Affymetrix) probe level analysis using GeneChip Operating Software (GCOS 1.4) and the final data extraction was done with the DataMining Tool 3.1 (Affymetrix, St. Clara, Calif.).

CEL files were imported and processed in R/Bioconductor (Gentleman et al., 2004). Briefly, data was preprocessed using quantile normalization (Gentleman et al., 2004) and combat (Johnson et al., 2007), linear models were calculated using limma (Smyth GK, 2005) and genes with a p-value of the f-statistics <5e-3 were called significant. Those genes were grouped into 20 clusters of co-regulated genes. The procedure of modeling and clustering was repeated for GOLD and phlegm as covariates.

For subsequent Gene Ontology (GO)-analysis it was necessary to separate the effects of GOLD and phlegm on gene expression. To this end, the GOLD classifications were grouped into "no COPD" (healthy and GOLD 0) and "COPD" (GOLD grades I-IV). Similarly, phlegm was reclassified into a "phlegm" group (productive or severe) and a "no phlegm" group (health or no/dry). Based on these reclassifications, gene expression was modeled using a 2×2 factorial design, resulting in five different lists of genes: (1) genes which are regulated with phlegm in the presence of COPD, (2) genes which are regulated with phlegm in the absence of COPD, (3) genes which are regulated with COPD in the presence of COPD, (4) genes which are regulated with COPD in the absence of COPD and finally (5) genes which are regulated differently with COPD, depending on whether there is phlegm or not.

These lists were annotated with respect to their biological functions as catalogued in the Gene Ontology (GO) database using the ClueGO plugin for the Cytoscape framework.

Results of Combined Clinical and Molecular Analysis

Activation of Epithelial Repair Mechanisms

Systematic analysis of the significant changes of gene expression during COPD development reveals a differentiated picture: As shown in FIGS. 6A to 6D, mechanisms of regeneration and repair commence as soon as the chronic inflammatory process in the peripheral bronchial tree is established. This is already the case in persistent or repeatedly manifesting bronchitis (COPD "at risk"). The functions associated with this kind of aberration from the normal equilibrium, in ontological terms still only potential COPD, include mediators involved in the regulation of embryonic epidermal and pulmonary growth, such as ELFS (E74-like factor 5; ETS domain transcription factor) which confers spatially controlled outgrowth of epithelial structures (Metzger et al., 2008; Yaniw et al., 2005) as well as mucosal immunity of the lung (Lei et al., 2007). Not surprisingly, the expression of ELFS is accompanied by a significant upregulation of stratifin (SFN) conferring increased epidermal regeneration and differentiation (Medina et al., 2007), yet also reduced deposition of matrix proteins including collagen I (Chavez-Munoz et al., 2012) and reduced functions of non-specific surface immunity (Butt et al., 2012). This regenerative phase of repair involves not only the G protein-coupled orphan receptor GPR110 and the smoke-inducible growth differentiation factor 15 (GDF15) (Wu et al., 2012), a member of the bone morphogenic protein-transforming growth factor-beta superfamily, but also mediators directing differentiated epithelial repair, such as the zinc-binding alpha-2-glycoprotein 1 (AZGP1), and the DMBT1 gene (deleted in malignant brain tumors 1) which is strongly upregulated during acute but resolving bacterial inflammation in enteral epithelia during appendicitis (Kaemmerer et al., 2012), suggesting a functional relevance for mucosal defense (Diegelmann et al., 2012). The almost identical expression profile of DMBT1 and AZGP1, a mediator capable of inducing a strong epithelial transdifferentiation in tumor cells (Kong et al., 2010), suggests an as yet undefined combinatory effect of both mediators on cellular differentiation during epithelial regeneration. Notably, the expression of these genes is strongly increased in individuals with COPD GOLD I and decreases significantly with progression of COPD, as also shown in FIG. 6A. In line with this observation, all mediators conveying epithelial regeneration and differentiation were found to be significantly downregulated during the transition from COPD stage III to COPD stage IV.

Activation of mediators of regenerative repair was also found in individuals demonstrating significant symptoms of bronchial inflammation, as demonstrated by a uniform increase of gene expression of SFN, GPR110 (see also FIG. 6D), and aquaporin 3 (AQP3) (see FIG. 6A) being an additional mediator known to guide proliferation and differentiation of epithelial cells (Nakahigashi et al., 2011; Kim et al., 2010). However, expression of these factors did not further increase with an increase of severity of bronchial inflammation, much in contrast to mediators capable of intensifying inflammation on epithelial surfaces, such as the carcinoembryonic antigen-related cell adhesion molecule 5 (CEACAMS) (see FIGS. 5A and 5D), or factors being part of the preferentially mesenchymal wound healing response during inflammatory repair (Agarwal et al., 2012; Agarwal et al., 2013), such as the cartilage oligomeric matrix protein (COMP) (see FIGS. 8A and 8C). The study design allowed as well for the measurement of changes of gene expression occurring throughout the study period of 3 years, possibly indicating significant changes of repair during short-term progression of COPD. Here, a significant downregulation of GPR110 and DMBT1 genes correlating with deteriorated lung function according to GOLD was found, as also shown in FIGS. 6B and 6D. This decrease of regenerative gene activity started already in GOLD stage II, where it was accompanied by a striking increase of repair functions related to mesenchymal wound healing (see also FIG. 8).

Progressive Activation of Mesenchymal Repair

During later stages of COPD, expression of mediators favoring mesenchymal repair became increasingly prominent. This did not only relate to the increased expression of the COMP gene (see FIGS. 8A and 8C), but also to the expression of potent activators of mesenchymal stem cells, such as the son of sevenless homolog 1 (SOS1) gene, a guanine nucleotide exchange factor for RAS proteins acting as the cognate receptor for hepatocyte growth factor, and to the paired related homeobox 1 gene (PRRX1), a transcriptional co-activator of RAS transcription factors belonging to the HOX family of early differentiation factors able to induce mesenchymal outgrowth in liver cirrhosis (Jiang et al., 2008) as well as epithelial-to-mesenchymal transition (EMT) during cancer development (Ocaña et al., 2012). While their pattern of expression indicates that both COMP and PRRX1 genes take also part in the regenerative phase of wound healing characterizing GOLD stage I and II, their later increase during transition from GOLD stage III to IV suggests an additional involvement in the progressive scarring of the airways. Increased expression of pro-fibrotic factors is further demonstrated by the striking increase of expression of neurotrophic tyrosine kinase receptor type 2 (or tropomyosin receptor kinase B receptor; TrkB) (NTRK2). NTRK2/TrkB, thus far known to act as high affinity receptor for various neurotrophic growth factors during nerve development, is also capable of promoting resistance of mesenchymal cells towards apoptosis and anoikis (Frisch et al., 2013). The combined increase of profibrotic mediators includes as well the expression of the collagen triple helix repeat containing 1 gene (CTHRC1) capable of conferring fibrotic organ dystrophy (Spector et al., 2013). Notably, while the increased expression of CTHRC1 starts only at GOLD stage II, cumulative activation of NTRK2/TrkB is a hallmark throughout progression of COPD in general, suggesting a permanent contribution of NTRK2/TrkB signaling to the aberrant repair response in the peripheral airways during COPD development. This view is further supported by the observation that a disturbed TrkB axis may contribute to experimental pulmonary fibrosis (Avcuogiu et al., 2011).

With the exception of COMP expression, where clinical deterioration correlates with worsening of bronchial obstruction according to GOLD (see also FIG. 8C), neither increased long-term expression of NTRK2 (see also FIG. 8B), nor of PRRX1 (see also FIG. 8B) or CTHRC1 genes (see also FIG. 8C) demonstrate a comparable short-term impact on bronchial obstruction during the controlled 3-year observational study period. Corresponding results were obtained when assessing the correlation of gene expression with progressive bronchial inflammation: while the expression of all genes favoring mesenchymal repair is increased as a result of intensified bronchitis, significant changes were only found for the PRRX1 and CTHRC1 genes (see also FIGS. 8B and 8C).

Loss of Structural Integrity of Epithelial Surfaces

Unexpectedly, the present analysis revealed a very significant downregulation of expression of a group of genes which guide movement, distribution and activation of the cellular cytoskeleton and which, as a result, are likely to profoundly influence structural integrity and barrier function of the mucosal surface. The downregulation of these genes takes place already during establishment of chronic bronchitis, well before the establishment of bronchial obstruction according to GOLD, as also shown in FIG. 4A. The genes closely connected to this development are thymosin beta 15 A (TMSB15A), dipeptidyl-peptidase 6 (DPP6), nudix (nucleoside diphosphate linked moiety X)-type motif 11 (NUDT11), integrin alpha 10 (ITGA10), cystatin E/M (CST6), and PRICKLE2 (data not shown). Notably, the two genes most significantly decreased during progression of COPD, TMSB15A and DPP6, are also significantly downregulated in correlation with symptoms of increased bronchial inflammation (see also FIG. 4B). Beta thymosins are controllers of both composition and sequestration of the actin cytoskeleton (Hannappel, 2007; Huff et al., 2001;

Malinda et al., 1999), by that influencing membrane structure, surface stability and cellular phenotype (Husson et al., 2010).

One of the outcomes of elevated levels of beta thymosins during wound healing seems to be a protection from fibrotic aberrations of repair (De Santis et al., 2011), in part by preventing the expression of a-smooth muscle stress fibers preventing them from a transdifferentiation into myofibroblasts most characteristic for fibrotic tissue development. Currently, little is known about the function of DPP6 in regenerative wound healing. However, DPP6, a member of the S9B family of membrane-bound serine proteases which is lacking any detectable protease activity, has recently been demonstrated to confer membrane stability and controlled outgrowth of cells during nerve development including close control of cell attachment and motility (Lin et al., 2013). Moreover, given its proven association with and control of membrane-bound ion channel expression and activation (Jerng et al., 2012), in particular of voltage-gated potassium channels, expression of DPP6 is also capable of controlling the resting membrane potential (Nadin et al., 2013), thereby controlling both activity and intracellular distribution of the actin cytoskeleton (Mazzochi et al., 2006; Chifflet et al., 2003).

Combined with the striking reduction of TMSB15A gene expression, the significant decrease of DPP6 expression suggests a severe disturbance of regular movement and distribution of the cellular actin skeleton, reducing physicochemical integrity of the epithelial lipid bilayers. As this occurs already very early in COPD development, this finding could indicate an initiating and possibly predisposing mechanism leading to non-specific surface inflammation.

Cystatin M/E (CST6), on the other side, is an epithelium-specific protease inhibitor belonging to the cystatin family of secreted cysteine protease inhibitors indispensable for the physiological regulation of protease activity during growth and differentiation of epithelial structures. CST6 is expressed both in dermal and bronchial epithelia where it characterizes the status of functional differentiation (Zeeuwen et al., 2009). Significant downregulation of CST6 has already been shown to cause a marked disturbance of both surface integrity and differentiation status in the dermis of mice (Zeeuwen et al., 2010). Progressive downregulation of CST6 as observed during advancement of COPD is thus likely to destabilize the intricate balance between proteases and protease inhibitors, by that contributing to a loss of surface stability as well as cellular adhesion and differentiation in the regenerating bronchial epithelium. Within this context, significant downregulation of two other genes intricately involved in the regulation of cell adhesion and motility has also been observed, namely of integrin a10 (ITGA10) being part of differentiated mesenchymal structures, and the nudix (nucleoside diphosphate linked moiety X)-type motif hydrolase 11 (NUDT11), capable of hydrolyzing diphosphoinositol polyphosphates derived from cellular lipid bilayer structures, and diadenosine polyphosphates, mostly based on adenosine triphosphate (ATP).

The consequence of these changes in gene expression is expected to be a disintegration of the epithelial barrier function, probably starting on the cellular level (continuous shear stress within the cellular lipid bilayer due to uncoordinated accumulation and movements of the actin cytoskeleton attached to it), and aggravated by disintegration of the extracellular matrix composition itself. This is supported by the significant increase of gene expression of the KIAA1199 gene during progression of CORD from GOLD stage I to GOLD stage IV (see FIG. 5B). Increased expression of KIAA1199, in addition to mediating cellular attachment and contact inhibition (Tian et al., 2013), has just recently been demonstrated to cause the leakage of endoplasmatic reticulum (ER) contents into the cytosol of cancer cells (Evensen et al., 2013). Moreover, increased expression of KIAA1199 is capable of activating hyaluronidases (HAase), enzymes capable of degrading high-molecular mass hyaluronic acid (HMM-HA), one of the major constituents of the extracellular matrix (Toole, 2004). Biological responses triggered by hyaluronic acid (HA) depend on the HA polymer length. HMM-HA has strong anti-inflammatory properties (Kothapalli et al., 2007), whereas low-molecular-mass HA promotes inflammation and concomitant cellular proliferation (Pure et al., 2009). In support of this view, degradation of HA has been shown to trigger skin inflammation by generation of low molecular weight fragments of HA (Yoshida et al., 2013).

In line with this, expression of HA synthases (HAS1-3) is not changed during progression of COPD (see FIG. 5G), while the hyaluronidase 2 (HYAL2) gene is upregulated between GOLD stages I and III (see also FIG. 5C). Indeed, the pattern of expression of both HYAL1 and HYAL2 follows the expression pattern of KIAA1199, showing a downregulation during the most intense regenerative phase of repair in COPD progression (chronic bronchitis and CORD GOLD 1). Upregulation of KIAA1199 in turn is synchronous to that of the PLAZA gene (see FIG. 5B) which is a phosphatidylserine-specific phospholipase expressed in macrophages stimulated by typical mechanisms of surface immunity, such as toll-like receptor 4 (TLR4) signaling (Wakahara et al., 2007). Both intensified KIAA1199 and PLA1A expression were found to be connected to short-term worsening of pulmonary function according to GOLD criteria (see also FIG. 5B).

Decrease of Pro-Angiogenic Mediators During Progression of COPD

Effective organ repair involves mechanisms concomitantly directing spatially controlled epithelial, mesenchymal and endothelial outgrowth. However, in contrast to gene functions contributing to epithelial and mesenchymal repair, gene expression promoting angiogenesis and vascular differentiation was found to decrease as soon as chronic bronchitis was present. During development of COPD (GOLD stage I and II), this pattern of gene expression proceeded significantly, as also shown in FIG. 8D. Even the increase of Bex1 and Ghrelin (GHRL) gene expression occurring at GOLD stage I is rather small and insignificant compared to gene functions aimed at the regeneration of epithelial outgrowth, such as DMBT1 and AZGP1. Some of the functions, such as FIBIN (fin bud initiation factor homolog), ESM1 (endothelial cell-specific molecule 1) and ghrelin (GHRL) are known to act, in part, as mediators in the early phases of organ development. For instance, FIBIN takes part in mesodermal lateral plate development (Wakahara et al., 2007) which is crucial for early vasculogenesis (Paffett-Lugassy et al., 2013), ESM1 mediates VEGF-A-dependent signaling (Zhang et al., 2012) and is typically expressed in growing vascular tissue which includes tumor angiogenesis (Zhang et al., 2012; Roudnicky et al., 2013; Chen et al., 2010) and regenerative wound healing (Béchard et al., 2001).

Ghrelin, on the other hand, is a typical marker of microvascular development (Li et al., 2007; Wang et al., 2012; Rezaeian et al., 2012) being vital for continuous epithelial oxygen and energy supply preventing excessive apoptosis characteristic for emphysema development (Mimae et al., 2013). BEX1 and BEX5 (Brain Expressed, X-Linked 1 and 5) are genes encoding adapter molecules interfering with p75NTR signaling events. p75NTR is one of the two receptors central to nerve growth factor (NGF) signaling. While BEX1 is known to induce sustained cell proliferation under conditions of growth arrest in response to NGF, much less is known about its possible involvement in angiogenesis and vessel formation, although NGF signaling itself is well-known to promote angiogenesis (Cantarella et al., 2002). One possible interaction could be that reduced BEX1 gene expression would increase p75NTR signaling efficacy causing increased endothelial apoptosis, as the blockade of p75NTR signaling significantly decreases endothelial apoptosis (Han et al., 2008; Caporali et al., 2008). The BEX5 promoter, in turn, contains regulatory binding sites for TALI (T-cell acute lymphocytic leukemia 1), a direct transcriptional activator of angiopoietin 2, which is significantly upregulated during angiogenesis (Deleuze et al., 2012). TAL1, however, is downregulated as well during progression of COPD, as also shown in FIG. 8D.

Stage-Dependent Activation of the Immune Response

Based on the significant changes of gene expression measured during progression of COPD, four sequential phases of gene expression were distinguished: Phase 1 is characterized by a rapid increase of genes involved in the acute immune response, such as fibrinogen (FGG) (Duvoix et al., 2013; Cockayne et al., 2012), and products of aryl hydrocarbon receptor (AHR) signaling, such as CYP1A1 (cytochrome P450, family 1, subfamily A, polypeptide 1) and CYP1B1 (cytochrome P450, family 1, subfamily B, polypeptide 1) expression, as also shown in FIGS. 5A to 5E. This includes as well an increased expression of carcinoembryonic antigen (CEA)-related cell adhesion molecules (CEACAMs), particularly of the CEACAMS gene (see FIGS. 5A and 5D). At this early stage, still representing chronic bronchitis without significant changes of pulmonary function (COPD "at risk"), expression of genes mediating functions of primarily adaptive immunity, such as RASGRF2 (Ras protein-specific guanine nucleotide-releasing factor 2), KIAA1199 or CXCL3 was not significantly changed (see also FIGS. 5H and 5F). At phase 2 (representing GOLD stage I), expression of these genes remained stable or even decreased to some extent (see FIGS. 4A and 5A), probably reflecting the stabilizing outcome of regenerative repair efforts which was most intense at GOLD stage I (see also FIG. 6A). However, phase 3 which includes GOLD stages II and III was characterized by a significant increase of expression of all genes related to immunity including genes indicating increased AHR signaling, such as CYP1A1, CYP1A2 and CYP1B1 (see also FIGS. 5A, 5E and 5F). The latter ones most likely reflect the impact of cigarette smoking, ail the more as three quarters of the participants were still actives smokers at this stage (see FIG. 3C). Increased gene expression reflecting intensified AHR signaling could be demonstrated in spite of elevated levels of the aryl hydrocarbon receptor repressor (AHRR) gene known to inhibit AHR signaling events, particularly during GOLD stages II and III.

Nonetheless, short-term analysis of gene expression addressing a development of COPD over a period of 3 years (see also FIGS. 5A and 5D, middle) indicates that the overall impact of AHR signaling on the deterioration of pulmonary function is more important than the additional expression of CEACAMS which, comparable to FGG expression (see also FIG. 5D), seems to reflect the intensity of bronchitis much better. Phase 4 representing GOLD stage IV shows a striking downregulation of the majority of immune-related functions upregulated during earlier phases of COPD development, comparable to the regulation of genes controlling cellular regeneration and differentiation. interestingly, however, this does not apply to the expression of KIAA1199 and RASGRF2 genes which are both upregulated even at GOLD stage IV, the latter one being again capable of influencing cellular movements by inhibition of the actin cytoskeleton (Calvo et al., 2011): RASGRF2 belongs to a group of activators of the GTPase RAS involved as well in the activation of T cells and required for the induction of NF-AT, IL-2 and TNF-α (Ruiz et al., 2007).

Within this context, the slow yet constant and highly significant upregulation of the guanine-nucleotide exchange factor (GEF) son of sevenless homolog 1 (SOS1) (see FIG. 8A), capable of continually activating RAS, could significantly contribute to the chronic inflammatory process facilitating the bronchial wall scarring characteristic for late stage COPD.

Members of the carcinoembryonic antigen-related cell adhesion molecule (CEACAM) family serve as cellular receptors for typical gram-negative bacteria frequently colonizing the surface of the human airways, such as *Neisseria meningitidis, Haemophilus influenzae* and *Moraxella catarrhalis* expressing opacity (Opa) proteins (Muenzner et al., 2010; Bookwalter et al., 2008; Muenzner et al., 2005). It was recently suggested that non-typable *Haemophilus influenzae* and *Moraxella catarrhalis* are able to increase the expression of their respective receptors on host cells (Klaile et al., 2013). However, no correlation between the expression of members of the CEACAM family and COPD was found under the conditions employed in that study. In the present study, only the expression of the CEACAM5 gene was significantly increased up to GOLD stage III, in that following the inflammatory reaction in general, while significantly decreasing afterwards in GOLD stage IV. This does not, however, exclude the aggravation of mucosa! inflammation as a result of a persistent upregulation of CEACAM5, all the more as the expression of CEACAM5 was found to be increased in combination with a growing intensity of bronchial inflammation (see FIG. 5D).

Conclusions

Between 2007 and 2012, a controlled prospective pilot trial was conducted in finally 120 volunteers in order to identify metabolic markers indicative of the progression of COPD. By adopting parts of the design of the ECLIPSE trial (Vestbo et al., 2011), the largest and most elaborate study performed thus far to identify clinical markers describing both progress and variability of COPD, the Vienna COPD study combined controlled assessment of validated clinical measures with unsupervised assessment of genome-wide gene transcription in pulmonary tissue representing the focus of COPD pathology (Hogg JC, 2004 (b)). The correlation of gene expression with clinical development was based a) on the extent of non-reversible pulmonary obstruction at visit 1 (according to the Global Initiative for Obstructive Lung Disease; GOLD), b) on the worsening of non-reversible obstruction according to GOLD between visit 1 and 3 (covering a period of three years), and c) on symptoms indicative of an increasing intensity of bronchitis being recorded during structured clinical history at visits 1 and 3.

This analysis revealed changes of gene expression indicative of six major deviations from regular maintenance of pulmonary structure and defense: (1) Progressive loss of functions guiding epithelial and (2) vascular regeneration combined with (3) persistent and increasing activation of mechanism of fibroproliferative repair, together indicating a transition from regenerative to fibrotic repair during progression of COPD; (4) intensifying bronchial inflammation being antagonized at GOLD stage I when regenerative repair activity is highest, and culminating afterwards at GOLD stages II and III; (5) a complete loss of structural maintenance at GOLD stage IV connected to a finally failing immunity, both suggestive of the formation of scar tissue; and lastly, a rapid and persistent downregulation of functions controlling the intracellular distribution, aggregation and sequestration of actin polymers which form the cytoskeleton (6). The latter finding is of particular interest as the changes in the transcription of the corresponding genes, in particular the downregulation of TMSB15A, DPP6, NUDT11 and PRICKLE2, were already observed at GOLD stage 0 (COPD "at risk"), well before any change of pulmonary function was measurable. This striking loss occurs together with a significant increase of functions determining bronchial inflammation suggesting that these changes might be the first to predispose the bronchi to persistent inflammation. The outcome of such an early and simultaneous downregulation of the TMSB15A, DPP6, NUDT11 and PRICKLE2 genes will be discussed in the following.

Thymosin beta 15A (TMSB15A) belongs to the group of WH2 (WASP-homologue 2) domain binding proteins which are necessary for the depolymerization of actin filaments during cellular movements (Husson et al., 2010; Hertzog et al., 2004). Formation and rapid movement of actin filaments in turn are indispensable for processes such as cell division, intercalation and cellular extrusion. This applies as well to the regulation of apicobasal cell polarity (Nishimura et al., 2012), and even more important, to the formation and maintenance of tight and adherens junctions (Shen et al., 2005; Calautti et al., 2002). These complex membrane dynamics are not only an answer to external and internal stress, but also part of regular tissue growth and as such energy-dependent. The assembly of the actin skeleton is highly dynamic and creates a layer of epidermal cells acting as an impenetrable fluid-like shield composed of the constantly moving lipid border of the cells (Guillot et al., 2013). Thus, a persistent downregulation of TMSB15A is likely to prevent any fast adaptive arrangement of the surface lipid layers during cellular movements causing repeated perturbations of the epithelial barrier function.

DPP6, on the other hand, is known to stabilize the membrane potential by acting on membrane-bound potassium channels, and has also a profound impact on the organization of the actin cytoskeleton (Chifflet et al., 2003), supporting the perception of a failing barrier function. The same applies to the downregulation of NUDT11 gene expression. The nucleoside diphosphate linked moiety X (nudix)-type motif 11 (NUDT11) gene encodes a type 3 diphosphoinositol polyphosphate phosphohydrolase which generates energy-rich phosphates essential for vesicle trafficking, maintenance of cell-wall integrity in Saccharomyces and for the mediation of cellular responses to environmental salt stress (Dubois et al., 2002). As the adaptive assembly of F and G actin fibers within the cytoskeleton occurs in seconds, it is easily conceivable that energy-rich diphosphoinositol polyphosphates being integral constituents of any cell membrane will be utilized as rapidly accessible source of energy.

These findings point towards a synchronized dysregulation of genes necessary for upholding the epithelial barrier. Moreover, the downregulation of the PRICKLE2 gene was also shown to be vital for the formation of polarized epithelial layers during mouse embryogenesis (Tao et al., 2012). Decreased expression of all four genes (i.e., TMSB15A, DPP6, NUDT11 and PRICKLE2), however, was associated with significantly increased bronchial inflammation, suggesting a functional correlation between the downregulation of genes that guide functionally interrelated features of cytoskeleton assembly with the activation of bronchitis. This sheds a new light on the progression of bronchial inflammation as it indicates a direct connection between the loss of a protective epithelial shield and the aggravation of chronic bronchitis. Based on the physicochemical nature of such an effect, penetration of the epithelial membranes by any potential antigen or allergen is likely to be enhanced, particularly during intensified repair due to repeated smoke-induced damage or following viral infections. This could not only explain the remarkable heterogeneity of inflammatory conditions characteristic for COPD, but also the observation that the capacity to achieve intense cellular regeneration in spite of ongoing inflammation might be helpful in suppressing pro-inflammatory gene expression.

This view is further supported by the significant downregulation of the protease inhibitor cystatin M/E (CST6) during progression of COPD (see also FIG. 4A). CST6 is known to control the homeostasis of the stratum corneum, its deficiency in mice causing severe ichthyosis and neonatal lethality (Zeeuwen et al., 2009). The progressive loss of a protease inhibitor in later phases of COPD known to preserve the integrity of epithelial structures wiii most likely contribute to a failure of the protective barrier function, not only by a disintegration of the epithelial layer but also by facilitating the breakdown of the matrix itself.

In this context, the strong upregulation of the KIAA1199 gene which has been demonstrated to significantly increase the activity of matrix hyaluronidases, is probably equally important, as this upregulation is directly associated with a significant worsening of lung function, even within the relatively short observational period of the present study (see also FIG. 5B). It has recently been shown that matrix structures containing large amounts of high molecular mass hyaluronan as well as the inhibition of hyaluronidase activity protect against both inflammation and cancer progression (Tian et al., 2013). In summary, these findings provide the first conclusive evidence for a progressive breakdown of bronchial surface integrity during the course of COPD development causing growing non-specific bronchial inflammation that varies with frequency and intensity of the physicochemical assaults attacking the bronchial surfaces.

According to results described herein, the response to these assaults is a slow progressive scarring process in the peripheral bronchi, whereby the combined upregulation of CTHRC1, SOS1 and NTRK2 genes (see also FIG. 8A) is likely to indicate mechanisms of preferentially mesenchymal wound healing while the stage dependent expression of the PRRX1 and COMP genes suggests their participation in regular organ repair as well demonstrating the ambiguity between regular matrix support during regenerative repair and scar formation as a result of a progressive failure of the organ's regenerative repair capacity.

This fits well to the progressive downregulation of genes mainly controlling functions of regenerative growth of the vascular tree as demonstrated by the concomitant decrease of the expression of FIBIN, TAL1, BEX1/5, and Ghreiin (GHRL) genes (see also FIG. 8D). Here again, the increasing capacity of the peripheral lung to employ mechanisms of preferentially regenerative repair during GOLD stage I becomes evident as BEX1 and GHRL increase at this stage while progressively decreasing during further progression of COPD.

Thus, in the COPD AUVA study, the clinical progression of COPD has been successfully correlated with the biological analysis of gene expression in pulmonary tissue. In particular, it has been demonstrated that the expression of the genes KIAA1199, DMBT1, ELFS, AZGP1, PRRX1, AQP3, SFN, GPR110, GDF15, RASGRF2, RND1, FGG, CEACAM5, AHRR, CXCL3, CYP1A1, CYP1B1, CYP1A2, NTRK2 and COMP is increased in pulmonary tissue samples from subjects prone to develop progressive COPD, while the expression of the genes TMSB15A, DPP6, SLC51B, NUDT11, PLA1A, HYAL2, CST6, ITGA10, CTHRC1, TAL1, FIBIN, BEXS, BEX1, ESM1 and GHRL is decreased in pulmonary tissue samples from subjects prone to develop progressive COPD, as compared to the expression of the corresponding genes in pulmonary tissue samples from healthy subjects. These molecular biomarkers can thus be used for assessing the susceptibility/proneness of a subject to develop progressive COPD in accordance with the present invention, particularly in the method of the second aspect of the invention. Moreover, it has also been demonstrated that the expression of the genes DMBT1, ELFS, AZGP1, PRRX1, AQP3, SFN, GPR110, GDF15, RASGRF2, RND1, FGG, CEACAM5, AHRR, CXCL3, CYP1A1, CYP1B1, CYP1A2, NTRK2 and COMP is increased in pulmonary tissue samples from subjects suffering from or prone to suffer from stable COPD, while the expression of the genes KIAA1199, TMSB15A, DPP6, SLC51B, NUDT11, PLA1A, HYAL2, CST6, ITGA10, CTHRC1, TAL1, FIBIN, BEXS, BEX1, ESM1 and GHRL is decreased in pulmonary tissue samples from subjects suffering from or prone to suffer from stable COPD, as compared to the expression of the corresponding genes in pulmonary tissue samples from healthy subjects, indicating that these biomarkers are suitable for diagnosing stable COPD or assessing the susceptibility of a subject to develop stable COPD in accordance with the invention, particularly in the method of the third aspect of the invention.

REFERENCES

Agarwal P, et al. *J Biol Chem.* 2012; 287(27):22549-59. doi:10.1074/jbc.M111.335935.

Agarwal P, et al. *Matrix Biol.* 2013; 32(6):325-31. doi: 10.1016/j.matbio.2013.02.010.

Avcuoglu S, et al. *Am J Respir Cell Mo! Biol.* 2011; 45(4):768-80. doi:10.1165!rcmb.2010-01950C.

Béchard D, et al. *J Biol Chem.* 2001; 276(51):48341-9.

Bookwalter J E, et al. *Infect Immun.* 2008; 76(1):48-55.

Butt A Q, et al. *J Biol Chem.* 2012; 287(46):38665-79. doi:10.1074/jbc.M112.367490.

Calautti E, et al. *J Cell Biol.* 2002; 156:137-48.

Calvo F, et al. *Nat Cell Biol.* 2011; 13(7):819-26. doi: 10.1038/ncb2271.

Cantarella G, et at. *FASEB J.* 2002; 16(10):1307-9.

Caporali A, et al. *Circ Res.* 2008; 103(2):e15-26. doi: 10.1161/CIRCRESAHA.108.177386.

Chavez-Muñoz C, et al. *J Cell Biochem.* 2012; 113(8): 2622-32. doi:10.1002/jcb.24137.

Chen L Y, et al. *J Int Med Res.* 2010; 38(2):498-510.

Chifflet S, et al. *Exp Cell Res.* 2003; 282(1):1-13.

Cockayne D A, et al. *PLoS One.* 2012; 7(6):e38629. doi:10.1371/journal.pone.0038629.

Cole S P C, et al. *Monoclonal Antibodies and Cancer Therapy.* 1985; 27:77-96.

De Santis M, et al. *Respir Res.* 2011; 12:22. doi:10.1186/1465-9921-12-22.

Deleuze V, et al. *PLoS One.* 2012; 7(7):e40484. doi: 10.1371/journal.pone.0040484.

Diegelmann J, et al. *J Biol Chem.* 2012; 287(1):286-98. doi:10.1074/jbc.M111.294355.

Ding C, et al. *J Biochem Mol Biol.* 2004; 37(1):1-10.

Dubois E, et al. *J Biol Chem.* 2002; 277:23755-63.

Duvoix A, et al. *Thorax.* 2013; 68(7):670-6. doi:10.1136/thoraxjn1-2012-201871.

Evensen N A, et al. *J Natl Cancer Inst.* 2013; 105(18): 1402-16. doi:10.1093/jnci/djt224.

Frisch S M, et al. *J Cell Sci.* 2013; 126(Pt1):21-9. doi: 10.1242/jcs.120907.

Gentleman R, et al. *Genome Biology.* 2004; 5:R80.

Green, M R et al. Molecular Cloning: A Laboratory Manual. Cold Spring Harbor Laboratory Press. Fourth Edition. 2012. ISBN: 978-1936113422.

Guillot C, et al. *Science.* 2013; 340:1185-9.

Halbert R J, et al. *Eur Respir J.* 2006; 28:523-32.

Han Y, et al. *Biochem Biophys Res Commun.* 2008; 366(3):685-91.

Han M K, et al. *Am J Respir Crit Care Med.* 2010; 182:598-604.

Hannappel E. *Ann NY Acad Sci.* 2007; 1112:21-37. doi: 10.1196/annals.1415.018.

Harlow E, et al. Using Antibodies: A Laboratory Manual. Cold Spring Harbor Laboratory Press. 1998. ISBN: 978-0879695446.

Harnoncourt K, et al. *Osterreich Arzteztg.* 1982; 37:1640-2.

Hertzog M, et al. *Cell.* 2004; 117:611-623.

Hogg J C, et al. *N Engl J Med.* 2004; 350:2645-2653. (a)

Hogg J C. *Lancet.* 2004; 364:709-721. (b)

Huff T, et al. *Int J Biochem Cell Biol.* 2001; 33:205-220. doi:10.1016/S1357-2725(00)00087-X.

Hurst J R, et al. *N Engl J Med.* 2010; 363:1128-1138.

Husson C, et at. *Ann NYAcad Sci.* 2010; 1194:44-52. doi:10.1111/j.1749-6632.2010.05473.x.

Jerng H H, et al. *PLoS One.* 2012; 7(6):e38205. doi: 10.1371/journal.pone.0038205.

Jiang F, et al. *Exp Biol Med* (*Maywood*). 2008; 233(3): 286=96. doi:10.3181/0707-RM-177.

Johnson W E, et al. *Biostatistics.* 2007; 8(1):118-127.

Kaemmerer E, et al. *Histopathology.* 2012; 60(4):561-9.doi:10.1111/j.1365-2559.2011.04159.x.

Kim N H, et al. *J Invest Dermatol.* 2010; 130(9):2231-9. doi:10.1038/jid.2010.99.

Klaile E, et al. *Respir Res.* 2013; 14:85. doi:10.1186/1465-9921-14-85.

Köhler G, et al. *Nature.* 1975; 256(5517):495-7.

Kong B, et al. *Oncogene.* 2010; 29(37):5146-58. doi: 10.1038/onc.2010.258.

Kothapalli D, et al. *J Cell Biol.* 2007; 176:535-44.

Kozbor D, et al. *Immunol Today.* 1983; 4(3):72-9.

Lei W, et al. *Am J Physiol Lung Cell Mol Physiol.* 2007; 293(5):L1359-68.

Li A, et at. *Biochem Biophys Res Commun.* 2007; 353 (2):238-43.

Lin L, et al. *Nat Commun.* 2013; 4:2270. doi:10.1038/ncomms3270.

Malinda K M, et al. *J Invest Dermatol.* 1999; 113(3):364-8. doi:10.1046/j.1523-1747.1999.00708.x.

Mazzochi C, et al. *Am J Physiol Renal Physiol.* 2006; 291(6):F1113-22.

Medina A, et al. *Mol Cell Biochem.* 2007; 305:255-64.

Metzger D E, et al. *Dev Biol.* 2008; 320(1):149-60. doi:10.1016/j.ydbio.2008.04.038.

Mimae T, et al. *Thorax.* 2013. doi:10.1136/thoraxjn1-2013-203867.

Muenzner P, et al. *J Cell Biol.* 2005; 170(5):825-36. doi:10.1083/jcb.200412151

Muenzner P, et al. *Science.* 2010; 329(5996):1197-201. doi:10.1126/science.1190892.

Murray C J L, et al. *Lancet.* 1997; 349:1498-504.

Nadin B M, et al. PLoS One. 2013; 8(4):e60831. doi:10.1371/journal.pone.0060831.

Nakahigashi K, et al. *J Invest Dermatol.* 2011; 131(4):865-73. doi:10.1038/jid.2010.395.

Nishimura T, et al. *Cell.* 2012; 149(5):1084-97. doi:10.1016/j.ce11.2012.04.021.

Ocaña O H, et al. *Cancer Cell.* 2012; 22(6):709-24. doi:10.1016/j.ccr.2012.10.012.

Paffett-Lugassy N, et al. *Nat Cell Biol.* 2013; 15(11):1362-9. doi:10.1038/ncb2862.

Pauwels, R A et al. *Am J Respir Crit Care Med.* 2001; 163(5):1256-76.

Price D, et al. *Prim Care Respir J.* 2011; 20(1):15-22. doi:10.4104/perj.2010.00060.

Pure E, et al. *Cell Signal.* 2009; 21(5):651-5. doi:10.1016/j.cellsig.2009.01.024.

Rabe K F, et al. *Am J Respir Crit Care Med.* 2007; 176(6):532-55.

Rezaeian F, et al. *Am J Physiol Heart Circ Physiol.* 2012; 302(3):H603-10. doi:10.1152/ajpheart.00390.2010.

Roudnicky F, et al. *Cancer Res.* 2013; 73(3):1097-106. doi:10.1158/0008-5472.CAN-12-1855.

Ruiz S, et al. *Mol Cell Biol.* 2007; 27(23):8127-42.

Shen L, et al. *Mol Bio Cell.* 2005; 16:3919-36.

Smyth G K. limma: linear models for microarray data. In: Gentleman R, et al. Bioinformatics and Computational Biology Solutions using R and Bioconductor. 2005. Springer, N.Y., pages 397-420.

Spector I, et al. *Am J Pathol.* 2013; 182(3):905-16. doi:10.1016/j.ajpath.2012.11.004.

Tao H, et al. *Dev Biol.* 2012; 364(2):138-48. doi:10.1016/j.ydbio.2012.01.025.

Tian X, et al. *Nature.* 2013; 499(7458):346-9. doi:10.1038/nature12234.

Toole B P. *Nat Rev Cancer.* 2004; 4(7):528-39.

US Burden of Disease Collaborators. *JAMA.* 2013; 310(6):591-608.

Vestbo J, et al. *N Engl J Med.* 2011; 365(13):1184-92.

Vestbo J, et al. *Am J Respir Crit Care Med.* 2013; 187(4):347-65. doi:10.1164/rccm.201204-0596PP.

Wang L, et al. *Peptides.* 2012; 33(1):92-100. doi:10.1016/j.peptides.2011.11.001.

Wakahara T, et al. *Dev Biol.* 2007; 303(2):527-35.

Wedzicha J A. *Thorax.* 2000; 55:631-632.

Wu Q, et al. *Innate Immun.* 2012; 18(4):617-26. doi:10.1177/1753425911429837.

Yaniw D, et al. *Cell Res.* 2005; 15(6):423-9.

Yoshida H, et al. *Proc Natl Acad Sci USA.* 2013; 110(14):5612-7. doi:10.1073/pnas.1215432110.

Zeeuwen P L J M, et al. *J Invest Dermatol.* 2009; 129:1327-38. doi:10.1038/jid.2009.40.

Zeeuwen P L J M, et al. *FASEB J.* 2010; 24:3744-55. doi:10.1096/fj.10-155879.

Zhang S M, et al. *Biotech Histochem.* 2012; 87(3):172-8. doi:10.3109/10520295.2011.577754.

SEQUENCE LISTING

```
<160> NUMBER OF SEQ ID NOS: 59

<210> SEQ ID NO 1
<211> LENGTH: 2471
<212> TYPE: DNA
<213> ORGANISM: Homo sapiens

<400> SEQUENCE: 1

agaaagcgag cagccaccca gctccccgcc accgccatgg tccccgacac cgcctgcgtt      60

cttctgctca ccctggctgc cctcggcgcg tccggacagg gccagagccc gttgggctca     120

gacctgggcc cgcagatgct tcgggaactg caggaaacca acgcggcgct gcaggacgtg     180

cgggagctgc tgcggcagca ggtcagggag atcacgttcc tgaaaaacac ggtgatggag     240

tgtgacgcgt gcgggatgca gcagtcagta cgcaccggcc tacccagcgt gcggcccctg     300

ctccactgcg cgcccggctt ctgcttcccc ggcgtggcct gcatccagac ggagagcggc     360

gcgcgctgcg gcccctgccc cgcgggcttc acgggcaacg gctcgcactg caccgacgtc     420

aacgagtgca acgcccaccc ctgcttcccc cgagtccgct gtatcaacac cagcccgggg     480

ttccgctgcg aggcttgccc gccggggtac agcggcccca cccaccaggg cgtggggctg     540

gctttcgcca aggccaacaa gcaggtttgc acggacatca acgagtgtga gaccgggcaa     600

cataactgcg tccccaactc cgtgtgcatc aacacccggg gctccttcca gtgcggcccg     660

tgccagcccg gcttcgtggg cgaccaggcg tccggctgcc agcggcgcgc acagcgcttc     720

tgccccgacg gctcgcccag cgagtgccac gagcatgcag actgcgtcct agagcgcgat     780

ggctcgcggt cgtgcgtgtg tgccgttggc tgggccggca acgggatcct ctgtggtcgc     840

gacactgacc tagacggctt cccggacgag aagctgcgct gcccggagcg ccagtgccgt     900
```

```
aaggacaact gcgtgactgt gcccaactca gggcaggagg atgtggaccg cgatggcatc    960
ggagacgcct gcgatccgga tgccgacggg gacggggtcc ccaatgaaaa ggacaactgc   1020
ccgctggtgc ggaacccaga ccagcgcaac acggacgagg acaagtgggg cgatgcgtgc   1080
gacaactgcc ggtcccagaa gaacgacgac caaaaggaca cagaccagga cggccggggc   1140
gatgcgtgcg acgacgacat cgacggcgac cggatccgca accaggccga caactgccct   1200
agggtaccca actcagacca gaaggacagt gatggcgatg gtatagggga tgcctgtgac   1260
aactgtcccc agaagagcaa cccggatcag gcggatgtgg accacgactt tgtgggagat   1320
gcttgtgaca gcgatcaaga ccaggatgga gacggacatc aggactctcg ggacaactgt   1380
cccacggtgc ctaacagtgc ccaggaggac tcagaccacg atggccaggg tgatgcctgc   1440
gacgacgacg acgacaatga cggagtccct gacagtcggg acaactgccg cctggtgcct   1500
aaccccggcc aggaggacgc ggacagggac ggcgtgggcg acgtgtgcca ggacgacttt   1560
gatgcagaca aggtggtaga caagatcgac gtgtgtccgg agaacgctga agtcacgctc   1620
accgacttca gggccttcca gacagtcgtg ctggacccgg agggtgacgc gcagattgac   1680
cccaactggg tggtgctcaa ccagggaagg gagatcgtgc agacaatgaa cagcgaccca   1740
ggcctggctg tgggttacac tgccttcaat ggcgtggact tcgagggcac gttccatgtg   1800
aacacggtca cggatgacga ctatgcgggc ttcatctttg gctaccagga cagctccagc   1860
ttctacgtgg tcatgtggaa gcagatggag caaacgtatt ggcaggcgaa ccccttccgt   1920
gctgtggccg agcctggcat ccaactcaag gctgtgaagt cttccacagg ccccggggaa   1980
cagctgcgga acgctctgtg gcatacagga gacacagagt cccaggtgcg gctgctgtgg   2040
aaggacccgc gaaacgtggg ttggaaggac aagaagtcct atcgttggtt cctgcagcac   2100
cggccccaag tgggctacat cagggtgcga ttctatgagg gccctgagct ggtggccgac   2160
agcaacgtgg tcttggacac aaccatgcgg ggtggccgcc tgggggtctt ctgcttctcc   2220
caggagaaca tcatctgggc caacctgcgt taccgctgca atgacaccat cccagaggac   2280
tatgagaccc atcagctgcg gcaagcctag ggaccagggt gaggacccgc cggatgacag   2340
ccaccctcac cgcggctgga tgggggctct gcacccagcc ccaaggggtg gccgtcctga   2400
gggggaagtg agaagggctc agagaggaca aaataaagtg tgtgtgcagg gaaaaaaaaa   2460
aaaaaaaaaa a                                                        2471
```

<210> SEQ ID NO 2
<211> LENGTH: 5160
<212> TYPE: DNA
<213> ORGANISM: Homo sapiens

<400> SEQUENCE: 2

```
aaaacccgga ggagcgggat ggcgcgcttt gactctggag tgggagtggg agcgagcgct     60
tctgcgactc cagttgtgag agccgcaagg gcatgggaat tgacgccact caccgacccc    120
cagtctcaat ctcaacgctg tgaggaaacc tcgactttgc caggtcccca agggcagcgg    180
ggctcggcga gcgaggcacc cttctccgtc cccatcccaa tccaagcgct cctggcactg    240
acgacgccaa gagactcgag tgggagttaa agcttccagt gagggcagca ggtgtccagg    300
ccgggcctgc gggttcctgt tgacgtcttg ccctaggcaa aggtcccagt tccttctcgg    360
agccggctgt cccgcgccac tggaaaccgc acctccccgc agcatgggca ccagcctcag    420
cccgaacgac ccttggccgc taaacccgct gtccatccag cagaccacgc tcctgctact    480
```

-continued

```
cctgtcggtg ctggccactg tgcatgtggg ccagcggctg ctgaggcaac ggaggcggca    540
gctccggtcc gcgcccccgg gcccgtttgc gtggccactg atcggaaacg cggcggcggt    600
gggccaggcg gctcacctct cgttcgctcg cctggcgcgg cgctacggcg acgttttcca    660
gatccgcctg ggcagctgcc ccatagtggt gctgaatggc gagcgcgcca tccaccaggc    720
cctggtgcag cagggctcgg ccttcgccga ccggccggcc ttcgcctcct tccgtgtggt    780
gtccggcggc cgcagcatgg ctttcggcca ctactcggag cactggaagg tgcagcggcg    840
cgcagcccac agcatgatgc gcaacttctt cacgcgccag ccgcgcagcc gccaagtcct    900
cgagggccac gtgctgagcg aggcgcgcga gctggtggcg ctgctggtgc gcggcagcgc    960
ggacggcgcc ttcctcgacc cgaggccgct gaccgtcgtg gccgtggcca acgtcatgag   1020
tgccgtgtgt ttcggctgcc gctacagcca cgacgacccc gagttccgtg agctgctcag   1080
ccacaacgaa gagttcgggc gcacggtggg cgcgggcagc ctggtggacg tgatgccctg   1140
gctgcagtac ttccccaacc cggtgcgcac cgttttccgc gaattcgagc agctcaaccg   1200
caacttcagc aacttcatcc tggacaagtt cttgaggcac tgcgaaagcc ttcggcccgg   1260
ggccgccccc cgcgacatga tggacgcctt tatcctctct gcggaaaaga aggcggccgg   1320
ggactcgcac ggtggtggcg cgcggctgga tttggagaac gtaccggcca ctatcactga   1380
catcttcggc gccagccagg acaccctgtc caccgcgctg cagtggctgc tcctcctctt   1440
caccaggtat cctgatgtgc agactcgagt gcaggcagaa ttggatcagg tcgtggggag   1500
ggaccgtctg ccttgtatgg gtgaccagcc caacctgccc tatgtcctgg ccttccttta   1560
tgaagccatg cgcttctcca gctttgtgcc tgtcactatt cctcatgcca ccactgccaa   1620
cacctctgtc ttgggctacc acattcccaa ggacactgtg gtttttgtca accagtggtc   1680
tgtgaatcat gacccactga agtggcctaa cccggagaac tttgatccag ctcgattctt   1740
ggacaaggat ggcctcatca acaaggacct gaccagcaga gtgatgattt tttcagtggg   1800
caaaaggcgg tgcattggcg aagaactttc taagatgcag ctttttctct tcatctccat   1860
cctggctcac cagtgcgatt tcagggccaa cccaaatgag cctgcgaaaa tgaatttcag   1920
ttatggtcta accattaaac ccaagtcatt taaagtcaat gtcactctca gagagtccat   1980
ggagctcctt gatagtgctg tccaaaattt acaagccaag gaaacttgcc aataagaagc   2040
aagaggcaag ctgaaatttt agaaatattc acatcttcgg agatgaggag taaaattcag   2100
ttttttcca gttcctcttt tgtgctgctt ctcaattagc gtttaaggtg agcataaatc   2160
aactgtccat caggtgaggt gtgctccata cccagcggtt cttcatgagt agtgggctat   2220
gcaggagctt ctgggagatt tttttgagtc aaagacttaa agggcccaat gaattattat   2280
atacatactg catcttggtt atttctgaag gtagcattct ttggagttaa aatgcacata   2340
tagacacata cacccaaaca cttacaccaa actactgaat gaagcagtat tttggtaacc   2400
aggccatttt tggtgggaat ccaagattgg tctcccatat gcagaaatag acaaaaagta   2460
tattaaacaa agtttcagag tatattgttg aagagacaga gacaagtaat ttcagtgtaa   2520
agtgtgtgat tgaaggtgat aagggaaaag ataaagacca gaaattccct tttcaccttt   2580
tcaggaaaat aacttagact ctagtattta tgggtggatt tatccttttg ccttctggta   2640
tacttcctta cttttaagga taaatcataa agtcagttgc tcaaaaagaa atcaatagtt   2700
gaattagtga gtatagtggg gttccatgag ttatcatgaa ttttaaagta tgcattatta   2760
aattgtaaaa ctccaaggtg atgttgtacc tcttttgctt gccaaagtac agaatttgaa   2820
ttatcagcaa agaaaaaaaa aaaagccagc caagctttaa attatgtgac cataatgtac   2880
```

```
tgatttcagt aagtctcata ggttaaaaaa aaaagtcacc aaatagtgtg aaatatatta   2940
cttaactgtc cgtaagcagt atattagtat tatcttgttc aggaaaaggt tgaataatat   3000
atgccttgta taatattgaa aattgaaaag tacaactaac gcaaccaagt gtgctaaaaa   3060
tgagcttgat taaatcaacc acctattttt gacatggaaa tgaagcaggg tttcttttct   3120
tcactcaaat tttggcgaat ctcaaaatta gatcctaaga tgtgttctta tttttataac   3180
atctttattg aaattctatt tataatacag aatcttgttt tgaaaataac ctaattaata   3240
tattaaaatt ccaaattcat ggcatgctta aattttaact aaattttaaa gccattctga   3300
ttattgagtt ccagttgaag ttagtggaaa tctgaacatt ctcctgtgga aggcagagaa   3360
atctaagctg tgtctgccca atgaataatg gaaaatgcca tgaattacct ggatgttctt   3420
tttacgaggt gacaagagtt ggggacagaa ctcccattac aactgaccaa gtttctcttc   3480
tagatgattt tttgaaagtt aacattaatg cctgcttttt ggaaagtcag aatcagaaga   3540
tagtcttgga agctgtttgg aaaagacagt ggagatgagg tcagttgtgt tttttaagat   3600
ggcaattact ttggtagctg ggaaagcata aagctcaaat gaaatgtatg cattcacatt   3660
tagaaaagtg aattgaagtt tcaagtttta aagttcattg caattaaact tccaaagaaa   3720
gttctacagt gtcctaagtg ctaagtgctt attacatttt attaagcttt ttggaatctt   3780
tgtaccaaaa ttttaaaaaa gggagttttt gatagttgtg tgtatgtgtg tgtggggtgg   3840
ggggatggta agagaaaaga gagaaacact gaaaagaagg aaagatggtt aaacattttc   3900
ccactcattc tgaattaatt aatttggagc acaaaattca aagcatggac atttagaaga   3960
aagatgtttg gcgtagcaga gttaaatctc aaataggcta ttaaaaaagt ctacaacata   4020
gcagatctgt tttgtggttt ggaatattaa aaaacttcat gtaattttat tttaaaattt   4080
catagctgta cttcttgaat ataaaaaatc atgccagtat ttttaaaggc attagagtca   4140
actacacaaa gcaggcttgc ccagtacatt taaatttttt ggcacttgcc attccaaaat   4200
attatgcccc accaaggctg agacagtgaa tttgggctgc tgtagcctat ttttttagat   4260
tgagaaatgt gtagctgcaa aaataatcat gaaccaatct ggatgcctca ttatgtcaac   4320
caggtccaga tgtgctataa tctgttttta cgtatgtagg cccagtcgtc atcagatgct   4380
tgcggcaaaa ggaaagctgt gtttatatgg aagaaagtaa ggtgcttgga gtttacctgg   4440
cttatttaat atgcttataa cctagttaaa gaaaggaaaa gaaaacaaaa aacgaatgaa   4500
aataactgaa tttggaggct ggagtaatca gattactgct ttaatcagaa accctcattg   4560
tgtttctacc ggagagagaa tgtatttgct gacaaccatt aaagtcagaa gttttactcc   4620
aggttattgc aataaagtat aatgtttatt aaatgcttca tttgtatgtc aaagctttga   4680
ctctataagc aaattgcttt tttccaaaac aaaaagatgt ctcaggtttg ttttgtgaat   4740
tttctaaaag ctttcatgtc ccagaactta gcctttacct gtgaagtgtt actacagcct   4800
taatattttc ctagtagatc tatattagat caaatagttg catagcagta tatgttaatt   4860
tgtgtgtttt tagctgtgac acaactgtgt gattaaaagg tatactttag tagacattta   4920
taactcaagg ataccttctt atttaatctt ttcttatttt tgtactttat catgaatgct   4980
tttagtgtgt gcataatagc tacagtgcat agttgtagac aaagtacatt ctggggaaac   5040
aacatttata tgtagccttt actgtttgat ataccaaatt aaaaaaaaat tgtatctcat   5100
tacttatact gggacaccat taccaaaata ataaaaatca ctttcataat cttgaaaaaa   5160
```

<210> SEQ ID NO 3

<211> LENGTH: 2608
<212> TYPE: DNA
<213> ORGANISM: Homo sapiens

<400> SEQUENCE: 3 ctcaccctga aggtgacagt tccttggaac cttccctgat ccttgtgatc ccaggctcca 60 agagtccacc cttcccagct cagctcagta cctcagccac ctccaagatc cctacactga 120 tcatgctttt cccaatctcc atgtcggcca cggagtttct tctggcctct gtcatcttct 180 gtctggtatt ctgggtaatc agggcctcaa gacctcaggt ccccaaaggc ctgaagaatc 240 caccagggcc atggggctgg cctctgattg ggcacatgct gaccctggga aagaacccgc 300 acctggcact gtcaaggatg agccagcagt atggggacgt gctgcagatc cgaattggct 360 ccacacccgt ggtggtgctg agcggcctgg acaccatccg gcaggccctg gtgcggcagg 420 gcgatgattt caagggccgg cccgacctct acaccttcac cctcatcagt aatggtcaga 480 gcatgtcctt cagcccagac tctggaccag tgtgggctgc ccgccggcgc ctggcccaga 540 atggcctgaa aagtttctcc attgcctctg acccagcctc ctcaacctcc tgctacctgg 600 aagagcatgt gagcaaggag gctgaggtcc tgataagcac gttgcaggag ctgatggcag 660 ggcctgggca ctttaacccc tacaggtatg tggtggtatc agtgaccaat gtcatctgtg 720 ccatttgctt tggccggcgc tatgaccaca accaccaaga actgcttagc ctagtcaacc 780 tgaataataa tttcggggag gtggttggct ctggaaaccc agctgacttc atccctattc 840 ttcgctacct acccaaccct tccctgaatg ccttcaagga cctgaatgag aagttctaca 900 gcttcatgca gaagatggtc aaggagcact acaaaacctt tgagaagggc cacatccggg 960 acatcacaga cagcctgatt gagcactgtc aggagaagca gctggatgag aacgccaatg 1020 tccagctgtc agatgagaag atcattaaca tcgtcttgga cctctttgga gctgggtttg 1080 acacagtcac aactgctatc tcctggagcc tcatgtattt ggtgatgaac cccagggtac 1140 agagaaagat ccaagaggag ctagacacag tgattggcag gtcacggcgg ccccggctct 1200 ctgacagatc ccatctgccc tatatggagg ccttcatcct ggagaccttc cgacactctt 1260 ccttcgtccc cttcaccatc ccccacagca caacaagaga cacaagtttg aaaggctttt 1320 acatccccaa ggggcgttgt gtctttgtaa accagtggca gatcaaccat gaccagaagc 1380 tatgggtcaa cccatctgag ttcctacctg aacggtttct cacccctgat ggtgctatcg 1440 acaaggtgtt aagtgagaag gtgattatct ttggcatggg caagcggaag tgtatcggtg 1500 agaccattgc ccgctgggag gtctttctct tcctggctat cctgctgcaa cgggtggaat 1560 tcagcgtgcc actgggcgtg aaggtggaca tgacccccat ctatgggcta accatgaagc 1620 atgcctgctg tgagcacttc caaatgcagc tgcgctctta ggtgcttgag agccctgagg 1680 cctagactct gtctacctgg tctggttggg cagccagacc agcaggctgg cctatgtggt 1740 ctaaggttca gcctgaaact catagacact gatctggctg cagttttgct atctgggctg 1800 tgggcaagcc taagggatcc tgcctgcccc taccctggac ttgcctctgc acaccctcca 1860 gagacaacag gtaaaacagg gccacataga tgctgatgga gccttcccaa gttgtgcttg 1920 agccaggagg cctgctaggg ttaggaggtc cttaggcctc tgagaagctc tgaagaactc 1980 tctggaagcc cctgggccca gtacctagct ggctctgtga gggtgctgac tggcttcagc 2040 aagttagaac tagccaaacc aggaccctgt ccaatctttg acaattggga gctgccaaga 2100 gtgaagggaa gagacagccc aggatactgg cacagaggta gtctcactgc ttgaactagg 2160 ctgagcaatc tgaccctatg ggtctaggac acagttcctg ggaacatcac attcctctgc 2220

```
ccttcctgca ggcaggaaca aacagggctg ccttctggcc ttgtaagacc cttattgctg   2280

tcctggaggg gctggggact tgtgtctgcg gggatcagag cgcacaggga gtgcacatat   2340

ccaggcacca ggactagggc tggagtgagg ggggggtatt tcaattacct tctattggtc   2400

tcccttctct acactcttgt aataaaatgt ctatttttaa tgtttgtaca caacaatcct   2460

tctattctag cctgcattga gcttgcatgc ttgcataaga gcttaagaac cattgattta   2520

atgtaatagg gaaaattcta acccaggtat ccaaaaatgt gtaagaacaa ctacctgagc   2580

taaataaaga tattgttcag aaatccta                                      2608
```

<210> SEQ ID NO 4
<211> LENGTH: 1665
<212> TYPE: DNA
<213> ORGANISM: Homo sapiens

<400> SEQUENCE: 4

```
cttctggtaa ggaggccccg tgatcagctc cagccatttg cagtcctggc tatcccagga     60

gcttacataa agggacaatt ggagcctgag aggtgacagt gctgacacta caaggctcgg    120

agctccgggc actcagacat catgagttgg tccttgcacc cccggaattt aattctctac    180

ttctatgctc ttttatttct ctcttcaaca tgtgtagcat atgttgctac cagagacaac    240

tgctgcatct tagatgaaag attcggtagt tattgtccaa ctacctgtgg cattgcagat    300

ttcctgtcta cttatcaaac caaagtagac aaggatctac agtctttgga agacatctta    360

catcaagttg aaaacaaaac atcagaagtc aaacagctga taaaagcaat ccaactcact    420

tataatcctg atgaatcatc aaaaccaaat atgatagacg ctgctacttt gaagtccagg    480

aaaatgttag aagaaattat gaaatatgaa gcatcgattt taacacatga ctcaagtatt    540

cgatatttgc aggaaatata taattcaaat aatcaaaaga ttgttaacct gaaagagaag    600

gtagcccagc ttgaagcaca gtgccaggaa ccttgcaaag acacggtgca aatccatgat    660

atcactggga aagattgtca agacattgcc aataagggag ctaaacagag cgggctttac    720

tttattaaac ctctgaaagc taaccagcaa ttcttagtct actgtgaaat cgatgggtct    780

ggaaatggat ggactgtgtt tcagaagaga cttgatggca gtgtagattt caagaaaaac    840

tggattcaat ataaagaagg atttggacat ctgtctccta ctggcacaac agaattttgg    900

ctgggaaatg agaagattca tttgataagc acacagtctg ccatcccata tgcattaaga    960

gtggaactgg aagactggaa tggcagaacc agtactgcag actatgccat gttcaaggtg   1020

ggacctgaag ctgacaagta ccgcctaaca tatgcctact tcgctggtgg ggatgctgga   1080

gatgcctttg atggctttga ttttggcgat gatcctagtg acaagttttt cacatcccat   1140

aatggcatgc agttcagtac ctgggacaat gacaatgata agtttgaagg caactgtgct   1200

gaacaggatg gatctggttg gtggatgaac aagtgtcacg ctggccatct caatggagtt   1260

tattaccaag gtggcactta ctcaaaagca tctactccta atggttatga taatggcatt   1320

atttgggcca cttggaaaac ccggtggtat tccatgaaga aaaccactat gaagataatc   1380

ccattcaaca gactcacaat tggagaagga cagcaacacc acctgggggg agccaaacag   1440

gctggagacg tttaaaagac cgtttcaaaa gagatttact tttttaaagg actttatctg   1500

aacagagaga tataatattt ttcctattgg acaatggact tgcaaagctt cacttcattt   1560

taagagcaaa agaccccatg ttgaaaactc cataacagtt ttatgctgat gataatttat   1620

ctacatgcat ttcaataaac cttttgtttc ctaagactag aaaaa                   1665
```

<210> SEQ ID NO 5
<211> LENGTH: 840
<212> TYPE: DNA
<213> ORGANISM: Homo sapiens

<400> SEQUENCE: 5 agacccagag ccaatgcgtg gattagtccc tcctcctagt tgcagtctgg tagttgtcgc 60 tggccgtgtg acggctcgct gttgccctga aggcaggcga gccagctgcc caggaaaggt 120 ggaaagtggt agaagctgac ccctgagccc tggcaggtct ttaagtgcgt ttgtgcagcc 180 gatttcaagg ctaagagaga aagactgcct ctgatccctg aaggaagaaa aaaaaaaaaa 240 aaacaggaaa aaaactcaac atggaaaatg tccccaagga aaacaaagtt gtggagaagg 300 ccccagtgca gaatgaagcc cccgctttag gaggtggtga ataccaggag cctggaggaa 360 atgttaaagg ggtttgggct ccacctgccc cgggttttgg agaggatgtg cccaataggc 420 ttgtcgataa cattgatatg atagatggag atggagatga tatggaacgg ttcatggagg 480 agatgagaga gctaaggagg aaaattaggg aacttcagtt gaggtacagt ctgcgcattc 540 ttatagggga ccctcctcac catgatcatc atgatgagtt ttgccttatg ccttgaatct 600 tgaggttaat aatcataaaa tccctgcttt ctaaattcgc atttttcctg gtgtaccttt 660 aatgtgaacc ttttggcatt cttctgcaat tttctgattg gagattgcat tttgacctag 720 tctgtaagtt tttctgtcag aagaggactt tcatcaactt tcatggaaag atgtttattg 780 catactgtaa agttaataaa gcaatttaaa agcagtctaa aaaaaaaaaa aaaaaaaaaa 840

<210> SEQ ID NO 6
<211> LENGTH: 8340
<212> TYPE: DNA
<213> ORGANISM: Homo sapiens

<400> SEQUENCE: 6 actaattttc tggagtttct gcccctgctc tgcgtcagcc ctcacgtcac ttcgccagca 60 gtagcagagg cggcggcggc ggctcccgga attgggttgg agcaggagcc tcgctggctg 120 cttcgctcgc gctctacgcg ctcagtcccc ggcggtagca ggagcctgga cccaggcgcc 180 gccggcgggc gtgaggcgcc ggagcccggc ctcgaggtgc ataccggacc cccattcgca 240 tctaacaagg aatctgcgcc ccagagagtc ccgggagcgc cgccggtcgg tgcccggcgc 300 gccgggccat gcagcgacgg ccgccgcgga gctccgagca gcggtagcgc ccccctgtaa 360 agcggttcgc tatgccgggg ccactgtgaa ccctgccgcc tgccggaaca ctcttcgctc 420 cggaccagct cagcctctga taagctggac tcggcacgcc cgcaacaagc accgaggagt 480 taagagagcc gcaagcgcag ggaaggcctc cccgcacggg tgggggaaag cggccggtgc 540 agcgcgggga caggcactcg ggctggcact ggctgctagg gatgtcgtcc tggataaggt 600 ggcatggacc cgccatggcg cggctctggg gcttctgctg gctggttgtg ggcttctgga 660 gggccgcttt cgcctgtccc acgtcctgca aatgcagtgc ctctcggatc tggtgcagcg 720 acccttctcc tggcatcgtg gcatttccga gattggagcc taacagtgta gatcctgaga 780 acatcaccga aattttcatc gcaaaccaga aaaggttaga aatcatcaac gaagatgatg 840 ttgaagctta tgtgggactg agaaatctga caattgtgga ttctggatta aaatttgtgg 900 ctcataaagc atttctgaaa aacagcaacc tgcagcacat caattttacc cgaaacaaac 960 tgacgagttt gtctaggaaa catttccgtc accttgactt gtctgaactg atcctggtgg 1020 gcaatccatt tacatgctcc tgtgacatta tgtggatcaa gactctccaa gaggctaaat 1080

```
ccagtccaga cactcaggat ttgtactgcc tgaatgaaag cagcaagaat attcccctgg   1140
caaacctgca gatacccaat tgtggtttgc catctgcaaa tctggccgca cctaacctca   1200
ctgtggagga aggaaagtct atcacattat cctgtagtgt ggcaggtgat ccggttccta   1260
atatgtattg ggatgttggt aacctggttt ccaaacatat gaatgaaaca agccacacac   1320
agggctcctt aaggataact aacatttcat ccgatgacag tgggaagcag atctcttgtg   1380
tggcggaaaa tcttgtagga gaagatcaag attctgtcaa cctcactgtg cattttgcac   1440
caactatcac atttctcgaa tctccaacct cagaccacca ctggtgcatt ccattcactg   1500
tgaaaggcaa ccccaaacca gcgcttcagt ggttctataa cggggcaata ttgaatgagt   1560
ccaaatacat ctgtactaaa atacatgtta ccaatcacac ggagtaccac ggctgcctcc   1620
agctggataa tcccactcac atgaacaatg gggactacac tctaatagcc aagaatgagt   1680
atgggaagga tgagaaacag atttctgctc acttcatggg ctggcctgga attgacgatg   1740
gtgcaaaccc aaattatcct gatgtaattt atgaagatta tggaactgca gcgaatgaca   1800
tcggggacac cacgaacaga agtaatgaaa tcccttccac agacgtcact gataaaaccg   1860
gtcgggaaca tctctcggtc tatgctgtgg tggtgattgc gtctgtggtg ggattttgcc   1920
ttttggtaat gctgtttctg cttaagttgg caagacactc caagtttggc atgaaagatt   1980
tctcatggtt tggatttggg aaagtaaaat caagacaagg tgttggccca gcctccgtta   2040
tcagcaatga tgatgactct gccagcccac tccatcacat ctccaatggg agtaacactc   2100
catcttcttc ggaaggtggc ccagatgctg tcattattgg aatgaccaag atccctgtca   2160
ttgaaaatcc ccagtacttt ggcatcacca acagtcagct caagccagac acatggccca   2220
gaggttcccc caagaccgcc tgataataat ttggtatttg gaggctcctg tgtcactgca   2280
ggaactaaag gaggctaaat ccatgcctga tggaggagaa gagttctatg gttatctgca   2340
aattctggcc agacaacatc ttgacgtcac tccttagctt ccataaccta gccaagcaag   2400
aagttgcctt tccaagacaa agcagtgtgc tctaatgact aacccctcaa agtactatgc   2460
cactttaact atagacccat ctcctcgatc aatcaggatg gcaagatgga gctgaggagc   2520
tcagcaacat caagtctgga gttggtcttt aactcaacta gctcgtttag acgtgtctga   2580
acaccacatc acctgacagc acggggtggt ttcccagtaa aatttacaaa ctcagctcaa   2640
gggcagctgt gttgctttcc tttccttgac tgctgagaaa ctttttgaca gggaacaatg   2700
gaaacacacc ttctgagctg aaacaaacaa acagaaacaa aacatactaa ccagcaaaat   2760
ccccaaatca tcaatcttgg gttctcttga agggcaggag tgtgttttat cttctcccgt   2820
cggagcaaac actatagatg tcctccctaa aattctgtct tccctagagc agccttgtaa   2880
attagctagg gtcctagggt tgaggcctaa atcaacttaa aattgtctct aaatatgtac   2940
ctggatgtgt ttgtacttgc agagcatgcc ctcttcatgt gcctagggct agtaactccc   3000
tgtggcagag gcatgtaaag tattctgact tttttttttt caacttaatt ccatttccaa   3060
tgaaatggat ttttaaaaat tttctccaga gtgtgccata cttctccagc tattatagtt   3120
aatgtgtgtg tatccttgtg tatatgtgtg tttgtgtgtg catatgtgtt ttcctagtgg   3180
ttacatgctt actaggcaat tatgtaaata agcacagatt cataggccag ctaggcctga   3240
ggaaagaaga cattataaag ggagggagta ttttaacatt agctaaagct atcacacaag   3300
gcacccattc tgctcccctc aacagccaca gcccacttcg tccttgtctt accaataagg   3360
ggaaaggctg gaggtgatat ttttcacaga accgcagagg ttttgaacat atttgcaaca   3420
```

-continued

```
ttactttgag tacacatgag caaaaattct gaattacatc caggacccca gaagctcatt   3480
agatcaaaga gtgcggggcc cctcagagtt accagagatt atctgcagac ttcagtgcaa   3540
tcgaatgacc atggtccatt ttgatggtca gaggtaggac tgaaaaacgg gtagaaacaa   3600
ttgctttagc gcttccttct gtactttgcc tattaatgtt ttgtctttca aaaatatatt   3660
ttctcctaat tgtttaattg gccaaataat ggctgctttg ggagttgttt gtatgccttg   3720
gaaggccatg gcctgcactt taaaaataag ctaagtccat tctgcccagc acgagcatta   3780
ggacagagaa tgcacttatt ttaggatcct taaaaattgc ttcttttatg gcacactggg   3840
ttgacgactc atctcgtggg agccttcatg gcacattgct gctgttctgc aggtcccaat   3900
acaattcctt ccccctctca gtgccacggc ccccccattg ctagctacaa caatttgata   3960
tcatattccc ttttcaactc caaaggagat gataagaagc tatcaaataa tgctttaaaa   4020
aagcaacttg agtttcttaa aagaaaggaa atgaatacat gctgcataat tacatttaaa   4080
atgtaagcca tgttattata agccgcactg agatgaagat ttgttagcaa accagtttca   4140
agcacactca cagtgaagta aaatcatgtt tttagcatct gaccattggg taatattatt   4200
ctttgttatc aaaagagaaa tatcacccaa gtatagtata cttagacctc ctagaggaaa   4260
cactccagtc ctaagcttgg tgtctgaaaa gaaaaacaaa aataaagatt atggatttag   4320
gtcagggaga cagagtgata ttctgaagac tgtgtttact ccctcatcat cggccaacca   4380
agatggagtt ctgcatcctg cacatatcag acatttcagt ccaatttcac caaagcatca   4440
gtgatgttct agaagcatcc cagcagatgg aggatcctaa tgtatttgtt ctgggtattt   4500
cccaaggccc agcctgactg gagtgtgtgt accaacagga tgaatccaat caagctacgc   4560
ccccattttg gtttcggatt ggccactctt gcatgtgcta gtagattgtg gaccaggacc   4620
agctgagcaa acacagttgc agagtagcct cctatgttgc taagaagctc ctgctaccca   4680
ggtgctttga acaattgagt gctccctctg gttaagtaga gatggcacca ccggagtttt   4740
tcttggatgt gaggctcaat cctttacggc agctattata acaaagtgaa ggttttctcc   4800
ctgggaaatg cagcttttct ctgtctttac taattctgcc agcctgtgag agtaaccacc   4860
gtagctgggc ttcttctcag attaattgtc atgccaggtc tccttcctgg ggagctgtga   4920
tgctgctctg aggttgattg ctgaggttgt agtgggtttt tgtttgtttt tgtttagttt   4980
ttcttgattg ttcttctttc tcttgaatgg caagagaaga aacactttct ctaacccacg   5040
gccaggaagg aaatggggag agagctactt cttagttcaa cctggttgcc acataaagga   5100
atctctctcc ttggactcag cccctaactg gaagcaagag ccactgccct ctgagactga   5160
gagagcagcc cgaggaggag atgaatccat tctgcccttt gtttgggttt gcttcctgtc   5220
agtgagagaa tgctgaggca gttcctgtta tgtgaaactt tcatttttaa aaccaggaca   5280
gtcctaaaca gactggaatg agttggtcaa tcccagttgg tataggccca atgatttttg   5340
ctagtaagat aggattgtct tcctcaccca aaatgccttc aagtgcccta aaatgggtat   5400
tttaaaataa gaataaataa tgtagattta gtagaaaacc tggaaaacat aagaaacaaa   5460
gatgaaacga aaagtcccat gtaattccac cagttagagt taaccactga tatcgtttgg   5520
atatatggct ttctagtctt gtggatatcc ttttaatctc ttgtaatata aagtctgacc   5580
atatgtgtcc ttgcatttgt ttgtactgga ctctgttaat atttctatag taatggctca   5640
ctttggggag attgtgctgc acagtgtgta ggaagcacat tgggtgtatt attcccagtt   5700
ttgtattttg tatttccttg gagatgtgca ggggttaaga gcgggggtct ggccatagct   5760
ggccacgtca gactctcata tggtaagtat cacagagcac atgaggcctg tgttatgcgc   5820
```

tggaaagact caggaaatga gaggctctct tgttctgaca aggcaggctg agagctctca 5880
tttagggtca tcactccaga taactccaaa tgcagtttat tgctcaactg aagcagatga 5940
tcactttttg cctccaagtt cttcacccta gctagctcct ttcaaagagc cgagtatgct 6000
ggatcttaaa gggccaaact agttacatct catacatttc ctgatgttta gggatgcctt 6060
cacttccatc aaggatacct tggctgtgca aggacctctg atagctggag tctccttttg 6120
gtcactccca gctttgctta aacttgatgg agtttgctgt ccagtgatcc ccggatcttt 6180
catcatgaaa gccttccttc ctctcctgat gtctcaggcc tctagaccta gactggggtt 6240
ctggcaagga ggcctctatc aatagtatga catccaataa tatgttagtg ttgatatttt 6300
gcacagtaat attaagttta agagattata aaaatgagtt caaatgaata agttcctgtg 6360
atgtaagaga ttagatatgt gtgatttcag aaccaaaggc agggggggaat cccagaaaga 6420
aaacaataat ataatcctag tttctatata ttatttttat tcattactgt atatgggtag 6480
agatcaatat tctttcttat gctgttacta ttaattaaca catttttaa ccatgccatt 6540
gaacttttgg gtgcattaaa gtggaaccca agctcctcat tagataataa tggcatttgg 6600
actgagtgcc atattcctaa atttccaata aagtggttga tatagagagg acaggataaa 6660
gccctatagt gtgcagttat atcaaaacag ctagtctcca ctttagggaa tgcctttact 6720
agagattaca tgaaatgtct gcttataaaa taagcagaga tggcaccact aagcagccac 6780
ctgaattgtt ttcctacagg aatgattact tttcagatcc atttatgttt tcatgctcaa 6840
tacttactcc ccttccctgc aacacccaaa gagtttactt ttgcaagtca tttggtcttc 6900
agtctactac tgaggaatag agaggcacta actgctttac ccaggatcag aactcatgtt 6960
cttaccttct attaatagag tacttgagcc agatggacta actggtctca cattttctct 7020
atcttggttt tacttccata aacatcaata tctttaccca catgattttt ccatcctccc 7080
atttttttcc atatgtatta gggttcagga actatgatgc taatgatcac atttcttcct 7140
agttcctaat ttcattagtg ccatttcctg atatctacag aaacaattat caatacatgt 7200
agctgcttga gccttattta gaaggctagc ctttcttttc caagtgctgt cagaatgtat 7260
acatttagtc tgtctttttc ccttttagga gtctttgttc tgggttgatg gcaaaattcc 7320
tctttttaca tgtgagattt ttgatttcac tgaattctac ctagattttt atggacattg 7380
gattttaaag aggaaaacac tcattttctt agtaagatat tggtgataca tagctatgcc 7440
attgatttcc atactcctga gctttgggga gggagacagt ggccaagtag caggcagaat 7500
aagatcatca ctcatgtcct gaatcaatca cactttcctt ctcggattgt gtatatgctc 7560
tgccacttcc tacatattac atcctgagtt tttaagtaaa gtggatctta gccagatttg 7620
agtctaatgg ctgattcatc ggcatagttc ttggcgttaa catctcagtg tcctctttag 7680
ttctctttga ggattcatgt cattgagggc ctttgtgcct ccacttgtct cagtatgagg 7740
aagaactttg gtgtgagggc ggagctatgt gaagggttgc tgggttgggg gattagttca 7800
tatggtcccc atgccatcta tttacttttg gagagagggg actttgagtg ggtgggtatg 7860
gatagatgtt cctcaaggaa accctgctgg ctaatgggca ctacatctgt gtattactgt 7920
gattctctct gtaagctccc catgtggcca aggacccccc tcctaccagg gcacttcctg 7980
ccacctcatt gcactggtct caaccattca gcctgctgct gctgcaccat gttgggctgc 8040
ggtaggatag ggaaggggtt ctgttgattg ctaaatgttg cctaacttta tttccctctc 8100
ccacatttca tgcaagggag cggacctaac acatgacttg cattctcttc ctatgttcag 8160

```
aaactccagg gcttgcccac gtgtatgtat gagtgaccaa tggagcttgg aattctttat   8220

ctatatgatc tgtccgaaaa tgagatcttt tgtactggaa tttgtgatgt agttgatcat   8280

tcagagccaa acgcatatac caataaagac aagactgtca tataaaaaaa aaaaaaaaaa   8340
```

<210> SEQ ID NO 7
<211> LENGTH: 8292
<212> TYPE: DNA
<213> ORGANISM: Homo sapiens

<400> SEQUENCE: 7

```
actaattttc tggagtttct gcccctgctc tgcgtcagcc ctcacgtcac ttcgccagca     60

gtagcagagg cggcggcggc ggctcccgga attgggttgg agcaggagcc tcgctggctg    120

cttcgctcgc gctctacgcg ctcagtcccc ggcggtagca ggagcctgga cccaggcgcc    180

gccggcgggc gtgaggcgcc ggagcccggc ctcgaggtgc ataccggacc cccattcgca    240

tctaacaagg aatctgcgcc ccagagagtc ccgggagcgc cgccggtcgg tgcccggcgc    300

gccgggccat gcagcgacgg ccgccgcgga gctccgagca gcggtagcgc ccccctgtaa    360

agcggttcgc tatgccgggg ccactgtgaa ccctgccgcc tgccggaaca ctcttcgctc    420

cggaccagct cagcctctga taagctggac tcggcacgcc cgcaacaagc accgaggagt    480

taagagagcc gcaagcgcag ggaaggcctc cccgcacggg tgggggaaag cggccggtgc    540

agcgcgggga caggcactcg ggctggcact ggctgctagg gatgtcgtcc tggataaggt    600

ggcatggacc cgccatggcg cggctctggg gcttctgctg gctggttgtg ggcttctgga    660

gggccgcttt cgcctgtccc acgtcctgca aatgcagtgc ctctcggatc tggtgcagcg    720

acccttctcc tggcatcgtg gcatttccga gattggagcc taacagtgta gatcctgaga    780

acatcaccga aattttcatc gcaaaccaga aaaggttaga aatcatcaac gaagatgatg    840

ttgaagctta tgtgggactg agaaatctga caattgtgga ttctggatta aaatttgtgg    900

ctcataaagc atttctgaaa aacagcaacc tgcagcacat caattttacc cgaaacaaac    960

tgacgagttt gtctaggaaa catttccgtc accttgactt gtctgaactg atcctggtgg   1020

gcaatccatt tacatgctcc tgtgacatta tgtggatcaa gactctccaa gaggctaaat   1080

ccagtccaga cactcaggat ttgtactgcc tgaatgaaag cagcaagaat attcccctgg   1140

caaacctgca gatacccaat tgtggtttgc catctgcaaa tctggccgca cctaacctca   1200

ctgtggagga aggaaagtct atcacattat cctgtagtgt ggcaggtgat ccggttccta   1260

atatgtattg ggatgttggt aacctggttt ccaaacatat gaatgaaaca agccacacac   1320

agggctcctt aaggataact aacatttcat ccgatgacag tgggaagcag atctcttgtg   1380

tggcggaaaa tcttgtagga gaagatcaag attctgtcaa cctcactgtg cattttgcac   1440

caactatcac atttctcgaa tctccaacct cagaccacca ctggtgcatt ccattcactg   1500

tgaaaggcaa ccccaaacca gcgcttcagt ggttctataa cggggcaata ttgaatgagt   1560

ccaaatacat ctgtactaaa atacatgtta ccaatcacac ggagtaccac ggctgcctcc   1620

agctggataa tcccactcac atgaacaatg gggactacac tctaatagcc aagaatgagt   1680

atgggaagga tgagaaacag atttctgctc acttcatggg ctggcctgga attgacgatg   1740

gtgcaaaccc aaattatcct gatgtaattt atgaagatta tggaactgca gcgaatgaca   1800

tcggggacac cacgaacaga agtaatgaaa tcccttccac agacgtcact gataaaaccg   1860

gtcgggaaca tctctcggtc tatgctgtgg tggtgattgc gtctgtggtg ggattttgcc   1920

ttttggtaat gctgtttctg cttaagttgg caagacactc caagtttggc atgaaaggcc   1980
```

```
cagcctccgt tatcagcaat gatgatgact ctgccagccc actccatcac atctccaatg   2040
ggagtaacac tccatcttct tcggaaggtg gcccagatgc tgtcattatt ggaatgacca   2100
agatccctgt cattgaaaat ccccagtact ttggcatcac caacagtcag ctcaagccag   2160
acacatggcc cagaggttcc cccaagaccg cctgataata atttggtatt tggaggctcc   2220
tgtgtcactg caggaactaa aggaggctaa atccatgcct gatggaggag aagagttcta   2280
tggttatctg caaattctgg ccagacaaca tcttgacgtc actccttagc ttccataacc   2340
tagccaagca agaagttgcc tttccaagac aaagcagtgt gctctaatga ctaacccctc   2400
aaagtactat gccactttaa ctatagaccc atctcctcga tcaatcagga tggcaagatg   2460
gagctgagga gctcagcaac atcaagtctg gagttggtct ttaactcaac tagctcgttt   2520
agacgtgtct gaacaccaca tcacctgaca gcacggggtg gtttcccagt aaaatttaca   2580
aactcagctc aagggcagct gtgttgcttt cctttccttg actgctgaga aactttttga   2640
cagggaacaa tggaaacaca ccttctgagc tgaaacaaac aaacagaaac aaaacatact   2700
aaccagcaaa atccccaaat catcaatctt gggttctctt gaagggcagg agtgtgtttt   2760
atcttctccc gtcggagcaa acactataga tgtcctccct aaaattctgt cttccctaga   2820
gcagccttgt aaattagcta gggtcctagg gttgaggcct aaatcaactt aaaattgtct   2880
ctaaatatgt acctggatgt gtttgtactt gcagagcatg ccctcttcat gtgcctaggg   2940
ctagtaactc cctgtggcag aggcatgtaa agtattctga ctttttttt ttcaacttaa   3000
ttccatttcc aatgaaatgg atttttaaaa attttctcca gagtgtgcca tacttctcca   3060
gctattatag ttaatgtgtg tgtatccttg tgtatatgtg tgtttgtgtg tgcatatgtg   3120
ttttcctagt ggttacatgc ttactaggca attatgtaaa taagcacaga ttcataggcc   3180
agctaggcct gaggaaagaa gacattataa agggagggag tattttaaca ttagctaaag   3240
ctatcacaca aggcacccat tctgctcccc tcaacagcca cagcccactt cgtccttgtc   3300
ttaccaataa ggggaaaggc tggaggtgat atttttcaca gaaccgcaga ggttttgaac   3360
atatttgcaa cattactttg agtacacatg agcaaaaatt ctgaattaca tccaggaccc   3420
cagaagctca ttagatcaaa gagtgcgggg cccctcagag ttaccagaga ttatctgcag   3480
acttcagtgc aatcgaatga ccatggtcca ttttgatggt cagaggtagg actgaaaaac   3540
gggtagaaac aattgcttta gcgcttcctt ctgtactttg cctattaatg ttttgtcttt   3600
caaaaatata ttttctccta attgtttaat tggccaaata atggctgctt tgggagttgt   3660
ttgtatgcct tggaaggcca tggcctgcac tttaaaaata agctaagtcc attctgccca   3720
gcacgagcat taggacagag aatgcactta ttttaggatc cttaaaaatt gcttctttta   3780
tggcacactg ggttgacgac tcatctcgtg ggagccttca tggcacattg ctgctgttct   3840
gcaggtccca atacaattcc ttccccctct cagtgccacg gcccccccat tgctagctac   3900
aacaatttga tatcatattc ccttttcaac tccaaaggag atgataagaa gctatcaaat   3960
aatgctttaa aaaagcaact tgagtttctt aaaagaaagg aaatgaatac atgctgcata   4020
attacattta aaatgtaagc catgttatta taagccgcac tgagatgaag atttgttagc   4080
aaaccagttt caagcacact cacagtgaag taaaatcatg tttttagcat ctgaccattg   4140
ggtaatatta ttctttgtta tcaaaagaga aatatcaccc aagtatagta tacttagacc   4200
tcctagagga aacactccag tcctaagctt ggtgtctgaa aagaaaaaca aaaataaaga   4260
ttatggattt aggtcaggga gacagagtga tattctgaag actgtgttta ctccctcatc   4320
```

```
atcggccaac caagatggag ttctgcatcc tgcacatatc agacatttca gtccaatttc   4380
accaaagcat cagtgatgtt ctagaagcat cccagcagat ggaggatcct aatgtatttg   4440
ttctgggtat ttcccaaggc ccagcctgac tggagtgtgt gtaccaacag gatgaatcca   4500
atcaagctac gccccccattt tggtttcgga ttggccactc ttgcatgtgc tagtagattg   4560
tggaccagga ccagctgagc aaacacagtt gcagagtagc ctcctatgtt gctaagaagc   4620
tcctgctacc caggtgcttt gaacaattga gtgctccctc tggttaagta gagatggcac   4680
caccggagtt tttcttggat gtgaggctca atcctttacg gcagctatta taacaaagtg   4740
aaggttttct ccctgggaaa tgcagctttt ctctgtcttt actaattctg ccagcctgtg   4800
agagtaacca ccgtagctgg gcttcttctc agattaattg tcatgccagg tctccttcct   4860
ggggagctgt gatgctgctc tgaggttgat tgctgaggtt gtagtgggtt tttgtttgtt   4920
tttgtttagt ttttcttgat tgttcttctt tctcttgaat ggcaagagaa gaaacacttt   4980
ctctaaccca cggccaggaa ggaaatgggg agagagctac ttcttagttc aacctggttg   5040
ccacataaag gaatctctct ccttggactc agcccctaac tggaagcaag agccactgcc   5100
ctctgagact gagagagcag cccgaggagg agatgaatcc attctgccct ttgtttgggt   5160
ttgcttcctg tcagtgagag aatgctgagg cagttcctgt tatgtgaaac tttcattttt   5220
aaaaccagga cagtcctaaa cagactggaa tgagttggtc aatcccagtt ggtataggcc   5280
caatgatttt tgctagtaag ataggattgt cttcctcacc caaaatgcct tcaagtgccc   5340
taaaatgggt attttaaaat aagaataaat aatgtagatt tagtagaaaa cctggaaaac   5400
ataagaaaca aagatgaaac gaaaagtccc atgtaattcc accagttaga gttaaccact   5460
gatatcgttt ggatatatgg ctttctagtc ttgtggatat ccttttaatc tcttgtaata   5520
taaagtctga ccatatgtgt ccttgcattt gtttgtactg gactctgtta atatttctat   5580
agtaatggct cactttgggg agattgtgct gcacagtgtg taggaagcac attgggtgta   5640
ttattcccag ttttgtattt tgtatttcct tggagatgtg caggggttaa gagcgggggt   5700
ctggccatag ctggccacgt cagactctca tatggtaagt atcacagagc acatgaggcc   5760
tgtgttatgc gctggaaaga ctcaggaaat gagaggctct cttgttctga caaggcaggc   5820
tgagagctct catttagggt catcactcca gataactcca aatgcagttt attgctcaac   5880
tgaagcagat gatcactttt tgcctccaag ttcttcaccc tagctagctc ctttcaaaga   5940
gccgagtatg ctggatctta aagggccaaa ctagttacat ctcatacatt tcctgatgtt   6000
tagggatgcc ttcacttcca tcaaggatac cttggctgtg caaggacctc tgatagctgg   6060
agtctccttt tggtcactcc cagctttgct taaacttgat ggagtttgct gtccagtgat   6120
ccccggatct ttcatcatga aagccttcct tcctctcctg atgtctcagg cctctagacc   6180
tagactgggg ttctggcaag gaggcctcta tcaatagtat gacatccaat aatatgttag   6240
tgttgatatt ttgcacagta atattaagtt taagagatta taaaaatgag ttcaaatgaa   6300
taagttcctg tgatgtaaga gattagatat gtgtgatttc agaaccaaag gcagggggga   6360
atcccagaaa gaaaacaata atataatcct agtttctata tattattttt attcattact   6420
gtatatgggt agagatcaat attctttctt atgctgttac tattaattaa cacatttttt   6480
aaccatgcca ttgaactttt gggtgcatta aagtggaacc caagctcctc attagataat   6540
aatggcattt ggactgagtg ccatattcct aaatttccaa taaagtggtt gatatagaga   6600
ggacaggata aagccctata gtgtgcagtt atatcaaaac agctagtctc cactttaggg   6660
aatgccttta ctagagatta catgaaatgt ctgcttataa aataagcaga gatggcacca   6720
```

```
ctaagcagcc acctgaattg ttttcctaca ggaatgatta cttttcagat ccatttatgt   6780
tttcatgctc aatacttact ccccttccct gcaacaccca aagagtttac ttttgcaagt   6840
catttggtct tcagtctact actgaggaat agagaggcac taactgcttt acccaggatc   6900
agaactcatg ttcttacctt ctattaatag agtacttgag ccagatggac taactggtct   6960
cacattttct ctatcttggt tttacttcca taaacatcaa tatctttacc cacatgattt   7020
ttccatcctc ccatttttt ccatatgtat tagggttcag gaactatgat gctaatgatc   7080
acatttcttc ctagttccta atttcattag tgccatttcc tgatatctac agaaacaatt   7140
atcaatacat gtagctgctt gagccttatt tagaaggcta gcctttcttt tccaagtgct   7200
gtcagaatgt atacatttag tctgtctttt tccctttag gagtctttgt tctgggttga   7260
tggcaaaatt cctcttttta catgtgagat ttttgatttc actgaattct acctagattt   7320
ttatggacat tggattttaa agaggaaaac actcattttc ttagtaagat attggtgata   7380
catagctatg ccattgattt ccatactcct gagctttggg gagggagaca gtggccaagt   7440
agcaggcaga ataagatcat cactcatgtc ctgaatcaat cacactttcc ttctcggatt   7500
gtgtatatgc tctgccactt cctacatatt acatcctgag tttttaagta aagtggatct   7560
tagccagatt tgagtctaat ggctgattca tcggcatagt tcttggcgtt aacatctcag   7620
tgtcctcttt agttctcttt gaggattcat gtcattgagg gcctttgtgc ctccacttgt   7680
ctcagtatga ggaagaactt tggtgtgagg gcggagctat gtgaagggtt gctgggttgg   7740
gggattagtt catatggtcc ccatgccatc tatttacttt tggagagagg ggactttgag   7800
tgggtgggta tggatagatg ttcctcaagg aaaccctgct ggctaatggg cactacatct   7860
gtgtattact gtgattctct ctgtaagctc cccatgtggc caaggacccc cctcctacca   7920
gggcacttcc tgccacctca ttgcactggt ctcaaccatt cagcctgctg ctgctgcacc   7980
atgttgggct gcggtaggat agggaagggg ttctgttgat tgctaaatgt tgcctaactt   8040
tatttccctc tcccacattt catgcaaggg agcggaccta acacatgact tgcattctct   8100
tcctatgttc agaaactcca gggcttgccc acgtgtatgt atgagtgacc aatggagctt   8160
ggaattcttt atctatatga tctgtccgaa aatgagatct tttgtactgg aatttgtgat   8220
gtagttgatc attcagagcc aaacgcatat accaataaag acaagactgt catataaaaa   8280
aaaaaaaaaa aa                                                       8292
```

<210> SEQ ID NO 8
<211> LENGTH: 549
<212> TYPE: DNA
<213> ORGANISM: Homo sapiens

<400> SEQUENCE: 8

```
acctccgcca ggaactgcag gcccacctgt ctgcaaccca gctgaggcca tgccctcccc     60
agggaccgtc tgcagcctcc tgctcctcgg catgctctgg ctggacttgg ccatggcagg    120
ctccagcttc ctgagccctg aacaccagag agtccagaga aaggagtcga agaagccacc    180
agccaagctg cagccccgag ctctagcagg ctggctccgc ccggaagatg gaggtcaagc    240
agaaggggca gaggatgaac tggaagtccg gttcaacgcc ccctttgatg ttggaatcaa    300
gctgtcaggg gttcagtacc agcagcacag ccaggccctg gggaagtttc ttcaggacat    360
cctctgggaa gaggccaaag aggccccagc cgacaagtga tcgcccacaa gccttactca    420
cctctctcta agtttagaag cgctcatctg gcttttcgct tgcttctgca gcaactccca    480
```

cgactgttgt acaagctcag gaggcgaata aatgttcaaa ctgtaaaaaa aaaaaaaaaa 540 aaaaaaaaa 549

<210> SEQ ID NO 9
<211> LENGTH: 501
<212> TYPE: DNA
<213> ORGANISM: Homo sapiens

<400> SEQUENCE: 9 agttccccaa agataacaca gctttgcaca gtggatgttt acttgctggt ggtcttatct 60 aagatcaaca ttggcagctg tgcccggaga ggcctccagg gtccagcaga gaaaggagtc 120 gaagaagcca ccagccaagc tgcagccccg agctctagca ggctggctcc gcccggaaga 180 tggaggtcaa gcagaagggg cagaggatga actggaagtc cggttcaacg cccccttttga 240 tgttggaatc aagctgtcag gggttcagta ccagcagcac agccaggccc tggggaagtt 300 tcttcaggac atcctctggg aagaggccaa agaggcccca gccgacaagt gatcgcccac 360 aagccttact cacctctctc taagtttaga agcgctcatc tggcttttcg cttgcttctg 420 cagcaactcc cacgactgtt gtacaagctc aggaggcgaa taaatgttca aactgtaaaa 480 aaaaaaaaaa aaaaaaaaaa a 501

<210> SEQ ID NO 10
<211> LENGTH: 498
<212> TYPE: DNA
<213> ORGANISM: Homo sapiens

<400> SEQUENCE: 10 agttccccaa agataacaca gctttgcaca gtggatgttt acttgctggt ggtcttatct 60 aagatcaaca ttggcagctg tgcccggaga ggcctccagg gtccagagaa aggagtcgaa 120 gaagccacca gccaagctgc agccccgagc tctagcaggc tggctccgcc cggaagatgg 180 aggtcaagca gaaggggcag aggatgaact ggaagtccgg ttcaacgccc cctttgatgt 240 tggaatcaag ctgtcagggg ttcagtacca gcagcacagc caggccctgg ggaagtttct 300 tcaggacatc ctctgggaag aggccaaaga ggccccagcc gacaagtgat cgcccacaag 360 ccttactcac ctctctctaa gtttagaagc gctcatctgg cttttcgctt gcttctgcag 420 caactcccac gactgttgta caagctcagg aggcgaataa atgttcaaac tgtaaaaaaa 480 aaaaaaaaaa aaaaaaaa 498

<210> SEQ ID NO 11
<211> LENGTH: 384
<212> TYPE: DNA
<213> ORGANISM: Homo sapiens

<400> SEQUENCE: 11 agttccccaa agataacaca gctttgcaca gtggatgttt acttgctggt ggtcttatct 60 aagatcaaca ttggcagctg tgcccggaga ggcctccagg gtccagttca acgccccctt 120 tgatgttgga atcaagctgt caggggttca gtaccagcag cacagccagg ccctggggaa 180 gtttcttcag gacatcctct gggaagaggc caaagaggcc ccagccgaca agtgatcgcc 240 cacaagcctt actcacctct ctctaagttt agaagcgctc atctggcttt tcgcttgctt 300 ctgcagcaac tcccacgact gttgtacaag ctcaggaggc gaataaatgt tcaaactgta 360 aaaaaaaaaa aaaaaaaaaa aaaa 384

<210> SEQ ID NO 12
<211> LENGTH: 1939
<212> TYPE: DNA
<213> ORGANISM: Homo sapiens

<400> SEQUENCE: 12 agtttggacg gctgcttccc accagcaaag accacgactg gagagccgag ccggaggcag 60 ctgggaaaca tgaagagcgt cttgctgctg accacgctcc tcgtgcctgc acacctggtg 120 gccgcctgga gcaataatta tgcggtggac tgccctcaac actgtgacag cagtgagtgc 180 aaaagcagcc cgcgctgcaa gaggacagtg ctcgacgact gtggctgctg ccgagtgtgc 240 gctgcagggc ggggagaaac ttgctaccgc acagtctcag gcatggatgg catgaagtgt 300 ggcccggggc tgaggtgtca gccttctaat ggggaggatc cttttggtga agagtttggt 360 atctgcaaag agcatgacat ggcatctgga gatggcaata ttgtgagaga agaagttgtg 420 aaagagaatg ctgccgggtc tcccgtaatg aggaaatggt taaatccacg ctgatcccgg 480 ctgtgatttc tgagagaagg ctctattttc gtgattgttc aacacacagc caacatttta 540 ggaactttct agattatagc ataaggacat gtaatttttg aagaccaaat gtgatgcatg 600 gtggatccag aaaacaaaaa gtaggatact tacaatccat aacatccata tgactgaaca 660 cttgtatgtg tttgttaaat attcgaatgc atgtagattt gttaaatgtg tgtgtatagt 720 aacactgaag aactaaaaat gcaatttagg taatcttacg tggagacagg tcaaccaaag 780 agggagctag gcaaagctga agaccgcagt gagtcaaatt agttctttga ctttgatgta 840 cattaatgtt gggatatgga atgaagactt aagagcagga gaagatgggg agggggtggg 900 agtgggaaat aaaatattta gcccttcctt ggtaggtagc ttctctagaa tttaattgtg 960 ctttttttt tttttttggc tttgggaaaa gtcaaaataa aacaaccaga aaacccctga 1020 aggaagtaag atgtttgaag cttatggaaa tttgagtaac aaacagcttt gaactgagag 1080 caatttcaaa aggctgctga tgtagttccc gggttacctg tatctgaagg acggttctgg 1140 ggcataggaa acacatacac ttccataaat agctttaacg tatgccacct cagagataaa 1200 tctaagaagt attttaccca ctggtggttt gtgtgtgtat gaaggtaaat atttatatat 1260 ttttataaat aaatgtgtta gtgcaagtca tcttccctac ccatatttat catcctcttg 1320 aggaaagaaa tctagtatta tttgttgaaa atggttagaa taaaactatg actctataag 1380 gttttcaaac atctgaggca tgataaattt attatccata attatagtaa taataacctt 1440 aataagcata agaaaaacag agtcactctg gatttcaaaa atgtcaaaaa atgagcaaca 1500 gagggtcctt atttaaacat aagtgctgtg acttaggtga attttcaatt taaggtagaa 1560 aataagtttt taggaggttt gtaaaagaag aatcaatttt cagcagaaaa catgtcaact 1620 ttaaaatata gtttattttc atattttttt cttttaaact tggttgataa gtggaattag 1680 gagtatattt gaaagaatct tagcacaaac aggactgttg tactagatgt tcttaggaaa 1740 tatctcagaa gtattttatt tgaagtgaag aacttattta agaattattt cagtatttac 1800 ctgtatttta ttcttgaagt tggccaacag agttgtgaat gtgtgtggga aggcctttga 1860 atgtaaagct gcataagctg ttaggttttg ttttaaaagg acatgtttat tattgttcaa 1920 taaaaaagaa caagataca 1939

<210> SEQ ID NO 13
<211> LENGTH: 882
<212> TYPE: DNA
<213> ORGANISM: Homo sapiens

<400> SEQUENCE: 13

```
cacccttttcc agatacacac ccgtttagtg cgagaaatgg agcggttggg gagaggatct     60
cccgaggggg ctggattgag aatgggtacc atttgagatc tcctaggagg ccggccatcg    120
ggcaatgtct gatggagtcc agccggtgga ggagactgaa aggaaacagc ctgcttcctg    180
caggtccgcg ggagggaggt ctttaagtgc gtttgtgcag ccgatttcaa ggctaagaga    240
gaaagactgc ctctgatccc tgaaggaaga aaaaaaaaaa aaaaacagga aaaaaactca    300
acatggaaaa tgtccccaag gaaaacaaag ttgtggagaa ggccccagtg cagaatgaag    360
cccccgcttt aggaggtggt gaataccagg agcctggagg aaatgttaaa ggggtttggg    420
ctccacctgc cccgggtttt ggagaggatg tgcccaatag gcttgtcgat aacattgata    480
tgatagatgg agatggagat gatatggaac ggttcatgga ggagatgaga gagctaagga    540
ggaaaattag ggaacttcag ttgaggtaca gtctgcgcat tcttataggg gaccctcctc    600
accatgatca tcatgatgag ttttgcctta tgccttgaat cttgaggtta ataatcataa    660
aatccctgct ttctaaattc gcatttttcc tggtgtacct ttaatgtgaa ccttttggca    720
ttcttctgca attttctgat tggagattgc attttgacct agtctgtaag tttttctgtc    780
agaagaggac tttcatcaac tttcatggaa agatgtttat tgcatactgt aaagttaata    840
aagcaattta aaagcagtct aaaaaaaaaa aaaaaaaaaa aa                       882
```

<210> SEQ ID NO 14
<211> LENGTH: 1278
<212> TYPE: DNA
<213> ORGANISM: Homo sapiens

<400> SEQUENCE: 14

```
ccattggcct gtagattcac ctcccctggg cagggcccca ggacccagga taatatctgt     60
gcctcctgcc cagaaccctc caagcagaca caatggtaag aatggtgcct gtcctgctgt    120
ctctgctgct gcttctgggt cctgctgtcc cccaggagaa ccaagatggt cgttactctc    180
tgacctatat ctacactggg ctgtccaagc atgttgaaga cgtccccgcg tttcaggccc    240
ttggctcact caatgacctc cagttcttta gatacaacag taaagacagg aagtctcagc    300
ccatgggact ctggagacag gtggaaggaa tggaggattg gaagcaggac agccaacttc    360
agaaggccag ggaggacatc tttatggaga ccctgaaaga catcgtggag tattacaacg    420
acagtaacgg gtctcacgta ttgcagggaa ggtttggttg tgagatcgag aataacagaa    480
gcagcggagc attctggaaa tattactatg atggaaagga ctacattgaa ttcaacaaag    540
aaatcccagc ctgggtcccc ttcgacccag cagcccagat aaccaagcag aagtgggagg    600
cagaaccagt ctacgtgcag cgggccaagg cttacctgga ggaggagtgc cctgcgactc    660
tgcggaaata cctgaaatac agcaaaaata tcctggaccg gcaagatcct ccctctgtgg    720
tggtcaccag ccaccaggcc ccaggagaaa agaagaaact gaagtgcctg gcctacgact    780
tctacccagg gaaaattgat gtgcactgga ctcgggccgg cgaggtgcag gagcctgagt    840
tacggggaga tgttcttcac aatggaaatg gcacttacca gtcctgggtg gtggtggcag    900
tgcccccgca ggacacagcc ccctactcct gccacgtgca gcacagcagc ctggcccagc    960
ccctcgtggt gccctgggag gccagctagg aagcaagggt tggaggcaat gtgggatctc   1020
agacccagta gctgcccttc ctgcctgatg tgggagctga accacagaaa tcacagtcaa   1080
tggatccaca aggcctgagg agcagtgtgg ggggacagac aggaggtgga tttggagacc   1140
gaagactggg atgcctgtct tgagtagact tggacccaaa aaatcatctc accttgagcc   1200
```

```
cacccccacc ccattgtcta atctgtagaa gctaataaat aatcatccct ccttgcctag   1260

cataaaaaaa aaaaaaaa                                                 1278


<210> SEQ ID NO 15
<211> LENGTH: 1801
<212> TYPE: DNA
<213> ORGANISM: Homo sapiens

<400> SEQUENCE: 15

gggttatatg atctctttgg ctttagggaa ttactccata ccagctctga gatttccagc     60

tcagcgatgc ccccaggtcc ctgggagagc tgcttctggg tgggggggcct cattttgtgg    120

ctcagcgttg gaagttcagg ggatgcacct cctaccccac agccaaagtg cgctgacttc    180

cagagcgcca acctttttga aggcaccgat ctcaaagtcc agtttctcct ctttgtccct    240

tcgaatccta gctgtgggca gctagtagaa ggaagcagtg acctccaaaa ctctgggttc    300

aatgccactc tgggaaccaa actaattatc catggattca gggttttagg aacaaagcct    360

tcctggattg acacatttat tagaaccctt ctgcgtgcaa cgaatgctaa tgtgattgcc    420

gtggactgga tttatgggtc tacaggagtc tacttctcag ctgtgaaaaa tgtgctgggt    480

gtgtcggaat cctcaatcca catcattggt gttagcctgg gggcccacgt tgggggcatg    540

gtgggacagc tcttcggagg ccagctggga cagatcacag gcctggaccc cgctggacct    600

gagtacacca gggccagtgt ggaagagcgc ttggatgctg gagatgccct cttcgtggaa    660

gccatccaca cagacaccga caatttgggt attcggattc ccgttggaca tgtggactac    720

ttcgtcaacg gaggccaaga ccaacctggc tgccccacct tcttttacgc aggttatagt    780

tatctgatct gtgatcacat gagggctgtg cacctctaca tcagcgccct ggagaattcc    840

tgtccactga tggcctttcc ctgtgccagc tacaaggcct tccttgctgg acgctgtctg    900

gattgcttta accctttttct gctttcctgc ccaaggatag gactggtgga acaaggtggt    960

gtcaagatag agccgctccc caaggaagtg aaagtctacc tcctgactac ttccagtgct   1020

ccgtactgca tgcatcacag cctcgtggag tttcacttga aggaactgag aaacaaggac   1080

accaacatcg aggttacctt ccttagcagt aacatcacct cttcatctaa gatcaccata   1140

cctaagcagc aacgctatgg gaaaggaatc atagcccatg ccaccccaca atgccagata   1200

aaccaagtga aattcaagtt tcagtcttcc aaccgagttt ggaaaaaaga ccggactacc   1260

attattggga agttctgcac tgccctttttg cctgtcaatg acagagaaaa gatggtctgc   1320

ttacctgaac cagtgaactt acaagcaagt gtgactgttt cctgtgacct gaagatagcc   1380

tgtgtgtagt ttaacctggg caggacacat ctccctgcat tttttttttt tttttgagag   1440

agaggtgtga tgagggatgt gtgtgtgcag cttattgtag accattacta ctaaggagaa   1500

aagcaaagct ctttcttatt ttcctcataa tcagctaccc tggaggggag ggagaactca   1560

ttttacagaa cttggtttcc tttgccgatc ttatgtacat acccatttta gctttcccat   1620

gcatacttaa ctgcacttgc tttatctcct tgggcattcg tacttaggat tcaatagaaa   1680

catgtacagg gtaaacaatt ttttaaaaat aaaacttcat ggagtatctg aaaaaaaaaa   1740

aaaaaaaaaa aaaaaaaaaa aaaaaaaaaa aaaaaaaaaa aaaaaaaaaa aaaaaaaaaa   1800

a                                                                   1801


<210> SEQ ID NO 16
<211> LENGTH: 1647
<212> TYPE: DNA
```

<213> ORGANISM: Homo sapiens

<400> SEQUENCE: 16 gggttatatg atctctttgg ctttagggaa ttactccata ccagctctga gatttccagc 60 tcagcgatgc ccccaggtcc ctgggagagc tgcttctggg tgggggggcct cattttgtgg 120 ctcagcgttg gaagttcagg gttttaggaa caaagccttc ctggattgac acatttatta 180 gaacccttct gcgtgcaacg aatgctaatg tgattgccgt ggactggatt tatgggtcta 240 caggagtcta cttctcagct gtgaaaaatg tgattaagtt gagcctcgag atctcccttt 300 tcctcaataa actcctggtg ctgggtgtgt cggaatcctc aatccacatc attggtgtta 360 gcctgggggc ccacgttggg ggcatggtgg gacagctctt cggaggccag ctgggacaga 420 tcacaggcct ggaccccgct ggacctgagt acaccagggc cagtgtggaa gagcgcttgg 480 atgctggaga tgccctcttc gtggaagcca tccacacaga caccgacaat ttgggtattc 540 ggattcccgt tggacatgtg gactacttcg tcaacggagg ccaagaccaa cctggctgcc 600 ccaccttctt ttacgcaggt tatagttatc tgatctgtga tcacatgagg gctgtgcacc 660 tctacatcag cgccctggag aattcctgtc cactgatggc ctttccctgt gccagctaca 720 aggccttcct tgctggacgc tgtctggatt gctttaaccc ttttctgctt tcctgcccaa 780 ggataggact ggtggaacaa ggtggtgtca agatagagcc gctccccaag gaagtgaaag 840 tctacctcct gactacttcc agtgctccgt actgcatgca tcacagcctc gtggagtttc 900 acttgaagga actgagaaac aaggacacca acatcgaggt taccttcctt agcagtaaca 960 tcacctcttc atctaagatc accataccta agcagcaacg ctatgggaaa ggaatcatag 1020 cccatgccac cccacaatgc cagataaacc aagtgaaatt caagtttcag tcttccaacc 1080 gagtttggaa aaaagaccgg actaccatta ttgggaagtt ctgcactgcc cttttgcctg 1140 tcaatgacag agaaaagatg gtctgcttac ctgaaccagt gaacttacaa gcaagtgtga 1200 ctgtttcctg tgacctgaag atagcctgtg tgtagtttaa cctgggcagg acacatctcc 1260 ctgcattttt tttttttttt tgagagagag gtgtgatgag ggatgtgtgt gtgcagctta 1320 ttgtagacca ttactactaa ggagaaaagc aaagctcttt cttattttcc tcataatcag 1380 ctaccctgga ggggagggag aactcatttt acagaacttg gtttcctttg ccgatcttat 1440 gtacataccc attttagctt tcccatgcat acttaactgc acttgcttta tctccttggg 1500 cattcgtact taggattcaa tagaaacatg tacagggtaa acaatttttt aaaaataaaa 1560 cttcatggag tatctgaaaa aaaaaaaaaa aaaaaaaaaa aaaaaaaaaa aaaaaaaaaa 1620 aaaaaaaaaa aaaaaaaaaa aaaaaaa 1647

<210> SEQ ID NO 17
<211> LENGTH: 5622
<212> TYPE: DNA
<213> ORGANISM: Homo sapiens

<400> SEQUENCE: 17 ggcacgtgga ctccctttaa tccagtgact gtcaggtcga tcatatgccg aggacgatga 60 tcccgccggg ggagtgcacg tacgcgggcc ggaagcggag gaggcccctg cagaaacaga 120 ggcccgccgt gggggcagag aagtccaacc cctccaagcg acaccgggac cgcctcaacg 180 ccgagttgga ccacctggcc agcctgctgc cgttcccgcc tgacatcatc tccaagctgg 240 acaagctttc tgtcctgcgc ctcagtgtca gttacctccg ggtgaagagc ttcttccaag 300 tcgtgcagga gcagagctca cggcagcctg cggccggcgc cccctcgccc ggagacagct 360 gtcctcttgc agggtctgcc gtgctggagg gaaggctgct gttggagtct cttaatggct 420
ttgctctggt cgtgagtgca gaagggacga tattttatgc atcagcaacg atcgtggact 480
atctgggctt ccatcagacg gatgtaatgc accagaacat ttatgactac atccacgtgg 540
acgaccgcca ggacttctgc cggcagctcc actgggccat ggaccctccc caggtggtgt 600
ttgggcagcc cccgcccttg gagacaggag atgatgctat cctggggagg ctgctcaggg 660
cccaggagtg gggcacaggc acgcccaccg agtactcggc cttcctgacc cgctgcttca 720
tctgccgtgt gcgctgcctg ctggacagca cctcgggctt cctgacgatg cagtttcaag 780
gaaaactaaa attcctgttt ggacagaaga agaaggcgcc gtcaggagcc atgctcccgc 840
cgcggctgtc gctgttctgc attgcggcac ccgttctcct cccctccgca gcggagatga 900
aaatgaggag cgcgctcctg agggcaaaac ccagagcaga caccgcagcc accgcggatg 960
caaaagtaaa agccaccacc agtctgtgcg aatcggaact gcatggaaaa cccaattact 1020
cagcaggaag gagcagcaga gagagcggcg ttttggtgct cagggaacag actgacgctg 1080
gccgatgggc acaggttccc gccagggccc catgcctgtg cctccggggt ggccctgacc 1140
ttgtccttga ccccaagggg ggctcagggg acagggagga ggagcagcac aggatgctga 1200
gcagggcctc tggagtgaca gggcggaggg agactccagg acccacaaag cccctgccct 1260
ggacagcggg aaagcacagt gaggatggtg ccaggccgag gctgcagccc agcaagaatg 1320
acccgccctc cctgcgcccc atgccccgcg gctcctgcct gccctgcccg tgtgtccagg 1380
gcactttcag gaactcgccc atctctcacc cgccgagccc gtcccccagt gcctactcca 1440
gccggaccag cagacccatg cgggatgtcg gtgaggacca ggtgcaccct cccctctgcc 1500
actttcccca gaggagcctg cagcaccagc tccctcagcc tggagctcag cgttttgcca 1560
cgaggggcta tcccatggag gacatgaagc tgcaaggtgt accgatgcct ccgggggacc 1620
tgtgtggtcc gacgctgctg ctagatgtgt ccatcaagat ggagaaggac tctgggtgtg 1680
agggtgctgc agacggctgt gtgcccagcc aggtgtggct gggggccagt gacaggagcc 1740
acccagccac cttccctacc aggatgcacc tgaaaacaga gccagactct cggcaacagg 1800
tgtacatctc gcacctgggg cacggcgtgc ggggggctca gccccatggg agggccactg 1860
ctgggcgcag cagggagctg acccctttcc accctgcaca ctgtgcctgc ctggagccca 1920
cagacggcct tccccagtcg gagcctcccc accagctctg tgcacggggc cgaggtgaac 1980
agtcctgcac ctgcagagct gctgaggccg cccctgtggt caagcgggag cccttggact 2040
caccccagtg ggctactcac agccagggaa tggtgcccgg gatgttgccc aaaagtgcct 2100
tggccacgct ggtcccgccc caagcttcgg ggtgcacatt cctgccatag cgcagtgacc 2160
accatccaag ctcagatctg tgtgtctacg ctcagatgcg tcggtggctg ggctgccctg 2220
ctcctggtca ggccggagcc cgtcctaaga cacacgcttt gcagagctgt gcatgcgcag 2280
tctgctagtg tgtgtgtgca gcatacgcag gagcctatcc tgaattttgt aaaatatccc 2340
aacagttctt aaatgaaaac tggccttaag tctattcaag catgacagca tttctctttg 2400
aggaattaaa atctttagga aagtgatcat ggctggacag cttcatgccc cagaggcagc 2460
gagcacccgt cccatggctg ccaagtccac agtcggggat gaagcagtcg ggtgatgctc 2520
ccaagtccgc agtcggggat gaagcggtcg ggtgatgctc ccaagtccgc agtcggggat 2580
gaagcggtcg ggtgacacac ctagctcagc cctcccaggc cacctgcagc tcccagcctg 2640
tgctgtgcag gcagggtcag cccatcgcca cagtgcactg tagaggccag cacacggcaa 2700

-continued

```
attagaaata caacacgcgg agaaaggggt ccgtgagccc actcatagag gaatctagaa   2760
cgttccaggc agcagaggct ggcagcgtgg gtcccacact gccccacacc gtgcggcagg   2820
tgctccatgg cgccatgaca gagtctgagg ccagacctgg actggaattg acagcataac   2880
ccctgttcct tctggacatc tcccgagttc tcagtgggtc tctgcggacg gttcttccta   2940
atctgcctct tggtacatca cgtaatacag agttcacaga ctccgggttt ggaagtacag   3000
agaaacacac aacgtagaga gaagacacag gaaactgcgc tgcctgtggg ggtttctctc   3060
tggctggctg tacagttcac tcaaatgagg gttcccattg ccatcctagg agaataatta   3120
gggacaagac agacaagtat taatagcatt aaaacagttg taaaggcgat attttctgag   3180
agtaggaaat ttggatacaa aagcataagt cagaaagtga aggtcaccaa tccaccaacc   3240
cgagaaccta cagctgatgg tgcatttcag gcttcttcca cggtctggcc tggaacccca   3300
cccggctggt gcaggcatca gatcagggtg tagaagtcac cccaagcaag aggaagccag   3360
gcagtgaggc cctggggtgt ggctgcagct gggcccacct gtgcgggggt gggaaggccc   3420
catcctcagg gagagggcat cggcgccctg acgtcagctc cactgggagt ggcaggagct   3480
gtgggagccc atgggtgagg gacccaccac cccgctgcac tgtgcattgt gcctcccgtg   3540
tggacgccct ctctgttgtt ggcccgcggg tgagggaccc accaccccta gggacccacc   3600
accccgccgc actgtgcatt ctgcctcctg tgtggacgcc ctctctgttg tcagtggctt   3660
tgaggtgtca gtgcttactt agatgctggt ttaatgctgg acccatttgt taaacgcacc   3720
ttcactttgt caaaacccag gtttggttgg caggactggg tcttctgccc aatgccaggt   3780
gcctgcgcct ctcagtggcc tggttcttgg acagtttgcc cccatgtggc agggataggg   3840
ataaggatct cctctcagta ctggaagaga acagccaacc atctgagccc agagtcacag   3900
atccatcgtg gccccctatg acccccaagc cctaccgagg gggcactcac tctctgctta   3960
gccagggggc gtctttcaaa aggtgacctc catgctgtgc tgtcgtgggt gtgagacgtg   4020
ctcatggcct tccactgcca tctctccctt atctgatgcc taaagtcacg atggggacag   4080
agctacccag gggccagcca tggggtgacc agccacctga gggtcagtca cctgtggaga   4140
gcaggcacct gtgaagacca ggcacctgag gactggcgcc tacttcccac tttggcccta   4200
cactggcaca gagcccctct ttattcattt ctcatgctga gcatggcaca cttctggcct   4260
ctgggcattt atggatttaa gaccaggatg gtatttcaga agcttcccac ttccttccta   4320
ttctaaccga gtgcccagct cctttgctga tcatggaaag acccttaata attaggcctg   4380
caggccaggc gcagtggctc atgcctataa tcccagcact ttaggaggtc aaggtaggag   4440
gatcgcttaa gcccaggagt tcaagaccag cctgggcaac acaggaagaa tgtgtctcta   4500
caaaaaataa ttaaaaatca gatctgctgt atccctgaaa aagtctcaat caacatgcat   4560
gttccactct tggagttccc tgttctgagg gccagccacg tcctgtgtcc tggagcttag   4620
ccctcagcag ctcccttcag cctgggcgcc gcctgggtcc caaacgtggc agctgctctt   4680
ccagtctcgg ggccgaggag ggcagggagc tcagtgactg agagtcttgt gtatcacatg   4740
tcttgagtgt cctggagcca acggctgtca ctgggaaaaa caccaggccc caaagatcga   4800
atcagagacg tggctgcgtg tttgcgattg tagccaggcc cttcagtgtc atcaaaggag   4860
cactggggcc tccttaagca cagacggcag cccctgccca ggaggcttct tcaccacgtc   4920
ctgccctgca gcctcccaga cctttagatg cgcccctgcc caaggccctc ctggtgacag   4980
gtgccagatt gagtggtggg ttgctgccag gcaggccacg ctgtgttgac gctgcactca   5040
gcacgtgggt gttggctctg ccggttttgt ggtgtgggga ccctacagga ggctgcggcc   5100
```

```
ctgagagcct gggatcagcg aggtgtccga catcccttcc tcaacggcaa caaaaactcc   5160

ccaagtcagc actttggtta ttttatagcc acaaccctct tggaaaacag tggggaagac   5220

tatggaacat agaaagtgtg gatgtatcac ttctctctaa aatgtcattg ttagcactaa   5280

ttacaggttc atgtttttct gtgtatgtag cttttcccta tatagctgaa aaagtattaa   5340

agtcaaatat aaggtgggaa tgggatggaa gggaggagat caatacaact tatatttttg   5400

cagtttctac tggaagaaaa aagttttcaa tacctagacc aacttgttga atttttaaaa   5460

cttatgcact ataaatgcaa ctttctctac tgctttctca gtgcctttag gaagctttca   5520

aatttttttg tactgtggtt tgtattaaat ttgcaatatt gatgtaaaat acatgacatg   5580

ctagtacatg tttaacaaaa atttaaaaaa aaaaaaaaaa aa                      5622
```

<210> SEQ ID NO 18
<211> LENGTH: 2039
<212> TYPE: DNA
<213> ORGANISM: Homo sapiens

<400> SEQUENCE: 18

```
gtaggtgtca cttatatcac aaggctacag gtgtctttat ttccactgca cgctggtgct     60

gggagcgcct gccttctctt gccttgaaag cctcctcttt ggacctagcc accgctgccc    120

tcacggtaat gttggactcg gtgacacaca gcaccttcct gcctaatgca tccttctgcg    180

atcccctgat gtcgtggact gatctgttca gcaatgaaga gtactaccct gcctttgagc    240

atcagacaga tgctgattcc aactgcttga aaacaagtgg catcaaaagt caagactgtc    300

acagtcatag tagaacaagc ctccaaagtt ctcatctatg ggaatttgta cgagacctgc    360

ttctatctcc tgaagaaaac tgtggcattc tggaatggga agatagggaa caaggaattt    420

ttcgggtggt taaatcggaa gccctggcaa agatgtgggg acaaaggaag aaaaatgaca    480

gaatgacata tgaaaagttg agcagagccc tgagatacta ctataaaaca ggaattttgg    540

agcgggttga ccgaaggtta gtgtacaaat ttggaaaaaa tgcacacggg tggcaggaag    600

acaagctatg atctgctcca ggcatcaagc tcattttatg gatttctgtc ttttaaaaca    660

atcagattgc aatagacatt cgaaaggctt cattttcttc tctttttttt taacctgcaa    720

acatgctgat aaaatttctc cacatctcag cttacatttg gattcagagt tgttgtctac    780

ggagggtgag agcagaaact cttaagaaat cctttcttct ccctaagggg atgaggggat    840

gatcttttgt ggtgtcttga tcaaacttta ttttcctaga gttgtggaat gacaacagcc    900

catgccattg atgctgatca gagaaaaact attcaattct gccattagag acacatccaa    960

tgctcccatc ccaaaggttc aaaagttttc aaataactgt ggcagctcac caaaggtggg   1020

ggaaagcatg attagtttgc aggttatggt aggagagggt gagatataag acatacatac   1080

tttagatttt aaattattaa agtcaaaaat ccatagaaaa gtatcccttt tttttttttt   1140

gagacgggtt ctcactatgt tgcccagggc tggtcttgaa ctcctatgct caagtgatcc   1200

tcccacctcg gcctcccaaa gtactgtgat tacaagcgtg agccacggca cctgggcaga   1260

aaagtatctt aattaatgaa agagctaagc catcaagctg ggacttaatt ggatttaaca   1320

taggttcaca gaaagtttcc taaccagagc atctttttga ccactcagca aaacttccac   1380

agacatcctt ctggacttaa acacttaaca ttaaccacat tattaattgt tgctgagttt   1440

attccccctt ctaactgatg gctggcatct gatatgcaga gttagtcaac agacactggc   1500

atcaattaca aaatcactgc tgtttctgtg attcaagctg tcaacacaat aaaatcgaaa   1560
```

```
ttcattgatt ccatctctgg tccagatgtt aaacgtttat aaaaccggaa atgtcctaac   1620

aactctgtaa tggcaaatta aattgtgtgt ctttttgtt ttgtctttct acctgatgtg   1680

tattcaagcg ctataacacg tatttccttg acaaaaatag tgacagtgaa ttcacactaa   1740

taaatgttca taggttaaag tctgcactga cattttctca tcaatcactg gtatgtaagt   1800

tatcagtgac tgacagctag gtggactgcc cctaggactt ctgtttcacc agagcaggaa   1860

tcaagtggtg aggcactgaa tcgctgtaca ggctgaagac ctccttatta gagttgaact   1920

tcaaagtaac ttgttttaaa aaatgtgaat tactgtaaaa taatctattt tggattcatg   1980

tgttttccag gtggatatag tttgtaaaca atgtgaataa agtatttaac atgtaaaaa    2039
```

<210> SEQ ID NO 19
<211> LENGTH: 2222
<212> TYPE: DNA
<213> ORGANISM: Homo sapiens

<400> SEQUENCE: 19

```
ggctgagtgg tttgctcctt cccctctctc tgggaggctg agcaggggtg ccgggttgct     60

caggccatgg gagccacacc tgttattgct gcctctgatt tgtgtgacac tgagaagccc    120

acaggcctgt ccctccaact cggtggaccc tctctgtgtg catttggtgt gtgagccagc    180

tctgagaagg gttcagaagc cactggaggc atctggggac ctcagcttcc atgccatctc    240

tgcctcactc ccacagggta atgttggact cggtgacaca cagcaccttc ctgcctaatg    300

catccttctg cgatcccctg atgtcgtgga ctgatctgtt cagcaatgaa gagtactacc    360

ctgcctttga gcatcagaca ggttactcct tttttaatga cgctgaagaa agcaaggcca    420

ccatcaaaga ctatgctgat tccaactgct tgaaaacaag tggcatcaaa agtcaagact    480

gtcacagtca tagtagaaca agcctccaaa gttctcatct atgggaattt gtacgagacc    540

tgcttctatc tcctgaagaa aactgtggca ttctggaatg ggaagatagg gaacaaggaa    600

tttttcgggt ggttaaatcg gaagccctgg caaagatgtg gggacaaagg aagaaaaatg    660

acagaatgac atatgaaaag ttgagcagag ccctgagata ctactataaa acaggaattt    720

tggagcgggt tgaccgaagg ttagtgtaca aatttggaaa aaatgcacac gggtggcagg    780

aagacaagct atgatctgct ccaggcatca agctcatttt atggatttct gtcttttaaa    840

acaatcagat tgcaatagac attcgaaagg cttcattttc ttctcttttt ttttaacctg    900

caaacatgct gataaaattt ctccacatct cagcttacat ttggattcag agttgttgtc    960

tacggagggt gagagcagaa actcttaaga aatcctttct tctccctaag gggatgaggg   1020

gatgatcttt tgtggtgtct tgatcaaact ttattttcct agagttgtgg aatgacaaca   1080

gcccatgcca ttgatgctga tcagagaaaa actattcaat tctgccatta gagacacatc   1140

caatgctccc atcccaaagg ttcaaaagtt ttcaaataac tgtggcagct caccaaaggt   1200

gggggaaagc atgattagtt tgcaggttat ggtaggagag ggtgagatat aagacataca   1260

tactttagat tttaaattat taaagtcaaa aatccataga aaagtatccc tttttttttt   1320

tttgagacgg gttctcacta tgttgcccag ggctggtctt gaactcctat gctcaagtga   1380

tcctcccacc tcggcctccc aaagtactgt gattacaagc gtgagccacg gcacctgggc   1440

agaaaagtat cttaattaat gaaagagcta agccatcaag ctgggactta attggattta   1500

acataggttc acagaaagtt tcctaaccag agcatctttt tgaccactca gcaaaacttc   1560

cacagacatc cttctggact taaacactta acattaacca cattattaat tgttgctgag   1620

tttattcccc cttctaactg atggctggca tctgatatgc agagttagtc aacagacact   1680
```

```
ggcatcaatt acaaaatcac tgctgtttct gtgattcaag ctgtcaacac aataaaatcg   1740

aaattcattg attccatctc tggtccagat gttaaacgtt tataaaaccg gaaatgtcct   1800

aacaactctg taatggcaaa ttaaattgtg tgtctttttt gttttgtctt tctacctgat   1860

gtgtattcaa gcgctataac acgtatttcc ttgacaaaaa tagtgacagt gaattcacac   1920

taataaatgt tcataggtta aagtctgcac tgacattttc tcatcaatca ctggtatgta   1980

agttatcagt gactgacagc taggtggact gcccctagga cttctgtttc accagagcag   2040

gaatcaagtg gtgaggcact gaatcgctgt acaggctgaa gacctcctta ttagagttga   2100

acttcaaagt aacttgtttt aaaaaatgtg aattactgta aaataatcta ttttggattc   2160

atgtgttttc caggtggata tagtttgtaa acaatgtgaa taaagtattt aacatgtaaa   2220

aa                                                                  2222
```

<210> SEQ ID NO 20
<211> LENGTH: 1214
<212> TYPE: DNA
<213> ORGANISM: Homo sapiens

<400> SEQUENCE: 20

```
agaaggttta aggccggaaa gggaaatgaa ggggcccggc gctaaccctc taaggacctg     60

ttttgcttct gtttaaacca aatgggcagt ctgtcattac acacaccctg ggtcttcata    120

tgtggccgcc aggtaggagc atcacagtca agctacggga gaaaacagtt tccaggaaac    180

tggaaatgaa cggcccgagt gctttccagg ggctcatctg tgggaagtat aatggaatgt    240

gcttacaagg gccagcagga gtgcctggtc gagacgggag ccctggggcc aatggcattc    300

cgggtacacc tgggatccca ggtcgggatg gattcaaagg agaaaagggg gaatgtctga    360

gggaaagctt tgaggagtcc tggacaccca actacaagca gtgttcatgg agttcattga    420

attatggcat agatcttggg aaaattgcgg agtgtacatt tacaaagatg cgttcaaata    480

gtgctctaag agttttgttc agtggctcac ttcggctaaa atgcagaaat gcatgctgtc    540

agcgttggta tttcacattc aatggagctg aatgttcagg acctcttccc attgaagcta    600

taatttattt ggaccaagga agccctgaaa tgaattcaac aattaatatt catcgcactt    660

cttctgtgga aggactttgt gaaggaattg gtgctggatt agtggatgtt gctatctggg    720

ttggtacttg ttcagattac ccaaaaggag atgcttctac tggatggaat tcagtttctc    780

gcatcattat tgaagaacta ccaaaataaa tgctttaatt ttcatttgct acctcttttt    840

ttattatgcc ttggaatggt tcacttaaat gacattttaa ataagtttat gtatacatct    900

gaatgaaaag caaagctaaa tatgtttaca gaccaaagtg tgatttcaca ctgtttttaa    960

atctagcatt attcattttg cttcaatcaa aagtggtttc aatatttttt ttagttggtt   1020

agaatacttt cttcatagtc acattctctc aacctataat ttggaatatt gttgtggtct   1080

tttgtttttt ctcttagtat agcattttta aaaaaatata aaagctacca atctttgtac   1140

aatttgtaaa tgttaagaat ttttttata tctgttaaat aaaaattatt tccaacaacc   1200

ttaatatctt taaa                                                     1214
```

<210> SEQ ID NO 21
<211> LENGTH: 618
<212> TYPE: DNA
<213> ORGANISM: Homo sapiens

<400> SEQUENCE: 21

```
gcggccgcaa gctcggcact cacggctctg agggctccga cggcactgac ggccatggcg     60

cgttcgaacc tcccgctggc gctgggcctg gccctggtcg cattctgcct cctggcgctg    120

ccacgcgacg cccgggcccg gccgcaggag cgcatggtcg gagaactccg ggacctgtcg    180

cccgacgacc cgcaggtgca gaaggcggcg caggcggccg tggccagcta caacatgggc    240

agcaacagca tctactactt ccgagacacg cacatcatca aggcgcagag ccagctggtg    300

gccggcatca agtacttcct gacgatggag atggggagca cagactgccg caagaccagg    360

gtcactggag accacgtcga cctcaccact tgccccctgg cagcaggggc gcagcaggag    420

aagctgcgct gtgactttga ggtccttgtg gttccctggc agaactcctc tcagctccta    480

aagcacaact gtgtgcagat gtgataagtc cccgagggcg aaggccattg ggtttggggc    540

catggtggag ggcacttcag gtccgtgggc cgtatctgtc acaataaatg gccagtgctg    600

cttcttgcaa aaaaaaaa                                                  618
```

<210> SEQ ID NO 22
<211> LENGTH: 2324
<212> TYPE: DNA
<213> ORGANISM: Homo sapiens

<400> SEQUENCE: 22

```
gtaggtgtca cttatatcac aaggctacag gtgtctttat ttccactgca cgctggtgct     60

gggagcgcct gccttctctt gccttgaaag cctcctcttt ggacctagcc accgctgccc    120

tcacggtaat gttggactcg gtgacacaca gcaccttcct gcctaatgca tccttctgcg    180

atcccctgat gtcgtggact gatctgttca gcaatgaaga gtactaccct gcctttgagc    240

atcagacagc ctgtgactca tactggacat cagtccaccc tgaatactgg actaagcgcc    300

atgtgtggga gtggctccag ttctgctgcg accagtacaa gttggacacc aattgcatct    360

ccttctgcaa cttcaacatc agtggcctgc agctgtgcag catgacacag gaggagttcg    420

tcgaggcagc tggcctctgc ggcgagtacc tgtacttcat cctccagaac atccgcacac    480

aaggttactc ctttttaat gacgctgaag aaagcaaggc caccatcaaa gactatgctg    540

attccaactg cttgaaaaca agtggcatca aaagtcaaga ctgtcacagt catagtagaa    600

caagcctcca aagttctcat ctatgggaat ttgtacgaga cctgcttcta tctcctgaag    660

aaaactgtgg cattctggaa tgggaagata gggaacaagg aatttttcgg gtggttaaat    720

cggaagccct ggcaaagatg tggggacaaa ggaagaaaaa tgacagaatg acatatgaaa    780

agttgagcag agccctgaga tactactata aaacaggaat tttggagcgg gttgaccgaa    840

ggttagtgta caaatttgga aaaaatgcac acgggtggca ggaagacaag ctatgatctg    900

ctccaggcat caagctcatt ttatggattt ctgtctttta aaacaatcag attgcaatag    960

acattcgaaa ggcttcattt tcttctcttt ttttttaacc tgcaaacatg ctgataaaat   1020

ttctccacat ctcagcttac atttggattc agagttgttg tctacggagg gtgagagcag   1080

aaactcttaa gaaatccttt cttctcccta aggggatgag gggatgatct tttgtggtgt   1140

cttgatcaaa ctttattttc ctagagttgt ggaatgacaa cagcccatgc cattgatgct   1200

gatcagagaa aaactattca attctgccat tagagacaca tccaatgctc ccatcccaaa   1260

ggttcaaaag ttttcaaata actgtggcag ctcaccaaag gtgggggaaa gcatgattag   1320

tttgcaggtt atggtaggag agggtgagat ataagacata catactttag attttaaatt   1380

attaaagtca aaaatccata gaaaagtatc cctttttttt tttttgagac gggttctcac   1440

tatgttgccc agggctggtc ttgaactcct atgctcaagt gatcctccca cctcggcctc   1500
```

```
ccaaagtact gtgattacaa gcgtgagcca cggcacctgg gcagaaaagt atcttaatta   1560
atgaaagagc taagccatca agctgggact taattggatt taacataggt tcacagaaag   1620
tttcctaacc agagcatctt tttgaccact cagcaaaact tccacagaca tccttctgga   1680
cttaaacact taacattaac cacattatta attgttgctg agtttattcc cccttctaac   1740
tgatggctgg catctgatat gcagagttag tcaacagaca ctggcatcaa ttacaaaatc   1800
actgctgttt ctgtgattca agctgtcaac acaataaaat cgaaattcat tgattccatc   1860
tctggtccag atgttaaacg tttataaaac cggaaatgtc ctaacaactc tgtaatggca   1920
aattaaattg tgtgtctttt ttgttttgtc tttctacctg atgtgtattc aagcgctata   1980
acacgtattt ccttgacaaa aatagtgaca gtgaattcac actaataaat gttcataggt   2040
taaagtctgc actgacattt tctcatcaat cactggtatg taagttatca gtgactgaca   2100
gctaggtgga ctgcccctag gacttctgtt tcaccagagc aggaatcaag tggtgaggca   2160
ctgaatcgct gtacaggctg aagacctcct tattagagtt gaacttcaaa gtaacttgtt   2220
ttaaaaaatg tgaattactg taaaataatc tattttggat tcatgtgttt tccaggtgga   2280
tatagtttgt aaacaatgtg aataaagtat ttaacatgta aaaa                    2324
```

<210> SEQ ID NO 23
<211> LENGTH: 1166
<212> TYPE: DNA
<213> ORGANISM: Homo sapiens

<400> SEQUENCE: 23

```
gctccgggaa tttccctggc ccggccgctc cgggctttcc agtctcaacc atgcataaaa     60
agggttcgcc gatcttgggg agccacacag cccgggtcgc aggcacctcc ccgccagctc    120
tcccgcttct cgcacagctt cccgacgcgt ctgctgagcc ccatggccca cgccacgctc    180
tccgccgccc ccagcaatcc ccggctcctg cgggtggcgc tgctgctcct gctcctggtg    240
gccgccagcc ggcgcgcagc aggagcgtcc gtggtcactg aactgcgctg ccagtgcttg    300
cagacactgc agggaattca cctcaagaac atccaaagtg tgaatgtaag gtcccccgga    360
ccccactgcg cccaaaccga agtcatagcc acactcaaga atgggaagaa agcttgtctc    420
aaccccgcat cccccatggt tcagaaaatc atcgaaaaga tactgaacaa ggggagcacc    480
aactgacagg agagaagtaa gaagcttatc agcgtatcat tgacacttcc tgcagggtgg    540
tccctgccct taccagagct gaaaatgaaa aagagaacag cagctttcta gggacagctg    600
gaaaggactt aatgtgtttg actatttctt acgagggttc tacttattta tgtatttatt    660
tttgaaagct tgtattttaa tattttacat gctgttattt aaagatgtga gtgtgtttca    720
tcaaacatag ctcagtcctg attatttaat tggaatatga tgggttttaa atgtgtcatt    780
aaactaatat ttagtgggag accataatgt gtcagccacc ttgataaatg acagggtggg    840
gaactggagg gtgggggggat tgaaatgcaa gcaattagtg gatcactgtt agggtaaggg    900
aatgtatgta cacatctatt ttttatactt tttttttaaa aaaagaatgt cagttgttat    960
ttattcaaat tatctcacat tatgtgttca acatttttat gctgaagttt cccttagaca   1020
ttttatgtct tgcttgtagg gcataatgcc ttgtttaatg tccattctgc agcgtttctc   1080
tttcccttgg aaaagagaat ttatcattac tgttacattt gtacaaatga catgataata   1140
aaagttttat gaaaaaaaaa aaaaaa                                        1166
```

<210> SEQ ID NO 24

<211> LENGTH: 5189
<212> TYPE: DNA
<213> ORGANISM: Homo sapiens

<400> SEQUENCE: 24

```
gggaaagtga agaaaacaga aaaggagagg gacagaggcc agaggacttc tcatactgga     60
cagaaaccga tcaggcatgg aactcccctt cgtcactcac ctgttcttgc ccctggtgtt    120
cctgacaggt ctctgctccc cctttaacct ggatgaacat cacccacgcc tattcccagg    180
gccaccagaa gctgaatttg gatacagtgt cttacaacat gttgggggtg gacagcgatg    240
gatgctggtg ggcgcccccct gggatgggcc ttcaggcgac cggagggggg acgtttatcg    300
ctgccctgta gggggggccc acaatgcccc atgtgccaag ggccacttag gtgactacca    360
actgggaaat tcatctcatc ctgctgtgaa tatgcacctg gggatgtctc tgttagagac    420
agatggtgat gggggattca tggcctgtgc ccctctctgg tctcgtgctt gtggcagctc    480
tgtcttcagt tctgggatat gtgcccgtgt ggatgcttca ttccagcctc agggaagcct    540
ggcacccact gcccaacgct gcccaacata catggatgtt gtcattgtct tggatggctc    600
caacagcatc taccccctggt ctgaagttca gaccttccta cgaagactgg tagggaaact    660
gtttattgac ccagaacaga tacaggtggg actggtacag tatggggaga gccctgtaca    720
tgagtggtcc ctgggagatt tccgaacgaa ggaagaagtg gtgagagcag caaagaacct    780
cagtcggcgg gagggacgag aaacaaagac tgcccaagca ataatggtgg cctgcacaga    840
agggttcagt cagtcccatg ggggccgacc cgaggctgcc aggctactgg tggttgtcac    900
tgatggagag tcccatgatg gagaggagct tcctgcagca ctaaaggcct gtgaggctgg    960
aagagtgaca cgctatggga ttgcagtcct tggtcactac ctccggcggc agcgagatcc   1020
cagctctttc ctgagagaaa ttagaactat tgccagtgat ccagatgagc gattcttctt   1080
caatgtcaca gatgaggctg ctctgactga cattgtggat gcactaggag atcggatttt   1140
tggccttgaa gggtcccatg cagaaaacga aagctccttt gggctggaaa tgtctcagat   1200
tggtttctcc actcatcggc taaaggatgg gattcttttt gggatggtgg gggcctatga   1260
ctggggaggc tctgtgctat ggcttgaagg aggccaccgc cttttccccc cacgaatggc   1320
actggaagac gagttccccc ctgcactgca gaaccatgca gcctacctgg gttactctgt   1380
ttcttccatg cttttgcggg gtggacgccg cctgtttctc tctggggctc ctcgatttag   1440
acatcgagga aaagtcatcg ccttccagct taagaaagat ggggctgtga gggttgccca   1500
gagcctccag ggggagcaga ttggttcata ctttggcagt gagctctgcc cattggatac   1560
agatagggat ggaacaactg atgtcttact tgtggctgcc cccatgttcc tgggacccca   1620
gaacaaggaa acaggacgtg tttatgtgta tctggtaggc cagcagtcct tgctgaccct   1680
ccaaggaaca cttcagccag aaccccccca ggatgctcgg tttggctttg ccatgggagc   1740
tcttcctgat ctgaaccaag atggttttgc tgatgtggct gtgggggcgc ctctggaaga   1800
tgggcaccag ggagcactgt acctgtacca tggaacccag agtggagtca ggccccatcc   1860
tgcccagagg attgctgctg cctccatgcc acatgccctc agctactttg gccgaagtgt   1920
ggatggtcgg ctagatctgg atggagatga tctggtcgat gtggctgtgg gtgcccaggg   1980
ggcagccatc ctgctcagct cccggcccat tgtccatctg accccatcac tggaggtgac   2040
cccacaggcc atcagtgtgg ttcagaggga ctgtaggcgg cgaggccaag aggcagtctg   2100
tctgactgca gccctttgct tccaagtgac ctcccgtact cctggtcgct gggatcacca   2160
attctacatg aggttcaccg catcactgga tgaatggact gctggggcac gtgcagcatt   2220
```

```
tgatggctct ggccagaggt tgtcccctcg gaggctccgg ctcagtgtgg ggaatgtcac   2280
ttgtgagcag ctacacttcc atgtgctgga tacatcagat tacctccggc cagtggcctt   2340
gactgtgacc tttgccttgg acaatactac aaagccaggg cctgtgctga atgagggctc   2400
acccacctct atacaaaagc tggtcccctt ctcaaaggat tgtggccctg acaatgaatg   2460
tgtcacagac ctggtgcttc aagtgaatat ggacatcaga ggctccagga aggccccatt   2520
tgtggttcga ggtggccggc ggaaagtgct ggtatctaca actctggaga acagaaagga   2580
aaatgcttac aatacgagcc tgagtctcat cttctctaga aacctccacc tggccagtct   2640
cactcctcag agagagagcc caataaaggt ggaatgtgcc gccccttctg ctcatgcccg   2700
gctctgcagt gtggggcatc ctgtcttcca gactggagcc aaggtgacct ttctgctaga   2760
gtttgagttt agctgctcct ctctcctgag ccaggtcttc gtgaagctga ctgccagcag   2820
tgacagcctg gagagaaatg ggacccttca agataacaca gcccagacct cagcctacat   2880
ccaatatgag ccccacctcc tgttctctag tgagtctacc ctgcaccgct atgaggttca   2940
cccatatggg accctcccag tgggtcctgg cccagaattc aaaaccactc tcagggttca   3000
gaacctaggc tgctatgtgg tcagtggcct catcatctca gccctccttc cagctgtggc   3060
ccatgggggc aattacttcc tatcactgtc tcaagtcatc actaacaatg caagctgcat   3120
agtgcagaac ctgactgaac ccccaggccc acctgtgcat ccagaggagc ttcaacacac   3180
aaacagactg aatgggagca atactcagtg tcaggtggtg aggtgccacc ttgggcagct   3240
ggcaaagggg actgaggtct ctgttggact attgaggctg gttcacaatg aatttttccg   3300
aagagccaag ttcaagtccc tgacggtggt cagcaccttt gagctgggaa ccgaagaggg   3360
cagtgtccta cagctgactg aagcctcccg ttggagtgag agcctcttgg aggtggttca   3420
gacccggcct atcctcatct ccctgtggat cctcataggc agtgtcctgg gagggttgct   3480
cctgcttgct ctccttgtct tctgcctgtg gaagcttggc ttctttgccc ataagaaaat   3540
ccctgaggaa gaaaaaagag aagagaagtt ggagcaatga atgtagaata agggtctaga   3600
aagtcctccc tggcagcttc ttcaagagac ttgcataaaa gcagaggttt gggggctcag   3660
atgggacaag aagccgcctc tggactatct ccccagacca gcagcctgac ttgacttttg   3720
agtcctaggg atgctgctgg ctagagatga ggctttacct cagacaagaa gagctggcac   3780
caaaactagc catgctccca ccctctgctt ccctcctcct cgtgatcctg gttccatagc   3840
caacactggg gcttttgttt ggggtccttt tatccccagg aatcaataat ttttttgcct   3900
aggtgcctga ctcctttcag attccctctt tatcttccct cacagtttgg aaaggatgag   3960
ggttatcttc ctcgattctt ccaccctctc actttcctgc ctgttcccca ctccacagga   4020
gggagctgac gttggcttga aaggagtaaa gtcaacatct gctgctttcc tgtggactct   4080
ggtgattcat agagccggat ggggagagtc aacaggaaaa aaggagggag gaggaaaagc   4140
cacaagagac attctgtaca attccaagga acagagaagc ctttagacag gcaactgcca   4200
tcccccctga aacctgagac ctgtagtgca ctcgaccgcc ctcaggtgtt ggtgaaacag   4260
agctgccccc aggctcgctg ggcataggct tcctgattcc aagccttttc tgggagcaaa   4320
gccagggcct ggtgcctgat tttctgaagc caggagccct caggtggctg gagctggaat   4380
agcagggagg actgggtgta cctaggcagt attttctcta cttctctcaa gtcttatact   4440
cactcttgag ccctccttgg ggcctgctta gaaagcagac aggagagaga gtactgctac   4500
ttgatgatgg gaaatgcttt cactttacca gctttgggaa gcagcagccc catgggatct   4560
```

```
aaaagtgtgg agtctgcatt aagaaaccta catgggtggc atggggctct ggggagcaag   4620

cccttacttg ctcagcactg gttatgtagc acaaatagct cctaggaaaa tgtttctggg   4680

gcaaccctag aaccctggtc atattttgca gggtttctct ggtggaatca gtttgccagc   4740

ccttgcttga tgcttactgg aaatctccag gttaatttct atctctgatc cctccccaac   4800

ccactccata tttgggtcat ggacagtaaa ggcagttgga ttctcataga caactgggta   4860

acttatattt ctttgtaatc aagacttgag atatcgaagt cagttattgg tctccagagt   4920

gcagctctgg gagccttttg aagaatcagc actcattaag agctgagaag agagaagacc   4980

tgattgggtg gttgactagc agtcacagaa cctgtcctcc caggctgttc ctgaggcctg   5040

accacagtat ttattttggc atgtctctgg ccttctgcag aggcccaccc tcatgggcat   5100

tgtctctgtt tcccagtggg gtggacagta tatcagatgg tcagaacaaa taaagttcag   5160

tgtcaaatga aaaaaaaaaa aaaaaaaaa                                     5189
```

<210> SEQ ID NO 25
<211> LENGTH: 2005
<212> TYPE: DNA
<213> ORGANISM: Homo sapiens

<400> SEQUENCE: 25

```
tttcctctca gggggcagca ggaagtgagg agaaagggct gggatgggag gcgggagcgg     60

atgggaggga atggggttta tcaagtcctc ggcgagctgc ccaacgggca gcagctggcg    120

caagtagcct agctggagag gctcacccca ggaaggaggg aggccaccga cctactgggc    180

cgacggactc ccacacagtt cctgagctgg tgccaggcag gtgacacctc ctgcagcccc    240

cagcatgcgg gcaggcccag gccccaccgt tacattggcc ctggtgctgg cggtgtcatg    300

ggccatggag ctcaagccca cagcaccacc catcttcact ggccggccct ttgtggtagc    360

gtgggacgtg cccacacagg actgtggccc acgcctcaag gtgccactgg acctgaatgc    420

ctttgatgtg caggcctcac ctaatgaggg ttttgtgaac cagaatatta ccatcttcta    480

ccgcgaccgt ctaggcctgt atccacgctt cgattctgcc ggaaggtctg tgcatggtgg    540

tgtgccacag aatgtcagcc tttgggcaca ccggaagatg ctgcagaaac gtgtggagca    600

ctacattcgg acacaggagt ctgcggggct ggcggtcatc gactgggagg actggcgacc    660

tgtgtgggtg cgcaactggc aggacaaaga tgtgtatcgc cggttatcac gccagctagt    720

ggccagtcgt caccctgact ggcctccaga ccgcatagtc aaacaggcac aatatgagtt    780

tgagttcgca gcacagcagt tcatgctgga gacactgcgt tatgtcaagg cagtgcggcc    840

ccggcacctc tggggcttct acctctttcc tgactgctac aatcatgatt atgtgcagaa    900

ctgggagagc tacacaggcc gctgccctga tgttgaggtg gcccgcaatg accagctggc    960

ctggctgtgg gctgagagca cggccctctt cccgtctgtc tacctggacg agacacttgc   1020

ttcctcccgc catggccgca actttgtgag cttccgtgtt caggaggccc ttcgtgtggc   1080

tcgcacccac catgccaacc atgcactccc agtctacgtc ttcacacgac ccacctacag   1140

ccgcaggctc acggggctta gtgagatgga cctcatctct accattggcg agagtgcggc   1200

cctgggcgca gctggtgtca tcctctgggg tgacgcgggg tacaccacaa gcacggagac   1260

ctgccagtac ctcaaagatt acctgacacg gctgctggtc ccctacgtgg tcaatgtgtc   1320

ctgggccacc caatattgca gccgggccca gtgccatggc catgggcgct gtgtgcgccg   1380

caaccccagt gccagtacct tcctgcatct cagcaccaac agtttccgcc tagtgcctgg   1440

ccatgcacct ggtgaacccc agctgcgacc tgtgggggag ctcagttggg ccgacattga   1500
```

```
ccacctgcag acacacttcc gctgccagtg ctacttgggc tggagtggtg agcaatgcca   1560

gtgggaccat aggcaggcag ctggaggtgc cagcgaggcc tgggctgggt cccacctcac   1620

cagtctgctg gctctggcag ccctggcctt tacctggacc ttgtaggggt ctcctgccta   1680

gctgcctagc aagctggcct ctaccacaag ggctctctta ggcatgtagg accctgcagg   1740

gggtggacaa actggagtct ggagtgggca gagcccccag gaagcccagg agggcatcca   1800

taccagctcg cacccccctg ttctaagggg gaggggaagt ccctgggagg ccccttctct   1860

ccctgccaga ggggaaggag ggtacagctg ggctggggag gacctgaccc tactcccttg   1920

ccctagatag tttattatta ttattatttt ggggtctctt ttgtaaatta aacataaaac   1980

aattgcttct ctgcttggat tttgt                                         2005
```

<210> SEQ ID NO 26
<211> LENGTH: 5802
<212> TYPE: DNA
<213> ORGANISM: Homo sapiens

<400> SEQUENCE: 26

```
tttatagcag cagtagaaat ataccaccct agaggacaca cctcctttta gctaggtacc     60

tataaatgtc caggattttc tattcaattg agaagaaccc agcaaaatgg ggatctccac    120

agtcatcctt gaaatgtgtc ttttatgggg acaagttcta tctacaggtg ggtggatccc    180

aaggactaca gactacgctt cactgattcc ctcggaggtg cccttggatc caactgtagc    240

agaaggttct ccatttccct cggagtcgac cctggagtca actgtagcag aaggttctcc    300

gatttccttg gagtcaaccc tggagtcaac cgtagcagaa ggttctctga ttccctcaga    360

gtcaaccctg gagtcaactg tagcagaagg atctgattct ggtttggccc tgaggctggt    420

gaatggagat ggcaggtgtc agggccgagt ggagatccta taccgaggct cctggggcac    480

cgtgtgtgat gacagctggg acaccaatga tgccaacgtg gtctgtaggc agctgggttg    540

tggctgggcc atgtcagctc caggaaatgc ctggtttggc cagggctcag gacccattgc    600

cctggatgat gtgcgctgct caggacacga atcctacctg tggagctgcc cccacaatgg    660

ctggctctcc cataactgtg gccatggtga agatgctggt gttatctgct cagctgccca    720

gcctcagtca acactcaggc cagaaagttg gcctgtcagg atatcaccac ctgtacccac    780

agaaggatct gaatccagtt tggccctgag gctggtgaat ggaggcgaca ggtgtcgagg    840

ccgagtggag gtcctatacc gaggctcctg gggcaccgtg tgtgatgact actgggacac    900

caatgatgcc aatgtggtct gcaggcagct gggctgtggc tgggccatgt cagccccagg    960

aaatgcccag tttggccagg gctcaggacc cattgtcctg gatgatgtgc gctgctcagg   1020

acatgagtcc tacctgtgga gctgccccca caatggctgg ctcacccaca actgtggcca   1080

tagtgaagac gctggtgtca tctgctcagc tccccagtcc cggccgacac ccagcccaga   1140

tacttggccg acctcacatg catcaacagc aggacctgaa tccagtttgg ccctgaggct   1200

ggtgaatgga ggtgacaggt gtcagggccg agtggaggtc ctataccgag gctcctgggg   1260

caccgtgtgt gatgatagct gggacaccag tgacgccaat gtggtctgcc ggcagctggg   1320

ctgtggctgg gccacgtcag ccccaggaaa tgcccggttt ggccagggtt caggacccat   1380

tgtcctggat gacgtgcgct gctcaggcta tgagtcctac ctgtggagct gcccccacaa   1440

tggctggctc tcccataact gtcagcacag tgaagacgct ggtgtcatct gctcagctgc   1500

ccactcctgg tcgacgccca gtccagacac attgccgacc atcaccttgc ctgcatcgac   1560
```

-continued

```
agtaggatct gaatccagtt tggccctgag gctggtgaat ggaggtgaca ggtgtcaggg   1620
ccgagtggag gtcctatacc aaggctcctg gggcaccgtg tgcgatgaca gctgggacac   1680
caatgatgcc aatgtcgtct gcaggcaact gggctgtggc tgggccatgt cagccccagg   1740
aaatgcccgg tttggtcagg gctcaggacc cattgtcctg gatgatgtgc gctgctcagg   1800
acacgagtct tacctgtgga gctgccccca caatggctgg ctctcccaca actgtggcca   1860
tagtgaagac gctggtgtca tctgctcagc ttcccagtcc cggccaacac ctagtccaga   1920
cacttggcca acctcacatg catcaacagc aggatctgaa tccagtttgg ccctgaggct   1980
ggtgaatgga ggtgacaggt gtcagggccg agtggaggtc ctataccgag gctcctgggg   2040
caccgtgtgt gatgactact gggacaccaa tgatgccaat gtggtttgca ggcagctggg   2100
ctgtggctgg gccatgtcag ccccaggaaa tgcccggttt ggccagggtt caggacccat   2160
tgtcctggat gatgtgcgct gctcaggaca tgagtcctat ctgtggagct gcccccacaa   2220
tggctggctc tcccacaact gtggccatca tgaagacgct ggtgtcatct gctcagcttc   2280
ccagtcccag ccgacaccca gcccagacac ttggccaacc tcacatgcat caacagcagg   2340
atctgaatcc agtttggccc tgaggctggt gaatggaggt gacaggtgtc agggccgagt   2400
ggaggtccta taccgaggct cctggggcac cgtgtgtgat gactactggg acaccaatga   2460
tgccaatgtg gtttgcaggc agctgggctg tggctgggcc acgtcagccc caggaaatgc   2520
ccggtttggc cagggttcag gacccattgt cctggatgat gtgcgctgct caggacatga   2580
gtcctatctg tggagctgcc cccacaatgg ctggctctcc cacaactgtg gccatcatga   2640
agacgctggt gtcatctgct cagcttccca gtcccagccg acacccagcc cagacacttg   2700
gccaacctct cgtgcatcaa cagcaggatc tgaatccact ttggccctga gactggtgaa   2760
tggaggtgac aggtgtcgag gccgagtgga ggtcctatac caaggctcct ggggcaccgt   2820
gtgtgatgac tactgggaca ccaatgatgc caacgtggtc tgcaggcagc tgggctgtgg   2880
ctgggccatg tcagccccag gaaatgccca gtttggccag ggctcaggac ccattgtcct   2940
ggatgatgtg cgctgctcag gacacgagtc ttacctgtgg agctgccccc acaatggctg   3000
gctctcccac aactgtggcc atcatgaaga tgctggtgtc atctgctcag ctgctcagtc   3060
ccagtcaacg cccaggccag atacttggct gaccaccaac ttaccggcat tgacagtagg   3120
atctgaatcc agtttggctc tgaggctggt gaatggaggt gacaggtgtc gaggccgagt   3180
ggaggtcctg tatcgaggct cctggggaac cgtgtgtgat gacagctggg acaccaatga   3240
tgccaatgtg gtctgcaggc agctgggctg tggctgggcc atgtcggccc caggaaatgc   3300
ccggtttggc cagggctcag gacccattgt cctggatgat gtgcgctgct cagggaatga   3360
gtcctacctg tggagctgcc cccacaaagg ctggctcacc cacaactgtg gccatcacga   3420
agacgctggt gtcatctgct cagccaccca aataaattct actacgacag attggtggca   3480
tccaacaact acaaccactg caagaccctc ttcaaattgt ggtggcttct tattctatgc   3540
cagtgggaca ttctccagcc catcctaccc tgcatactac cccaacaatg ctaagtgtgt   3600
ttgggaaata gaagtgaatt ctggttatcg cataaacctg ggcttcagta atctgaaatt   3660
ggaggcacac cataactgca gttttgatta tgttgaaatc tttgatggat cattgaatag   3720
cagtctcctg ctggggaaaa tctgtaatga taccaggcaa atatttacat cttcttacaa   3780
ccgaatgacc attcactttc gaagtgacat cagtttccaa aacactggct ttttggcttg   3840
gtataactcc ttcccaagcg atgccacctt gaggttggtc aatttaaatt catcctatgg   3900
tctatgtgcc gggcgtgtag aaatttacca tggtggcacc tgggggacag tttgtgatga   3960
```

```
ctcctggacc attcaggaag ctgaggtggt ctgcagacag ctagggtgtg gacgtgcagt   4020
ttcagccctt ggaaatgcat attttggctc tggctctggc cccatcaccc tggacgatgt   4080
agagtgctca gggacggaat ccactctctg gcagtgccgg aaccgaggct ggttctccca   4140
caactgtaat catcgtgaag atgctggtgt catctgctca ggaaaccatc tatcgacacc   4200
tgctcctttt ctcaacatca cccgtccaaa cacagattat tcctgcggag gcttcctatc   4260
ccaaccatca ggggactttt ccagcccatt ctatcccggg aactatccaa acaatgccaa   4320
gtgtgtgtgg gacattgagg tgcaaaacaa ctaccgtgtg actgtgatct tcagagatgt   4380
ccagcttgaa ggtggctgca actatgatta tattgaagtt ttcgatggcc cctaccgcag   4440
ttcccctctc attgctcgag tttgtgatgg ggccagaggc tccttcactt cttcctccaa   4500
cttcatgtcc attcgcttca tcagtgacca cagcatcaca aggagagggt tccgggctga   4560
gtactactcc agtccctcca atgacagcac caacctgctc tgtctgccaa atcacatgca   4620
agccagtgtg agcaggagct atctccaatc cttgggcttt tctgccagtg accttgtcat   4680
ttccacctgg aatggatact acgagtgtcg gccccagata acgccgaacc tggtgatatt   4740
cacaattccc tactcaggct gcggcacctt caagcaggca gacaatgaca ccatcgacta   4800
ttccaacttc ctcacagcag ctgtctcagg tggcatcatc aagaggagga cagacctccg   4860
tattcacgtc agctgcagaa tgcttcagaa cacctgggtc gacaccatgt acattgctaa   4920
tgacaccatc cacgttgcta ataacaccat ccaggtcgag gaagtccagt atggcaattt   4980
tgacgtgaac atttcctttt atacttcctc atctttcttg tatcctgtga ccagccgccc   5040
ttactacgtg gacctgaacc aggacttgta cgttcaggct gaaatcctcc attctgatgc   5100
tgtactgacc ttgtttgtgg acacctgcgt ggcatcacca tactccaatg acttcacgtc   5160
tttgacttat gatctaatcc ggagtggatg cgtgagggat gacacctacg gaccctactc   5220
ctcgccatct cttcgcattg cccgcttccg gttcagggcc ttccacttcc tgaaccgctt   5280
cccctccgtg tacctgcgtt gtaaaatggt ggtgtgcaga gcgtatgacc cctcttcccg   5340
ctgctaccga ggctgtgtgt tgaggtcgaa gagggatgtg ggctcctacc aggaaaaggt   5400
ggacgtcgtc ctgggtccca tccagctgca gaccccccca cgccgagaag aggagcctcg   5460
gtaggtggtc gctctcagac cccactgtcc accggggcgc agacccctga ctcggggact   5520
tgggatgttc ctcttggtgt catattccaa ctcagattga gccctacatt gtgctgcacc   5580
tggtcatacg gagttgaatc agacctggtt cccgcctccc ccaaggctca tggtccttgg   5640
aggacccgtt gcagggtgag gtcaagagag ttctgacctg gatggcccat agacctgacg   5700
tcccagaatc catgcttctc atctgcaaaa tgaaaatgtc aatacttact tcttagcact   5760
gttgagaggg ttacttacat aaaggaattt tggtgaaact gc                      5802
```

<210> SEQ ID NO 27
<211> LENGTH: 1220
<212> TYPE: DNA
<213> ORGANISM: Homo sapiens

<400> SEQUENCE: 27

```
agtcccagct cagagccgca acctgcacag ccatgcccgg gcaagaactc aggacggtga     60
atggctctca gatgctcctg gtgttgctgg tgctctcgtg gctgccgcat gggggcgccc    120
tgtctctggc cgaggcgagc cgcgcaagtt tcccgggacc ctcagagttg cactccgaag    180
actccagatt ccgagagttg cggaaacgct acgaggacct gctaaccagg ctgcgggcca    240
```

```
accagagctg ggaagattcg aacaccgacc tcgtcccggc ccctgcagtc cggatactca    300

cgccagaagt gcggctggga tccggcggcc acctgcacct gcgtatctct cgggccgccc    360

ttcccgaggg gctccccgag gcctcccgcc ttcaccgggc tctgttccgg ctgtccccga    420

cggcgtcaag gtcgtgggac gtgacacgac cgctgcggcg tcagctcagc cttgcaagac    480

cccaggcgcc cgcgctgcac ctgcgactgt cgccgccgcc gtcgcagtcg gaccaactgc    540

tggcagaatc ttcgtccgca cggccccagc tggagttgca cttgcggccg caagccgcca    600

gggggcgccg cagagcgcgt gcgcgcaacg gggaccactg tccgctcggg cccgggcgtt    660

gctgccgtct gcacacggtc cgcgcgtcgc tggaagacct gggctgggcc gattgggtgc    720

tgtcgccacg ggaggtgcaa gtgaccatgt gcatcggcgc gtgcccgagc cagttccggg    780

cggcaaacat gcacgcgcag atcaagacga gcctgcaccg cctgaagccc gacacggtgc    840

cagcgccctg ctgcgtgccc gccagctaca atcccatggt gctcattcaa aagaccgaca    900

ccggggtgtc gctccagacc tatgatgact tgttagccaa agactgccac tgcatatgag    960

cagtcctggt ccttccactg tgcacctgcg cggaggacgc gacctcagtt gtcctgccct   1020

gtggaatggg ctcaaggttc ctgagacacc cgattcctgc ccaaacagct gtatttatat   1080

aagtctgtta tttattatta atttattggg gtgaccttct tggggactcg ggggctggtc   1140

tgatggaact gtgtatttat ttaaaactct ggtgataaaa ataaagctgt ctgaactgtt   1200

aaaaaaaaaa aaaaaaaaaa                                               1220
```

<210> SEQ ID NO 28
<211> LENGTH: 1882
<212> TYPE: DNA
<213> ORGANISM: Homo sapiens

<400> SEQUENCE: 28

```
agcgctccta taaagggagc caccagcgct ggaggccgct gctcgctgcg ccaccgcctc     60

ccgccacccc tgcccgcccg acagcgccgc cgcctgcccc gccatgggtc gacagaagga    120

gctggtgtcc cgctgcgggg agatgctcca catccgctac cggctgctcc gacaggcgct    180

ggccgagtgc ctggggaccc tcatcctggt gatgtttggc tgtggctccg tggcccaggt    240

tgtgctcagc cggggcaccc acggtggttt cctcaccatc aacctggcct ttggctttgc    300

tgtcactctg ggcatcctca tcgctggcca ggtctctggg gcccacctga accctgccgt    360

gacctttgcc atgtgcttcc tggctcgtga gccctggatc aagctgccca tctacaccct    420

ggcacagacg ctgggagcct tcttgggtgc tggaatagtt tttgggctgt attatgatgc    480

aatctggcac ttcgccgaca accagctttt tgtttcgggc cccaatggca cagccggcat    540

ctttgctacc taccccctctg gacacttgga tatgatcaat ggcttctttg accagttcat    600

aggcacagcc tcccttatcg tgtgtgtgct ggccattgtt gacccctaca acaaccccgt    660

cccccgaggc ctggaggcct tcaccgtggg cctggtggtc ctggtcattg gcacctccat    720

gggcttcaac tccggctatg ccgtcaaccc tgcccgggac tttggccccc gccttttac     780

agcccttgcg ggctggggct ctgcagtctt cacgaccggc cagcattggt ggtgggtgcc    840

catcgtgtcc ccactcctgg gctccattgc gggtgtcttc gtgtaccagc tgatgatcgg    900

ctgccacctg gagcagcccc caccctccaa cgaggaagag aatgtgaagc tggcccatgt    960

gaagcacaag gagcagatct gagtgggcag gggccatctc cccactccgc tgccctggcc   1020

ttgagcatcc actgactgtc caagggccac tcccaagaag cccccttcac gatccaccct   1080

ttcaggctaa ggagctccct atctaccctc accccacgag acagcccctt caggatttcc   1140
```

```
actggacctt gcccaaatag caccttaggc cactgcccct aagctggggt ggaaccggaa   1200

tttgggtcaa tacatccttt tgtctcccaa gggaagagaa tgggcagcag gtatgtgtgt   1260

gtgtgcatgt gtgtgcatgt gtgtgcatgt gtgtgcaggg gtgtgtgtgt gtgggggggg   1320

ttcccagata ttcagggcaa gggaccagtc ggaagggatt ctggctattg ggggagccca   1380

gagacagggg aaggcagcct gtccatctgt gcataaggag aggaaagttc cagggtgtgt   1440

atgtttcagg ggcttcacat ggaggagctg cagatagata tgtgtttctg tgtatgtgta   1500

tgtctgcctt tttttctaag tgggggcttc tacaggcttt tgggaagtag ggtggatgtg   1560

ggtagggctg ggaggagggg gccacagctt aggtttggag ctctggatgt acatacataa   1620

gtaggagcag tgggacgtgt ttctgtcata atgcaggcat gaagggtgga gtgaagtcag   1680

gtcataagtt tcatgtttgc ttttgttttg ttttgttttt aatgtatgta gcagatgtta   1740

cagtcttagg gatccgggat gggagacccc actttagaaa gggtcgtcac tcctttaatc   1800

ctctactcaa caatgtactc ttttactttt atattaaaaa aaataaaata aatatgtgcc   1860

taaaacctcc aaaaaaaaaa aa                                            1882
```

<210> SEQ ID NO 29
<211> LENGTH: 1336
<212> TYPE: DNA
<213> ORGANISM: Homo sapiens

<400> SEQUENCE: 29

```
gagagacaca gagtccggca ttggtcccag gcagcagtta gcccgccgcc cgcctgtgtg     60

tccccagagc catggagaga gccagtctga tccagaaggc caagctggca gagcaggccg    120

aacgctatga ggacatggca gccttcatga aaggcgccgt ggagaagggc gaggagctct    180

cctgcgaaga gcgaaacctg ctctcagtag cctataagaa cgtggtgggc ggccagaggg    240

ctgcctggag ggtgctgtcc agtattgagc agaaaagcaa cgaggagggc tcggaggaga    300

aggggcccga ggtgcgtgag taccgggaga aggtggagac tgagctccag ggcgtgtgcg    360

acaccgtgct gggcctgctg gacagccacc tcatcaagga ggccggggac gccgagagcc    420

gggtcttcta cctgaagatg aagggtgact actaccgcta cctggccgag gtggccaccg    480

gtgacgacaa gaagcgcatc attgactcag cccggtcagc ctaccaggag gccatggaca    540

tcagcaagaa ggagatgccg cccaccaacc ccatccgcct gggcctggcc ctgaactttt    600

ccgtcttcca ctacgagatc gccaacagcc ccgaggaggc catctctctg gccaagacca    660

ctttcgacga ggccatggct gatctgcaca ccctcagcga ggactcctac aaagacagca    720

ccctcatcat gcagctgctg cgagacaacc tgacactgtg gacggccgac aacgccgggg    780

aagagggggg cgaggctccc caggagcccc agagctgagt gttgcccgcc accgccccgc    840

cctgcccccct ccagtccccc accctgccga gaggactagt atggggtggg aggccccacc    900

cttctcccct aggcgctgtt cttgctccaa agggctccgt ggagagggac tggcagagct    960

gaggccacct ggggctgggg atcccactct tcttgcagct gttgagcgca cctaaccact   1020

ggtcatgccc ccacccctgc tctccgcacc cgcttcctcc cgaccccagg accaggctac   1080

ttctcccctc ctcttgcctc cctcctgccc ctgctgcctc tgatcgtagg aattgaggag   1140

tgtcccgcct tgtggctgag aactggacag tggcaggggc tggagatggg tgtgtgtgtg   1200

tgtgtgtgtg tgtgtgtgtg tgtgcgcgcg cgccagtgca agaccgagat tgagggaaag   1260

catgtctgct gggtgtgacc atgtttcctc tcaataaagt tcccctgtga cactcaaaaa   1320
```

```
aaaaaaaaaa aaaaaa                                                    1336


<210> SEQ ID NO 30
<211> LENGTH: 8171
<212> TYPE: DNA
<213> ORGANISM: Homo sapiens

<400> SEQUENCE: 30

gaggcagggg tgagaccggc ggccacccgt gagccctccg cacccgcacc atgcagaaga     60

gcgtgcgcta caacgagggg cacgccctgt acctggcctt tctggcgcgc aaggagggca    120

ccaagcgcgg cttcctgagt aagaagacgg ccgaggcgag ccgctggcac gagaagtggt    180

tcgccctcta ccagaatgtg ctcttctact tcgagggcga gcagagctgc cgcccggcgg    240

gcatgtacct cctggagggc tgcagctgcg aacgaacgcc cgcgccaccc agggccggcg    300

ccgggcaggg aggcgtccga gacgcgctgg acaagcagta ttactttact gttctttttg    360

gccatgaagg tcagaagcca ctggagctgc gctgtgagga ggagcaggat ggtaaagagt    420

ggatggaggc cattcaccaa gccagttatg cagacatttt gattgagagg gaagtattaa    480

tgcagaagta cattcatcta gttcagatcg tagagacaga aaaaattgca gctaaccaac    540

tccgacatca acttgaagat caagacacag aaatcgaaag gcttaaatca gagattattg    600

ctcttaataa aaccaaagaa cgaatgcgac cttaccaaag caaccaagaa gacgaagatc    660

cagacatcaa gaagattaaa aaggttcaga gcttcatgcg aggatggttg tgcagaagga    720

aatggaagac catcgtgcag gattacattt gttctcctca tgctgaaagt atgaggaaga    780

gaaaccagat tgtgttcacc atggtggagg cagagtcaga gtacgttcac cagctctaca    840

tcctggtcaa tggctttctc cggcccctgc gtatggccgc cagctccaag aagcccccca    900

tcagccacga cgacgtcagc agtatttttc ttaacagtga aacaatcatg tttcttcatg    960

aaatatttca tcaaggacta aaggcaagga tagcaaactg gcccacttta attttagctg   1020

atctgtttga tattttgctc cccatgctga acatttatca agaatttgtg cgtaatcacc   1080

agtacagcct gcaagttctc gccaattgta agcaaaacag agattttgac aaactcttaa   1140

aacagtatga agccaatcca gcctgtgagg ggaggatgct ggagacattc ttgacctatc   1200

ccatgtttca gatccccaga tatatcatca cactccatga gctccttgct cacacacccc   1260

atgagcatgt ggaaaggaaa agcctggagt ttgccaaatc aaagctagag gaactatcca   1320

gagtaatgca cgatgaagtc agcgacactg aaaacataag gaaaaacctt gccatcgaaa   1380

gaatgatcgt ggagggctgt gacatcttgc tggacaccag ccaaacgttc atccgccaag   1440

gttctcttat tcaagtacct tccgttgaga gggggaaact tagtaaagtt cgcctgggtt   1500

cgttgtcttt gaaaaaggaa ggagagagac aatgcttctt atttacaaaa cactttttaa   1560

tatgtacaag aagttcagga gggaagcttc atctgctcaa gacaggtggg gttctgtctc   1620

taatagactg cacattgatt gaggagccag atgcaagcga tgatgactct aaaggttctg   1680

ggcaagtgtt tgggcacctg gattttaaaa tagtggtgga gcctcctgac gctgccgcct   1740

tcactgttgt cttgttagca ccctcacgcc aggagaaagc tgcctggatg agtgacatca   1800

gtcagtgtgt ggacaatata cgatgtaatg gtttaatgac tatagtgttt gaagagaatt   1860

ccaaagtcac tgtgccacat atgattaagt ctgatgcccg tcttcataaa gacgacactg   1920

acatttgctt cagtaaaaca ctcaactcct gcaaagtgcc ccagatccgt tatgccagcg   1980

tggagcgcct cttggaacga ctgacagact tgcggtttct tagtattgat ttcctcaaca   2040

cctttctgca cacctatcgt attttcacta ctgccgctgt ggtgctgggg aaactctccg   2100
```

```
acatatacaa gaggcctttc acctccatcc ctgtcaggtc attggaattg ttttttgcta   2160
ccagccagaa caacagaggt gaacatttgg tggatggcaa atccccacgt ctgtgtcgca   2220
aattctcttc cccgccacca ctggctgtgt ccagaacatc ttccccagtg agggccagaa   2280
agctgtcttt gacttctccc ttgaactcaa agataggagc attggacctg acaacttcca   2340
gcagtcccac caccaccacc cagagtcccg ctgcgtctcc accaccacac actggtcaga   2400
taccactgga tctcagcaga ggcctctctt ctccagagca aagcccggga acggtagaag   2460
agaatgtcga taacccacgc gtggatctgt gtaacaagct aaaacgaagt attcaaaaag   2520
cagtcctaga gtctgcacca gcggaccgag caggagtgga aagctcccct gcagcggaca   2580
ccacagaact ttcaccttgc agatcccccct caactcctcg gcacctccgc tatcgacagc   2640
ctggaggaca gacggcggac aatgcccact gctctgtttc accggcttct gcttttgcaa   2700
tagccacagc tgcagcagga catgggagtc caccaggctt taacaacacc gagagaacat   2760
gtgataaaga gtttattata cggagaacgg ctaccaatcg agttctgaac gtcctccgtc   2820
actgggtctc aaagcacgca caggatttcg aactcaacaa tgaactaaag atgaatgtcc   2880
taaatttgct agaagaagtt ttgcgagacc cagaccttct tccccaagaa aggaaagccg   2940
ccgcgaatat cctcagggcc ctttcacaag atgaccaaga tgacatccac ctaaaattag   3000
aggatataat tcaaatgact gactgcatga aggccgaatg ctttgagtcc ttgtcggcca   3060
tggagctggc agaacagatc accctcctgg accatgtcat tttcagaagc attccctacg   3120
aggagtttct tgggcagggg tggatgaagc tggataaaaa cgaaagaact ccttacatta   3180
tgaaaaccag ccaacacttc aatgacatga gtaacctggt ggcctcccag ataatgaact   3240
atgctgatgt cagctcccgt gccaacgcca tcgagaaatg ggtggcagtg gcggacatct   3300
gccgatgcct gcacaactac aacggcgtgc tggagatcac ctcggcctta aacagaagtg   3360
ccatctacag gctgaagaaa acctgggcca aggtctctaa gcagacaaaa gctctaatgg   3420
acaaacttca aaagactgtt tcctctgaag gaagatttaa aaatcttaga gaaaccctta   3480
aaaattgtaa ccctcctgca gttccttatc ttgggatgta cttgacagac ctggcattta   3540
ttgaagaagg aacaccaaac tttactgagg aaggccttgt caatttctcc aaaatgagaa   3600
tgatatcaca catcatcaga gagatacgcc agttccagca gacttcctac agaatagatc   3660
atcagccaaa ggtcgcacag tacttgcttg acaaagacct tatcatagat gaagatacgc   3720
tatatgagct gtcactaaaa attgaacctc gactccctgc ttgaagatct ggccttgccc   3780
ctgagtccac gggatgttca tggaaagcag gacagacaga attgtgtatg ccttgcctat   3840
cacggtacag cacgaagcca ggctcctttc tccaccaaag aagatggaac cagactggaa   3900
ttctgtctcc agagagaaac ccagctgttt gggtcaaaga cagatgcttc agacttgggt   3960
gggaaggtga aagatggcta tttagaaagc tggtggcacg ttttacataa gggaatgtca   4020
gatgggagat gctagttgcc attttaacaa agcaggtaaa tcggtaaatt ttaaactctg   4080
tccatgttct gttagaactc agggacaagg atccatgaaa aagacctgtg atgtttctct   4140
ggcgctttac tggcctgggc acacctacca atcttctagg atttgactgg ttccattaca   4200
tttccttttg gtataagctt cacagaaaag ctgacacttc ctctacagag atggaccaaa   4260
acataagcaa tttcagtcta cagcatgtgc atggttgtca gtgcattcta aatatttcta   4320
tgtgaggaat ggtaccttct gaaactgcct ttccagtctt taggcaatgg gataggaaag   4380
aaagaatgaa acacaaatgg atttgtatgt aacatttcct taattaaatg cagtaggctg   4440
```

```
tgccccagag gattccagac agtggctggc tgaggtgggt ggggagcttt tccttgagac   4500
tgttggtcct aagaagccag ccctttttgga gaggcagctg caaaaaggtg cacgcccatc   4560
tcaccgacaa aactgtggaa cagaaggcca ccaagtgctg tggggaatca tgggtttcag   4620
tgctgagtga aaatctatac ctaaaaatca tctctgcacc ttgctttgtt tgttttcttt   4680
ccccactcat agtactgcag gaatctattc tcatttacac agaccttttt ttaggcttac   4740
tatgaacatt ggctgtattt tttttaaaca gtttagtgaa attttctttt caaaacccac   4800
acttccatat gctgttcgta gatctctttc tttaaaaact gatgttgaga gatctctgag   4860
aatattataa gtgcatggga aatgggccca accaccgaac agctcttaca ttacaaaacc   4920
aaatgcaagg gttagtcctg ctacctgagg ctggggaagt gaccttcctt ttcccaagat   4980
tgtcagttgt tgaagaaata gggctatctc attgtttacc tccctcttct cttctcaggg   5040
agactgctgc tttaaaagaa ggaagagaaa aaatatagtt ctatttccct gaacctgttg   5100
cacctgacat tttctcttag cagcatgaaa cttattgatg ctgacaatga aaaatggatc   5160
tgtctggctg ctttccctct ttccttgcac tttaattatg ttgctagagc taacagacta   5220
ataaattcca cctgctggct cttaagactc agtgaaagag ctagcattgg taatgcacca   5280
tagaggtaga gaatgtacac tttctgcacg gtaagtgcca tctctgtatg taactatata   5340
gtgaaatatc aactaagtaa aagaaaatat aatatttgaa gaccattccc aaaatatttt   5400
caatagttca tattagccaa cagtgtagca ctcaacccaa ggagggttcc ttatggatgc   5460
tttctttttc ttttttaaag ttgcttgttt gttctcttta gtttcaaata agaggttgac   5520
gcatcttgat gcatgatgag aagcatgggc tgtttggatc ctaacaacgc ataacttgtg   5580
atttatttct cagtgctcca gaaactgagg gtttgaaata atatgtatca gttgcaccaa   5640
acacctcaag gtcttgcaga agaaaagtaa aggttagctt tcatggctca aaagcatagt   5700
cctgaagggt gaactaaaac cgggacaaat ctgtgagagg accacacaca tactagtttc   5760
gggccaaaca acacgtggaa aggtgcatgc attctactct gccttggagt tgccagagtc   5820
cttcagaggg aaagggatgg ttctgtgtgc actttttctg gaagttcgga ctcatttctt   5880
tgacccaaat gttccagaga cactgcagcc attcttatta acaaaaaata agacaggagt   5940
ttccaaatgc tccttccctt ttggatcgca gcttttcttc aactagtgac aaagcttttg   6000
cgcctatttc ctgcaggatg ttggaactgc cccgcactgg tcatattagg cactgtcaat   6060
tgctatgctg acttttaggg ggtttttgtt tgtttgaaaa acagggtctc accatgttgc   6120
ccaggctggt ctcgaactcc tggactcaag caatcttcct gcctcagcct ctcaagcagc   6180
tgggactgca ggggtgtgcc actcactagc ctttcgcatt tttgtttgag aattacacca   6240
ctttctggag tctgcagcct tcctggagct gcaagagggc aagagagaga gctccacctc   6300
tgagggagtg tctgttgatg acctgcacta ttcgtgtgcc agctgggaga ggaatgcaca   6360
ttttaaaatc ccttcaattt ggtcaaatta aaaatcccca agagcaattt gcagtgtttt   6420
ttctggtcgt taaagtaccc atcctcttct gcctacacac aaagcatgca ttcccagctg   6480
catctgcctc tagtccatta tggagaccca tttctaagag gagatgggag gtcaacctct   6540
aacagccaag tagcgaacat gtatactgta aaattaacct agaaaatcag aagaaaaatc   6600
caatttcatg ctttcgaatg aatgcccaca ttttgtactg tcaacgaaat tatcttggag   6660
cttttagggg atgccttttc gttattaact gagacatcta gttttgctac agggacaaat   6720
ctcttaccta atccaatata ttatttgaca gattcaggca tgaagtaaaa cgtcgtcact   6780
tttccttagt gcttttctga aggaatttaa agacggaatt ttaaacggcc attgcaatat   6840
```

```
tttcaagtgg ctctcatacc aagtcccatt actgtttgtt aaatttcagt acgtcttaaa   6900
gtactactta taaacaaatg aaactcagag aaactgaatc acctggaaga gaaaaatcca   6960
ttatggtccc atgtggagtg aataatgatg gatcagcacc ctttctctca tgttattgta   7020
taagacgaga cttttgggcc agcagcgatt gggcagcttt taaattctta actgaaaaga   7080
gtaatgcaat acagggatta ttcccaataa aattaacttt tatttaaaag caagagattt   7140
tacttagctt tttttttca aagtttgatt ttatcccctt gaaaaaaaat ctcttcactt   7200
taaagtataa aggtttttaa aaatccaatt gcaaaatgta ttatttttac aactatcgaa   7260
aaggcataaa agagaacata ctatttatgg ctgaagggta tagccaggct aatgtgcaca   7320
gagggaatca ataaataaaa ctctttttca tttcagtaag aaatcagatt gtaagtttaa   7380
tggctccatt atagatacca ccgtgtaata gaagacttaa gtcaatgaaa tctaatcagt   7440
gtgtcatttc tcagcggcca ttggtgactt aaaattaaga tgaggcagag ccaaaatgga   7500
aaacagtcat tttgttgtag gtataaacac atgaacgatt cagaaaatta ttcatctcag   7560
ctgccatgca gcatgacatt aacattagga ttgatagcac tagtctgatc tgctcaagga   7620
aaataatagt tctattatac ttaatgatgt tggtttttac acagctcatt tcatttttca   7680
ctagaaagcc agttatgaaa gagagctggc ctaggcatcc cggccctgag tcctaggccc   7740
agtctccaac tggaaaacct taggctggtg tttacacatc cctgagcctc agtttcctca   7800
tctgcaaaac ggtgtgaata gtaatccctg tgctgcttat ctcacagggc tattgtgagg   7860
accaaatgga ttagactgta aactgcaaag tgctgtccgc acatgaggtc atctgattac   7920
tgtcctcaga tctcttttgt agaggatttc aatgtatttc tttatcattt gagtgtgtgt   7980
gtgatggacg aatatgtgtg tgagtttgag aagcatatcg ttcgtgtcca gttactttgc   8040
aaatttgtgg acatttgtga ttggacagag gggtttgtgc tgtggcctaa cacttgccaa   8100
gtgaggtgta ggttatgcct atatgcaaat taaacttcac ctttcttgaa tattcaaaaa   8160
aaaaaaaaaa a                                                        8171
```

<210> SEQ ID NO 31
<211> LENGTH: 2089
<212> TYPE: DNA
<213> ORGANISM: Homo sapiens

<400> SEQUENCE: 31

```
agtttggacg gctgcttccc accagcaaag accacgactg gagagccgag ccggaggcag     60
ctgggaaaca tgaagagcgt cttgctgctg accacgctcc tcgtgcctgc acacctggtg    120
gccgcctgga gcaataatta tgcggtggac tgccctcaac actgtgacag cagtgagtgc    180
aaaagcagcc cgcgctgcaa gaggacagtg ctcgacgact gtggctgctg ccgagtgtgc    240
gctgcagggc ggggagaaac ttgctaccgc acagtctcag gcatggatgg catgaagtgt    300
ggcccggggc tgaggtgtca gccttctaat ggggaggatc cttttggtga agagtttggt    360
atctgcaaag actgtcccta cggcaccttc gggatggatt gcagagagac ctgcaactgc    420
cagtcaggca tctgtgacag ggggacggga aaatgcctga aattcccctt cttccaatat    480
tcagtaacca agtcttccaa cagatttgtt tctctcacgg agcatgacat ggcatctgga    540
gatggcaata ttgtgagaga agaagttgtg aaagagaatg ctgccgggtc tcccgtaatg    600
aggaaatggt taaatccacg ctgatcccgg ctgtgatttc tgagagaagg ctctattttc    660
gtgattgttc aacacacagc caacatttta ggaactttct agattatagc ataaggacat    720
```

```
gtaatttttg aagaccaaat gtgatgcatg gtggatccag aaaacaaaaa gtaggatact    780
tacaatccat aacatccata tgactgaaca cttgtatgtg tttgttaaat attcgaatgc    840
atgtagattt gttaaatgtg tgtgtatagt aacactgaag aactaaaaat gcaatttagg    900
taatcttacg tggagacagg tcaaccaaag agggagctag gcaaagctga agaccgcagt    960
gagtcaaatt agttctttga ctttgatgta cattaatgtt gggatatgga atgaagactt   1020
aagagcagga gaagatgggg agggggtggg agtgggaaat aaaatattta gcccttcctt   1080
ggtaggtagc ttctctagaa tttaattgtg ctttttttt tttttttggc tttgggaaaa   1140
gtcaaaataa aacaaccaga aaacccctga aggaagtaag atgtttgaag cttatggaaa   1200
tttgagtaac aaacagcttt gaactgagag caatttcaaa aggctgctga tgtagttccc   1260
gggttacctg tatctgaagg acggttctgg ggcataggaa acacatacac ttccataaat   1320
agctttaacg tatgccacct cagagataaa tctaagaagt attttaccca ctggtggttt   1380
gtgtgtgtat gaaggtaaat atttatatat ttttataaat aaatgtgtta gtgcaagtca   1440
tcttccctac ccatatttat catcctcttg aggaaagaaa tctagtatta tttgttgaaa   1500
atggttagaa taaaactatg actctataag gttttcaaac atctgaggca tgataaattt   1560
attatccata attatagtaa taataacctt aataagcata agaaaaacag agtcactctg   1620
gatttcaaaa atgtcaaaaa atgagcaaca gagggtcctt atttaaacat aagtgctgtg   1680
acttaggtga attttcaatt taaggtagaa aataagtttt taggaggttt gtaaaagaag   1740
aatcaatttt cagcagaaaa catgtcaact ttaaaatata gtttattttc atattttttt   1800
cttttaaact tggttgataa gtggaattag gagtatattt gaaagaatct tagcacaaac   1860
aggactgttg tactagatgt tcttaggaaa tatctcagaa gtattttatt tgaagtgaag   1920
aacttattta agaattattt cagtatttac ctgtatttta ttcttgaagt tggccaacag   1980
agttgtgaat gtgtgtggga aggcctttga atgtaaagct gcataagctg ttaggttttg   2040
ttttaaaagg acatgtttat tattgttcaa taaaaaagaa caagataca               2089
```

<210> SEQ ID NO 32
<211> LENGTH: 7686
<212> TYPE: DNA
<213> ORGANISM: Homo sapiens

<400> SEQUENCE: 32

```
tttatagcag cagtagaaat ataccaccct agaggacaca cctcctttta gctaggtacc     60
tataaatgtc caggattttc tattcaattg agaagaaccc agcaaaatgg ggatctccac    120
agtcatcctt gaaatgtgtc ttttatgggg acaagttcta tctacaggtg ggtggatccc    180
aaggactaca gactacgctt cactgattcc ctcggaggtg cccttggatc caactgtagc    240
agaaggttct ccatttccct cggagtcgac cctggagtca actgtagcag aaggttctcc    300
gatttccttg gagtcaaccc tggagtcaac cgtagcagaa ggttctctga ttccctcaga    360
gtcaaccctg gagtcaactg tagcagaagg atctgattct ggtttggccc tgaggctggt    420
gaatggagat ggcaggtgtc agggccgagt ggagatccta taccgaggct cctggggcac    480
cgtgtgtgat gacagctggg acaccaatga tgccaacgtg gtctgtaggc agctgggttg    540
tggctgggcc atgtcagctc caggaaatgc ctggtttggc cagggctcag gacccattgc    600
cctggatgat gtgcgctgct caggacacga atcctacctg tggagctgcc cccacaatgg    660
ctggctctcc cataactgtg gccatggtga agatgctggt gttatctgct cagctgccca    720
gcctcagtca acactcaggc cagaaagttg gcctgtcagg atatcaccac ctgtacccac    780
```

```
agaaggatct gaatccagtt tggccctgag gctggtgaat ggaggcgaca ggtgtcgagg    840
ccgagtggag gtcctatacc gaggctcctg gggcaccgtg tgtgatgact actgggacac    900
caatgatgcc aatgtggtct gcaggcagct gggctgtggc tgggccatgt cagccccagg    960
aaatgcccag tttggccagg gctcaggacc cattgtcctg gatgatgtgc gctgctcagg   1020
acatgagtcc tacctgtgga gctgccccca caatggctgg ctcacccaca actgtggcca   1080
tagtgaagac gctggtgtca tctgctcagc tccccagtcc cggccgacac ccagcccaga   1140
tacttggccg acctcacatg catcaacagc aggacctgaa tccagtttgg ccctgaggct   1200
ggtgaatgga ggtgacaggt gtcagggccg agtggaggtc ctataccgag gctcctgggg   1260
caccgtgtgt gatgatagct gggacaccag tgacgccaat gtggtctgcc ggcagctggg   1320
ctgtggctgg gccacgtcag ccccaggaaa tgcccggttt ggccagggtt caggacccat   1380
tgtcctggat gacgtgcgct gctcaggcta tgagtcctac ctgtggagct gcccccacaa   1440
tggctggctc tcccataact gtcagcacag tgaagacgct ggtgtcatct gctcagctgc   1500
ccactcctgg tcgacgccca gtccagacac gttgccgacc atcaccttac ctgcatcgac   1560
agtaggatct gaatccagtt tggccctgag gctggtgaat ggaggtgaca ggtgtcaggg   1620
ccgagtggag gtcctatacc gaggctcctg gggcaccgtg tgtgatgaca gctgggacac   1680
caatgatgcc aatgtggtct gcaggcagct gggctgtggc tgggccatgt tggccccagg   1740
aaatgcccgg tttggtcagg gctcaggacc cattgtcctg gatgacgtgc gctgctcagg   1800
gaatgagtcc tacttgtgga gctgccccca caatggctgg ctctcccata actgtggcca   1860
tagtgaagac gctggtgtca tctgctcagg acctgaatcc agtttggccc tgaggctggt   1920
gaatggaggt gacaggtgtc agggccgagt ggaggtccta taccgaggct cttggggcac   1980
cgtgtgtgat gacagctggg acaccaatga tgccaatgtg gtctgcaggc agctgggctg   2040
tggctgggcc acgtcagccc caggaaatgc ccggtttggt cagggctcag gacccattgt   2100
cctggatgat gtgcgctgct caggacatga gtcctacctg tggagctgcc ccaacaatgg   2160
ctggctctcc cacaactgtg gccatcatga agatgctggt gtcatctgct cagctgccca   2220
gtcccggtcg acgcccaggc cagacacgtt gtcgaccatc acgttacctc catcgacagt   2280
aggatctgaa tccagtttga ccctgaggct ggtgaatgga agtgacaggt gtcagggccg   2340
agtagaggtc ctataccgag gctcctgggg caccgtgtgt gatgacagct gggataccaa   2400
tgatgccaat gtggtctgca ggcagctggg ctgtggctgg gccacgtcgg ccccaggaaa   2460
tgcccggttt ggccagggct caggacccat tgttctggat gatgtgcgct gctcaggaca   2520
cgagtcctac ctgtggagct gcccccacaa tggctggctc tcccacaact gtggccatca   2580
tgaagatgct ggtgtcatct gctcagtttc ccagtcccgg ccgacaccca gtccagatac   2640
ttggccgacc tcacatgcat caacagcagg acctgaatcc agtttggccc tgaggctggt   2700
gaatggaggt gacaggtgtc agggccgagt ggaggtccta taccgaggct cctggggcac   2760
cgtgtgtgat gatagctggg acaccagtga cgccaatgtg gtctgccggc agctgggctg   2820
tggctgggcc acgtcagccc caggaaatgc ccggtttggc cagggttcag gacccattgt   2880
cctggatgac gtgcgctgct caggctatga gtcctacctg tggagctgcc cccacaatgg   2940
ctggctctcc cataactgtc agcacagtga agacgctggt gtcatctgct cagctgccca   3000
ctcctggtcg acgcccagtc cagacacatt gccgaccatc accttgcctg catcgacagt   3060
aggatctgaa tccagtttgg ccctgaggct ggtgaatgga ggtgacaggt gtcagggccg   3120
```

```
agtggaggtc ctataccaag gctcctgggg caccgtgtgc gatgacagct gggacaccaa   3180
tgatgccaat gtcgtctgca ggcaactggg ctgtggctgg gccatgtcag ccccaggaaa   3240
tgcccggttt ggtcagggct caggacccat tgtcctggat gatgtgcgct gctcaggaca   3300
cgagtcttac ctgtggagct gcccccacaa tggctggctc tcccacaact gtggccatag   3360
tgaagacgct ggtgtcatct gctcagcttc ccagtcccgg ccaacaccta gtccagacac   3420
ttggccaacc tcacatgcat caacagcagg atctgaatcc agtttggccc tgaggctggt   3480
gaatggaggt gacaggtgtc agggccgagt ggaggtccta taccgaggct cctggggcac   3540
cgtgtgtgat gactactggg acaccaatga tgccaatgtg gtttgcaggc agctgggctg   3600
tggctgggcc atgtcagccc caggaaatgc ccggtttggc cagggttcag gacccattgt   3660
cctggatgat gtgcgctgct caggacatga gtcctatctg tggagctgcc cccacaatgg   3720
ctggctctcc cacaactgtg gccatcatga agacgctggt gtcatctgct cagcttccca   3780
gtcccagccg acacccagcc cagacacttg gccaacctca catgcatcaa cagcaggatc   3840
tgaatccagt ttggccctga ggctggtgaa tggaggtgac aggtgtcagg gccgagtgga   3900
ggtcctatac cgaggctcct ggggcaccgt gtgtgatgac tactgggaca ccaatgatgc   3960
caatgtggtt tgcaggcagc tgggctgtgg ctgggccacg tcagccccag gaaatgcccg   4020
gtttggccag ggttcaggac ccattgtcct ggatgatgtg cgctgctcag gacatgagtc   4080
ctatctgtgg agctgccccc acaatggctg gctctcccac aactgtggcc atcatgaaga   4140
cgctggtgtc atctgctcag cttcccagtc ccagccgaca cccagcccag acacttggcc   4200
aacctcacat gcatcaacag caggatctga atccagtttg gccctgaggc tggtgaatgg   4260
aggtgacagg tgtcagggcc gagtggaggt cctataccga ggctcctggg gcaccgtgtg   4320
tgatgactac tgggacacca atgatgccaa tgtggtttgc aggcagctgg gctgtggctg   4380
ggccacgtca gccccaggaa atgcccggtt tggccagggt tcaggaccca ttgtcctgga   4440
tgatgtgcgc tgctcaggac atgagtccta tctgtggagc tgcccccaca atggctggct   4500
ctcccacaac tgtggccatc atgaagacgc tggtgtcatc tgctcagctt cccagtccca   4560
gccgacaccc agcccagaca cttggccaac ctctcgtgca tcaacagcag gatctgaatc   4620
cactttggcc ctgagactgg tgaatggagg tgacaggtgt cgaggccgag tggaggtcct   4680
ataccaaggc tcctggggca ccgtgtgtga tgactactgg gacaccaatg atgccaacgt   4740
ggtctgcagg cagctgggct gtggctgggc catgtcagcc ccaggaaatg cccagtttgg   4800
ccagggctca ggacccattg tcctggatga tgtgcgctgc tcaggacacg agtcttacct   4860
gtggagctgc ccccacaatg gctggctctc ccacaactgt ggccatcatg aagatgctgg   4920
tgtcatctgc tcagctgctc agtcccagtc aacgcccagg ccagatactt ggctgaccac   4980
caacttaccg gcattgacag taggatctga atccagtttg gctctgaggc tggtgaatgg   5040
aggtgacagg tgtcgaggcc gagtggaggt cctgtatcga ggctcctggg gaaccgtgtg   5100
tgatgacagc tgggacacca atgatgccaa tgtggtctgc aggcagctgg gctgtggctg   5160
ggccatgtcg gccccaggaa atgcccggtt tggccagggc tcaggaccca ttgtcctgga   5220
tgatgtgcgc tgctcaggga atgagtccta cctgtggagc tgcccccaca aaggctggct   5280
cacccacaac tgtggccatc acgaagacgc tggtgtcatc tgctcagcca cccaaataaa   5340
ttctactacg acagattggt ggcatccaac aactacaacc actgcaagac cctcttcaaa   5400
ttgtggtggc ttcttattct atgccagtgg gacattctcc agcccatcct accctgcata   5460
ctaccccaac aatgctaagt gtgtttggga aatagaagtg aattctggtt atcgcataaa   5520
```

```
cctgggcttc agtaatctga aattggaggc acaccataac tgcagttttg attatgttga   5580
aatctttgat ggatcattga atagcagtct cctgctgggg aaaatctgta atgataccag   5640
gcaaatattt acatcttctt acaaccgaat gaccattcac tttcgaagtg acatcagttt   5700
ccaaaacact ggctttttgg cttggtataa ctccttccca agcgatgcca ccttgaggtt   5760
ggtcaattta aattcatcct atggtctatg tgccgggcgt gtagaaattt accatggtgg   5820
cacctggggg acagtttgtg atgactcctg gaccattcag gaagctgagg tggtctgcag   5880
acagctaggg tgtggacgtg cagtttcagc ccttggaaat gcatattttg gctctggctc   5940
tggccccatc accctggacg atgtagagtg ctcagggacg gaatccactc tctggcagtg   6000
ccggaaccga ggctggttct cccacaactg taatcatcgt gaagatgctg gtgtcatctg   6060
ctcaggaaac catctatcga cacctgctcc ttttctcaac atcacccgtc caaacacaga   6120
ttattcctgc ggaggcttcc tatcccaacc atcaggggac ttttccagcc cattctatcc   6180
cgggaactat ccaaacaatg ccaagtgtgt gtgggacatt gaggtgcaaa acaactaccg   6240
tgtgactgtg atcttcagag atgtccagct tgaaggtggc tgcaactatg attatattga   6300
agttttcgat ggcccctacc gcagttcccc tctcattgct cgagtttgtg atggggccag   6360
aggctccttc acttcttcct ccaacttcat gtccattcgc ttcatcagtg accacagcat   6420
cacaaggaga gggttccggg ctgagtacta ctccagtccc tccaatgaca gcaccaacct   6480
gctctgtctg ccaaatcaca tgcaagccag tgtgagcagg agctatctcc aatccttggg   6540
cttttctgcc agtgaccttg tcatttccac ctggaatgga tactacgagt gtcggcccca   6600
gataacgccg aacctggtga tattcacaat tccctactca ggctgcggca ccttcaagca   6660
ggcagacaat gacaccatcg actattccaa cttcctcaca gcagctgtct caggtggcat   6720
catcaagagg aggacagacc tccgtattca cgtcagctgc agaatgcttc agaacacctg   6780
ggtcgacacc atgtacattg ctaatgacac catccacgtt gctaataaca ccatccaggt   6840
cgaggaagtc cagtatggca attttgacgt gaacatttcc ttttatactt cctcatcttt   6900
cttgtatcct gtgaccagcc gcccttacta cgtggacctg aaccaggact tgtacgttca   6960
ggctgaaatc ctccattctg atgctgtact gaccttgttt gtggacacct gcgtggcatc   7020
accatactcc aatgacttca cgtctttgac ttatgatcta atccggagtg gatgcgtgag   7080
ggatgacacc tacggaccct actcctcgcc atctcttcgc attgcccgct tccggttcag   7140
ggccttccac ttcctgaacc gcttcccctc cgtgtacctg cgttgtaaaa tggtggtgtg   7200
cagagcgtat gacccctctt cccgctgcta ccgaggctgt gtgttgaggt cgaagaggga   7260
tgtgggctcc taccaggaaa aggtggacgt cgtcctgggt cccatccagc tgcagacccc   7320
cccacgccga gaagaggagc ctcggtaggt ggtcgctctc agaccccact gtccaccggg   7380
gcgcagaccc ctgactcggg gacttgggat gttcctcttg gtgtcatatt ccaactcaga   7440
ttgagcccta cattgtgctg cacctggtca tacggagttg aatcagacct ggttcccgcc   7500
tcccccaagg ctcatggtcc ttggaggacc cgttgcaggg tgaggtcaag agagttctga   7560
cctggatggc ccatagacct gacgtcccag aatccatgct tctcatctgc aaaatgaaaa   7620
tgtcaatact tacttcttag cactgttgag agggttactt acataaagga attttggtga   7680
aactgc                                                              7686
```

<210> SEQ ID NO 33
<211> LENGTH: 1665
<212> TYPE: DNA

<213> ORGANISM: Homo sapiens

<400> SEQUENCE: 33 agttggaggg aggcagggaa tctggcttga ttggcgtgct gagacgcacc tggcgcaacc 60 ctcccttctg aatcgaagtt caagtcccgc ggacactgca accatgaagg agagacgggc 120 cccccagcca gtcgtggcca gatgtaagct cgttctggtc ggggacgtgc agtgtgggaa 180 gaccgcgatg ttgcaagtgt tagcgaagga ttgctatcca gagacctatg tgcccaccgt 240 gttcgaaaat tacacagcct gtttggagac agaggaacag agggtggagc ttagtctctg 300 ggatacctca ggatctccct actacgataa tgtccgtcca ctctgctaca gcgactcgga 360 tgcagtatta ctatgttttg acatcagccg tccagagaca gtggacagcg cactcaagaa 420 gtggaggaca gaaatcctag attattgtcc cagcacccgc gttttgctca ttggctgcaa 480 gacagacctg cgaacagacc tgagtactct gatggagctg tcccaccaga agcaggcgcc 540 catctcctat gagcagggtt gtgcaatagc aaagcagctg ggtgcagaaa tctacctgga 600 aggctcagct ttcacctcag aaaagagcat ccacagcatc tttcggacgg catccatgct 660 gtgtctgaac aagcctagcc cactgcccca gaagagccct gtccgaagcc tctccaaacg 720 actgctccac ctccccagtc gctctgaact catctcttct accttcaaga aggaaaaggc 780 caaaagctgt tccattatgt gaagtggaaa ttggaggggg gagacaaccc cctacttcct 840 cccttggggt gcagaggcac ggggagaggg aggatgagac aatttaggac actggacatg 900 agtttttcag atggccacgg tgagggcttg gaaggagaca ggaatggggc gaggaaggag 960 ccaggcccgg catgaggacc tgacgctgag agagaaccat catacccccaa gccaggcact 1020 agattttgga gggggcgact accccagtgc ccccccccgct ccagaggaag gaaagctgtg 1080 ggggacgggg ggcatgctgg cctcatgggc ttgggggcct acagcagcct caccttcagc 1140 ttcatgcctc ttccacacag cgtttccatg caggtcaggg gatgggaggg gtccctgagc 1200 ccttcccttc ccctctaagg aggcagcaac ggagagtggg gaagtggagc ggcagctccc 1260 ttgggggctt agcccaggtg cttcgtaact gcaatcggaa gtgcaggagc tggtcagagc 1320 caatgagaag gaaacctcat ctttgcatag cccatgcctc atggagaggt gacatcatac 1380 attcacatgc ttctcaccta agtccccagg gtccaaggga gaagccccag accccccttct 1440 cttgcagagt gtgggggtgg tggtgctgca ggggcagggc tgggtggggg tcaccagact 1500 ttttctgccc ttagggtagt acagctggca tttgttttat agactcttgt ctttggaatt 1560 gggggggaggg ggggagtgtt tcaatctgtt atatgttctg tgtttaatga agaaaaccta 1620 tttattaatg aaaaatataa tacatataaa gaatttggct ccgta 1665

<210> SEQ ID NO 34
<211> LENGTH: 1849
<212> TYPE: DNA
<213> ORGANISM: Homo sapiens

<400> SEQUENCE: 34 gggttatatg atctctttgg ctttagggaa ttactccata ccagctctga gatttccagc 60 tcagcgatgc ccccaggtcc ctgggagagc tgcttctggg tgggggggcct cattttgtgg 120 ctcagcgttg gaagttcagg ggatgcacct cctaccccac agccaaagtg cgctgacttc 180 cagagcgcca accttttttga aggcaccgat ctcaaagtcc agtttctcct ctttgtccct 240 tcgaatccta gctgtgggca gctagtagaa ggaagcagtg acctccaaaa ctctgggttc 300 aatgccactc tgggaaccaa actaattatc catggattca gggttttagg aacaaagcct 360

```
tcctggattg acacatttat tagaaccctt ctgcgtgcaa cgaatgctaa tgtgattgcc    420
gtggactgga tttatgggtc tacaggagtc tacttctcag ctgtgaaaaa tgtgattaag    480
ttgagcctcg agatctccct tttcctcaat aaactcctgg tgctgggtgt gtcggaatcc    540
tcaatccaca tcattggtgt tagcctgggg gcccacgttg ggggcatggt gggacagctc    600
ttcggaggcc agctgggaca gatcacaggc ctggaccccg ctggacctga gtacaccagg    660
gccagtgtgg aagagcgctt ggatgctgga gatgccctct tcgtggaagc catccacaca    720
gacaccgaca atttgggtat tcggattccc gttggacatg tggactactt cgtcaacgga    780
ggccaagacc aacctggctg ccccaccttc ttttacgcag gttatagtta tctgatctgt    840
gatcacatga gggctgtgca cctctacatc agcgccctgg agaattcctg tccactgatg    900
gcctttccct gtgccagcta caaggccttc cttgctggac gctgtctgga ttgctttaac    960
ccttttctgc tttcctgccc aaggatagga ctggtggaac aaggtggtgt caagatagag   1020
ccgctcccca aggaagtgaa agtctacctc ctgactactt ccagtgctcc gtactgcatg   1080
catcacagcc tcgtggagtt tcacttgaag gaactgagaa acaaggacac caacatcgag   1140
gttaccttcc ttagcagtaa catcacctct tcatctaaga tcaccatacc taagcagcaa   1200
cgctatggga aaggaatcat agcccatgcc accccacaat gccagataaa ccaagtgaaa   1260
ttcaagtttc agtcttccaa ccgagtttgg aaaaaagacc ggactaccat tattgggaag   1320
ttctgcactg cccttttgcc tgtcaatgac agagaaaaga tggtctgctt acctgaacca   1380
gtgaacttac aagcaagtgt gactgtttcc tgtgacctga agatagcctg tgtgtagttt   1440
aacctgggca ggacacatct ccctgcattt tttttttttt tttgagagag aggtgtgatg   1500
agggatgtgt gtgtgcagct tattgtagac cattactact aaggagaaaa gcaaagctct   1560
ttcttatttt cctcataatc agctaccctg gaggggaggg agaactcatt ttacagaact   1620
tggtttcctt tgccgatctt atgtacatac ccattttagc tttcccatgc atacttaact   1680
gcacttgctt tatctccttg ggcattcgta cttaggattc aatagaaaca tgtacagggt   1740
aaacaatttt ttaaaaataa aacttcatgg agtatctgaa aaaaaaaaaa aaaaaaaaaa   1800
aaaaaaaaaa aaaaaaaaaa aaaaaaaaaa aaaaaaaaaa aaaaaaaaa               1849
```

<210> SEQ ID NO 35
<211> LENGTH: 7656
<212> TYPE: DNA
<213> ORGANISM: Homo sapiens

<400> SEQUENCE: 35

```
tttatagcag cagtagaaat ataccaccct agaggacaca cctcctttta gctaggtacc     60
tataaatgtc caggattttc tattcaattg agaagaaccc agcaaaatgg ggatctccac    120
agtcatcctt gaaatgtgtc ttttatgggg acaagttcta tctacaggtg ggtggatccc    180
aaggactaca gactacgctt cactgattcc ctcggaggtg cccttggatc caactgtagc    240
agaaggttct ccatttccct cggagtcgac cctggagtca actgtagcag aaggttctcc    300
gatttccttg gagtcaaccc tggagtcaac cgtagcagaa ggttctctga ttccctcaga    360
gtcaaccctg gagtcaactg tagcagaagg atctgattct ggtttggccc tgaggctggt    420
gaatggagat ggcaggtgtc agggccgagt ggagatccta taccgaggct cctggggcac    480
cgtgtgtgat gacagctggg acaccaatga tgccaacgtg gtctgtaggc agctgggttg    540
tggctgggcc atgtcagctc caggaaatgc ctggtttggc cagggctcag gacccattgc    600
```

-continued

```
cctggatgat gtgcgctgct caggacacga atcctacctg tggagctgcc cccacaatgg    660
ctggctctcc cataactgtg gccatggtga agatgctggt gttatctgct cagctgccca    720
gcctcagtca acactcaggc cagaaagttg gcctgtcagg atatcaccac ctgtacccac    780
agaaggatct gaatccagtt tggccctgag gctggtgaat ggaggcgaca ggtgtcgagg    840
ccgagtggag gtcctatacc gaggctcctg gggcaccgtg tgtgatgact actgggacac    900
caatgatgcc aatgtggtct gcaggcagct gggctgtggc tgggccatgt cagccccagg    960
aaatgcccag tttggccagg gctcaggacc cattgtcctg gatgatgtgc gctgctcagg   1020
acatgagtcc tacctgtgga gctgccccca caatggctgg ctcacccaca actgtggcca   1080
tagtgaagac gctggtgtca tctgctcagc tccccagtcc cggccgacac ccagcccaga   1140
tacttggccg acctcacatg catcaacagc aggacctgaa tccagtttgg ccctgaggct   1200
ggtgaatgga ggtgacaggt gtcagggccg agtggaggtc ctataccgag gctcctgggg   1260
caccgtgtgt gatgatagct gggacaccag tgacgccaat gtggtctgcc ggcagctggg   1320
ctgtggctgg gccacgtcag ccccaggaaa tgcccggttt ggccagggtt caggacccat   1380
tgtcctggat gacgtgcgct gctcaggcta tgagtcctac ctgtggagct gcccccacaa   1440
tggctggctc tcccataact gtcagcacag tgaagacgct ggtgtcatct gctcagacac   1500
gttgccgacc atcaccttac ctgcatcgac agtaggatct gaatccagtt tggccctgag   1560
gctggtgaat ggaggtgaca ggtgtcaggg ccgagtggag gtcctatacc gaggctcctg   1620
gggcaccgtg tgtgatgaca gctgggacac caatgatgcc aatgtggtct gcaggcagct   1680
gggctgtggc tgggccatgt tggccccagg aaatgcccgg tttggtcagg gctcaggacc   1740
cattgtcctg gatgacgtgc gctgctcagg gaatgagtcc tacttgtgga gctgccccca   1800
caatggctgg ctctcccata actgtggcca tagtgaagac gctggtgtca tctgctcagg   1860
acctgaatcc agtttggccc tgaggctggt gaatggaggt gacaggtgtc agggccgagt   1920
ggaggtccta taccgaggct cttggggcac cgtgtgtgat gacagctggg acaccaatga   1980
tgccaatgtg gtctgcaggc agctgggctg tggctgggcc acgtcagccc caggaaatgc   2040
ccggtttggt cagggctcag gacccattgt cctggatgat gtgcgctgct caggacatga   2100
gtcctacctg tggagctgcc ccaacaatgg ctggctctcc cacaactgtg gccatcatga   2160
agatgctggt gtcatctgct cagctgccca gtcccggtcg acgcccaggc cagacacgtt   2220
gtcgaccatc acgttacctc catcgacagt aggatctgaa tccagtttga ccctgaggct   2280
ggtgaatgga agtgacaggt gtcagggccg agtagaggtc ctataccgag gctcctgggg   2340
caccgtgtgt gatgacagct gggataccaa tgatgccaat gtggtctgca ggcagctggg   2400
ctgtggctgg gccacgtcgg ccccaggaaa tgcccggttt ggccagggct caggacccat   2460
tgttctggat gatgtgcgct gctcaggaca cgagtcctac ctgtggagct gcccccacaa   2520
tggctggctc tcccacaact gtggccatca tgaagatgct ggtgtcatct gctcagtttc   2580
ccagtcccgg ccgacaccca gtccagatac ttggccgacc tcacatgcat caacagcagg   2640
acctgaatcc agtttggccc tgaggctggt gaatggaggt gacaggtgtc agggccgagt   2700
ggaggtccta taccgaggct cctggggcac cgtgtgtgat gatagctggg acaccagtga   2760
cgccaatgtg gtctgccggc agctgggctg tggctgggcc acgtcagccc caggaaatgc   2820
ccggtttggc cagggttcag gacccattgt cctggatgac gtgcgctgct caggctatga   2880
gtcctacctg tggagctgcc cccacaatgg ctggctctcc cataactgtc agcacagtga   2940
agacgctggt gtcatctgct cagctgccca ctcctggtcg acgcccagtc cagacacatt   3000
```

```
gccgaccatc accttgcctg catcgacagt aggatctgaa tccagtttgg ccctgaggct   3060
ggtgaatgga ggtgacaggt gtcagggccg agtggaggtc ctataccaag gctcctgggg   3120
caccgtgtgc gatgacagct gggacaccaa tgatgccaat gtcgtctgca ggcaactggg   3180
ctgtggctgg gccatgtcag ccccaggaaa tgcccggttt ggtcagggct caggacccat   3240
tgtcctggat gatgtgcgct gctcaggaca cgagtcttac ctgtggagct gcccccacaa   3300
tggctggctc tcccacaact gtggccatag tgaagacgct ggtgtcatct gctcagcttc   3360
ccagtcccgg ccaacaccta gtccagacac ttggccaacc tcacatgcat caacagcagg   3420
atctgaatcc agtttggccc tgaggctggt gaatggaggt gacaggtgtc agggccgagt   3480
ggaggtccta taccgaggct cctggggcac cgtgtgtgat gactactggg acaccaatga   3540
tgccaatgtg gtttgcaggc agctgggctg tggctgggcc atgtcagccc caggaaatgc   3600
ccggtttggc cagggttcag gacccattgt cctggatgat gtgcgctgct caggacatga   3660
gtcctatctg tggagctgcc cccacaatgg ctggctctcc cacaactgtg gccatcatga   3720
agacgctggt gtcatctgct cagcttccca gtcccagccg acacccagcc cagacacttg   3780
gccaacctca catgcatcaa cagcaggatc tgaatccagt ttggccctga ggctggtgaa   3840
tggaggtgac aggtgtcagg gccgagtgga ggtcctatac cgaggctcct ggggcaccgt   3900
gtgtgatgac tactgggaca ccaatgatgc caatgtggtt tgcaggcagc tgggctgtgg   3960
ctgggccacg tcagccccag gaaatgcccg gtttggccag ggttcaggac ccattgtcct   4020
ggatgatgtg cgctgctcag gacatgagtc ctatctgtgg agctgccccc acaatggctg   4080
gctctcccac aactgtggcc atcatgaaga cgctggtgtc atctgctcag cttcccagtc   4140
ccagccgaca cccagcccag acacttggcc aacctcacat gcatcaacag caggatctga   4200
atccagtttg gccctgaggc tggtgaatgg aggtgacagg tgtcagggcc gagtggaggt   4260
cctataccga ggctcctggg gcaccgtgtg tgatgactac tgggacacca atgatgccaa   4320
tgtggtttgc aggcagctgg gctgtggctg ggccacgtca gccccaggaa atgcccggtt   4380
tggccagggt tcaggaccca ttgtcctgga tgatgtgcgc tgctcaggac atgagtccta   4440
tctgtggagc tgcccccaca atggctggct ctcccacaac tgtggccatc atgaagacgc   4500
tggtgtcatc tgctcagctt cccagtccca gccgacaccc agcccagaca cttggccaac   4560
ctctcgtgca tcaacagcag gatctgaatc cactttggcc ctgagactgg tgaatggagg   4620
tgacaggtgt cgaggccgag tggaggtcct ataccaaggc tcctggggca ccgtgtgtga   4680
tgactactgg gacaccaatg atgccaacgt ggtctgcagg cagctgggct gtggctgggc   4740
catgtcagcc ccaggaaatg cccagtttgg ccagggctca ggacccattg tcctggatga   4800
tgtgcgctgc tcaggacacg agtcttacct gtggagctgc ccccacaatg gctggctctc   4860
ccacaactgt ggccatcatg aagatgctgg tgtcatctgc tcagctgctc agtcccagtc   4920
aacgcccagg ccagatactt ggctgaccac caacttaccg gcattgacag taggatctga   4980
atccagtttg gctctgaggc tggtgaatgg aggtgacagg tgtcgaggcc gagtggaggt   5040
cctgtatcga ggctcctggg gaaccgtgtg tgatgacagc tgggacacca atgatgccaa   5100
tgtggtctgc aggcagctgg gctgtggctg ggccatgtcg gccccaggaa atgcccggtt   5160
tggccagggc tcaggaccca ttgtcctgga tgatgtgcgc tgctcaggga atgagtccta   5220
cctgtggagc tgcccccaca aaggctggct cacccacaac tgtggccatc acgaagacgc   5280
tggtgtcatc tgctcagcca cccaaataaa ttctactacg acagattggt ggcatccaac   5340
```

```
aactacaacc actgcaagac cctcttcaaa ttgtggtggc ttcttattct atgccagtgg   5400
gacattctcc agcccatcct accctgcata ctaccccaac aatgctaagt gtgtttggga   5460
aatagaagtg aattctggtt atcgcataaa cctgggcttc agtaatctga aattggaggc   5520
acaccataac tgcagttttg attatgttga aatctttgat ggatcattga atagcagtct   5580
cctgctgggg aaaatctgta atgataccag gcaaatattt acatcttctt acaaccgaat   5640
gaccattcac tttcgaagtg acatcagttt ccaaaacact ggctttttgg cttggtataa   5700
ctccttccca agcgatgcca ccttgaggtt ggtcaattta aattcatcct atggtctatg   5760
tgccgggcgt gtagaaattt accatggtgg cacctggggg acagtttgtg atgactcctg   5820
gaccattcag gaagctgagg tggtctgcag acagctaggg tgtggacgtg cagtttcagc   5880
ccttggaaat gcatattttg gctctggctc tggccccatc accctggacg atgtagagtg   5940
ctcagggacg gaatccactc tctggcagtg ccggaaccga ggctggttct cccacaactg   6000
taatcatcgt gaagatgctg gtgtcatctg ctcaggaaac catctatcga cacctgctcc   6060
ttttctcaac atcacccgtc caaacacaga ttattcctgc ggaggcttcc tatcccaacc   6120
atcaggggac ttttccagcc cattctatcc cgggaactat ccaaacaatg ccaagtgtgt   6180
gtgggacatt gaggtgcaaa acaactaccg tgtgactgtg atcttcagag atgtccagct   6240
tgaaggtggc tgcaactatg attatattga agttttcgat ggcccctacc gcagttcccc   6300
tctcattgct cgagtttgtg atggggccag aggctccttc acttcttcct ccaacttcat   6360
gtccattcgc ttcatcagtg accacagcat cacaaggaga gggttccggg ctgagtacta   6420
ctccagtccc tccaatgaca gcaccaacct gctctgtctg ccaaatcaca tgcaagccag   6480
tgtgagcagg agctatctcc aatccttggg cttttctgcc agtgaccttg tcatttccac   6540
ctggaatgga tactacgagt gtcggcccca gataacgccg aacctggtga tattcacaat   6600
tccctactca ggctgcggca ccttcaagca ggcagacaat gacaccatcg actattccaa   6660
cttcctcaca gcagctgtct caggtggcat catcaagagg aggacagacc tccgtattca   6720
cgtcagctgc agaatgcttc agaacacctg ggtcgacacc atgtacattg ctaatgacac   6780
catccacgtt gctaataaca ccatccaggt cgaggaagtc cagtatggca attttgacgt   6840
gaacatttcc ttttatactt cctcatcttt cttgtatcct gtgaccagcc gcccttacta   6900
cgtggacctg aaccaggact tgtacgttca ggctgaaatc ctccattctg atgctgtact   6960
gaccttgttt gtggacacct gcgtggcatc accatactcc aatgacttca cgtctttgac   7020
ttatgatcta atccggagtg gatgcgtgag ggatgacacc tacggaccct actcctcgcc   7080
atctcttcgc attgcccgct tccggttcag ggccttccac ttcctgaacc gcttcccctc   7140
cgtgtacctg cgttgtaaaa tggtggtgtg cagagcgtat gacccctctt cccgctgcta   7200
ccgaggctgt gtgttgaggt cgaagaggga tgtgggctcc taccaggaaa aggtggacgt   7260
cgtcctgggt cccatccagc tgcagacccc cccacgccga gaagaggagc ctcggtaggt   7320
ggtcgctctc agaccccact gtccaccggg gcgcagaccc ctgactcggg gacttgggat   7380
gttcctcttg gtgtcatatt ccaactcaga ttgagcccta cattgtgctg cacctggtca   7440
tacggagttg aatcagacct ggttcccgcc tcccccaagg ctcatggtcc ttggaggacc   7500
cgttgcaggg tgaggtcaag agagttctga cctggatggc ccatagacct gacgtcccag   7560
aatccatgct tctcatctgc aaaatgaaaa tgtcaatact tacttcttag cactgttgag   7620
agggttactt acataaagga attttggtga aactgc                             7656
```

<210> SEQ ID NO 36
<211> LENGTH: 2413
<212> TYPE: DNA
<213> ORGANISM: Homo sapiens

<400> SEQUENCE: 36 cccgggctcg cgggcagacg gaggcgcctc tctttccccg cccctcgcct cggccctttc 60 tcttcccagc acctcggctg ttccccggcg gcggcagcgg cagcggcggc ccacacagca 120 gcgagaggcg agaggaggct gcctcgagga ggctgcctcg aggatgaagt gcaaacccaa 180 ccagacgcgg acctacgacc ccgaggggtt caagaagcgg gcggcgtgcc tgtgcttccg 240 gagcgaacgc gaggacgagg tcctgttagt gagtagcagc cggtacccgg accgctggat 300 cgtgccgggc gggggcatgg agcccgagga ggagccgggc ggtgcggcgg tccgagaggt 360 gtacgaagaa gcgggagtca aggggaagtt aggccggctc ctgggcgtct tcgaacagaa 420 ccaggatcgc aagcacagaa cgtacgtgta tgtactgact gtcacggagc tgctggagga 480 ttgggaagat tcggttagca ttgggaggaa gcgagagtgg ttcaaagtcg aagatgccat 540 caaggttctc cagtgccaca agcccgtgca cgccgaatat ctggagaaac taaagctggg 600 cggttcccca accaatggaa actccatggc cccatcctcg ccagatagcg atccctaatg 660 aacagcaaag atgttcagta ttgtgctgaa agaaacattg atgtgaaccc agtgatcagt 720 ggaattgtca agtacaggtg agcacttctg tgttcccaag aagacagctc atctggtttc 780 ttcctgcatc ttgggacact ccttccctgt ctataccact gactcttgct ctggttgttg 840 tactcttata cgtgaataga ctcttaattc agcacctata gccttttgtt gtgctttttt 900 gatgtgtctg ccttcattag actatgatgt ctttgagagc aaagactatt tttccttact 960 ctttgcatat tctgcatctg agacactact tgaaatatgg ttggcatcac tgaaggttct 1020 ttgattcaat taatattttg taatcaccgt gtggcaaaac attccccttc caatctggtg 1080 ctagtagagt atatgctatc taggcaccat gtgtgtggct tttgtgtatc aggtgtttca 1140 gaaatatttc aagacagttg taagatgttt gaggacaaga attattactc ctatttctat 1200 gtcataccac acagtagctg cacagtttta agattatgcc atcacctagg gtaatgtttt 1260 gtagaatcag tccttcgtgt aacaactcta gtgtttttgt actgttgatg atttgcttaa 1320 attttattca aaaactatca cttgctataa aggtaattgt aaaaataaat acagtggacg 1380 caaaataatg ttgtgagttt ttataaaaat aaattttaaa atgatatata agacattttt 1440 ttgcaatgcc tgccctaacc acttcttaca tgtcatctta acatctcttt gaggaaacac 1500 tgtttcctca ttttacagat ttaacatact gtattatttg atgccagagc caacaggcta 1560 tatcataggc agtttccaaa cttaattatg ccatttagtt tgtctagatt tcttttgcct 1620 ctctcactga tccatttggc tgtagttttc atccctttc cagtacacac agctagctcc 1680 tcatcctacc tggtttctgc atatgagaat gcagagggct gagagagggc aaaattgttg 1740 tcatttagaa aaggcattta ggaaagaggc tgctattaga ggggaacaca aagtgaaggt 1800 ttttttaaaa aagaggactt gcatcagctg cctccagaac aattttaaga aaataacaaa 1860 gatgtttaga agaaatctta cggagtttgc catgggatgt gtgatatcag cagtcttcag 1920 ctccttacaa attaccaaaa gtggttctaa tatgctagtt tgtttgattt tttcttttat 1980 attataaagc aattgcatcg ataaaagctt ggactccatt ttagtgtgac actcttcctc 2040 atgataccag tgaaatgtat tgattgtgtc cccagttgtt acataatttg aaataaaaat 2100 ataacttctt gatttattgt tttttaagat gtgatatggt actgtggtta tgttgtttta 2160

```
aaaaatgatt atcttttaga gaagtatact gaaaaatgta caggtgaaat gatatgttac   2220

tggtattcgc ttcaaaatca tctgagtgtg gggtaattga gtacatagat gaaacaagat   2280

tggccataaa ttggtaattg ctgaagctgt gtgatggatg tttgagagtt cattatacta   2340

ttctctatac ttttgtatat gtttgaaatt ttccataata aaaattgaaa aaagtaaaaa   2400

aaaaaaaaaa aaa                                                      2413
```

<210> SEQ ID NO 37
<211> LENGTH: 862
<212> TYPE: DNA
<213> ORGANISM: Homo sapiens

<400> SEQUENCE: 37

```
cttggcggtg acgcacggcc ctcacgtgac cgggagctgc agagctacgc agccttcggt     60

gcagtcgtca ctcgtgtctc gctaccagct ccccgctgcc ctgcgctcgg cgggctggca    120

tccggcccgg gggaaagcgg accagccctt ctgcaggtct gcggggccaa gtgtcccggc    180

ggcgcacctc gtggcgagaa tcgggagaag gaggagacta caaggatagg cccaggagta    240

atggagtcca aagagaaacg agcagtaaac agtctcagca tggaaaatgc caaccaagaa    300

aatgaagaaa aggagcaagt tgctaataaa ggggagccct tggccctccc tttggatgct    360

ggtgaatact gtgtgcctag aggaaatcgt aggcggttcc gcgttaggca gcccatcctg    420

cagtatagat gggatatgat gcataggctt ggagaaccac aggcaaggat gagagaagag    480

aatatggaaa ggattgggga ggaggtgaga cagctgatgg aaaagctgag ggaaaagcag    540

ttgagtcata gtctgcgggc agtcagcact gaccccccctc accatgacca tcatgatgag    600

ttttgcctta tgccctgaat cctgatggtt tccctaaagt tattacggaa acagacccct    660

gctttcgaat ttacatgttc atgatgtgcc cttgttgtaa acctttacct gtcacttgtt    720

tacgtgggtc tcctattacc agcttctaat tgaatattgt gtttttgaac cagtctgtaa    780

gatttttgtt agcagaagaa ttttacctat tgcatggaaa gatgctcatt atagtgaagt    840

taataaagca cctttaaaaa gc                                             862
```

<210> SEQ ID NO 38
<211> LENGTH: 7080
<212> TYPE: DNA
<213> ORGANISM: Homo sapiens

<400> SEQUENCE: 38

```
gagctagcgc tcaagcagag cccagcgcgg tgctatcgga cagagcctgg cgagcgcaag     60

cggcgcgggg agccagcggg gctgagcgcg gccagggtct gaacccagat ttcccagact    120

agctaccact ccgcttgccc acgccccggg agctcgcggc gcctggcggt cagcgaccag    180

acgtccgggg ccgctgcgct cctggcccgc gaggcgtgac actgtctcgg ctacagaccc    240

agagggagca cactgccagg atgggagctg ctgggaggca ggacttcctc ttcaaggcca    300

tgctgaccat cagctggctc actctgacct gcttccctgg ggccacatcc acagtggctg    360

ctgggtgccc tgaccagagc cctgagttgc aaccctggaa ccctggccat gaccaagacc    420

accatgtgca tatcggccag ggcaagacac tgctgctcac ctcttctgcc acggtctatt    480

ccatccacat ctcagaggga ggcaagctgg tcattaaaga ccacgacgag ccgattgttt    540

tgcgaacccg gcacatcctg attgacaacg gaggagagct gcatgctggg agtgccctct    600

gccctttcca gggcaatttc accatcattt tgtatggaag ggctgatgaa ggtattcagc    660

cggatcctta ctatggtctg aagtacattg gggttggtaa aggaggcgct cttgagttgc    720
```

```
atggacagaa aaagctctcc tggacatttc tgaacaagac ccttcaccca ggtggcatgg    780
cagaaggagg ctatttttt gaaaggagct ggggccaccg tggagttatt gttcatgtca    840
tcgaccccaa atcaggcaca gtcatccatt ctgaccggtt tgacacctat agatccaaga    900
aagagagtga acgtctggtc cagtatttga acgcggtgcc cgatggcagg atcctttctg    960
ttgcagtgaa tgatgaaggt tctcgaaatc tggatgacat ggccaggaag gcgatgacca   1020
aattgggaag caaacacttc ctgcaccttg gatttagaca cccttggagt tttctaactg   1080
tgaaaggaaa tccatcatct tcagtggaag accatattga atatcatgga catcgaggct   1140
ctgctgctgc ccgggtattc aaattgttcc agacagagca tggcgaatat ttcaatgttt   1200
ctttgtccag tgagtgggtt caagacgtgg agtggacgga gtggttcgat catgataaag   1260
tatctcagac taaaggtggg gagaaaattt cagacctctg gaaagctcac ccaggaaaaa   1320
tatgcaatcg tcccattgat atacaggcca ctacaatgga tggagttaac ctcagcaccg   1380
aggttgtcta caaaaaaggc caggattata ggtttgcttg ctacgaccgg ggcagagcct   1440
gccggagcta ccgtgtacgg ttcctctgtg ggaagcctgt gaggcccaaa ctcacagtca   1500
ccattgacac caatgtgaac agcaccattc tgaacttgga ggataatgta cagtcatgga   1560
aacctggaga taccctggtc attgccagta ctgattactc catgtaccag gcagaagagt   1620
tccaggtgct tccctgcaga tcctgcgccc ccaaccaggt caaagtggca gggaaaccaa   1680
tgtacctgca catcggggag gagatagacg gcgtggacat gcgggcggag gttgggcttc   1740
tgagccggaa catcatagtg atgggggaga tggaggacaa atgctacccc tacagaaacc   1800
acatctgcaa tttctttgac ttcgatacct ttgggggcca catcaagttt gctctgggat   1860
ttaaggcagc acacttggag ggcacggagc tgaagcatat gggacagcag ctggtgggtc   1920
agtacccgat tcacttccac ctggccggtg atgtagacga aaggggaggt tatgacccac   1980
ccacatacat cagggacctc tccatccatc atacattctc tcgctgcgtc acagtccatg   2040
gctccaatgg cttgttgatc aaggacgttg tgggctataa ctctttgggc cactgcttct   2100
tcacggaaga tgggccggag gaacgcaaca cttttgacca ctgtcttggc ctccttgtca   2160
agtctggaac cctcctcccc tcggaccgtg acagcaagat gtgcaagatg atcacagagg   2220
actcctaccc ggggtacatc cccaagccca ggcaagactg caatgctgtg tccaccttct   2280
ggatggccaa tcccaacaac aacctcatca actgtgccgc tgcaggatct gaggaaactg   2340
gattttggtt tatttttcac cacgtaccaa cgggcccctc cgtgggaatg tactccccag   2400
gttattcaga gcacattcca ctgggaaaat tctataacaa ccgagcacat tccaactacc   2460
gggctggcat gatcatagac aacggagtca aaaccaccga ggcctctgcc aaggacaagc   2520
ggccgttcct ctcaatcatc tctgccagat acagccctca ccaggacgcc gacccgctga   2580
agccccggga gccggccatc atcagacact tcattgccta caagaaccag gaccacgggg   2640
cctggctgcg cggcggggat gtgtggctgg acagctgccg gtttgctgac aatggcattg   2700
gcctgaccct ggccagtggt ggaaccttcc cgtatgacga cggctccaag caagagataa   2760
agaacagctt gtttgttggc gagagtggca acgtggggac ggaaatgatg gacaatagga   2820
tctggggccc tggcggcttg gaccatagcg gaaggaccct ccctataggc cagaattttc   2880
caattagagg aattcagtta tatgatggcc ccatcaacat ccaaaactgc actttccgaa   2940
agtttgtggc cctggagggc cggcacacca gcgccctggc cttccgcctg aataatgcct   3000
ggcagagctg cccccataac aacgtgaccg gcattgcctt tgaggacgtt ccgattactt   3060
```

-continued

```
ccagagtgtt cttcggagag cctgggccct ggttcaacca gctggacatg gatggggata   3120
agacatctgt gttccatgac gtcgacggct ccgtgtccga gtaccctggc tcctacctca   3180
cgaagaatga caactggctg gtccggcacc cagactgcat caatgttccc gactggagag   3240
gggccatttg cagtgggtgc tatgcacaga tgtacattca agcctacaag accagtaacc   3300
tgcgaatgaa gatcatcaag aatgacttcc ccagccaccc tctttacctg gagggggcgc   3360
tcaccaggag cacccattac cagcaatacc aaccggttgt caccctgcag aagggctaca   3420
ccatccactg ggaccagacg gcccccgccg aactcgccat ctggctcatc aacttcaaca   3480
agggcgactg gatccgagtg gggctctgct acccgcgagg caccacattc tccatcctct   3540
cggatgttca caatcgcctg ctgaagcaaa cgtccaagac gggcgtcttc gtgaggacct   3600
tgcagatgga caaagtggag cagagctacc ctggcaggag ccactactac tgggacgagg   3660
actcagggct gttgttcctg aagctgaaag ctcagaacga gagagagaag tttgctttct   3720
gctccatgaa aggctgtgag aggataaaga ttaaagctct gattccaaag aacgcaggcg   3780
tcagtgactg cacagccaca gcttacccca agttcaccga gagggctgtc gtagacgtgc   3840
cgatgcccaa gaagctcttt ggttctcagc tgaaaacaaa ggaccatttc ttggaggtga   3900
agatggagag ttccaagcag cacttcttcc acctctggaa cgacttcgct tacattgaag   3960
tggatgggaa gaagtacccc agttcggagg atggcatcca ggtggtggtg attgacggga   4020
accaagggcg cgtggtgagc cacacgagct tcaggaactc cattctgcaa ggcataccat   4080
ggcagctttt caactatgtg gcgaccatcc ctgacaattc catagtgctt atggcatcaa   4140
agggaagata cgtctccaga ggcccatgga ccagagtgct ggaaaagctt ggggcagaca   4200
ggggtctcaa gttgaaagag caaatggcat tcgttggctt caaaggcagc ttccggccca   4260
tctgggtgac actggacact gaggatcaca aagccaaaat cttccaagtt gtgcccatcc   4320
ctgtggtgaa gaagaagaag ttgtgaggac agctgccgcc cggtgccacc tcgtggtaga   4380
ctatgacggt gactcttggc agcagaccag tgggggatgg ctgggtcccc cagcccctgc   4440
cagcagctgc ctgggaaggc cgtgtttcag ccctgatggg ccaagggaag gctatcagag   4500
accctggtgc tgccacctgc ccctactcaa gtgtctacct ggagcccctg gggcggtgct   4560
ggccaatgct ggaaacattc actttcctgc agcctcttgg gtgcttctct cctatctgtg   4620
cctcttcagt gggggtttgg ggaccatatc aggagacctg ggttgtgctg acagcaaaga   4680
tccactttgg caggagccct gacccagcta ggaggtagtc tggagggctg gtcattcaca   4740
gatccccatg gtcttcagca gacaagtgag ggtggtaaat gtaggagaaa gagccttggc   4800
cttaaggaaa tctttactcc tgtaagcaag agccaacctc acaggattag gagctggggt   4860
agaactggct atccttgggg aagaggcaag ccctgcctct ggccgtgtcc acctttcagg   4920
agactttgag tggcaggttt ggacttggac tagatgactc tcaaaggccc ttttagttct   4980
gagattccag aaatctgctg catttcacat ggtacctgga acccaacagt tcatggatat   5040
ccactgatat ccatgatgct gggtgcccca gcgcacacgg gatggagagg tgagaactaa   5100
tgcctagctt gaggggtctg cagtccagta gggcaggcag tcaggtccat gtgcactgca   5160
atgccaggtg gagaaatcac agagaggtaa aatggaggcc agtgccattt cagaggggag   5220
gctcaggaag gcttcttgct tacaggaatg aaggctgggg gcattttgct gggggggagat   5280
gaggcagcct ctggaatggc tcagggattc agccctccct gccgctgcct gctgaagctg   5340
gtgactacgg ggtcgccctt tgctcacgtc tctctggccc actcatgatg gagaagtgtg   5400
gtcagagggg agcaatgggc tttgctgctt atgagcacag aggaattcag tccccaggca   5460
```

gccctgcctc tgactccaag agggtgaagt ccacagaagt gagctcctgc cttagggcct 5520 catttgctct tcatccaggg aactgagcac agggggcctc caggagaccc tagatgtgct 5580 cgtactccct cggcctggga tttcagagct ggaaatatag aaaatatcta gcccaaagcc 5640 ttcattttaa cagatgggga aagtgagccc ccaagatggg aaagaaccac acagctaagg 5700 gagggcctgg ggagccccac cctagccctt gctgccacac cacattgcct caacaaccgg 5760 ccccagagtg cccaggcact cctgaggtag cttctggaaa tggggacaag tcccctcgaa 5820 ggaaaggaaa tgactagagt agaatgacag ctagcagatc tcttccctcc tgctcccagc 5880 gcacacaaac ccgccctccc cttggtgttg gcggtccctg tggccttcac tttgttcact 5940 acctgtcagc ccagcctggg tgcacagtag ctgcaactcc ccattggtgc tacctggctc 6000 tcctgtctct gcagctctac aggtgaggcc cagcagaggg agtagggctc gccatgtttc 6060 tggtgagcca atttggctga tcttgggtgt ctgaacagct attgggtcca ccccagtccc 6120 tttcagctgc tgcttaatgc cctgctctct ccctggccca ccttatagag agcccaaaga 6180 gctcctgtaa gagggagaac tctatctgtg gtttataatc ttgcacgagg caccagagtc 6240 tccctgggtc ttgtgatgaa ctacatttat cccctttcct gccccaacca caaactcttt 6300 ccttcaaaga gggcctgcct ggctccctcc acccaactgc acccatgaga ctcggtccaa 6360 gagtccattc cccaggtggg agccaactgt cagggaggtc tttcccacca aacatctttc 6420 agctgctggg aggtgaccat agggctctgc ttttaaagat atggctgctt caaaggccag 6480 agtcacagga aggacttctt ccagggagat tagtggtgat ggagaggaga gttaaaatga 6540 cctcatgtcc ttcttgtcca cggttttgtt gagttttcac tcttctaatg caagggtctc 6600 acactgtgaa ccacttagga tgtgatcact ttcaggtggc caggaatgtt gaatgtcttt 6660 ggctcagttc atttaaaaaa gatatctatt tgaaagttct cagagttgta catatgtttc 6720 acagtacagg atctgtacat aaaagtttct ttcctaaacc attcaccaag agccaatatc 6780 taggcatttt cttggtagca caaattttct tattgcttag aaaattgtcc tccttgttat 6840 ttctgtttgt aagacttaag tgagttaggt ctttaaggaa agcaacgctc ctctgaaatg 6900 cttgtctttt ttctgttgcc gaaatagctg gtcctttttc gggagttaga tgtatagagt 6960 gtttgtatgt aaacatttct tgtaggcatc accatgaaca aagatatatt ttctatttat 7020 ttattatatg tgcacttcaa gaagtcactg tcagagaaat aaagaattgt cttaaatgtc 7080

<210> SEQ ID NO 39
<211> LENGTH: 5676
<212> TYPE: DNA
<213> ORGANISM: Homo sapiens

<400> SEQUENCE: 39 ggcacgtgga ctccctttaa tccagtgact gtcaggtcga tcatatgccg aggacgatga 60 tcccgccggg ggagtgcacg tacgcgggcc ggaagcggag gaggcccctg cagaaacaga 120 ggcccgccgt gggggcagag aagtccaacc cctccaagcg acaccgggac cgcctcaacg 180 ccgagttgga ccacctggcc agcctgctgc cgttcccgcc tgacatcatc tccaagctgg 240 acaagctttc tgtcctgcgc ctcagtgtca gttacctccg ggtgaagagc ttcttccaag 300 tcgtgcagga gcagagctca cggcagcctg cggccggcgc cccctcgccc ggagacagct 360 gtcctcttgc agggtctgcc gtgctggagg gaaggctgct gttggagtct cttaatggct 420 ttgctctggt cgtgagtgca gaagggacga tattttatgc atcagcaacg atcgtggact 480

-continued

```
atctgggctt ccatcagacg gatgtaatgc accagaacat ttatgactac atccacgtgg    540
acgaccgcca ggacttctgc cggcagctcc actgggccat ggaccctccc caggtggtgt    600
ttgggcagcc cccgcccttg gagacaggag atgatgctat cctggggagg ctgctcaggg    660
cccaggagtg gggcacaggc acgcccaccg agtactcggc cttcctgacc cgctgcttca    720
tctgccgtgt gcgctgcctg ctggacagca cctcgggctt cctggcccgg gggtcacagg    780
cttggcagct gcggctctgc tgtcccgagc cactcatgac gatgcagttt caaggaaaac    840
taaaattcct gtttggacag aagaagaagg cgccgtcagg agccatgctc ccgccgcggc    900
tgtcgctgtt ctgcattgcg gcacccgttc tcctcccctc cgcagcggag atgaaaatga    960
ggagcgcgct cctgagggca aaacccagag cagacaccgc agccaccgcg gatgcaaaag   1020
taaaagccac caccagtctg tgcgaatcgg aactgcatgg aaaacccaat tactcagcag   1080
gaaggagcag cagagagagc ggcgttttgg tgctcaggga acagactgac gctggccgat   1140
gggcacaggt tcccgccagg gccccatgcc tgtgcctccg gggtggccct gaccttgtcc   1200
ttgaccccaa ggggggctca ggggacaggg aggaggagca gcacaggatg ctgagcaggg   1260
cctctggagt gacagggcgg agggagactc caggacccac aaagcccctg ccctggacag   1320
cgggaaagca cagtgaggat ggtgccaggc cgaggctgca gcccagcaag aatgacccgc   1380
cctccctgcg ccccatgccc cgcggctcct gcctgccctg cccgtgtgtc cagggcactt   1440
tcaggaactc gcccatctct cacccgccga gcccgtcccc cagtgcctac tccagccgga   1500
ccagcagacc catgcgggat gtcggtgagg accaggtgca ccctcccctc tgccactttc   1560
cccagaggag cctgcagcac cagctccctc agcctggagc tcagcgtttt gccacgaggg   1620
gctatcccat ggaggacatg aagctgcaag gtgtaccgat gcctccgggg gacctgtgtg   1680
gtccgacgct gctgctagat gtgtccatca agatggagaa ggactctggg tgtgagggtg   1740
ctgcagacgg ctgtgtgccc agccaggtgt ggctgggggc cagtgacagg agccacccag   1800
ccaccttccc taccaggatg cacctgaaaa cagagccaga ctctcggcaa caggtgtaca   1860
tctcgcacct ggggcacggc gtgcgggggg ctcagcccca tgggagggcc actgctgggc   1920
gcagcaggga gctgacccct ttccaccctg cacactgtgc ctgcctggag cccacagacg   1980
gccttcccca gtcggagcct ccccaccagc tctgtgcacg gggccgaggt gaacagtcct   2040
gcacctgcag agctgctgag gccgcccctg tggtcaagcg ggagcccttg gactcacccc   2100
agtgggctac tcacagccag ggaatggtgc ccgggatgtt gcccaaaagt gccttggcca   2160
cgctggtccc gccccaagct tcggggtgca cattcctgcc atagcgcagt gaccaccatc   2220
caagctcaga tctgtgtgtc tacgctcaga tgcgtcggtg gctgggctgc cctgctcctg   2280
gtcaggccgg agcccgtcct aagacacacg ctttgcagag ctgtgcatgc gcagtctgct   2340
agtgtgtgtg tgcagcatac gcaggagcct atcctgaatt ttgtaaaata tcccaacagt   2400
tcttaaatga aaactggcct taagtctatt caagcatgac agcatttctc tttgaggaat   2460
taaaatcttt aggaaagtga tcatggctgg acagcttcat gccccagagg cagcgagcac   2520
ccgtcccatg gctgccaagt ccacagtcgg ggatgaagca gtcgggtgat gctcccaagt   2580
ccgcagtcgg ggatgaagcg gtcgggtgat gctcccaagt ccgcagtcgg ggatgaagcg   2640
gtcgggtgac acacctagct cagccctccc aggccacctg cagctcccag cctgtgctgt   2700
gcaggcaggg tcagcccatc gccacagtgc actgtagagg ccagcacacg gcaaattaga   2760
aatacaacac gcggagaaag gggtccgtga gcccactcat agaggaatct agaacgttcc   2820
aggcagcaga ggctggcagc gtgggtccca cactgcccca caccgtgcgg caggtgctcc   2880
```

```
atggcgccat gacagagtct gaggccagac ctggactgga attgacagca taacccctgt   2940
tccttctgga catctcccga gttctcagtg ggtctctgcg gacggttctt cctaatctgc   3000
ctcttggtac atcacgtaat acagagttca cagactccgg gtttggaagt acagagaaac   3060
acacaacgta gagagaagac acaggaaact gcgctgcctg tgggggtttc tctctggctg   3120
gctgtacagt tcactcaaat gagggttccc attgccatcc taggagaata attagggaca   3180
agacagacaa gtattaatag cattaaaaca gttgtaaagg cgatattttc tgagagtagg   3240
aaatttggat acaaaagcat aagtcagaaa gtgaaggtca ccaatccacc aacccgagaa   3300
cctacagctg atggtgcatt tcaggcttct tccacggtct ggcctggaac cccacccggc   3360
tggtgcaggc atcagatcag ggtgtagaag tcaccccaag caagaggaag ccaggcagtg   3420
aggccctggg gtgtggctgc agctgggccc acctgtgcgg gggtgggaag gccccatcct   3480
cagggagagg gcatcggcgc cctgacgtca gctccactgg gagtggcagg agctgtggga   3540
gcccatgggt gagggaccca ccaccccgct gcactgtgca ttgtgcctcc cgtgtggacg   3600
ccctctctgt tgttggcccg cgggtgaggg acccaccacc cctagggacc caccaccccg   3660
ccgcactgtg cattctgcct cctgtgtgga cgccctctct gttgtcagtg gctttgaggt   3720
gtcagtgctt acttagatgc tggtttaatg ctggacccat ttgttaaacg caccttcact   3780
ttgtcaaaac ccaggtttgg ttggcaggac tgggtcttct gcccaatgcc aggtgcctgc   3840
gcctctcagt ggcctggttc ttggacagtt tgcccccatg tggcagggat agggataagg   3900
atctcctctc agtactggaa gagaacagcc aaccatctga gcccagagtc acagatccat   3960
cgtggccccc tatgaccccc aagccctacc gagggggcac tcactctctg cttagccagg   4020
gggcgtcttt caaaaggtga cctccatgct gtgctgtcgt gggtgtgaga cgtgctcatg   4080
gccttccact gccatctctc ccttatctga tgcctaaagt cacgatgggg acagagctac   4140
ccaggggcca gccatggggt gaccagccac ctgagggtca gtcacctgtg gagagcaggc   4200
acctgtgaag accaggcacc tgaggactgg cgcctacttc ccactttggc cctacactgg   4260
cacagagccc ctctttattc atttctcatg ctgagcatgg cacacttctg gcctctgggc   4320
atttatggat ttaagaccag gatggtattt cagaagcttc ccacttcctt cctattctaa   4380
ccgagtgccc agctcctttg ctgatcatgg aaagaccctt aataattagg cctgcaggcc   4440
aggcgcagtg gctcatgcct ataatcccag cactttagga ggtcaaggta ggaggatcgc   4500
ttaagcccag gagttcaaga ccagcctggg caacacagga agaatgtgtc tctacaaaaa   4560
ataattaaaa atcagatctg ctgtatccct gaaaaagtct caatcaacat gcatgttcca   4620
ctcttggagt tccctgttct gagggccagc cacgtcctgt gtcctggagc ttagccctca   4680
gcagctccct tcagcctggg cgccgcctgg gtcccaaacg tggcagctgc tcttccagtc   4740
tcggggccga ggagggcagg gagctcagtg actgagagtc ttgtgtatca catgtcttga   4800
gtgtcctgga gccaacggct gtcactggga aaaacaccag gccccaaaga tcgaatcaga   4860
gacgtggctg cgtgtttgcg attgtagcca ggcccttcag tgtcatcaaa ggagcactgg   4920
ggcctcctta agcacagacg gcagcccctg cccaggaggc ttcttcacca cgtcctgccc   4980
tgcagcctcc cagaccttta gatgcgcccc tgcccaaggc cctcctggtg acaggtgcca   5040
gattgagtgg tgggttgctg ccaggcaggc cacgctgtgt tgacgctgca ctcagcacgt   5100
gggtgttggc tctgccggtt ttgtggtgtg gggaccctac aggaggctgc ggccctgaga   5160
gcctgggatc agcgaggtgt ccgacatccc ttcctcaacg gcaacaaaaa ctccccaagt   5220
```

```
cagcactttg gttattttat agccacaacc ctcttggaaa acagtgggga agactatgga   5280

acatagaaag tgtggatgta tcacttctct ctaaaatgtc attgttagca ctaattacag   5340

gttcatgttt ttctgtgtat gtagcttttc cctatatagc tgaaaaagta ttaaagtcaa   5400

atataaggtg ggaatgggat ggaagggagg agatcaatac aacttatatt tttgcagttt   5460

ctactggaag aaaaaagttt tcaataccta gaccaacttg ttgaattttt aaaacttatg   5520

cactataaat gcaactttct ctactgcttt ctcagtgcct ttaggaagct ttcaaatttt   5580

tttgtactgt ggtttgtatt aaatttgcaa tattgatgta aaatacatga catgctagta   5640

catgtttaac aaaaatttaa aaaaaaaaaa aaaaaa                             5676
```

<210> SEQ ID NO 40
<211> LENGTH: 1763
<212> TYPE: DNA
<213> ORGANISM: Homo sapiens

<400> SEQUENCE: 40

```
cttctggtaa ggaggccccg tgatcagctc cagccatttg cagtcctggc tatcccagga     60

gcttacataa agggacaatt ggagcctgag aggtgacagt gctgacacta caaggctcgg    120

agctccgggc actcagacat catgagttgg tccttgcacc cccggaattt aattctctac    180

ttctatgctc ttttatttct ctcttcaaca tgtgtagcat atgttgctac cagagacaac    240

tgctgcatct tagatgaaag attcggtagt tattgtccaa ctacctgtgg cattgcagat    300

ttcctgtcta cttatcaaac caaagtagac aaggatctac agtctttgga agacatctta    360

catcaagttg aaaacaaaac atcagaagtc aaacagctga taaaagcaat ccaactcact    420

tataatcctg atgaatcatc aaaaccaaat atgatagacg ctgctacttt gaagtccagg    480

aaaatgttag aagaaattat gaaatatgaa gcatcgattt taacacatga ctcaagtatt    540

cgatatttgc aggaaatata taattcaaat aatcaaaaga ttgttaacct gaaagagaag    600

gtagcccagc ttgaagcaca gtgccaggaa ccttgcaaag acacggtgca aatccatgat    660

atcactggga aagattgtca agacattgcc aataagggag ctaaacagag cgggctttac    720

tttattaaac ctctgaaagc taaccagcaa ttcttagtct actgtgaaat cgatgggtct    780

ggaaatggat ggactgtgtt tcagaagaga cttgatggca gtgtagattt caagaaaaac    840

tggattcaat ataaagaagg atttggacat ctgtctccta ctggcacaac agaattttgg    900

ctgggaaatg agaagattca tttgataagc acacagtctg ccatcccata tgcattaaga    960

gtggaactgg aagactggaa tggcagaacc agtactgcag actatgccat gttcaaggtg   1020

ggacctgaag ctgacaagta ccgcctaaca tatgcctact tcgctggtgg ggatgctgga   1080

gatgcctttg atggctttga ttttggcgat gatcctagtg acaagttttt cacatcccat   1140

aatggcatgc agttcagtac ctgggacaat gacaatgata agtttgaagg caactgtgct   1200

gaacaggatg gatctggttg gtggatgaac aagtgtcacg ctggccatct caatggagtt   1260

tattaccaag gtggcactta ctcaaaagca tctactccta atggttatga taatggcatt   1320

atttgggcca cttggaaaac ccggtggtat tccatgaaga aaaccactat gaagataatc   1380

ccattcaaca gactcacaat tggagaagga cagcaacacc acctgggggg agccaaacag   1440

gtcagaccag agcaccctgc ggaaacagaa tatgactcac tttaccctga ggatgatttg   1500

tagaaaatta actgctaact tctattgacc cacaaagttt cagaaattct ctgaaagttt   1560

cttccttttt tctcttacta tatttattga tttcaagtct tctattaagg acatttagcc   1620

ttcaatggaa attaaaactc atttaggact gtatttccaa attactgata tcagagttat   1680
```

```
ttaaaaattg tttatttgag gagataacat ttcaactttg ttcctaaata tataataata   1740

aaatgattga ctttatttgc aaa                                           1763


<210> SEQ ID NO 41
<211> LENGTH: 666
<212> TYPE: DNA
<213> ORGANISM: Homo sapiens

<400> SEQUENCE: 41

gggtggctta gcactgcagg gctctgcgcg ggaacgctaa cctggtccgg agcgagtctg     60

ggtctcagcc ccgcgaacag cctttcacga gtcttcaagc tttcaggcta tcttctagtc    120

aagatgagtg ataagccaga cttgtcggaa gtggagaagt ttgacaggtc aaaactgaag    180

aaaactaata ctgaagaaaa aaatactctt ccctcaaagg aaactatcca gcaagagaaa    240

gagtgtgttc aaacatcata aaatggggat cgcctcccaa cagcagattt cgacattacc    300

tgagagtctt gattttaggc ttgtttttg taaacccatg tgtttgtaga gattttaggc    360

gtcttcggat atcttctcac ctatgttccc tggctaagaa gtcagaggta gccaatgttt    420

ccttaaattc atttttaaac ttaccattgg tgcatatgtt ccagatggca gatgctgtca    480

ataatctcac cattgatgac ctttgtgtat gtagttcttg catcctatac tggataagcc    540

tgttttaacc tgctatgatg ggtgcttcca ttgcttcata atcttcatga agttgcatgc    600

ttttgcagct tttcacagtt tatttgcatt tctaatgtag taataaagta accaatataa    660

tcatta                                                               666


<210> SEQ ID NO 42
<211> LENGTH: 1437
<212> TYPE: DNA
<213> ORGANISM: Homo sapiens

<400> SEQUENCE: 42

attgctgatg gatcagtgag cctgtgttca tgccagtgag ctgctgtggc tcagatactg     60

atactttctt tccaaacagc ataagaagtg attgagccac aagtatactg aaggaagggc    120

tccctcgagt tctggtgtga agagataaat caccagtcac agactatgca cccgactgct    180

gctgttcagt ccagggaaaa tgaaagttgg agtgctgtgg ctcatttctt tcttcacctt    240

cactgacggc cacggtggct tcctggggaa aaatgatggc atcaaaacaa aaaaagaact    300

cattgtgaat aagaaaaaac atctaggccc agtcgaagaa tatcagctgc tgcttcaggt    360

gacctataga gattccaagg agaaaagaga tttgagaaat tttctgaagc tcttgaagcc    420

tccattatta tggtcacatg ggctaattag aattatcaga gcaaaggcta ccacagactg    480

caacagcctg aatggagtcc tgcagtgtac ctgtgaagac agctacacct ggtttcctcc    540

ctcatgcctt gatccccaga actgctacct tcacacggct ggagcactcc caagctgtga    600

atgtcatctc aacaacctca gccagagtgt caatttctgt gagagaacaa agatttgggg    660

cactttcaaa attaatgaaa ggtttacaaa tgaccttttg aattcatctt ctgctatata    720

ctccaaatat gcaaatggaa ttgaaattca acttaaaaaa gcatatgaaa gaattcaagg    780

ttttgagtcg gttcaggtca cccaatttcg aatgtcactc ttgtcgccca agttggagtg    840

caatggcaca atctaggctc actgcaaccc tgcaacctct gcctaccggg ttcaagagat    900

tcccctgcct cagcctccca agtagctgga attacaggca cctgccacca catccagcta    960

actttttttg tatttttact agagacaggg tttcaccatg ttggccacac tggtctcaaa   1020
```

```
ctcctgacct caggtgatcc gcctgcctcg gcccccaaag tgctgggatt acaggcatga   1080

gccaccacat ctggcctagg accttaaata ttggaaagca tcctcaaaac tgtgggtcag   1140

tgagtagaac tacaaaacaa tagcagtagg gcagaaactt gaaagaaggc aggagatcat   1200

ggtgacagtg gatgggaaaa agtgagggtt ggggataagg gttgcgggtt gtcgaagggt   1260

ggattttctc cttcagcaac tacaggagat atgatgcctc ataattcgga gccagaagtg   1320

gggctttggg tgagatatct ttgcacagat aacatgtata catcatagtt caaaacccag   1380

tagtcattgt ttacagcaaa taaagaaata tttagtaaat taaaaaaaaa aaaaaaa      1437
```

<210> SEQ ID NO 43
<211> LENGTH: 2413
<212> TYPE: DNA
<213> ORGANISM: Homo sapiens

<400> SEQUENCE: 43

```
tttcctctca gggggcagca ggaagtgagg agaaagggct gggatgggag gcgggagcgg     60

atgggaggga atggggttta tcaagtcctc ggcgagctgc ccaacgggca gcagctggcg    120

caagtagcct agctggagag gctcacccca ggaaggaggg aggccaccga cctactgggc    180

cgacggactc ccacacaggg ctggcggcgc cgcggagctg ggaggactga accaccggcc    240

tcgggctgca ggggaaacat ttcaggctga ctggcgctcg tggctgagac tcccatagaa    300

agcccggctc agaggggcat tagggtccta aatgggcggc cacgtccctc tgcagaggac    360

ctggggctct tcgagcccga aacgaggcac cggcaccgag aaaggtggac cacaccttcc    420

cgccccgtcc gcaagtccaa tcccgggccc acctccgcac tggagtctta aagggccagc    480

gtgcctgggg gcggagccag cagaggcgct gagccgggcc gcgcctgggc gaacggccgg    540

agcgggctgg gctgggcccg ggatggcggt ggccctggcg ccggtcccgg tggcgccccg    600

cgcgagttcc tgagctggtg ccaggcaggt gacacctcct gcagcccccca gcatgcgggc    660

aggcccaggc cccaccgtta cattggccct ggtgctggcg gtgtcatggg ccatggagct    720

caagcccaca gcaccaccca tcttcactgg ccggcccttt gtggtagcgt gggacgtgcc    780

cacacaggac tgtggcccac gcctcaaggt gccactggac ctgaatgcct ttgatgtgca    840

ggcctcacct aatgagggtt ttgtgaacca gaatattacc atcttctacc gcgaccgtct    900

aggcctgtat ccacgcttcg attctgccgg aaggtctgtg catggtggtg tgccacagaa    960

tgtcagcctt tgggcacacc ggaagatgct gcagaaacgt gtggagcact acattcggac   1020

acaggagtct gcggggctgg cggtcatcga ctgggaggac tggcgacctg tgtgggtgcg   1080

caactggcag gacaaagatg tgtatcgccg gttatcacgc cagctagtgg ccagtcgtca   1140

ccctgactgg cctccagacc gcatagtcaa acaggcacaa tatgagtttg agttcgcagc   1200

acagcagttc atgctggaga cactgcgtta tgtcaaggca gtgcggcccc ggcacctctg   1260

gggcttctac ctctttcctg actgctacaa tcatgattat gtgcagaact gggagagcta   1320

cacaggccgc tgccctgatg ttgaggtggc ccgcaatgac cagctggcct ggctgtgggc   1380

tgagagcacg gccctcttcc cgtctgtcta cctggacgag acacttgctt cctcccgcca   1440

tggccgcaac tttgtgagct tccgtgttca ggaggccctt cgtgtggctc gcacccacca   1500

tgccaaccat gcactcccag tctacgtctt cacacgaccc acctacagcc gcaggctcac   1560

ggggcttagt gagatggacc tcatctctac cattggcgag agtgcggccc tgggcgcagc   1620

tggtgtcatc ctctggggtg acgcggggta caccacaagc acggagacct gccagtacct   1680

caaagattac ctgacacggc tgctggtccc ctacgtggtc aatgtgtcct gggccaccca   1740
```

```
atattgcagc cgggcccagt gccatggcca tgggcgctgt gtgcgccgca accccagtgc   1800
cagtaccttc ctgcatctca gcaccaacag tttccgccta gtgcctggcc atgcacctgg   1860
tgaaccccag ctgcgacctg tgggggagct cagttgggcc gacattgacc acctgcagac   1920
acacttccgc tgccagtgct acttgggctg gagtggtgag caatgccagt gggaccatag   1980
gcaggcagct ggaggtgcca gcgaggcctg ggctgggtcc cacctcacca gtctgctggc   2040
tctggcagcc ctggccttta cctggacctt gtaggggtct cctgcctagc tgcctagcaa   2100
gctggcctct accacaaggg ctctcttagg catgtaggac cctgcagggg gtggacaaac   2160
tggagtctgg agtgggcaga gcccccagga agcccaggag ggcatccata ccagctcgca   2220
ccccccctgtt ctaaggggga ggggaagtcc ctgggaggcc ccttctctcc ctgccagagg   2280
ggaaggaggg tacagctggg ctggggagga cctgacccta ctcccttgcc ctagatagtt   2340
tattattatt attattttgg ggtctctttt gtaaattaaa cataaaacaa ttgcttctct   2400
gcttggattt tgt                                                      2413
```

<210> SEQ ID NO 44
<211> LENGTH: 1279
<212> TYPE: DNA
<213> ORGANISM: Homo sapiens

<400> SEQUENCE: 44

```
gggagggaga gaggcgcgcg ggtgaaaggc gcattgatgc agcctgcggc ggcctcggag     60
cgcggcggag ccagacgctg accacgttcc tctcctcggt ctcctccgcc tccagctccg    120
cgctgcccgg cagccgggag ccatgcgacc ccagggcccc gccgcctccc cgcagcggct    180
ccgcggcctc ctgctgctcc tgctgctgca gctgcccgcg ccgtcgagcg cctctgagat    240
ccccaagggg aagcaaaagg cgcagctccg gcagagggag gtggtggacc tgtataatgg    300
aatgtgctta caagggccag caggagtgcc tggtcgagac gggagccctg gggccaatgg    360
cattccgggt acacctggga tcccaggtcg ggatggattc aaaggagaaa agggggaatg    420
tctgagggaa agctttgagg agtcctggac acccaactac aagcagtgtt catggagttc    480
attgaattat ggcatagatc ttgggaaaat tgcggagtgt acatttacaa agatgcgttc    540
aaatagtgct ctaagagttt tgttcagtgg ctcacttcgg ctaaaatgca gaaatgcatg    600
ctgtcagcgt tggtatttca cattcaatgg agctgaatgt tcaggacctc ttcccattga    660
agctataatt tatttggacc aaggaagccc tgaaatgaat tcaacaatta atattcatcg    720
cacttcttct gtggaaggac tttgtgaagg aattggtgct ggattagtgg atgttgctat    780
ctgggttggt acttgttcag attacccaaa aggagatgct tctactggat ggaattcagt    840
ttctcgcatc attattgaag aactaccaaa ataaatgctt taattttcat ttgctacctc    900
tttttttatt atgccttgga atggttcact taaatgacat tttaaataag tttatgtata    960
catctgaatg aaaagcaaag ctaaatatgt ttacagacca aagtgtgatt tcacactgtt   1020
tttaaatcta gcattattca ttttgcttca atcaaaagtg gtttcaatat tttttttagt   1080
tggttagaat actttcttca tagtcacatt ctctcaacct ataatttgga atattgttgt   1140
ggtcttttgt tttttctctt agtatagcat ttttaaaaaa atataaaagc taccaatctt   1200
tgtacaattt gtaaatgtta agaatttttt ttatatctgt taaataaaaa ttatttccaa   1260
caaccttaat atctttaaa                                                1279
```

<210> SEQ ID NO 45

<211> LENGTH: 4571
<212> TYPE: DNA
<213> ORGANISM: Homo sapiens

<400> SEQUENCE: 45 gcagtcagag ctgcctctcg ccctcgctag ctgggctcgc agcctcttcc tccctccctg 60 gctcctggct ttttgtttaa agcaacaccc accctccatc caggcttttt ttctttcttt 120 ctttattggt agcggccaaa aagagttgat tgctattggg atccgctgag taaagacacg 180 ggcaggggtg cgcggaggtg agaaaactga agacctggaa gatttttttt tccttcaaaa 240 acccgtttcc atccagtctt cagccagtcc agtctacttt aatcctcacc aggacaatgg 300 attaagtttc tcttccctgg accagaagtc gggttcggac ttggggcaaa atgaaggaaa 360 aggccatgat caagaccgct aagatgcagg ggaacgtgat ggagctggtg gggagtaacc 420 ctccgcagag gaattggaaa ggaatagcaa ttgcactgct tgtcattctg gtcatctgct 480 ccttgatcgt cacctcggtc atacttctga caccagcgga agataatagt ctgtctcaaa 540 agaagaaggt cactgtagaa gatctcttca gtgaagactt caaaattcat gaccccgagg 600 ctaagtggat aagtgataca gaattcatct acagagaaca gaaaggaaca gtgagactgt 660 ggaatgttga aacaaatact tctactgtct taatagaagg caaaaaaatt gaatcattaa 720 gagccatcag atatgaaata tctccagata gagagtatgc actttttca tacaatgtgg 780 aacccatata tcaacactcg tatactggat attacgtcct gagcaaaatt cctcatgggg 840 atcctcaaag tctggaccca ccagaagtca gcaatgcaaa acttcagtat gcaggatggg 900 gccctaaagg ccaacagctg atatttattt ttgaaaacaa tatctactac tgtgcacatg 960 tcgggaaaca ggccatccgt gtggtctcca ctggcaagga aggtgtgatt tacaatggcc 1020 tcagtgactg gctgtatgaa gaggagattt tgaagacaca catcgcacac tggtggtctc 1080 cggatggcac gagactcgcc tacgccgcca tcaatgattc ccgtgtcccc atcatggagc 1140 tcccaactta caccggctcc atctacccca ccgtgaagcc ctaccactat cccaaggctg 1200 gaagtgagaa ccccagcatt tccctacacg ttattggctt aaatggaccc acccatgatc 1260 tggagatgat gccgcctgat gatccacgga tgagggagta ctacatcacc atggtgaagt 1320 gggccaccag caccaaggtc gccgtgacct ggctgaaccg ggcgcagaac gtgtccatcc 1380 tcaccctctg cgacgccacc acgggggtct gcacgaagaa acacgaggat gaaagtgagg 1440 cctggctcca cagacagaat gaagaacctg tgttctccaa ggatggccga aagtttttct 1500 tcatcagagc catcccccag ggaggacgag ggaaattcta tcacatcacg gtgtcctcgt 1560 cccagcccaa cagcagcaac gacaacatcc agtccatcac ctccggggac tgggacgtga 1620 ccaagatcct agcctacgat gagaagggga ataagatcta cttcctgagc acggaggacc 1680 tgcctcggag acgacaactc tacagtgcca acacggtggg caacttcaac aggcagtgcc 1740 tctcctgtga cctggttgag aactgcacct acttcagcgc ttccttcagc catagcatgg 1800 acttcttcct gctcaagtgc gaaggtcctg gtgttcctat ggtgacggtg cacaacacaa 1860 cagataagaa aaaaatgttt gacctagaaa caaatgaaca tgtcaagaag gccataaatg 1920 accgacagat gcctaaagtg gaatacaggg acattgagat tgatgattac aacctgccca 1980 tgcagatact gaagccagca accttcaccg acaccaccca ctaccctctg ctcctggtgg 2040 tggatggcac cccaggcagc cagagtgtgg ctgagaagtt cgaggtgagc tgggagacgg 2100 tgatggtgag cagccacggc gcggtggtgg taaagtgtga cggccgtggc agcggcttcc 2160 aagggaccaa gctcctgcac gaagtgaggc ggcggctggg cttgctggag gagaaggacc 2220

```
agatggaggc cgtgcggacg atgctgaagg agcagtacat tgacaggacg cgcgtggccg   2280
tgtttgggaa ggattacggt ggctacctga gcacctacat cctcccagca aagggagaaa   2340
atcaaggcca gacattcacc tgcggctctg ctctctctcc aataacagac ttcaaactct   2400
atgcctctgc gttttccgag aggtacttgg gcctccatgg acttgacaac agagcatacg   2460
agatgaccaa ggtagcccat cgagtctccg cgctggaaga acagcagttc ctgatcattc   2520
atcccactgc cgatgaaaaa attcatttcc agcacacagc agaactcatt acacaactaa   2580
ttaggggaaa ggctaattac agcttacaga tttacccgga cgaaagccat tactttacca   2640
gctccagcct caaacagcat ctgtaccggt ccatcatcaa cttcttcgtg gaatgcttca   2700
ggatccagga caaactgctg acagtcacag cgaaagagga cgaggaggag gactaagctc   2760
aggtcgctct aagcacaaac gtggctcttt ctacaaccag atgcaaccga gggatttccc   2820
tgccctccct cttccctcgg aggggcgggg cggggcgggg ccgggtgttc catagcatgt   2880
gtgtctcgga tgcggaaggc agttttgctt gggaaacaag ctccttcccc ggggtcatca   2940
ctcacggcct ccatggcacc agggacaacg ctgtccccgc agcagcgcct cctcccggcg   3000
cccgagagac cggcacgcca cggcccctcc cccaaggaac agagcaaagg atggtggccg   3060
caggccccac gcgagcccac aggacaccgg cccctagatt ccagccacca agcggaagca   3120
tgagacccgc ccacactagc ctctgtgttc ccgttaggga catcacaccc tgtctcacgt   3180
cgcagtgcca tggacgcagc agttacagca ccattgtttt agcagtgcgt gttcatatat   3240
gggcttgcta cttcctgtaa tgaggacgtt caacatggtg aggggctaca agaaaacgct   3300
tttctgtaca gagtcttact gtagctacgc taatggttaa cctgatagaa ttaactcgta   3360
tttttctatg gttttaacct gatgctccac tgtctccgtc atggggttgt tttgctgttt   3420
ggggttgggc cttgtttccc tttcctttct ccagtccacg tgtagacttt gcgcttgatg   3480
aagaagcaga tcggaagtaa ctgctccctc ctcaaggttg tcttcagacg tcttggggac   3540
gttcctaaac actgaggggg aagacagcca atagcaccca ttaaaagaaa tacctaaata   3600
aaacctctct cccactcagc tatgctaggg cttggctgta ggtgtgcact gtctatttac   3660
atccgtcctt acaaccatcc ttgtcctcct tggtaccgta tcaagctctt tcccatgaca   3720
tttggtttaa aaaaaaaaaa aaaaaaaaaa aaaaaacaga aaaaagacaa agcgtcaact   3780
ccacccacag gcccgctgtg tgtgctcggg ccacgggagt cctgagggtt ctgtgggcct   3840
gcgcgcatcc ctctcccatc gtgggggtgg ctccgtgacc ttcctgccac gagcaggagg   3900
ttgatgatgt gctacgttag ccttgtaaga tacaccccca ccaaatgtgc agccggtgtt   3960
cccagtgtat atttcattct cttgtatata aaggaagcaa tgtgtgtcag gcctctgtgc   4020
agtcaaccca gcctcctccc gccagtgcta accccgtgtt gagcctgcat gctgacactg   4080
tggccgatct ggactctaga agtgctagtt tgaaatatat ccattactgt catttccttt   4140
tgagcttgtg gacaagctga atgtcaggac tgacttcgcc agctcccagc cctgcggggg   4200
tgtccttggc atcccatcag cagaggagat gcgtccctgt tgcattttgg cgtttggggc   4260
tttgggttta tccacatgag ctctgaacgt ccgttatagt tagggtgatt ggaaggtctc   4320
catcactggg tgttttaaag gtgattcacc accatttgtg aaaggaccaa cgtgctgata   4380
aacaggaccg atccgagtgc tacatgactg tgcgtttgct atttcaatgg gcctgaacga   4440
ctacaaagcc agctaggtct ggaaggggaa gccagctctg gccacgacat ctggtcggag   4500
ggaagtgggg atgtggcatg gtagcgtctg ttcatccatg gaataaaaca ttattttacc   4560
```

aaaaaaaaaa a 4571

<210> SEQ ID NO 46
<211> LENGTH: 4460
<212> TYPE: DNA
<213> ORGANISM: Homo sapiens

<400> SEQUENCE: 46 actaagcagc ggcagcttcc tgcttcggat cctctctctg ctgcttgcat ttaaagagca 60 aactcgtctt gtctacccac cctccctccc ccatcctccc caaaatagcc ttgtgatttc 120 ggaagtatgg actaaaatca cactcctcct taccttaccg cttggactct ggtggctccc 180 aactcgccgt cagaccccac ctgccccggt ggtgggaagc gcctggacag accatgacca 240 cagccaagga gccaagcgct tcggggaaat ccgtgcagca gcaggaacag gagctggtgg 300 ggagtaaccc tccgcagagg aattggaaag gaatagcaat tgcactgctt gtcattctgg 360 tcatctgctc cttgatcgtc acctcggtca tacttctgac accagcggaa gataatagtc 420 tgtctcaaaa gaagaaggtc actgtagaag atctcttcag tgaagacttc aaaattcatg 480 accccgaggc taagtggata agtgatacag aattcatcta cagagaacag aaaggaacag 540 tgagactgtg gaatgttgaa acaaatactt ctactgtctt aatagaaggc aaaaaaattg 600 aatcattaag agccatcaga tatgaaatat ctccagatag agagtatgca ctttttcat 660 acaatgtgga acccatatat caacactcgt atactggata ttacgtcctg agcaaaattc 720 ctcatgggga tcctcaaagt ctggacccac cagaagtcag caatgcaaaa cttcagtatg 780 caggatgggg ccctaaaggc caacagctga tatttatttt tgaaaacaat atctactact 840 gtgcacatgt cgggaaacag gccatccgtg tggtctccac tggcaaggaa ggtgtgattt 900 acaatggcct cagtgactgg ctgtatgaag aggagatttt gaagacacac atcgcacact 960 ggtggtctcc ggatggcacg agactcgcct acgccgccat caatgattcc cgtgtcccca 1020 tcatggagct cccaacttac accggctcca tctaccccac cgtgaagccc taccactatc 1080 ccaaggctgg aagtgagaac cccagcattt ccctacacgt tattggctta aatggaccca 1140 cccatgatct ggagatgatg ccgcctgatg atccacggat gagggagtac tacatcacca 1200 tggtgaagtg ggccaccagc accaaggtcg ccgtgacctg gctgaaccgg gcgcagaacg 1260 tgtccatcct caccctctgc gacgccacca cgggggtctg cacgaagaaa cacgaggatg 1320 aaagtgaggc ctggctccac agacagaatg aagaacctgt gttctccaag gatggccgaa 1380 agtttttctt catcagagcc atcccccagg gaggacgagg gaaattctat cacatcacgg 1440 tgtcctcgtc ccagcccaac agcagcaacg acaacatcca gtccatcacc tccggggact 1500 gggacgtgac caagatccta gcctacgatg agaaggggaa taagatctac ttcctgagca 1560 cggaggacct gcctcggaga cgacaactct acagtgccaa cacggtgggc aacttcaaca 1620 ggcagtgcct ctcctgtgac ctggttgaga actgcaccta cttcagcgct tccttcagcc 1680 atagcatgga cttcttcctg ctcaagtgcg aaggtcctgg tgttcctatg gtgacggtgc 1740 acaacacaac agataagaaa aaaatgtttg acctagaaac aaatgaacat gtcaagaagg 1800 ccataaatga ccgacagatg cctaaagtgg aatacaggga cattgagatt gatgattaca 1860 acctgcccat gcagatactg aagccagcaa ccttcaccga caccacccac taccctctgc 1920 tcctggtggt ggatggcacc ccaggcagcc agagtgtggc tgagaagttc gaggtgagct 1980 gggagacggt gatggtgagc agccacggcg cggtggtggt aaagtgtgac ggccgtggca 2040 gcggcttcca agggaccaag ctcctgcacg aagtgaggcg gcggctgggc ttgctggagg 2100

```
agaaggacca gatggaggcc gtgcggacga tgctgaagga gcagtacatt gacaggacgc   2160
gcgtggccgt gtttgggaag gattacggtg gctacctgag cacctacatc ctcccagcaa   2220
agggagaaaa tcaaggccag acattcacct gcggctctgc tctctctcca ataacagact   2280
tcaaactcta tgcctctgcg ttttccgaga ggtacttggg cctccatgga cttgacaaca   2340
gagcatacga gatgaccaag gtagcccatc gagtctccgc gctggaagaa cagcagttcc   2400
tgatcattca tcccactgcc gatgaaaaaa ttcatttcca gcacacagca gaactcatta   2460
cacaactaat taggggaaag gctaattaca gcttacagat ttacccggac gaaagccatt   2520
actttaccag ctccagcctc aaacagcatc tgtaccggtc catcatcaac ttcttcgtgg   2580
aatgcttcag gatccaggac aaactgctga cagtcacagc gaaagaggac gaggaggagg   2640
actaagctca ggtcgctcta agcacaaacg tggctctttc tacaaccaga tgcaaccgag   2700
ggatttccct gccctccctc ttccctcgga ggggcggggc ggggcggggc cgggtgttcc   2760
atagcatgtg tgtctcggat gcggaaggca gttttgcttg ggaaacaagc tccttccccg   2820
gggtcatcac tcacggcctc catggcacca gggacaacgc tgtccccgca gcagcgcctc   2880
ctcccggcgc ccgagagacc ggcacgccac ggcccctccc ccaaggaaca gagcaaagga   2940
tggtggccgc aggccccacg cgagcccaca ggacaccggc ccctagattc cagccaccaa   3000
gcggaagcat gagacccgcc cacactagcc tctgtgttcc cgttagggac atcacaccct   3060
gtctcacgtc gcagtgccat ggacgcagca gttacagcac cattgtttta gcagtgcgtg   3120
ttcatatatg ggcttgctac ttcctgtaat gaggacgttc aacatggtga ggggctacaa   3180
gaaaacgctt ttctgtacag agtcttactg tagctacgct aatggttaac ctgatagaat   3240
taactcgtat ttttctatgg ttttaacctg atgctccact gtctccgtca tggggttgtt   3300
ttgctgtttg gggttgggcc ttgtttccct ttcctttctc cagtccacgt gtagactttg   3360
cgcttgatga agaagcagat cggaagtaac tgctccctcc tcaaggttgt cttcagacgt   3420
cttggggacg ttcctaaaca ctgaggggga agacagccaa tagcacccat taaaagaaat   3480
acctaaataa aacctctctc ccactcagct atgctagggc ttggctgtag gtgtgcactg   3540
tctatttaca tccgtcctta caaccatcct tgtcctcctt ggtaccgtat caagctcttt   3600
cccatgacat ttggtttaaa aaaaaaaaaa aaaaaaaaaa aaaaacagaa aaaagacaaa   3660
gcgtcaactc cacccacagg cccgctgtgt gtgctcgggc cacgggagtc ctgagggttc   3720
tgtgggcctg cgcgcatccc tctcccatcg tgggggtggc tccgtgacct tcctgccacg   3780
agcaggaggt tgatgatgtg ctacgttagc cttgtaagat acacccccac caaatgtgca   3840
gccggtgttc ccagtgtata tttcattctc ttgtatataa aggaagcaat gtgtgtcagg   3900
cctctgtgca gtcaacccag cctcctcccg ccagtgctaa ccccgtgttg agcctgcatg   3960
ctgacactgt ggccgatctg gactctagaa gtgctagttt gaaatatatc cattactgtc   4020
atttcctttt gagcttgtgg acaagctgaa tgtcaggact gacttcgcca gctcccagcc   4080
ctgcgggggt gtccttggca tcccatcagc agaggagatg cgtccctgtt gcattttggc   4140
gtttggggct ttgggtttat ccacatgagc tctgaacgtc cgttatagtt agggtgattg   4200
gaaggtctcc atcactgggt gttttaaagg tgattcacca ccatttgtga aaggaccaac   4260
gtgctgataa acaggaccga tccgagtgct acatgactgt gcgtttgcta tttcaatggg   4320
cctgaacgac tacaaagcca gctaggtctg gaaggggaag ccagctctgg ccacgacatc   4380
tggtcggagg gaagtgggga tgtggcatgg tagcgtctgt tcatccatgg aataaaacat   4440
```

```
tattttacca aaaaaaaaaa                                                4460


<210> SEQ ID NO 47
<211> LENGTH: 4542
<212> TYPE: DNA
<213> ORGANISM: Homo sapiens

<400> SEQUENCE: 47

gctgctgctg ctgctgcctc cccaccgcct tttttttttt ttaatctgga gcggggtggg     60

gagtgggaac cggagagaaa gcaaaatatt aaaaagcccc aaagacagcc agcaggagcg    120

cggtgcccga tggcttcgct gtaccagagg ttcactggca agatcaacac ctcgaggtcc    180

ttccccgcgc ccccggaggc gagtcacctc ctgggcggcc aggggcccga ggaggacggc    240

ggcgcaggag ccaagcccct cggcccgcgg gcgcaggcgg cggcgccccg ggagcgcggc    300

ggcggcggcg gcggcgcggg tggccggccc cggttccagt accaggcgcg gagcgatggt    360

gacgaggagg acgagctggt ggggagtaac cctccgcaga ggaattggaa aggaatagca    420

attgcactgc ttgtcattct ggtcatctgc tccttgatcg tcacctcggt catacttctg    480

acaccagcgg aagataatag tctgtctcaa aagaagaagg tcactgtaga agatctcttc    540

agtgaagact tcaaaattca tgaccccgag gctaagtgga taagtgatac agaattcatc    600

tacagagaac agaaaggaac agtgagactg tggaatgttg aaacaaatac ttctactgtc    660

ttaatagaag gcaaaaaaat tgaatcatta agagccatca gatatgaaat atctccagat    720

agagagtatg cactttttc atacaatgtg gaacccatat atcaacactc gtatactgga    780

tattacgtcc tgagcaaaat tcctcatggg gatcctcaaa gtctggaccc accagaagtc    840

agcaatgcaa aacttcagta tgcaggatgg ggccctaaag gccaacagct gatatttatt    900

tttgaaaaca atatctacta ctgtgcacat gtcgggaaac aggccatccg tgtggtctcc    960

actggcaagg aaggtgtgat ttacaatggc ctcagtgact ggctgtatga agaggagatt   1020

ttgaagacac acatcgcaca ctggtggtct ccggatggca cgagactcgc ctacgccgcc   1080

atcaatgatt cccgtgtccc catcatggag ctcccaactt acaccggctc catctacccc   1140

accgtgaagc cctaccacta tcccaaggct ggaagtgaga accccagcat ttccctacac   1200

gttattggct taaatggacc cacccatgat ctggagatga tgccgcctga tgatccacgg   1260

atgagggagt actacatcac catggtgaag tgggccacca gcaccaaggt cgccgtgacc   1320

tggctgaacc gggcgcagaa cgtgtccatc ctcaccctct gcgacgccac cacgggggtc   1380

tgcacgaaga aacacgagga tgaaagtgag gcctggctcc acagacagaa tgaagaacct   1440

gtgttctcca aggatggccg aaagtttttc ttcatcagag ccatccccca gggaggacga   1500

gggaaattct atcacatcac ggtgtcctcg tcccagccca acagcagcaa cgacaacatc   1560

cagtccatca cctccgggga ctgggacgtg accaagatcc tagcctacga tgagaagggg   1620

aataagatct acttcctgag cacggaggac ctgcctcgga gacgacaact ctacagtgcc   1680

aacacggtgg gcaacttcaa caggcagtgc ctctcctgtg acctggttga gaactgcacc   1740

tacttcagcg cttccttcag ccatagcatg gacttcttcc tgctcaagtg cgaaggtcct   1800

ggtgttccta tggtgacggt gcacaacaca acagataaga aaaaaatgtt tgacctagaa   1860

acaaatgaac atgtcaagaa ggccataaat gaccgacaga tgcctaaagt ggaatacagg   1920

gacattgaga ttgatgatta caacctgccc atgcagatac tgaagccagc aaccttcacc   1980

gacaccaccc actaccctct gctcctggtg gtggatggca ccccaggcag ccagagtgtg   2040

gctgagaagt tcgaggtgag ctgggagacg gtgatggtga gcagccacgg cgcggtggtg   2100
```

gtaaagtgtg acggccgtgg cagcggcttc caagggacca agctcctgca cgaagtgagg 2160
cggcggctgg gcttgctgga ggagaaggac cagatggagg ccgtgcggac gatgctgaag 2220
gagcagtaca ttgacaggac gcgcgtggcc gtgtttggga aggattacgg tggctacctg 2280
agcacctaca tcctcccagc aaagggagaa aatcaaggcc agacattcac ctgcggctct 2340
gctctctctc caataacaga cttcaaactc tatgcctctg cgttttccga gaggtacttg 2400
ggcctccatg gacttgacaa cagagcatac gagatgacca aggtagccca tcgagtctcc 2460
gcgctggaag aacagcagtt cctgatcatt catcccactg ccgatgaaaa aattcatttc 2520
cagcacacag cagaactcat tacacaacta attaggggaa aggctaatta cagcttacag 2580
atttacccgg acgaaagcca ttactttacc agctccagcc tcaaacagca tctgtaccgg 2640
tccatcatca acttcttcgt ggaatgcttc aggatccagg acaaactgct gacagtcaca 2700
gcgaaagagg acgaggagga ggactaagct caggtcgctc taagcacaaa cgtggctctt 2760
tctacaacca gatgcaaccg agggatttcc ctgccctccc tcttccctcg gaggggcggg 2820
gcggggcggg gccgggtgtt ccatagcatg tgtgtctcgg atgcggaagg cagttttgct 2880
tgggaaacaa gctccttccc cggggtcatc actcacggcc tccatggcac cagggacaac 2940
gctgtccccg cagcagcgcc tcctcccggc gcccgagaga ccggcacgcc acggcccctc 3000
ccccaaggaa cagagcaaag gatggtggcc gcaggcccca cgcgagccca caggacaccg 3060
gcccctagat tccagccacc aagcggaagc atgagacccg cccacactag cctctgtgtt 3120
cccgttaggg acatcacacc ctgtctcacg tcgcagtgcc atggacgcag cagttacagc 3180
accattgttt tagcagtgcg tgttcatata tgggcttgct acttcctgta atgaggacgt 3240
tcaacatggt gaggggctac aagaaaacgc ttttctgtac agagtcttac tgtagctacg 3300
ctaatggtta acctgataga attaactcgt atttttctat ggttttaacc tgatgctcca 3360
ctgtctccgt catggggttg ttttgctgtt tggggttggg ccttgtttcc ctttcctttc 3420
tccagtccac gtgtagactt tgcgcttgat gaagaagcag atcggaagta actgctccct 3480
cctcaaggtt gtcttcagac gtcttgggga cgttcctaaa cactgagggg gaagacagcc 3540
aatagcaccc attaaaagaa atacctaaat aaaacctctc tcccactcag ctatgctagg 3600
gcttggctgt aggtgtgcac tgtctattta catccgtcct tacaaccatc cttgtcctcc 3660
ttggtaccgt atcaagctct ttcccatgac atttggttta aaaaaaaaaa aaaaaaaaaa 3720
aaaaaaacag aaaaaagaca aagcgtcaac tccacccaca ggcccgctgt gtgtgctcgg 3780
gccacgggag tcctgagggt tctgtgggcc tgcgcgcatc cctctcccat cgtgggggtg 3840
gctccgtgac cttcctgcca cgagcaggag gttgatgatg tgctacgtta gccttgtaag 3900
atacaccccc accaaatgtg cagccggtgt tcccagtgta tatttcattc tcttgtatat 3960
aaaggaagca atgtgtgtca ggcctctgtg cagtcaaccc agcctcctcc cgccagtgct 4020
aaccccgtgt tgagcctgca tgctgacact gtggccgatc tggactctag aagtgctagt 4080
ttgaaatata tccattactg tcatttcctt ttgagcttgt ggacaagctg aatgtcagga 4140
ctgacttcgc cagctcccag ccctgcgggg gtgtccttgg catcccatca gcagaggaga 4200
tgcgtccctg ttgcattttg gcgtttgggg ctttgggttt atccacatga gctctgaacg 4260
tccgttatag ttagggtgat tggaaggtct ccatcactgg gtgttttaaa ggtgattcac 4320
caccatttgt gaaaggacca acgtgctgat aaacaggacc gatccgagtg ctacatgact 4380
gtgcgtttgc tatttcaatg ggcctgaacg actacaaagc cagctaggtc tggaagggga 4440 agccagctct ggccacgaca tctggtcgga gggaagtggg gatgtggcat ggtagcgtct 4500 gttcatccat ggaataaaac attattttac caaaaaaaaa aa 4542

<210> SEQ ID NO 48
<211> LENGTH: 940
<212> TYPE: DNA
<213> ORGANISM: Homo sapiens

<400> SEQUENCE: 48 cctgggcgtg tgctaaggcc agagctacca gatgggtcca gctgccgcag gctctccagg 60 cactgtcccc taagtgacag ctgttactgc ctgggagagc tcaagtgcaa agactatcct 120 gttctcccat aaagaggagg aaaaggaaga tacagaaatc ggtgctgctc ccaacagcag 180 atcaaggcag tcgtcaggaa ctcaggatcc ggggggtctt cacggcttct ctgcccaggg 240 gccagaaccg aggaggccag gagggctgct ggggctaagg ggtctaagga cctcgttgca 300 cacgctacca ggagcagggg catggagcac agtgaggggg ctcccggaga cccagccggt 360 actgtggtac cccaggagct gctggaagag atgctttggt tttttcgtgt ggaagatgca 420 tctccctgga atcattccat ccttgccctg gcagctgtgg tggtcattat aagcatggtc 480 ctcctgggaa gaagcatcca ggcaagcaga aaagaaaaga tgcagccacc agaaaaagaa 540 actccagaag tcctgcattt ggatgaggcc aaggatcaca acagcctaaa caacctaaga 600 gaaactttgc tctcagaaaa gccaaacttg gcccaggtgg aacttgagtt aaaagagaga 660 gatgtgctgt cagttttcct tccggatgta ccagaaactg agagctagtg agggttcaga 720 gaagccccat cctaagccag acacatgatg tgggctcagc tcagtggcct gaaacctctc 780 aggttttaga gtctctccca agaagccgct tttttctttt tctttctttc tttttttttt 840 tcttagcaga tacaatgaat gaactgcaag caaactaaaa ttctgttatt aaaaaaaatc 900 ttttattaaa atgctcctgg aagggagcag gtggtattgc 940

<210> SEQ ID NO 49
<211> LENGTH: 5018
<212> TYPE: DNA
<213> ORGANISM: Homo sapiens

<400> SEQUENCE: 49 gcccgggact atcccttcgc ggtgtagcgg cagccggaga cctggctgag gaggcaaccg 60 cgtagacacc tccctgctta gaaaacaaac actgaaccag accgatccca gttggagggt 120 tcgaaaatgt tccagacagc ctgtcgggag gggttgttgt tgctgttgga ctaaatagct 180 attcctgatt ggtcatgtat agggtttttt aaggcgggtg gggggaggag ggggtagagg 240 aaaggctcca aacacctgca ggttgggggc ggaaagctgt ttgcgattcc ctggactggt 300 tggtcgggga caggaggtaa ttcccagcca ttgacccccca tttctctctc tccctccctc 360 ttgccctgcc tctttctctc cacccctatc tttcctggaa actcgctttg ggcgcggcag 420 atcgcccagg accacaccgc agcgtaactg caggcctctc agcgaaaaag ggggaaagca 480 aagacccggg tgtgcatcct cttcctcggc ttccgcccct ttccggcgga gtggagatcc 540 tattcagagg ggccggtctc tctaaatatg ccccaggatg accgagcggc cgccgagcga 600 ggcggctcgc agtgaccccc agctagaggg acgggacgcg gccgaggcca gcatggcccc 660 cccgcacctg gtcctgctga acggcgtcgc caaggagacg agccgcgcgg ccgcagcgga 720 gcccccagtc atcgaactgg gcgcgcgcgg aggcccgggg ggcggccctg ccggtggggg 780 cggcgccgcg agagacttaa agggccgcga cgcggcgacg gccgaagcgc gccatcgggt 840

```
gcccaccacc gagctgtgca gacctcccgg gcccgccccg gcccccgcgc ccgcctcggt    900
tacagcggag ctgcccggcg acggccgcat ggtgcagctg agtcctcccg cgctggctgc    960
ccccgccgcc cccggccgcg cgctgctcta cagcctcagc cagccgctgg cctctctcgg   1020
cagcgggttc tttggggagc cggatgcctt ccctatgttc accaccaaca atcgagtgaa   1080
gaggagacct tccccctatg agatggagat tactgatggt ccccacacca aagttgtgcg   1140
gcgtatcttc accaacagcc gggagcgatg gcggcagcag aatgtgaacg gggcctttgc   1200
cgagctccgc aagctgatcc ccacacatcc cccggacaag aagctcagca agaatgagat   1260
cctccgcctg gccatgaagt atatcaactt cttggccaag ctgctcaatg accaggagga   1320
ggagggcacc cagcgggcca agactggcaa ggaccctgtg gtgggggctg gtgggggtgg   1380
aggtggggga gggggcggcg cgcccccaga tgacctcctg caagacgtgc tttcccccaa   1440
ctccagctgc ggcagctccc tggatggggc agccagcccg gacagctaca cggaggagcc   1500
cgcgcccaaa cacacggccc gcagcctcca tcctgccatg ctgcctgccg ccgatggagc   1560
cggccctcgg tgatgggtct gggccaccag gatcagccag gagggcgttc ttaggctgct   1620
gggatggtgg gcttcagggc aggtggggtg agaattgggc ggctctgaag caaggcggtg   1680
gacttgaact ttcctggatg tctgaacttt gggaagcctt tactgaccct ggggctggct   1740
tttctgtttc ctgtaccagt aggagatcag aaaaatggag caaagtggta ggtacttttt   1800
gtgaagacgg cacggtcttc cctcttccct cagtcccaaa tccttcccaa gtaagaggct   1860
ggagttgtca ctgcttttgg cctggagttt gggatccctg tctttcctaa gacctggggt   1920
tgtcagctct catctgaggc atccagcagt ctctgccttg cctttagccc ctcccaagct   1980
ggctggggtg gcctgtgtgg ccacttctgt ccatatttat aggtacccaa tagctgccca   2040
tttcgtgagc cccatcttca cccaggccta tgttgatcca tccagcttgc cagatgctgc   2100
agagtcacaa gcctcgaggt gccttcttca gggcctggtt gaagaagatg atcagtggac   2160
agtctgctct agatgagctg ggccggaggg tcaggaaacc cagtcgccct tacttcttgc   2220
cctggggatc aaagttctgc tttctcccca atgagacttg ccttcctaag cctgtggctg   2280
tggagacaat gtctgcagcc ctgagaaagc cctgtcgggc tttgtgtgaa ggcagagaaa   2340
gggacaatga tagtagagtg atatggagca agagatattt tgggcatgtg ggcttcaact   2400
cctcgacatc actgttcatg ctggcgagtg aatgccagtg tgctgatggg cgtacgctgg   2460
tgctgagtag atgcgcagcc ccatctgtgc attctcctgg atgcttagag ggatttcttt   2520
gctgtaagat gtctgtttgc tgatggtctg gtctatgttc cgaattgagc acaaaacctg   2580
tcctatgaat gctttgcatt tggaattttt gcttgacttc agttattggt ggaatcttta   2640
gcgctcaata ggaccaggat ccagcctcac ttctagggta tgggaaatcc aatcagagac   2700
caggccctgg ctaagaccca aacatatgca cattcactta gcagaacctt aaacacccct   2760
cagttgtgca gcttttggtc atcaagggtg cgtctgggag gttggtttaa tgcaatagaa   2820
gtgctcccct ctgaaagttg tacatgaaat ttttgtaaat cacatcctta tccttcatct   2880
tttaaagaaa taaccactgc aagtcctttt gtaaagtgaa gaatcctttt gtagaatgaa   2940
ccactgcccc ttcattgatt tcctgtgtca atccagatgg tgggatgtgg ttttcttaag   3000
gtgaggcctg tctgtgacct gcatctaagc ccatgggaca aattgcacag aagtcctgta   3060
tgtctgtcat tgtaccctta agtcacccta gccctctccc tctaggctct gccttcgagg   3120
tcagaggaga gatagcctgt ggccctgtcc tgccatgcaa gaactcatca ctgtggctgt   3180
```

```
ctggaaagcc ccccttata gtttgggctt cagcctagtg gcttgtcctc accatgatgg   3240
ggccctaatt cagccatgta cagacagaga atatgtctgc tcctttcccc ttccttttaa   3300
gtaaggtcca attctcgagc ttggggcaac attgttcacc tttgtagcac tcaggctctc   3360
cattcaattt caggctcccc agatcatgtt ttggtgaaaa ttagggttgg ttcctttcca   3420
acgtttggaa gatcctgtga ggagccccat ctgtctaaag atagagtcat tgctgtagga   3480
tctaaggctg tttgcttcac cgtggattcg cttgagttag gaatgagaag tagccacagt   3540
atggatgggt ggatgggttt tatgagatgg atcacatatt ttattaagaa ctcaaacttc   3600
tggctccctc ttctttcaga cttgccatgt gactctggct tggcctatct cctagggcta   3660
tggtgtggac tgaatgggat catgaaagta gacagttttg agaacgtaaa gaactttttc   3720
ttttccctca atctcaatcc tgcagtgggg tttcgcagcc tgagtccacg acctaggcag   3780
taggccggtg tgcctgactg cccagcattt gggtaattta gattgtaaac cgctttggcc   3840
tgagttattg agattgtcct catttctcca gattatctat ttgtgtgtgt gtgtgtgtgt   3900
gtgtgagaga cggtgtcttg ttctgtcact caggctggag tacagtggtg ccatcattgc   3960
tgtctgcagc cttgaactct gggctcaagc aatcctctca cctcagcctc ccgagtaggg   4020
aggaccacag gtgtgagcca ccacacctgg ctaattttta cttttttttt tttttggtag   4080
agatggagtc ttgctatatt gcccaggctg gtcttgaagt cctggcttca ggcaattctc   4140
ctgcctttgc ctccagaagc actgggatca caggtgtcag ccattgcacc cagcccagat   4200
tgtcttaatt tctatcttgt tccaaggcca gggacagtaa taagaatgga aaagagatat   4260
gggaacactg gcagactgtg taaaatgtaa tgcaactacc caaaacaagc ctggtaggaa   4320
agggcaagtc tttaggtctt tgtaagaact aaagaagatc tgtaattttt attttcaccc   4380
tctgtacccc atgaccttat ccttcctctc cttccttgtt acccatgaaa aactggcaac   4440
attccaagaa tagcatctgt acaaagggga aagaacataa aggtaaaaca aaacaaaaca   4500
acattttgag aacaaagatg accataacca ctgaagggaa tcacatcttt taagacaaat   4560
tcatattctt ttatttgtta tggcagatga caagatggta caacctttat tcttttccaa   4620
aataaaacaa agggcacagc atctgtagtc agccgacaac tatttcggcc ttttgggggt   4680
gggtctggcc gtacttgtga tttcgatggt acgtgaccct ctgctgaaga cttgcccccct   4740
gcccgtgtac atagtgcatt gtttctgtgg gcgggcccag cactttccgt caacgttgta   4800
ctgtatgtga tgaattgcgt tggtctctgc atttttctgc agaagaggag taaccgctcc   4860
aggtaccttg acctttgtac agcccagagg ccaacactgt gggtgtgtga ctctttagca   4920
aaaaaaaccc atgtggtgat gatgtgtata tatatgtgag gatgtatcgg gaagatttct   4980
aaataaaagt tttacaaagg ggaaaaaaaa aaaaaaaa                           5018
```

<210> SEQ ID NO 50
<211> LENGTH: 3024
<212> TYPE: DNA
<213> ORGANISM: Homo sapiens

<400> SEQUENCE: 50

```
aggatatctt tagccaaagg aaaagctccg cattcccacc cagtccagaa attgaaatac     60
tatcaggggg caagagcctt tctctccagc tacacactcc atctcccggg agcaagggga    120
aactccgaga ggagggcaac agagccagca tcttgccagg gccccggagg aggggttccc    180
cgctacgcct gtgccggagg agttccagtc accgagcgag gggcgcaagg gtgggtgcat    240
cctgcgctgc ggcgggcgcg ctacccagac gctggtgtgc agagccacat gaagcctgct    300
```

```
ggggactggg ggccagggag cagcaagcca gctgggactg aggcggacgc tgtctcaggg    360
agacgctgac tcgcaaagac actcccttcc ttgtgcctgg gtaaaaagtc tcctcctggg    420
gtccctggcc atcctgaata tccagaatgg tgtttctgaa gttcttctgc atgagtttct    480
tctgccacct gtgtcaaggc tacttcgatg gccccctcta cccagagatg tccaatggga    540
ctctgcacca ctacttcgtg cccgatgggg actatgagga gaacgatgac cccgagaagt    600
gccagctgct cttcagggtg agtgaccaca ggcgctgctc ccagggggag gggagccagg    660
ttggcagcct gctgagcctc accctgcggg aggagttcac cgtgctgggc cgccaggtgg    720
aggatgctgg gcgcgtgctg gagggcatca gcaaaagcat ctcctacgac ctagacgggg    780
aagagagcta tggcaagtac ctgcggcggg agtcccacca gatcggggat gcctactcca    840
actcggacaa atccctcact gagctggaga gcaagttcaa gcagggccag gaacaggaca    900
gccggcagga gagcaggctc aacgaggact ttctgggaat gctggtccac accaggtccc    960
tgctgaagga gacactggac atctctgtgg ggctcaggga caaatacgag ctgctggccc   1020
tcaccattag gagccatggg acccgactag gtcggctgaa aaatgattat cttaaagtat   1080
aggtggaagg atacaaatgc tagaaagagg gaatcaaatc agccccgttt tggagggtgg   1140
gggacagaag atggggctac atttccccca tacctactat ttttttatat cccgatttgc   1200
actttgagaa tacatctaag gtcatctttc aaaagagaaa aattggacac ttgagtgact   1260
ttgtttttag ttttgttttt gtacattatt tatgtgattg ttatggaatt gtcacctgga   1320
aagaacaatt ttaagcaatg tcatttctag atgggtttct aattctgcag agacacccgt   1380
ttcagccaca tctaaaagag cacagtttat gtggtgcgga attaaacttc cccatcctgc   1440
agattatgtg gaaataccca aagataatag tgcatagctc ctttcagcct ctagccttca   1500
ctcctgggct ccaaaagcta tcccagttgc ctgtttttca aatgaggttc aaggtgctgc   1560
tttgcatgcc tgccaaccca tggaagttgt ttcttacttc ttttctctct tatttattaa   1620
ccatggtctg agagttgttt ttgttctatg taacagtatt gccacaaaac tataggcaaa   1680
tcgtgtttgc agggagattt ctgatgcctc tgtgggtgtg tgtaagttaa agtggccaca   1740
tttaagaagg ccaagctttg tagtggttgc acagtcacac tgatatgctg atttgctctt   1800
tctcattgta tgtctatgct ttgtcatcag tgctatagta aattacaaag aaataggtag   1860
attgtatgaa catacccaca aatgcctatg atttaggtta ccaatgtatt ctttctcatt   1920
tggggttttg cttctgtctg tctgtttatt ggaaacttgt acttcaagta gggggaatcc   1980
taattctaat aactccttag ctaagtttta ttattcaggc aataaacatg ttttcatgta   2040
atactggctt actttgtaat ttacatctgt aactttcata tttctaaaag gggccaatgc   2100
aaaaggagag agaaggactg gatttaagcc agtttactta gagtatatga taaagaaggc   2160
agaggaatag ctacatattt ggcaattctc ctctctgtag tcaccctgac atcctcacaa   2220
gaaaacaaat ctagccattg cccaaacttt aaatttgatc tctataggtc tgcttaaaga   2280
ctcaaatttt ctccagtttc tctcataaat tcaattgcaa aagtttctga caaggctcat   2340
accctgtacc cttatgcaga gcaagcattc catcctaagt tataaactac agtgatgttt   2400
aattttgaag ccaggtctac attatttaat taatggcttc aaaaggtgga gatgcacttt   2460
atttaatgtc tttccctagc taattcttac tctcacctta aatatgcttt cttgttgcat   2520
atatgcacag atacacacac acacacacac gaaaataaat aaatgttcat attcttctgt   2580
tcaacagaca tttattttct cctctccctt gaataagaaa ataagttttc cattcctatg   2640
```

```
aactgtctaa tatctttcta ttacagaagg ggaaactgag gctgggaaag gctaaatgac   2700

ttatcctcca tcagttataa cagcccctgg tcttcttaaa tttaaacacg ggacttcccg   2760

aactaatttt tttaaggata ctgaaaaatg agagagagtg gtcgaatgcc tgaaattttg   2820

cttaacttac tgtacttaaa atcaattata acttcttttt gttactcagg gccccacttt   2880

ttgttgcttt ctagacttgt gtgtagaaag aagattaatg atcacttaaa gtagtttcct   2940

tctttattct gaaaaaatga ggaaaaaata acaacagtgg caaataaaat catatttggt   3000

actaaaaaaa aaaaaaaaaa aaaa                                          3024
```

<210> SEQ ID NO 51
<211> LENGTH: 7111
<212> TYPE: DNA
<213> ORGANISM: Homo sapiens

<400> SEQUENCE: 51

```
gcgtcagccc tcacgtcact tcgccagcag tagcagaggc ggcggcggcg gctcccggaa     60

ttgggttgga gcaggagcct cgctggctgc ttcgctcgcg ctctacgcgc tcagtccccg    120

gcggtagcag gagcctggac ccaggcgccg ccggcgggcg tgaggcgccg gagcccggcc    180

tcgaggtgca taccggaccc ccattcgcat ctaacaagga atctgcgccc cagagagtcc    240

cgggagcgcc gccggtcggt gcccggcgcg ccgggccatg cagcgacggc cgccgcggag    300

ctccgagcag cggtagcgcc cccctgtaaa gcggttcgct atgccggggc cactgtgaac    360

cctgccgcct gccggaacac tcttcgctcc ggaccagctc agcctctgat aagctggact    420

cggcacgccc gcaacaagca ccgaggagtt aagagagccg caagcgcagg gaaggcctcc    480

ccgcacgggt gggggaaagc ggccggtgca gcgcggggac aggcactcgg gctggcactg    540

gctgctaggg atgtcgtcct ggataaggtg gcatggaccc gccatggcgc ggctctgggg    600

cttctgctgg ctggttgtgg gcttctggag ggccgctttc gcctgtccca cgtcctgcaa    660

atgcagtgcc tctcggatct ggtgcagcga cccttctcct ggcatcgtgg catttccgag    720

attggagcct aacagtgtag atcctgagaa catcaccgaa attttcatcg caaaccagaa    780

aaggttagaa atcatcaacg aagatgatgt tgaagcttat gtgggactga gaaatctgac    840

aattgtggat tctggattaa aatttgtggc tcataaagca tttctgaaaa acagcaacct    900

gcagcacatc aattttaccc gaaacaaact gacgagtttg tctaggaaac atttccgtca    960

ccttgacttg tctgaactga tcctggtggg caatccattt acatgctcct gtgacattat   1020

gtggatcaag actctccaag aggctaaatc cagtccagac actcaggatt tgtactgcct   1080

gaatgaaagc agcaagaata ttcccctggc aaacctgcag atacccaatt gtggtttgcc   1140

atctgcaaat ctggccgcac ctaacctcac tgtggaggaa ggaaagtcta tcacattatc   1200

ctgtagtgtg gcaggtgatc cggttcctaa tatgtattgg gatgttggta acctggtttc   1260

caaacatatg aatgaaacaa gccacacaca gggctcctta aggataacta acatttcatc   1320

cgatgacagt gggaagcaga tctcttgtgt ggcggaaaat cttgtaggag aagatcaaga   1380

ttctgtcaac ctcactgtgc attttgcacc aactatcaca tttctcgaat ctccaacctc   1440

agaccaccac tggtgcattc cattcactgt gaaaggcaac cccaaaccag cgcttcagtg   1500

gttctataac ggggcaatat tgaatgagtc caaatacatc tgtactaaaa tacatgttac   1560

caatcacacg gagtaccacg gctgcctcca gctggataat cccactcaca tgaacaatgg   1620

ggactacact ctaatagcca agaatgagta tgggaaggat gagaaacaga tttctgctca   1680

cttcatgggc tggcctggaa ttgacgatgg tgcaaaccca aattatcctg atgtaattta   1740
```

```
tgaagattat ggaactgcag cgaatgacat cggggacacc acgaacagaa gtaatgaaat   1800
cccttccaca gacgtcactg ataaaaccgg tcgggaacat ctctcggtct atgctgtggt   1860
ggtgattgcg tctgtggtgg gattttgcct tttggtaatg ctgtttctgc ttaagttggc   1920
aagacactcc aagtttggca tgaaaggttt tgttttgttt cataagatcc cactggatgg   1980
gtagctgaaa taaaggaaaa gacagagaaa ggggctgtgg tgcttgttgg ttgatgctgc   2040
catgtaagct ggactcctgg gactgctgtt ggcttatccc gggaagtgct gcttatctgg   2100
ggttttctgg tagatgtggg cggtgtttgg aggctgtact atatgaagcc tgcatatact   2160
gtgagctgtg attggggaac accaatgcag aggtaactct caggcagcta agcagcacct   2220
caagaaaaca tgttaaatta atgcttctct tcttacagta gttcaaatac aaaactgaaa   2280
tgaaatccca ttggattgta cttctcttct gaaaagtgtg ctttttgacc ctactggaca   2340
tttattgact taattgcttc tgtttattaa aattgacctg caaagttaaa aaaaaattaa   2400
agttgagaac aggtataagt gcacactgaa tagtctaatc tacatgtaac acatatttta   2460
gtgtgatttt ctatactcta atcagcactg aattcagagg gtttgacttt ttcatctata   2520
acacagtgac taaaagagtt aagggtatat ataccatcac tttgggactt ggtagtatta   2580
ttaaaaggtt atttccttca ctgtcaataa aagtccaaat gtttagctta ggtctgagag   2640
tcaaacaatg ttaaggattg tcttaaagtt ccttagccag caaaacaaaa caaaacaaaa   2700
caaacaaatg aaaaacgttt aaaaagaaga agaagaaaaa aaacaagaac aagcagcaac   2760
agctgttttg ttggggctat agatttaagt taggcatagt caatttcaga ataactaaga   2820
gtggaatata tgcatatggt gaaattataa ccttgccctt ttttatttgc cctctgcgat   2880
ccacctgctt tttagaagtc tgccgagtga gaaggccaca gtatctcatg ctgtttgcat   2940
tacagaactg cagcttttct actctgaaaa ggcctgggag cagaatggct ggcctgctgt   3000
gagcaggaga ggagattcta agaaggatag tccccccctac aacatactgt catactgctg   3060
ggttttcatg ggtaggaaag cttgtcctga ccccagcagc aaagaggtgg caggtcgcta   3120
atgaatatat gctttataat gtccttcttc attgctgaga gggcagcctt agagctgtgg   3180
atttctgcat cccccctgag tctgacccat ggacacctgt ttcattcact ttagcatcac   3240
agtgaccttt gtatgctctg ttcagtctgt gtcaggcagt atgcttgtcc tgaagagagg   3300
tttggctatc cccaccccac cccaccccac cctgttcctt ttttatcagg aggacttcag   3360
agccaggcct gcagcatttt gtttgaaaac acaatcagct ctgacagtta gacatgcaca   3420
cagacgccat agctggattg gaaacattga tgttttaaaa atttattttt tttggaaata   3480
gttgcacaaa tgctgcaatt tagctttaag gttctataga tttttaacta gtccaacaca   3540
gtcagaaaca ttgttttgaa tcctctgtaa accaaggcat taatcttaat aaaccaggat   3600
ccatttaggt accacttgat ataaaaagga tatccataat gaatatttta tactgcatcc   3660
tttacattag ccactaaata cgttattgct tgatgaagac ctttcacaga atcctatgga   3720
ttgcagcatt tcacttggct acttcatacc catgccttaa agaggggcag tttctcaaaa   3780
gcagaaacat gccgccagtt ctcaagtttt cctcctaact ccatttgaat gtaagggcag   3840
ctggccccca atgtggggag gtccgaacat tttctgaatt cccattttct tgttcgcggc   3900
taaatgacag tttctgtcat tacttagatt ccgatctttc ccaaaggtgt tgatttacaa   3960
agaggccagc taatagcaga aatcatgacc ctgaaagaga gatgaaattc aagctgtgag   4020
ccaggcagga gctcagtatg gcaaaggttc ttgagaatca gccatttggt acaaaaaaga   4080
```

```
tttttaaagc ttttatgtta taccatggag ccatagaaag gctatggatt gtttaagaac   4140
tattttaaag tgttccagac ccaaaaagga aaaataaaaa aaaaggaata tttgtaccca   4200
acagctagaa ggattgcaag gtagattttt gttttaaaat ggagagaagt ggacagataa   4260
ggccatttaa tatatcaaag atcagttgac atctcctagg gaatgatgaa aacagcaggc   4320
tattagaaaa ttatttcata tagttctcgt gttcttttct ttttttaat ccctgaaggg   4380
atgatcagta acatagcttc tcttttctgt actctagacc accccttttc atcattttgc   4440
tttttatgtc tcccataaga aatgtgcttt ttagagcttc ctaatgcatg tgttgcatta   4500
ttgcagcatt agaaaaggag aggtagcatt tttgctgaaa tcgggcctgt cactctccaa   4560
taaaggttct ggcacttcaa tgccaggcag gtctcctaaa tgaacagaat gatctgtgtg   4620
agccgatgcc tgcccttcca gaggggccac tgtccccagc cgcagccaac tgtgtcccac   4680
aggaatggga gcctaggttt ccaaatcttg tgattcttta ggagaaacat gaaacctgga   4740
tttcgtgtga aatgtcccga ttgttaaaaa gttggctcaa ttatttttaa aacattttgt   4800
aagccaacaa aagtctgtgg gctgccagtt tattactttt gtcttaaaac atgatcattg   4860
ttctctcacg gtatccttct gtcttcccgt tgcaaattca cttttctttc ttcctgacat   4920
tgccattgag ggctttgtta ccacaagcta agaaactgag tttaacagcc cagttatctg   4980
caacatgtca attacctttg ctcctctcct gtgattccca ccatgctgtg accctcagct   5040
gtctcccttt gctgggaatt ctgcaccaat gtctcccctc aacccattcc ctggttggtc   5100
ctactcccgt gtggccagag acatcctagc aaatccttcc tcctattata tctgacacta   5160
atttcttttc aacagcgctc atgtctcttg gcccagtcag gtgctgccag gtttagatag   5220
gaaagtacat gtcccatttt catgggtgcc cttaatgtgg tccacgtcct atatcttatt   5280
atatttactc atggctcaat gggggcctcc agagaccctc tcaggctgct gagctagact   5340
aaggaatgca tccaccgtca tcacatgaga cactgactct gtgacgacaa aagtacaaac   5400
agtctgaggc taagaaaggt tcatctcaca acaggaaaaa caaatctcaa cacacattag   5460
agataattga ttcaggggtt ttctctccca gtctcccagc agggactgat ttcatttctg   5520
acccactagg ttttctttcc agaaataggt agcaaggaca agaactaaac aatcccagcc   5580
ccacccagca acacagaaca caggagtttg cttttggctt ctcactctcc aagtaaccct   5640
gaattaggcc cagaatggct gaggcttgga gcatctcctc agacagagca gaggcgacac   5700
ctcttcaggg gtgtgtggag taaatagctc gaagagctga agacagaaaa ccagtttcac   5760
gccaggtgcg agagagagca taatggaggg aagcccgctt tctctctcct cttcttttct   5820
ctttatttct ttagagcact tgactttttt ttctctctct ctctagtatt ctaaactgac   5880
cccatgacca actgagaatt tatttttgtt tcattggttg tttcacagaa ttagaacaca   5940
cacgactttt tattcctcca ttgcaaaatg gaatcaagat actacacaag acctgtgctt   6000
tcttcctttg catgatttac acctccgcct gttttggtgc tagctgtcta gaacttctct   6060
cttggtttga atctgattcc ttcacactac actagaagtt tatttcatct tgttttgtct   6120
agactccaga tacagaggga cagctggact gaggacaagc aattccatct agcatagggt   6180
ctctcagggt tggtgcatcc agccacatgg gcagggccag tcacatctag tctatgtccc   6240
cagagccctt ggagttgcgc agcttagctg acttgactcc aaggaaatta gtacagaagt   6300
aaccactcta ttaagtgtgt tctgctatgt tcacatgcct gtagtacctg caaaccatgc   6360
caggttcatc taaagacata ggggaagatt aaggactctt ttggacagac catgaattga   6420
atttgctgcc aggtgctgcc agactgaatt tggctgacag aactcccagc ccaggaaagt   6480
```

```
tccatgacaa tgactgtcgc agaaggaaat ttcccactaa agtcagtcca ttttcaagtt   6540

ttggtcttca gagacaaaag aacgtcccag ccacctgatt ttgatggtga ggtaactcta   6600

agttgaattc aggctagtgt tgcagtatag ctttggcatg ttcatgagtg agcacccaga   6660

atgtgttgaa ccaaccccca cccctaacta ctgactatga ctgcagtggg tttttatggg   6720

gaaaaaaagt gtgaaaagca aaaagaaagg aacagagatt ttttatcacc tttattgtaa   6780

gacagtccat ttatgaattg agtataaaca catacaaagt aacaagagat tcctaagaaa   6840

cgcaaatcct tgagtttcac gcacttcatg ttcaaccatt tgctgtaatc cagaggcagc   6900

ctgtgaatca ttctcatgcc ctgtttttt tttttttttc ctataatgtt ctgggtttaa   6960

aagccatctt ttccacattt tctgtaaata atggataatc attttaaaaa tttttatttt   7020

tagtgctgtt ttaacaatgt agatagatca taaatgtact tgctgaattc aatcattttt   7080

aacaagccaa taaagtttga taattcatct c                                  7111
```

<210> SEQ ID NO 52
<211> LENGTH: 5560
<212> TYPE: DNA
<213> ORGANISM: Homo sapiens

<400> SEQUENCE: 52

```
aagacggatt ctcagacaag gcttgcaaat gccccgcagc catcatttaa ctgcacccgc     60

agaatagtta cggtttgtca cccgaccctc ccggatcgcc taatttgtcc ctagtgagac    120

cccgaggctc tgcccgcgcc tggcttcttc gtagctggat gcatatcgtg ctccgggcag    180

cgcgggcgca gggcacgcgt tcgcgcacac cctagcacac atgaacacgc gcaagagctg    240

aaccaagcac ggtttccatt tcaaaaaggg agacagcctc taccgcgatt gtagaagaga    300

ctgtggtgtg aattagggac cgggaggcgt cgaacggagg aacggttcat cttagagact    360

aattttctgg agtttctgcc cctgctctgc gtcagccctc acgtcacttc gccagcagta    420

gcagaggcgg cggcggcggc tcccggaatt gggttggagc aggagcctcg ctggctgctt    480

cgctcgcgct ctacgcgctc agtccccggc ggtagcagga gcctggaccc aggcgccgcc    540

ggcgggcgtg aggcgccgga gcccggcctc gaggtgcata ccggaccccc attcgcatct    600

aacaaggaat ctgcgcccca gagagtcccg ggagcgccgc cggtcggtgc ccggcgcgcc    660

gggccatgca gcgacggccg ccgcggagct ccgagcagcg gtagcgcccc cctgtaaagc    720

ggttcgctat gccggggcca ctgtgaaccc tgccgcctgc cggaacactc ttcgctccgg    780

accagctcag cctctgataa gctggactcg gcacgcccgc aacaagcacc gaggagttaa    840

gagagccgca agcgcaggga aggcctcccc gcacgggtgg gggaaagcgg ccggtgcagc    900

gcggggacag gcactcgggc tggcactggc tgctagggat gtcgtcctgg ataaggtggc    960

atggacccgc catggcgcgg ctctggggct tctgctggct ggttgtgggc ttctggaggg   1020

ccgctttcgc ctgtcccacg tcctgcaaat gcagtgcctc tcggatctgg tgcagcgacc   1080

cttctcctgg catcgtggca tttccgagat tggagcctaa cagtgtagat cctgagaaca   1140

tcaccgaaat tttcatcgca aaccagaaaa ggttagaaat catcaacgaa gatgatgttg   1200

aagcttatgt gggactgaga aatctgacaa ttgtggattc tggattaaaa tttgtggctc   1260

ataaagcatt tctgaaaaac agcaacctgc agcacatcaa ttttacccga aacaaactga   1320

cgagtttgtc taggaaacat ttccgtcacc ttgacttgtc tgaactgatc ctggtgggca   1380

atccatttac atgctcctgt gacattatgt ggatcaagac tctccaagag gctaaatcca   1440
```

-continued

```
gtccagacac tcaggatttg tactgcctga atgaaagcag caagaatatt cccctggcaa   1500
acctgcagat acccaattgt ggtttgccat ctgcaaatct ggccgcacct aacctcactg   1560
tggaggaagg aaagtctatc acattatcct gtagtgtggc aggtgatccg gttcctaata   1620
tgtattggga tgttggtaac ctggtttcca aacatatgaa tgaaacaagc cacacacagg   1680
gctccttaag gataactaac atttcatccg atgacagtgg gaagcagatc tcttgtgtgg   1740
cggaaaatct tgtaggagaa gatcaagatt ctgtcaacct cactgtgcat tttgcaccaa   1800
ctatcacatt tctcgaatct ccaacctcag accaccactg gtgcattcca ttcactgtga   1860
aaggcaaccc caaaccagcg cttcagtggt tctataacgg ggcaatattg aatgagtcca   1920
aatacatctg tactaaaata catgttacca atcacacgga gtaccacggc tgcctccagc   1980
tggataatcc cactcacatg aacaatgggg actacactct aatagccaag aatgagtatg   2040
ggaaggatga gaaacagatt tctgctcact tcatgggctg gcctggaatt gacgatggtg   2100
caaacccaaa ttatcctgat gtaatttatg aagattatgg aactgcagcg aatgacatcg   2160
gggacaccac gaacagaagt aatgaaatcc cttccacaga cgtcactgat aaaaccggtc   2220
gggaacatct ctcggtctat gctgtggtgg tgattgcgtc tgtggtggga ttttgccttt   2280
tggtaatgct gtttctgctt aagttggcaa gacactccaa gtttggcatg aaaggcccag   2340
cctccgttat cagcaatgat gatgactctg ccagcccact ccatcacatc tccaatggga   2400
gtaacactcc atcttcttcg gaaggtggcc cagatgctgt cattattgga atgaccaaga   2460
tccctgtcat tgaaaatccc cagtactttg gcatcaccaa cagtcagctc aagccagaca   2520
catttgttca gcacatcaag cgacataaca ttgttctgaa aagggagcta ggcgaaggag   2580
cctttggaaa agtgttccta gctgaatgct ataacctctg tcctgagcag gacaagatct   2640
tggtggcagt gaagaccctg aaggatgcca gtgacaatgc acgcaaggac ttccaccgtg   2700
aggccgagct cctgaccaac ctccagcatg agcacatcgt caagttctat ggcgtctgcg   2760
tggagggcga ccccctcatc atggtctttg agtacatgaa gcatggggac ctcaacaagt   2820
tcctcagggc acacggccct gatgccgtgc tgatggctga gggcaacccg cccacggaac   2880
tgacgcagtc gcagatgctg catatagccc agcagatcgc cgcgggcatg gtctacctgg   2940
cgtcccagca cttcgtgcac cgcgatttgg ccaccaggaa ctgcctggtc ggggagaact   3000
tgctggtgaa aatcggggac tttgggatgt cccgggacgt gtacagcact gactactaca   3060
gggtcggtgg ccacacaatg ctgcccattc gctggatgcc tccagagagc atcatgtaca   3120
ggaaattcac gacggaaagc gacgtctgga gcctgggggt cgtgttgtgg gagattttca   3180
cctatggcaa acagccctgg taccagctgt caaacaatga ggtgatagag tgtatcactc   3240
agggccgagt cctgcagcga ccccgcacgt gcccccagga ggtgtatgag ctgatgctgg   3300
ggtgctggca gcgagagccc cacatgagga agaacatcaa gggcatccat accctccttc   3360
agaacttggc caaggcatct ccggtctacc tggacattct aggctagggc ccttttcccc   3420
agaccgatcc ttcccaacgt actcctcaga cgggctgaga ggatgaacat cttttaactg   3480
ccgctggagg ccaccaagct gctctccttc actctgacag tattaacatc aaagactccg   3540
agaagctctc gagggaagca gtgtgtactt cttcatccat agacacagta ttgacttctt   3600
tttggcatta tctctttctc tctttccatc tcccttggtt gttccttttt ctttttttaa   3660
attttctttt tctttttttt ttcgtcttcc ctgcttcacg attcttaccc tttcttttga   3720
atcaatctgg cttctgcatt actattaact ctgcatagac aaaggcctta acaaacgtaa   3780
tttgttatat cagcagacac tccagtttgc ccaccacaac taacaatgcc ttgttgtatt   3840
```

cctgcctttg atgtggatga aaaaaaggga aaacaaatat ttcacttaaa ctttgtcact 3900 tctgctgtac agatatcgag agtttctatg gattcacttc tatttattta ttattattac 3960 tgttcttatt gtttttggat ggcttaagcc tgtgtataaa aaagaaaact tgtgttcaat 4020 ctgtgaagcc tttatctatg ggagattaaa accagagaga aagaagattt attatgaacc 4080 gcaatatggg aggaacaaag acaaccactg ggatcagctg gtgtcagtcc ctacttagga 4140 aatactcagc aactgttagc tgggaagaat gtattcggca ccttcccctg aggacctttc 4200 tgaggagtaa aaagactact ggcctctgtg ccatggatga ttcttttccc atcaccagaa 4260 atgatagcgt gcagtagaga gcaaagatgg cttccgtgag acacaagatg gcgcatagtg 4320 tgctcggaca cagttttgtc ttcgtaggtt gtgatgatag cactggtttg tttctcaagc 4380 gctatccaca gaacctttgt caacttcagt tgaaaagagg tggattcatg tccagagctc 4440 atttcggggt caggtgggaa agccaagaac ttggaaaaga taagacaagc tataaattcg 4500 gaggcaagtt tcttttacaa tgaacttttc agatctcact tccctccgac ccctaacttc 4560 catgcccacc cgtcctttta actgtgcaag caaaattgtg catggtcttc gtcgattaat 4620 accttgtgtg cagacactac tgctccagac gtcgtttccc tgataggtag agcagatcca 4680 taaaaaggta tgacttatac aattagggga agctaatgga gtttattagc tgagtatcaa 4740 tgtctctgcg ttgtacggtg gtgatgggtt ttaatgaata tggaccctga agcctggaaa 4800 tcctcatcca cgtcgaaccc acaggactgt gggaagggca gaatcaatcc ctaagggaaa 4860 ggaaacctca ccctgagggc atcacatgca ctcatgttca gtgtacacag gtcaagtccc 4920 ttgctctggg ctctagttgg gagagtggtt tcattccaag tgtactccat tgtcagtatg 4980 ctgtttttgt ttccttcact ccattcaaaa agtcaaaata caaaatttgg cacagcatgc 5040 caacgggagg ctgtgcccag accaagcact ggaagtgtgc ttctaggcat agtcattggt 5100 tttgcaaaaa gagggctcaa atttaaatag aaatttacag ctatttgaat ggtcagatat 5160 accaagaaag aaaaatattt ctgttcctca agaaaacttg ctaccctctg tgaggggaat 5220 tttgctaaac ttgacatctt tataacatga gccagattga aagggagtga ttttcattca 5280 tcttaggtca tgttatttca tatttgtttc tgaaggtgcg atagctctgt tttaggtttt 5340 gcttgcgcct gttaattact ggaacacctt atttttcatt aaaggctttg aaagccaatt 5400 ctcaaaaatt caaaagtgca aattaacaga acaaaaggaa atccagtagc aactgcagtc 5460 aagcgaggga gttgacaaga taaaccttac gtccattcaa gttatatgct ggcctatgag 5520 agatgagagt tgggtcgttt gttctctttg ttgatgattt 5560

<210> SEQ ID NO 53
<211> LENGTH: 5608
<212> TYPE: DNA
<213> ORGANISM: Homo sapiens

<400> SEQUENCE: 53 aagacggatt ctcagacaag gcttgcaaat gccccgcagc catcatttaa ctgcacccgc 60 agaatagtta cggtttgtca cccgaccctc ccggatcgcc taatttgtcc ctagtgagac 120 cccgaggctc tgcccgcgcc tggcttcttc gtagctggat gcatatcgtg ctccgggcag 180 cgcgggcgca gggcacgcgt tcgcgcacac cctagcacac atgaacacgc gcaagagctg 240 aaccaagcac ggtttccatt tcaaaaaggg agacagcctc taccgcgatt gtagaagaga 300 ctgtggtgtg aattagggac cgggaggcgt cgaacggagg aacggttcat cttagagact 360

-continued

```
aattttctgg agtttctgcc cctgctctgc gtcagccctc acgtcacttc gccagcagta    420
gcagaggcgg cggcggcggc tcccggaatt gggttggagc aggagcctcg ctggctgctt    480
cgctcgcgct ctacgcgctc agtccccggc ggtagcagga gcctggaccc aggcgccgcc    540
ggcgggcgtg aggcgccgga gcccggcctc gaggtgcata ccggaccccc attcgcatct    600
aacaaggaat ctgcgcccca gagagtcccg ggagcgccgc cggtcggtgc ccggcgcgcc    660
gggccatgca gcgacggccg ccgcggagct ccgagcagcg gtagcgcccc cctgtaaagc    720
ggttcgctat gccggggcca ctgtgaaccc tgccgcctgc cggaacactc ttcgctccgg    780
accagctcag cctctgataa gctggactcg gcacgcccgc aacaagcacc gaggagttaa    840
gagagccgca agcgcaggga aggcctcccc gcacgggtgg gggaaagcgg ccggtgcagc    900
gcggggacag gcactcgggc tggcactggc tgctagggat gtcgtcctgg ataaggtggc    960
atggacccgc catggcgcgg ctctggggct tctgctggct ggttgtgggc ttctggaggg   1020
ccgctttcgc ctgtcccacg tcctgcaaat gcagtgcctc tcggatctgg tgcagcgacc   1080
cttctcctgg catcgtggca tttccgagat tggagcctaa cagtgtagat cctgagaaca   1140
tcaccgaaat tttcatcgca aaccagaaaa ggttagaaat catcaacgaa gatgatgttg   1200
aagcttatgt gggactgaga aatctgacaa ttgtggattc tggattaaaa tttgtggctc   1260
ataaagcatt tctgaaaaac agcaacctgc agcacatcaa ttttacccga aacaaactga   1320
cgagtttgtc taggaaacat ttccgtcacc ttgacttgtc tgaactgatc ctggtgggca   1380
atccatttac atgctcctgt gacattatgt ggatcaagac tctccaagag gctaaatcca   1440
gtccagacac tcaggatttg tactgcctga atgaaagcag caagaatatt cccctggcaa   1500
acctgcagat acccaattgt ggtttgccat ctgcaaatct ggccgcacct aacctcactg   1560
tggaggaagg aaagtctatc acattatcct gtagtgtggc aggtgatccg gttcctaata   1620
tgtattggga tgttggtaac ctggtttcca aacatatgaa tgaaacaagc cacacacagg   1680
gctccttaag gataactaac atttcatccg atgacagtgg gaagcagatc tcttgtgtgg   1740
cggaaaatct tgtaggagaa gatcaagatt ctgtcaacct cactgtgcat tttgcaccaa   1800
ctatcacatt tctcgaatct ccaacctcag accaccactg gtgcattcca ttcactgtga   1860
aaggcaaccc caaaccagcg cttcagtggt tctataacgg ggcaatattg aatgagtcca   1920
aatacatctg tactaaaata catgttacca atcacacgga gtaccacggc tgcctccagc   1980
tggataatcc cactcacatg aacaatgggg actacactct aatagccaag aatgagtatg   2040
ggaaggatga gaaacagatt tctgctcact tcatgggctg gcctggaatt gacgatggtg   2100
caaacccaaa ttatcctgat gtaatttatg aagattatgg aactgcagcg aatgacatcg   2160
gggacaccac gaacagaagt aatgaaatcc cttccacaga cgtcactgat aaaaccggtc   2220
gggaacatct ctcggtctat gctgtggtgg tgattgcgtc tgtggtggga ttttgccttt   2280
tggtaatgct gtttctgctt aagttggcaa gacactccaa gtttggcatg aaagatttct   2340
catggtttgg atttgggaaa gtaaaatcaa gacaaggtgt tggcccagcc tccgttatca   2400
gcaatgatga tgactctgcc agcccactcc atcacatctc caatgggagt aacactccat   2460
cttcttcgga aggtggccca gatgctgtca ttattggaat gaccaagatc cctgtcattg   2520
aaaatcccca gtactttggc atcaccaaca gtcagctcaa gccagacaca tttgttcagc   2580
acatcaagcg acataacatt gttctgaaaa gggagctagg cgaaggagcc tttggaaaag   2640
tgttcctagc tgaatgctat aacctctgtc ctgagcagga caagatcttg gtggcagtga   2700
agaccctgaa ggatgccagt gacaatgcac gcaaggactt ccaccgtgag gccgagctcc   2760
```

```
tgaccaacct ccagcatgag cacatcgtca agttctatgg cgtctgcgtg gagggcgacc   2820
ccctcatcat ggtctttgag tacatgaagc atggggacct caacaagttc ctcagggcac   2880
acggccctga tgccgtgctg atggctgagg gcaacccgcc cacggaactg acgcagtcgc   2940
agatgctgca tatagcccag cagatcgccg cgggcatggt ctacctggcg tcccagcact   3000
tcgtgcaccg cgatttggcc accaggaact gcctggtcgg ggagaacttg ctggtgaaaa   3060
tcggggactt tgggatgtcc cgggacgtgt acagcactga ctactacagg gtcggtggcc   3120
acacaatgct gcccattcgc tggatgcctc cagagagcat catgtacagg aaattcacga   3180
cggaaagcga cgtctggagc ctgggggtcg tgttgtggga gattttcacc tatggcaaac   3240
agccctggta ccagctgtca aacaatgagg tgatagagtg tatcactcag ggccgagtcc   3300
tgcagcgacc ccgcacgtgc ccccaggagg tgtatgagct gatgctgggg tgctggcagc   3360
gagagcccca catgaggaag aacatcaagg gcatccatac cctccttcag aacttggcca   3420
aggcatctcc ggtctacctg gacattctag gctagggccc ttttccccag accgatcctt   3480
cccaacgtac tcctcagacg ggctgagagg atgaacatct tttaactgcc gctggaggcc   3540
accaagctgc tctccttcac tctgacagta ttaacatcaa agactccgag aagctctcga   3600
gggaagcagt gtgtacttct tcatccatag acacagtatt gacttctttt tggcattatc   3660
tctttctctc tttccatctc ccttggttgt tccttttttct ttttttaaat tttctttttc   3720
tttttttttt cgtcttccct gcttcacgat tcttaccctt tcttttgaat caatctggct   3780
tctgcattac tattaactct gcatagacaa aggccttaac aaacgtaatt tgttatatca   3840
gcagacactc cagtttgccc accacaacta acaatgcctt gttgtattcc tgcctttgat   3900
gtggatgaaa aaaagggaaa acaaatattt cacttaaact ttgtcacttc tgctgtacag   3960
atatcgagag tttctatgga ttcacttcta tttatttatt attattactg ttcttattgt   4020
ttttggatgg cttaagcctg tgtataaaaa agaaaacttg tgttcaatct gtgaagcctt   4080
tatctatggg agattaaaac cagagagaaa gaagatttat tatgaaccgc aatatgggag   4140
gaacaaagac aaccactggg atcagctggt gtcagtccct acttaggaaa tactcagcaa   4200
ctgttagctg ggaagaatgt attcggcacc ttcccctgag gacctttctg aggagtaaaa   4260
agactactgg cctctgtgcc atggatgatt cttttcccat caccagaaat gatagcgtgc   4320
agtagagagc aaagatggct tccgtgagac acaagatggc gcatagtgtg ctcggacaca   4380
gttttgtctt cgtaggttgt gatgatagca ctggtttgtt tctcaagcgc tatccacaga   4440
acctttgtca acttcagttg aaaagaggtg gattcatgtc cagagctcat ttcggggtca   4500
ggtgggaaag ccaagaactt ggaaaagata agacaagcta taaattcgga ggcaagtttc   4560
ttttacaatg aacttttcag atctcacttc cctccgaccc ctaacttcca tgcccacccg   4620
tccttttaac tgtgcaagca aaattgtgca tggtcttcgt cgattaatac cttgtgtgca   4680
gacactactg ctccagacgt cgtttccctg ataggtagag cagatccata aaaaggtatg   4740
acttatacaa ttaggggaag ctaatggagt ttattagctg agtatcaatg tctctgcgtt   4800
gtacggtggt gatgggtttt aatgaatatg gaccctgaag cctggaaatc ctcatccacg   4860
tcgaacccac aggactgtgg gaagggcaga atcaatccct aagggaaagg aaacctcacc   4920
ctgagggcat cacatgcact catgttcagt gtacacaggt caagtccctt gctctgggct   4980
ctagttggga gagtggtttc attccaagtg tactccattg tcagtatgct gtttttgttt   5040
ccttcactcc attcaaaaag tcaaaataca aaatttggca cagcatgcca acgggaggct   5100
```

```
gtgcccagac caagcactgg aagtgtgctt ctaggcatag tcattggttt tgcaaaaaga   5160

gggctcaaat ttaaatagaa atttacagct atttgaatgg tcagatatac caagaaagaa   5220

aaatatttct gttcctcaag aaaacttgct accctctgtg aggggaattt tgctaaactt   5280

gacatcttta taacatgagc cagattgaaa gggagtgatt ttcattcatc ttaggtcatg   5340

ttatttcata tttgtttctg aaggtgcgat agctctgttt taggttttgc ttgcgcctgt   5400

taattactgg aacaccttat ttttcattaa aggctttgaa agccaattct caaaaattca   5460

aaagtgcaaa ttaacagaac aaaaggaaat ccagtagcaa ctgcagtcaa gcgagggagt   5520

tgacaagata aaccttacgt ccattcaagt tatatgctgg cctatgagag atgagagttg   5580

ggtcgtttgt tctctttgtt gatgattt                                      5608
```

<210> SEQ ID NO 54
<211> LENGTH: 3600
<212> TYPE: DNA
<213> ORGANISM: Homo sapiens

<400> SEQUENCE: 54

```
gaagagactc agggcagagg gaggaaggac agcagaccag acagtcacag cagccttgac     60

aaaacgttcc tggaactcaa gctcttctcc acagaggagg acagagcaga cagcagagac    120

catggagtct ccctcggccc ctccccacag atggtgcatc ccctggcaga ggctcctgct    180

cacagcctca cttctaacct tctggaaccc gcccaccact gccaagctca ctattgaatc    240

cacgccgttc aatgtcgcag aggggaagga ggtgcttcta cttgtccaca atctgcccca    300

gcatcttttt ggctacagct ggtacaaagg tgaaagagtg gatggcaacc gtcaaattat    360

aggatatgta ataggaactc aacaagctac cccagggccc gcatacagtg gtcgagagat    420

aatatacccc aatgcatccc tgctgatcca gaacatcatc cagaatgaca caggattcta    480

caccctacac gtcataaagt cagatcttgt gaatgaagaa gcaactggcc agttccgggt    540

atacccggag ctgcccaagc cctccatctc cagcaacaac tccaaacccg tggaggacaa    600

ggatgctgtg gccttcacct gtgaacctga gactcaggac gcaacctacc tgtggtgggt    660

aaacaatcag agcctcccgg tcagtcccag gctgcagctg tccaatggca acaggaccct    720

cactctattc aatgtcacaa gaaatgacac agcaagctac aaatgtgaaa cccagaaccc    780

agtgagtgcc aggcgcagtg attcagtcat cctgaatgtc ctctatggcc cggatgcccc    840

caccatttcc cctctaaaca catcttacag atcaggggaa aatctgaacc tctcctgcca    900

cgcagcctct aacccacctg cacagtactc ttggtttgtc aatgggactt tccagcaatc    960

cacccaagag ctctttatcc ccaacatcac tgtgaataat agtggatcct atacgtgcca   1020

agcccataac tcagacactg gcctcaatag gaccacagtc acgacgatca cagtctatgc   1080

agagccaccc aaacccttca tcaccagcaa caactccaac cccgtggagg atgaggatgc   1140

tgtagcctta acctgtgaac ctgagattca gaacacaacc tacctgtggt gggtaaataa   1200

tcagagcctc ccggtcagtc ccaggctgca gctgtccaat gacaacagga ccctcactct   1260

actcagtgtc acaaggaatg atgtaggacc ctatgagtgt ggaatccaga acaaattaag   1320

tgttgaccac agcgacccag tcatcctgaa tgtcctctat ggcccagacg accccaccat   1380

ttccccctca tacacctatt accgtccagg ggtgaacctc agcctctcct gccatgcagc   1440

ctctaaccca cctgcacagt attcttggct gattgatggg aacatccagc aacacacaca   1500

agagctcttt atctccaaca tcactgagaa gaacagcgga ctctatacct gccaggccaa   1560

taactcagcc agtggccaca gcaggactac agtcaagaca atcacagtct ctgcggagct   1620
```

gcccaagccc tccatctcca gcaacaactc caaacccgtg gaggacaagg atgctgtggc 1680 cttcacctgt gaacctgagg ctcagaacac aacctacctg tggtgggtaa atggtcagag 1740 cctcccagtc agtcccaggc tgcagctgtc caatggcaac aggaccctca ctctattcaa 1800 tgtcacaaga aatgacgcaa gagcctatgt atgtggaatc cagaactcag tgagtgcaaa 1860 ccgcagtgac ccagtcaccc tggatgtcct ctatgggccg gacacccccca tcatttcccc 1920 cccagactcg tcttaccttt cgggagcgaa cctcaacctc tcctgccact cggcctctaa 1980 cccatccccg cagtattctt ggcgtatcaa tgggataccg cagcaacaca cacaagttct 2040 ctttatcgcc aaaatcacgc caaataataa cgggacctat gcctgttttg tctctaactt 2100 ggctactggc cgcaataatt ccatagtcaa gagcatcaca gtctctgcat ctggaacttc 2160 tcctggtctc tcagctgggg ccactgtcgg catcatgatt ggagtgctgg ttggggttgc 2220 tctgatatag cagccctggt gtagtttctt catttcagga agactgacag ttgttttgct 2280 tcttccttaa agcatttgca acagctacag tctaaaattg cttctttacc aaggatattt 2340 acagaaaaga ctctgaccag agatcgagac catcctagcc aacatcgtga aaccccatct 2400 ctactaaaaa tacaaaaatg agctgggctt ggtggcgcgc acctgtagtc ccagttactc 2460 gggaggctga ggcaggagaa tcgcttgaac ccgggaggtg gagattgcag tgagcccaga 2520 tcgcaccact gcactccagt ctggcaacag agcaagactc catctcaaaa agaaaagaaa 2580 agaagactct gacctgtact cttgaataca agtttctgat accactgcac tgtctgagaa 2640 tttccaaaac tttaatgaac taactgacag cttcatgaaa ctgtccacca agatcaagca 2700 gagaaaataa ttaatttcat gggactaaat gaactaatga ggataatatt ttcataattt 2760 tttatttgaa attttgctga ttctttaaat gtcttgtttc ccagatttca ggaaactttt 2820 tttcttttaa gctatccaca gcttacagca atttgataaa atatactttt gtgaacaaaa 2880 attgagacat ttacattttc tccctatgtg gtcgctccag acttgggaaa ctattcatga 2940 atatttatat tgtatggtaa tatagttatt gcacaagttc aataaaaatc tgctctttgt 3000 atgacagaat acatttgaaa acattggtta tattaccaag actttgacta gaatgtcgta 3060 tttgaggata taaacccata ggtaataaac ccacaggtac tacaaacaaa gtctgaagtc 3120 agccttggtt tggcttccta gtgtcaatta aacttctaaa agtttaatct gagattcctt 3180 ataaaaactt ccagcaaagc aactttaaaa aagtctgtgt gggccgggcg cggtggctca 3240 cgcctgtaat cccagcactt tgatccgccg aggcgggcgg atcacgaggt caggagatcc 3300 agaccatcct ggctaacaca gtgaaacccc gtctctacta aaaatacaaa aaaagttagc 3360 cgggcgtggt ggtgggggcc tgtagtccca gctactcagg aggctgaggc aggagaacgg 3420 catgaacccg ggaggcaggg cttgcagtga gccaagatca tgccgctgca ctccagcctg 3480 ggagacaaag tgagactccg tcaaaaaaaa aaaaaagtct atgtggtcag tcactactct 3540 tgctgcagtt atgaaaagaa tgaggccaag tctgatgaaa ataaacttat tttgaaaaca 3600

<210> SEQ ID NO 55
<211> LENGTH: 3095
<212> TYPE: DNA
<213> ORGANISM: Homo sapiens

<400> SEQUENCE: 55 attgctgatg gatcagtgag cctgtgttca tgccagtgag ctgctgtggc tcagatactg 60 atactttctt tccaaacagc ataagaagtg attgagccac aagtatactg aaggaagggc 120

```
tccctcgagt tctggtgtga agagataaat caccagtcac agactatgca cccgactgct    180
gctgttcagt ccagggaaaa tgaaagttgg agtgctgtgg ctcatttctt tcttcacctt    240
cactgacggc cacggtggct tcctggggaa aaatgatggc atcaaaacaa aaaaagaact    300
cattgtgaat aagaaaaaac atctaggccc agtcgaagaa tatcagctgc tgcttcaggt    360
gacctataga gattccaagg agaaaagaga tttgagaaat tttctgaagc tcttgaagcc    420
tccattatta tggtcacatg ggctaattag aattatcaga gcaaaggcta ccacagactg    480
caacagcctg aatggagtcc tgcagtgtac ctgtgaagac agctacacct ggtttcctcc    540
ctcatgcctt gatccccaga actgctacct tcacacggct ggagcactcc caagctgtga    600
atgtcatctc aacaacctca gccagagtgt caatttctgt gagagaacaa agatttgggg    660
cactttcaaa attaatgaaa ggtttacaaa tgaccttttg aattcatctt ctgctatata    720
ctccaaatat gcaaatggaa ttgaaattca acttaaaaaa gcatatgaaa gaattcaagg    780
ttttgagtcg gttcaggtca cccaatttcg aaatggaagc atcgttgctg ggtatgaagt    840
tgttggctcc agcagtgcat ctgaactgct gtcagccatt gaacatgttg ccgagaaggc    900
taagacagcc cttcacaagc tgtttccatt agaagacggc tctttcagag tgttcggaaa    960
agcccagtgt aatgacattg tctttggatt tgggtccaag gatgatgaat ataccctgcc   1020
ctgcagcagt ggctacaggg gaaacatcac agccaagtgt gagtcctctg ggtggcaggt   1080
catcagggag acttgtgtgc tctctctgct tgaagaactg aacaagaatt tcagtatgat   1140
tgtaggcaat gccactgagg cagctgtgtc atccttcgtg caaaatcttt ctgtcatcat   1200
tcggcaaaac ccatcaacca cagtggggaa tctggcttcg gtggtgtcga ttctgagcaa   1260
tatttcatct ctgtcactgg ccagccattt cagggtgtcc aattcaacaa tggaggatgt   1320
catcagtata gctgacaata tccttaattc agcctcagta accaactgga cagtcttact   1380
gcgggaagaa aagtatgcca gctcacggtt actagagaca ttagaaaaca tcagcactct   1440
ggtgcctccg acagctcttc ctctgaattt ttctcggaaa ttcattgact ggaaagggat   1500
tccagtgaac aaaagccaac tcaaaagggg ttacagctat cagattaaaa tgtgtcccca   1560
aaatacatct attcccatca gaggccgtgt gttaattggg tcagaccaat tccagagatc   1620
ccttccagaa actattatca gcatggcctc gttgactctg gggaacattc tacccgtttc   1680
caaaaatgga aatgctcagg tcaatggacc tgtgatatcc acggttattc aaaactattc   1740
cataaatgaa gttttcctat ttttttccaa gatagagtca aacctgagcc agcctcattg   1800
tgtgttttgg gatttcagtc atttgcagtg gaacgatgca ggctgccacc tagtgaatga   1860
aactcaagac atcgtgacgt gccaatgtac tcacttgacc tccttctcca tattgatgtc   1920
accttttgtc ccctctacaa tcttccccgt tgtaaaatgg atcacctatg tgggactggg   1980
tatctccatt ggaagtctca ttttatgcct gatcatcgag gctttgtttt ggaagcagat   2040
taaaaaaagc caaacctctc acacacgtcg tatttgcatg gtgaacatag ccctgtccct   2100
cttgattgct gatgtctggt ttattgttgg tgccacagtg gacaccacgg tgaacccttc   2160
tggagtctgc acagctgctg tgttctttac acacttcttc tacctctctt tgttcttctg   2220
gatgctcatg cttggcatcc tgctggctta ccggatcatc ctcgtgttcc atcacatggc   2280
ccagcatttg atgatggctg ttggattttg cctgggttat gggtgccctc tcattatatc   2340
tgtcattacc attgctgtca cgcaacctag caatacctac aaaaggaaag atgtgtgttg   2400
gcttaactgg tccaatggaa gcaaaccact cctggctttt gttgtccctg cactggctat   2460
tgtggctgtg aacttcgttg tggtgctgct agttctcaca aagctctgga ggccgactgt   2520
```

```
tggggaaaga ctgagtcggg atgacaaggc caccatcatc cgcgtgggga agagcctcct   2580

cattctgacc cctctgctag ggctcacctg gggctttgga ataggaacaa tagtggacag   2640

ccagaatctg gcttggcatg ttatttttgc tttactcaat gcattccagg gatttttat   2700

cttatgcttt ggaatactct tggacagtaa gctgcgacaa cttctgttca acaagttgtc   2760

tgccttaagt tcttggaagc aaacagaaaa gcaaaactca tcagatttat ctgccaaacc   2820

caaattctca aagcctttca acccactgca aaacaaaggc cattatgcat tttctcatac   2880

tggagattcc tccgacaaca tcatgctaac tcagtttgtc tcaaatgaat aaggcaagga   2940

atcataaaat caagaaaaaa tttccagaac aacttgacat ttagagacaa atgtcaatga   3000

agaaattatg ctcagtattc gatcgggttt tctgatttag gggtctggga ataaaacaag   3060

aatgtctcag tggcttcaaa aaaaaaaaaa aaaaa                              3095
```

<210> SEQ ID NO 56
<211> LENGTH: 4071
<212> TYPE: DNA
<213> ORGANISM: Homo sapiens

<400> SEQUENCE: 56

```
tgattcgagc gggaagaggg gggtgggtgg gatcggtggg ggagaccatg acctccagct     60

acgggcacgt tctggagcgg caaccggcgc tgggcggccg cttggacagc ccgggcaacc    120

tcgacaccct gcaggcgaaa aagaacttct ccgtcagtca cctgctagac ctggaggaag    180

ccggggacat ggtggcggca caggcggatg agaacgtggg cgaggctggc cggagcctgc    240

tggagtcgcc gggactcacc agcggcagcg acaccccgca gcaggacaat gaccagctga    300

actcagaaga aaaaaagaag agaaagcagc gaaggaatag gacaaccttc aatagcagcc    360

agctgcaggc tttggagcgt gtctttgagc ggacacacta tcctgatgct tttgtgcgag    420

aagaccttgc ccgccgggtg aacctcaccg aggcgagagt gcaggtgtgg tttcagaacc    480

gaagagccaa gttccgcagg aatgagagag ccatgctagc caataaaaac gcttccctcc    540

tcaaatccta ctcaggagac gtgactgctg tggagcagcc catcgtacct cgtcctgctc    600

cgagacccac cgattatctc tcctggggga cagcgtctcc gtacagatcc tcgtccctcc    660

caagatgttg tttacacgag gggcttcata acggattcta acggaagaca ctgaaaagcg    720

ccatggctac ttattctgcc acatgtgcca acaatagccc tgcacagggc atcaacatgg    780

ccaacagcat tgccaacctg agactgaagg ccaaggaata tagtttacag aggaaccagg    840

tgccaacagt caactgagga aaaaaaataa ttaaacaggc ctaagaagaa atcaaaaacc    900

ataagacacc tatcctgctc tgttatttct tcatctgctg gggggaaaaa gtaaattaca    960

aacaaacaaa caaagcagaa ctaaaatatt gggaccatgg cagagaaaag caggagagga   1020

gcaaaatgaa aattagttaa caaatgttcc tcctccctct gggataccac caccacttgt   1080

ttctgtgtgt gtttattttg tttttctttc attcatgctt tgcttaatgt actccaggct   1140

tcttcagata ggttcagccc acccaccccc atgattgtat gaagttttaa aaaaaactac   1200

agcagccaaa gaaactatat atatatatat atatatatat atccagaatg attgcctcta   1260

ctgtcctcat tgacttgttt gaaccttagt gccttaccct gtcctcttcc cagttctctt   1320

tatagaagct ctaggagctt tcgaaaagcc aaagtctttc tgaagaatct gtgctggaca   1380

gacataattc cctttctcat tgtctccatc tttgttggtc atggtaaggt ttttccatca   1440

gcctctgaaa aaatagttgt gcacaacatc tgctcactgg actgtctgat ccaatgtaat   1500
```

```
tggctgcgtc tggctaattc taagcactaa agtctacatc taagctatag atttaagctt   1560
gaagctacag attatatcac tatcaccacc acccctcacc ctatgcaatc aatcaatcaa   1620
tcatcttaag ttaaagatat ttgttgtctt tgaatgattt gctgtcacag actatttggt   1680
agaagaaata tttttcacct gagagaggaa gagaaatttc tctagtaaca caaagagtga   1740
gttctaaaag gcatgcccac atctctttcg tgccttaagg atagtgagat gcacacttat   1800
atatatactg tatatattta tatatttata tatatatttc atatatatat ataatattgc   1860
aagcttaagt ttgcaatttc ccaaacaata caaaaagcaa attacacacc ctcaccactg   1920
ttcttatctc tatagtgatg aaacattaat tagggatctt gctgcttttc tttttctaca   1980
cgaagttttc attaaagcca cagaataatt gatagggcag ctgtttgaga acaggtccca   2040
ttttcacatt agggctttaa atgaattaga aactatttga ggctataaaa atgtccttga   2100
gtttggagcc tgagctctgg tgaaatgctg atacatctga tctatcatgg gaattgcagt   2160
tagagagagt aaggaatacc atttagtcat ctatccgttc ttcacttagc aggaatatga   2220
aagaaaggca catgtttaag aggaatacct aaaggttttt ctaaattcca acatttaaaa   2280
ggcaattgtg ggctattttt atttttaat attttgaaat aaagtttagt gtctagggct   2340
gggagccagg actgatcttc catttctttt tctttgttcc cagccatgct tttgtaactt   2400
gccaggtgga cttgaccaac tacattacca tgctgtgcct cagtttaccc atttgtaaaa   2460
tgggattaat aatacttacc tacctcacag gggtgttgtg aggctctatt catttgctcc   2520
tttattcttt cctgtattct ctgtatgtcc agcactttgt agccatggga ggaaagggac   2580
tataaaagtg tacaatgtta atggaatgat acggtacctg aaagccttgt tttctagtaa   2640
gaaaatgcta ccttgctgta catacttata accttgtatt tggaaatgag aaataggttt   2700
atattttcag atctctcaaa aatcacatca tttgaccaaa gaataattta agacacatag   2760
aacagatttt tttaatttat attttcatcc tgaccagctt agttctaata atttttagtt   2820
gtgagtgatt aaaaaacttt ggatcaattt tggtcaaaca tgccaacttt gtagtctgag   2880
tgacaggcaa ggatttttgg gtttaagatg cacttttagc acacatttgt atttcccttg   2940
gcatatcaga ttgagctaat ggtgatgtta tttcaatcta acagccacca atctgaaatt   3000
gtatttcaaa tgttgattct gtagttcttt aaataataat gaagctcatc ttatacattt   3060
tgctttcacc aattgattcc ttcttctttt agcccactat taaaacattt cttactgaat   3120
ggttcatgta ggcttgctga acagcacgca ttacttgctt cctgaagagt tcccccattc   3180
atccatttgt cccattagtt gctgtggatt atcaagtttt gaaggaactg tacatcccaa   3240
cagactgaaa cattctaagt gaaatgagta taatccaagt aactggtgaa ctttggaggt   3300
ttggagcttg aagagaatgg ctaagaagat ttgaattata gggagggaac agaaatcata   3360
catgaaaagg ttttactgag aaggggaaaa ccttagatag agggacatgt gaaacaaaat   3420
catttgaaat tttgattcag acatccattt ccagtggcaa acagcaaagc ctgaacccat   3480
aaacccaaat gataggtgaa gttgggtggt tttatccaat gtctcaagca agcaatgtct   3540
gggaatatca tagagtaaca agtgctggtc agccaaagaa acattcactg ctggtgaacc   3600
aataccataa gcatgtatta tctaagcact tgatcaagaa atatacatgt tgtacaagct   3660
ctcaattttg ttcatttatt atcaaatttt taaaatacaa gtttggtatg tgatttggaa   3720
aagatgcctt ctggatctta agccagttgt cagtggaggt cctcagggct gcaaatgtca   3780
agacataacc ctgttcctca ccatcatgat accagataca ggtgaataca taggaactat   3840
ctgcctgtgt cctcaatctc ccttcaaaca agatgctgat ttgtagggta cttggcaggt   3900
```

```
taaattaaac cagaagaggt gacttaataa aaaagggaat gacatttagg gtataaagat   3960

ctcataagaa atgtaatatg taaattatat cttgctttat gttgtaaaat atacattgtt   4020

tgcgctagaa tagaaatgat ttcttttcaa taaaaagaaa gaaggactct a            4071
```

<210> SEQ ID NO 57
<211> LENGTH: 3999
<212> TYPE: DNA
<213> ORGANISM: Homo sapiens

<400> SEQUENCE: 57

```
tgattcgagc gggaagaggg gggtgggtgg gatcggtggg ggagaccatg acctccagct     60

acgggcacgt tctggagcgg caaccggcgc tgggcggccg cttggacagc ccgggcaacc    120

tcgacaccct gcaggcgaaa aagaacttct ccgtcagtca cctgctagac ctggaggaag    180

ccggggacat ggtggcggca caggcggatg agaacgtggg cgaggctggc cggagcctgc    240

tggagtcgcc gggactcacc agcggcagcg acaccccgca gcaggacaat gaccagctga    300

actcagaaga aaaaaagaag agaaagcagc gaaggaatag gacaaccttc aatagcagcc    360

agctgcaggc tttggagcgt gtctttgagc ggacacacta tcctgatgct tttgtgcgag    420

aagaccttgc ccgccgggtg aacctcaccg aggcgagagt gcaggtgtgg tttcagaacc    480

gaagagccaa gttccgcagg aatgagagag ccatgctagc caataaaaac gcttccctcc    540

tcaaatccta ctcaggagac gtgactgctg tggagcagcc catcgtacct cgtcctgctc    600

cgagacccac cgattatctc tcctggggga cagcgtctcc gtacagcgcc atggctactt    660

attctgccac atgtgccaac aatagccctg cacagggcat caacatggcc aacagcattg    720

ccaacctgag actgaaggcc aaggaatata gtttacagag gaaccaggtg ccaacagtca    780

actgaggaaa aaaaataatt aaacaggcct aagaagaaat caaaaaccat aagacaccta    840

tcctgctctg ttatttcttc atctgctggg gggaaaaagt aaattacaaa caaacaaaca    900

aagcagaact aaaatattgg gaccatggca gagaaaagca ggagaggagc aaaatgaaaa    960

ttagttaaca aatgttcctc ctccctctgg gataccacca ccacttgttt ctgtgtgtgt   1020

ttattttgtt tttctttcat tcatgctttg cttaatgtac tccaggcttc ttcagatagg   1080

ttcagcccac ccacccccat gattgtatga agttttaaaa aaaactacag cagccaaaga   1140

aactatatat atatatatat atatatatat ccagaatgat tgcctctact gtcctcattg   1200

acttgtttga accttagtgc cttaccctgt cctcttccca gttctcttta tagaagctct   1260

aggagctttc gaaaagccaa agtctttctg aagaatctgt gctggacaga cataattccc   1320

tttctcattg tctccatctt tgttggtcat ggtaaggttt ttccatcagc ctctgaaaaa   1380

atagttgtgc acaacatctg ctcactggac tgtctgatcc aatgtaattg gctgcgtctg   1440

gctaattcta agcactaaag tctacatcta agctatagat ttaagcttga agctacagat   1500

tatatcacta tcaccaccac ccctcaccct atgcaatcaa tcaatcaatc atcttaagtt   1560

aaagatattt gttgtctttg aatgatttgc tgtcacagac tatttggtag aagaaatatt   1620

tttcacctga gagaggaaga gaaatttctc tagtaacaca aagagtgagt tctaaaaggc   1680

atgcccacat ctctttcgtg ccttaaggat agtgagatgc acacttatat atatactgta   1740

tatatttata tatttatata tatatttcat atatatatat aatattgcaa gcttaagttt   1800

gcaatttccc aaacaataca aaaagcaaat tacacaccct caccactgtt cttatctcta   1860

tagtgatgaa acattaatta gggatcttgc tgcttttctt tttctacacg aagttttcat   1920
```

```
taaagccaca gaataattga tagggcagct gtttgagaac aggtcccatt ttcacattag   1980
ggctttaaat gaattagaaa ctatttgagg ctataaaaat gtccttgagt ttggagcctg   2040
agctctggtg aaatgctgat acatctgatc tatcatggga attgcagtta gagagagtaa   2100
ggaataccat ttagtcatct atccgttctt cacttagcag gaatatgaaa gaaaggcaca   2160
tgtttaagag gaatacctaa aggtttttct aaattccaac atttaaaagg caattgtggg   2220
ctatttttat tttttaatat tttgaaataa agtttagtgt ctagggctgg gagccaggac   2280
tgatcttcca tttctttttc tttgttccca gccatgcttt tgtaacttgc caggtggact   2340
tgaccaacta cattaccatg ctgtgcctca gtttacccat ttgtaaaatg ggattaataa   2400
tacttaccta cctcacaggg gtgttgtgag gctctattca tttgctcctt tattctttcc   2460
tgtattctct gtatgtccag cactttgtag ccatgggagg aaagggacta taaaagtgta   2520
caatgttaat ggaatgatac ggtacctgaa agccttgttt tctagtaaga aaatgctacc   2580
ttgctgtaca tacttataac cttgtatttg gaaatgagaa ataggtttat attttcagat   2640
ctctcaaaaa tcacatcatt tgaccaaaga ataatttaag acacatagaa cagatttttt   2700
taatttatat tttcatcctg accagcttag ttctaataat ttttagttgt gagtgattaa   2760
aaaactttgg atcaattttg gtcaaacatg ccaactttgt agtctgagtg acaggcaagg   2820
atttttgggt ttaagatgca cttttagcac acatttgtat ttcccttggc atatcagatt   2880
gagctaatgg tgatgttatt tcaatctaac agccaccaat ctgaaattgt atttcaaatg   2940
ttgattctgt agttctttaa ataataatga agctcatctt atacattttg ctttcaccaa   3000
ttgattcctt cttcttttag cccactatta aaacatttct tactgaatgg ttcatgtagg   3060
cttgctgaac agcacgcatt acttgcttcc tgaagagttc ccccattcat ccatttgtcc   3120
cattagttgc tgtggattat caagttttga aggaactgta catcccaaca gactgaaaca   3180
ttctaagtga aatgagtata atccaagtaa ctggtgaact ttggaggttt ggagcttgaa   3240
gagaatggct aagaagattt gaattatagg gagggaacag aaatcataca tgaaaaggtt   3300
ttactgagaa ggggaaaacc ttagatagag ggacatgtga aacaaaatca tttgaaattt   3360
tgattcagac atccatttcc agtggcaaac agcaaagcct gaacccataa acccaaatga   3420
taggtgaagt tgggtggttt tatccaatgt ctcaagcaag caatgtctgg gaatatcata   3480
gagtaacaag tgctggtcag ccaaagaaac attcactgct ggtgaaccaa taccataagc   3540
atgtattatc taagcacttg atcaagaaat atacatgttg tacaagctct caattttgtt   3600
catttattat caaattttta aaatacaagt ttggtatgtg atttggaaaa gatgccttct   3660
ggatcttaag ccagttgtca gtggaggtcc tcagggctgc aaatgtcaag acataaccct   3720
gttcctcacc atcatgatac cagatacagg tgaatacata ggaactatct gcctgtgtcc   3780
tcaatctccc ttcaaacaag atgctgattt gtagggtact tggcaggtta aattaaacca   3840
gaagaggtga cttaataaaa aagggaatga catttagggt ataaagatct cataagaaat   3900
gtaatatgta aattatatct tgctttatgt tgtaaaatat acattgtttg cgctagaata   3960
gaaatgattt cttttcaata aaaagaaaga aggactcta                          3999
```

<210> SEQ ID NO 58
<211> LENGTH: 2466
<212> TYPE: DNA
<213> ORGANISM: Homo sapiens

<400> SEQUENCE: 58

```
ggctgagtgg tttgctcctt cccctctctc tgggaggctg agcaggggtg ccgggttgct     60
```

caggccatgg gagccacacc tgttattgct gcctctgatt tgtgtgacac tgagaagccc 120
acaggcctgt ccctccaact cggtggaccc tctctgtgtg catttggtgt gtgagccagc 180
tctgagaagg gttcagaagc cactggaggc atctggggac ctcagcttcc atgccatctc 240
tgcctcactc ccacagggta atgttggact cggtgacaca cagcaccttc ctgcctaatg 300
catccttctg cgatcccctg atgtcgtgga ctgatctgtt cagcaatgaa gagtactacc 360
ctgcctttga gcatcagaca gcctgtgact catactggac atcagtccac cctgaatact 420
ggactaagcg ccatgtgtgg gagtggctcc agttctgctg cgaccagtac aagttggaca 480
ccaattgcat ctccttctgc aacttcaaca tcagtggcct gcagctgtgc agcatgacac 540
aggaggagtt cgtcgaggca gctggcctct gcggcgagta cctgtacttc atcctccaga 600
acatccgcac acaaggttac tccttttta atgacgctga agaaagcaag gccaccatca 660
aagactatgc tgattccaac tgcttgaaaa caagtggcat caaaagtcaa gactgtcaca 720
gtcatagtag aacaagcctc caaagttctc atctatggga atttgtacga gacctgcttc 780
tatctcctga agaaaactgt ggcattctgg aatgggaaga tagggaacaa ggaatttttc 840
gggtggttaa atcggaagcc ctggcaaaga tgtggggaca aaggaagaaa aatgacagaa 900
tgacatatga aaagttgagc agagccctga gatactacta taaaacagga attttggagc 960
gggttgaccg aaggttagtg tacaaatttg gaaaaaatgc acacgggtgg caggaagaca 1020
agctatgatc tgctccaggc atcaagctca ttttatggat ttctgtcttt taaaacaatc 1080
agattgcaat agacattcga aaggcttcat tttcttctct tttttttaa cctgcaaaca 1140
tgctgataaa atttctccac atctcagctt acatttggat tcagagttgt tgtctacgga 1200
gggtgagagc agaaactctt aagaaatcct ttcttctccc taaggggatg aggggatgat 1260
cttttgtggt gtcttgatca aactttattt tcctagagtt gtggaatgac aacagcccat 1320
gccattgatg ctgatcagag aaaaactatt caattctgcc attagagaca catccaatgc 1380
tcccatccca aaggttcaaa agttttcaaa taactgtggc agctcaccaa aggtggggga 1440
aagcatgatt agtttgcagg ttatggtagg agagggtgag atataagaca tacatacttt 1500
agattttaaa ttattaaagt caaaaatcca tagaaaagta tccctttttt tttttttgag 1560
acgggttctc actatgttgc ccagggctgg tcttgaactc ctatgctcaa gtgatcctcc 1620
cacctcggcc tcccaaagta ctgtgattac aagcgtgagc cacggcacct gggcagaaaa 1680
gtatcttaat taatgaaaga gctaagccat caagctggga cttaattgga tttaacatag 1740
gttcacagaa agtttcctaa ccagagcatc tttttgacca ctcagcaaaa cttccacaga 1800
catccttctg gacttaaaca cttaacatta accacattat taattgttgc tgagtttatt 1860
ccccttcta actgatggct ggcatctgat atgcagagtt agtcaacaga cactggcatc 1920
aattacaaaa tcactgctgt ttctgtgatt caagctgtca acacaataaa atcgaaattc 1980
attgattcca tctctggtcc agatgttaaa cgtttataaa accggaaatg tcctaacaac 2040
tctgtaatgg caaattaaat tgtgtgtctt ttttgttttg tctttctacc tgatgtgtat 2100
tcaagcgcta taacacgtat ttccttgaca aaaatagtga cagtgaattc acactaataa 2160
atgttcatag gttaaagtct gcactgacat tttctcatca atcactggta tgtaagttat 2220
cagtgactga cagctaggtg gactgcccct aggacttctg tttcaccaga gcaggaatca 2280
agtggtgagg cactgaatcg ctgtacaggc tgaagacctc cttattagag ttgaacttca 2340
aagtaacttg ttttaaaaaa tgtgaattac tgtaaaataa tctattttgg attcatgtgt 2400

```
tttccaggtg gatatagttt gtaaacaatg tgaataaagt atttaacatg taaaaaaaaa   2460

aaaaaa                                                              2466


<210> SEQ ID NO 59
<211> LENGTH: 3127
<212> TYPE: DNA
<213> ORGANISM: Homo sapiens

<400> SEQUENCE: 59

gaagctccac accagccatt acaaccctgc caatctcaag cacctgcctc tacagttggt     60

acagatggca ttgtcccagt ctgttccctt ctcggccaca gagcttctcc tggcctctgc    120

catcttctgc ctggtattct gggtgctcaa gggtttgagg cctcgggtcc ccaaaggcct    180

gaaaagtcca ccagagccat ggggctggcc cttgctcggg catgtgctga ccctggggaa    240

gaacccgcac ctggcactgt caaggatgag ccagcgctac ggggacgtcc tgcagatccg    300

cattggctcc acgcccgtgc tggtgctgag ccgcctggac accatccggc aggccctggt    360

gcggcagggc gacgatttca agggccggcc tgacctctac acctccaccc tcatcactga    420

tggccagagc ttgaccttca gcacagactc tggaccggtg tgggctgccc gccggcgcct    480

ggcccagaat gccctcaaca ccttctccat cgcctctgac ccagcttcct catcctcctg    540

ctacctggag gagcatgtga gcaaggaggc taaggccctg atcagcaggt tgcaggagct    600

gatggcaggg cctgggcact tcgaccctta caatcaggtg gtggtgtcag tggccaacgt    660

cattggtgcc atgtgcttcg gacagcactt ccctgagagt agcgatgaga tgctcagcct    720

cgtgaagaac actcatgagt tcgtggagac tgcctcctcc gggaaccccc tggacttctt    780

ccccatcctt cgctacctgc ctaaccctgc cctgcagagg ttcaaggcct tcaaccagag    840

gttcctgtgg ttcctgcaga aaacagtcca ggagcactat caggactttg acaagaacag    900

tgtccgggac atcacgggtg ccctgttcaa gcacagcaag aaggggccta gagccagcgg    960

caacctcatc ccacaggaga agattgtcaa ccttgtcaat gacatctttg gagcaggatt   1020

tgacacagtc accacagcca tctcctggag cctcatgtac cttgtgacca agcctgagat   1080

acagaggaag atccagaagg agctggacac tgtgattggc agggagcggc ggccccggct   1140

ctctgacaga ccccagctgc cctacttgga ggccttcatc ctggagacct tccgacactc   1200

ctccttcttg cccttcacca tcccccacag cacaacaagg gacacaacgc tgaatggctt   1260

ctacatcccc aagaaatgct gtgtcttcgt aaaccagtgg caggtcaacc atgacccaga   1320

gctgtgggag gacccctctg agttccggcc tgagcggttc ctcaccgccg atggcactgc   1380

cattaacaag cccttgagtg agaagatgat gctgtttggc atgggcaagc gccggtgtat   1440

cggggaagtc ctggccaagt gggagatctt cctcttcctg gccatcctgc tacagcaact   1500

ggagttcagc gtgccgccgg gcgtgaaagt cgacctgacc cccatctacg ggctgaccat   1560

gaagcacgcc cgctgtgaac atgtccaggc gcggctgcgc ttctccatca attgaagaag   1620

acaccaccat tctgaggcca gggagcgagt gggggccagc cacggggact cagcccttgt   1680

ttctcttcct ttctttttt aaaaaatagc agctttagcc aagtgcaggg cctgtaatcc   1740

cagcatttta ggaggccaag gttggaggat catttgagcc caggaattgg aaagcagcct   1800

ggccaacata gtgggaccct gtctctacaa aaaaaaaatt tgccaagagc ctgagtgaca   1860

gagcaagacc ccatctcaaa aaaaaaaaca aacaaacaaa aaaaaaacca tatatataca   1920

tatatatata gcagctttat ggagatataa ttcttatgcc atataattca ccttcttttt   1980

tttttttgt ctgagacaga atctcagtct gtcacccagg ttggagtgca gtggcgtgat   2040
```

-continued

```
ctcagctcac tgcaacctcc acctcgcagg ttcaagcaat cctcccactt cagcctccca   2100
agcacctggg attacaagca tgagtcacta cgcctggctg atttttgtag ttttagtgga   2160
gatggggttt caccatgttg gccaggcttg tctcgaactc ctgaccccaa gttatccacc   2220
tgccttggct tcccaaagtc ctgggattac aggtgtgagc caccacatcc agcctaactt   2280
acattcttaa agtgtcgaat gacttctagt gtagaattgt gcaaccatca ccagaattaa   2340
ttttattatt cttattattt ttgagacaga gtcttactct gttgccaggc tggagtgcag   2400
tggcgcgatc tcagctcact acaacctccg cctcccatgt tcaagcgatt ctcctgcctc   2460
agcctcccga gtagctggga ctataggcat gcgccaccat ggccagctaa tttttgtatt   2520
tttagtagag acgaggtttc actgtgttgg ccaggatggt ctccatctct tgacctcgtg   2580
atccacccgc ctcagcctcc caaagtgctg ggattaacag gtatgaacca ccgcgcccag   2640
cctttttgtt tttttttttt ttgagacaga gtcttcctct gtctcctaag ctggagtgca   2700
gtggcatcat ctcagctcac tgcaacctct gcctcccagg ttcaagtgct tctccagcct   2760
cagcctccca agtagctgag actacaggca cacaccacca cgcctggcta atttttgtat   2820
ttttagtaga gacgggtttc accatgttgg ctagactagt ctcaaactcc tgacctcaag   2880
tgatctgccc gcctcgacct ctctcaaagt gctggcatta caggtgtgag ccacggtgcc   2940
cggcccacaa ttaattttag aacattttca tcacccctaa aagaaaccct gcacccatta   3000
gcagtccctc cacatttccc cctagcctgc ctcccctgcc tcaccagccc tggcaactgc   3060
taatctactt tctgtgtcta tggatttgcc ttctctaaac atttcatata aatggaatta   3120
cacaatg                                                             3127
```

The invention claimed is:

1. A method of treating chronic obstructive pulmonary disease (COPD), in a human subject that is prone to develop progressive COPD involving the appearance of irreversible lung damage, the method comprising:

a) testing the level of RNA expression of the gene KIAA1199 in a lung tissue sample obtained from the human subject;

b) comparing the level of RNA expression of KIAA1199 in the lung tissue sample from the human subject to a control RNA expression level of KIAA1199 in a healthy human subject;

c) identifying the subject as being prone to develop progressive COPD involving the appearance of irreversible lung damage based on detecting an increase in the level of RNA expression of KIAA1199 in the lung tissue sample from the human subject as compared to the control RNA expression level of KIAA1199; and d) treating the subject identified in step c) with a drug against COPD.

2. The method of claim 1, wherein the drug against COPD is bitolterol, carbuterol, fenoterol, pirbuterol, procaterol, reproterol, rimiterol, salbutamol, levosalbutamol, terbutaline, tulobuterol, arformoterol, bambuterol, clenbuterol, formoterol, olodaterol, salmeterol, indacaterol, beclometasone, betamethasone, budesonide, ciclesonide, flunisolide, fluticasone, mometasone, triamcinolone, aclidinium bromide, glycopyrronium bromide, ipratropium bromide, oxitropium bromide, tiotropium bromide, cromoglicate, nedocromil, acefylline, ambuphylline, bamifylline, doxofylline, enprofylline, etamiphylline, proxyphylline, theobromine, theophylline, aminophylline, choline theophyllinate, montelukast, pranlukast, zafirlukast, zileuton, ramatroban, seratrodast, ibudilast, roflumilast, amlexanox, eprozinol, fenspiride, omalizumab, epinephrine, hexoprenaline, isoprenaline, isoproterenol, orciprenaline, metaproterenol, atropine, or a pharmaceutically acceptable salt of any of the aforementioned agents, or any combination thereof.

3. The method of claim 1, wherein the drug against COPD is roflumilast.

4. A method of treating or preventing chronic obstructive pulmonary disease (COPD), the method comprising administering a drug against COPD to a human subject that has been identified-as suffering from stable COPD or as being prone to suffer from stable COPD, the human subject having been identified by a method comprising:

a) testing the level of RNA expression of the gene KIAA1199 in a lung tissue sample obtained from the human subject;

b) comparing the level of RNA expression of KIAA1199 in the lung tissue sample from the human subject to a control RNA expression level of KIAA1199 in a healthy human subject; and c) identifying the subject as suffering from stable COPD or as being prone to suffer from stable COPD if the level of RNA expression of KIAA1199 in the lung tissue sample from the human subject is decreased as compared to the control RNA expression level of KIAA1199.

5. The method of claim 4, wherein the drug against COPD is bitolterol, carbuterol, fenoterol, pirbuterol, procaterol, reproterol, rimiterol, salbutamol, levosalbutamol, terbutaline, tulobuterol, arformoterol, bambuterol, clenbuterol, formoterol, olodaterol, salmeterol, indacaterol, beclometasone, betamethasone, budesonide, ciclesonide, flunisolide, fluticasone, mometasone, triamcinolone, aclidinium bromide, glycopyrronium bromide, ipratropium bromide, oxitropium bromide, tiotropium bromide, cromoglicate, nedocromil, acefylline, ambuphylline, bamifylline, doxofylline, enprofylline, etamiphylline, proxyphylline, theobromine, theophylline, aminophylline, choline theophyllinate, montelukast, pranlukast, zafirlukast, zileuton, ramatroban, seratrodast, ibudilast, roflumilast, amlexanox, eprozinol, fenspiride, omalizumab, epinephrine, hexoprenaline, isoprenaline, isoproterenol, orciprenaline, metaproterenol, atropine, or a pharmaceutically acceptable salt of any of the aforementioned agents, or any combination thereof.

6. A method of treating chronic obstructive pulmonary disease (COPD), the method comprising administering a drug against COPD to a human subject suffering from stable COPD and identified as being prone to develop progressive COPD involving the appearance of irreversible lung damage by a method comprising:

a) testing the level of RNA expression of the gene KIAA1199 in a lung tissue sample obtained from the human subject;

b) comparing the level of RNA expression of KIAA1199 in the lung tissue sample from the human subject to a control expression level of KIAA1199 in a human subject suffering from stable COPD; and c) identifying the human subject as being prone to develop progressive COPD involving the appearance of irreversible lung damage if the level of RNA expression of KIAA1199 in the lung tissue sample from the human subject is increased as compared to the control RNA expression level of KIAA1199.

7. The method of claim 6, wherein the drug against COPD is bitolterol, carbuterol, fenoterol, pirbuterol, procaterol, reproterol, rimiterol, salbutamol, levosalbutamol, terbutaline, tulobuterol, arformoterol, bambuterol, clenbuterol, formoterol, olodaterol, salmeterol, indacaterol, beclometasone, betamethasone, budesonide, ciclesonide, flunisolide, fluticasone, mometasone, triamcinolone, aclidinium bromide, glycopyrronium bromide, ipratropium bromide, oxitropium bromide, tiotropium bromide, cromoglicate, nedocromil, acefylline, ambuphylline, bamifylline, doxofylline, enprofylline, etamiphylline, proxyphylline, theobromine, theophylline, aminophylline, choline theophyllinate, montelukast, pranlukast, zafirlukast, zileuton, ramatroban, seratrodast, ibudilast, roflumilast, amlexanox, eprozinol, fenspiride, omalizumab, epinephrine, hexoprenaline, isoprenaline, isoproterenol, orciprenaline, metaproterenol, atropine, or a pharmaceutically acceptable salt of any of the aforementioned agents, or any combination thereof.

8. The method of claim 1, further comprising:

testing the level of RNA expression of one or more further genes, the one or more further gene(s) being DMBT1, TMSB15A, DPP6, SLC51B, NUDT11, ELF5, AZGP1, PRRX1, AQP3, SFN, GPR110, GDF15, RASGRF2, RND1, PLA1A, FGG, CEACAM5, HYAL2, AHRR, CXCL3, CYP1A1, CYP1B1, CYP1A2, CST6, NTRK2, COMP, ITGA10, CTHRC1, TAL1, FIBIN, BEX5, BEX1, ESM1 or GHRL in the lung tissue sample obtained from the human subject;

comparing the level of RNA expression of the one or more further genes to a control expression level of the one or more further gene(s) in a healthy human subject an increase in the level of RNA expression of KIAA1199, DMBT1, ELF5, AZGP1, PRRX1, AQP3, SFN, GPR110, GDF15, RASGRF2, RND1, FGG, CEACAM5, AHRR, CXCL3, CYP1A1, CYP1B1, CYP1A2, NTRK2 and/or COMP in the lung tissue sample from the human subject as compared to the control RNA expression level of the one or more further gene(s) being indicative of a proneness to develop progressive COPD, and a decrease in the level of RNA expression of TMSB15A, DPP6, SLC51B, NUDT11, PLA1A, HYAL2, CST6, ITGA10, CTHRC1, TAL1, FIBIN, BEX5, BEX1, ESM1 and/or GHRL in the lung tissue sample from the human subject as compared to the control RNA expression level of the one or more further gene(s) being indicative of a proneness to develop progressive COPD.

9. The method of claim 8, wherein the level of RNA expression of DMBT1 and TMSB15A is tested.

10. The method of claim 8, comprising testing the lung tissue sample to determine the level of RNA expression of DMBT1, TMSB15A and at least one further gene that is FGG, CYP1A1, CEACAM5, CTHRC1, NTRK2, RASGRF2, ELF5, AZGP1, PRRX1, AQP3, SFN, GPR110, GDF15, RASGRF2, RND1, DPP6, SLC51B or NUDT11.

11. The method of claim 8, comprising testing the lung tissue sample to determine that the subject is prone to develop progressive COPD involving the appearance of irreversible lung damage if the level of RNA expression of a majority of the number of genes tested is altered in the sense that (i) the level of RNA expression of KIAA1199, DMBT1, ELF5, AZGP1, PRRX1, AQP3, SFN, GPR110, GDF15, RASGRF2, RND1, FGG, CEACAM5, AHRR, CXCL3, CYP1A1, CYP1B1, CYP1A2, NTRK2 and/or COMP in the sample from the subject is increased as compared to the control RNA expression level of the gene(s) and (ii) the level of RNA expression of TMSB15A, DPP6, SLC51B, NUDT11, PLA1A, HYAL2, CST6, ITGA10, CTHRC1, TAL1, FIBIN, BEX5, BEX1, ESM1 and/or GHRL in the sample from the subject is decreased as compared to the control expression level of the gene(s).

12. The method of claim 8, comprising testing the lung tissue sample to determine that the subject is prone to develop progressive COPD involving the appearance of irreversible lung damage if the level of RNA expression of a majority of the number of genes tested is altered in the sense that (i) the level of RNA expression of KIAA1199, DMBT1, ELF5, AZGP1, PRRX1, AQP3, SFN, GPR110, GDF15, RASGRF2, RND1, FGG, CEACAM5, AHRR, CXCL3, CYP1A1, CYP1B1, CYP1A2, NTRK2 and/or COMP in the sample from the subject is at least 3-fold increased as compared to the control RNA expression level of the gene(s) and (ii) the level of RNA expression of TMSB15A, DPP6, SLC51B, NUDT11, PLA1A, HYAL2, CST6, ITGA10, CTHRC1, TAL1, FIBIN, BEX5, BEX1, ESM1 and/or GHRL in the sample from the subject is at least 3-fold decreased as compared to the control RNA expression level of the gene(s).

13. The method of claim 8, comprising testing the lung tissue sample to determine that the subject is prone to develop progressive COPD involving the appearance of irreversible lung damage if the level of RNA expression of at least 70% of the number of genes tested is altered in the sense that (i) the level of RNA expression of KIAA1199, DMBT1, ELF5, AZGP1, PRRX1, AQP3, SFN, GPR110, GDF15, RASGRF2, RND1, FGG, CEACAM5, AHRR, CXCL3, CYP1A1, CYP1B1, CYP1A2, NTRK2 and/or COMP in the sample from the subject is increased as compared to the control RNA expression level of the gene(s) and (ii) the level of RNA expression of TMSB15A, DPP6, SLC51B, NUDT11, PLA1A, HYAL2, CST6, ITGA10, CTHRC1, TAL1, FIBIN, BEX5, BEX1, ESM1 and/or GHRL in the sample from the subject is decreased as compared to the control RNA expression level of the gene(s).

14. The method of claim 8, comprising testing the lung tissue sample to determine that the subject is prone to develop progressive COPD involving the appearance of irreversible lung damage if the level of RNA expression of at least 70% of the number of genes tested is altered in the sense that (i) the level of RNA expression of KIAA1199, DMBT1, ELF5, AZGP1, PRRX1, AQP3, SFN, GPR110, GDF15, RASGRF2, RND1, FGG, CEACAM5, AHRR, CXCL3, CYP1A1, CYP1B1, CYP1A2, NTRK2 and/or COMP in the sample from the subject is at least 3-fold increased as compared to the control RNA expression level of the gene(s) and (ii) the level of RNA expression of TMSB15A, DPP6, SLC51B, NUDT11, PLA1A, HYAL2, CST6, ITGA10, CTHRC1, TAL1, FIBIN, BEX5, BEX1, ESM1 and/or GHRL in the sample from the subject is at least 3-fold decreased as compared to the control RNA expression level of the gene(s).

15. The method of claim 1, the sample obtained from the subject being a transbronchial lung biopsy sample or a bronchoalveolar lavage sample.

16. The method of claim 1, the level of RNA expression being determined using a quantitative reverse transcriptase polymerase chain reaction or a microarray.

17. The method of claim 4, further comprising:

testing the level of RNA expression of one or more further genes, the one or more further genes being DMBT1, TMSB15A, DPP6, SLC51B, NUDT11, ELF5, AZGP1, PRRX1, AQP3, SFN, GPR110, GDF15, RASGRF2, RND1, PLA1A, FGG, CEACAM5, HYAL2, AHRR, CXCL3, CYP1A1, CYP1B1, CYP1A2, CST6, NTRK2, COMP, ITGA10, CTHRC1, TAL1, FIBIN, BEX5, BEX1, ESM1 or GHRL in the lung tissue sample obtained from the human subject;

comparing the level of RNA expression of the one or more further genes to a control RNA expression level of the one or more gene(s) in a healthy human subject; and an increase in the level of RNA expression of DMBT1, ELF5, AZGP1, PRRX1, AQP3, SFN, GPR110, GDF15, RASGRF2, RND1, FGG, CEACAM5, AHRR, CXCL3, CYP1A1, CYP1B1, CYP1A2, NTRK2 and/or COMP in the lung tissue sample from the human subject as compared to the control RNA expression level of the one or more gene(s) being indicative of stable COPD or a proneness to stable COPD, and a decrease in the level of RNA expression of KIAA1199, TMSB15A, DPP6, SLC51B, NUDT11, PLA1A, HYAL2, CST6, ITGA10, CTHRC1, TAL1, FIBIN, BEX5, BEX1, ESM1 and/or GHRL in the lung tissue sample from the human subject as compared to the control RNA expression level of the one or more further gene(s) being indicative of stable COPD or a proneness to stable COPD.

18. The method of claim 17, comprising testing the lung tissue sample to determine if the human subject suffers from stable COPD or is prone to suffer from stable COPD if the level of RNA expression of a majority of the number of genes tested is altered in the sense that (i) the level of RNA expression of DMBT1, ELF5, AZGP1, PRRX1, AQP3, SFN, GPR110, GDF15, RASGRF2, RND1, FGG, CEACAM5, AHRR, CXCL3, CYP1A1, CYP1B1, CYP1A2, NTRK2 and/or COMP in the lung tissue sample from the human subject is increased as compared to the control RNA expression level of the one or more gene(s) and (ii) the level of RNA expression of KIAA1199, TMSB15A, DPP6, SLC51B, NUDT11, PLA1A, HYAL2, CST6, ITGA10, CTHRC1, TAL1, FIBIN, BEX5, BEX1, ESM1 and/or GHRL in the lung tissue sample from the human subject is decreased as compared to the control RNA expression level of the one or more gene(s).

19. The method of claim 17, comprising testing the lung tissue sample to determine if the human subject suffers from stable COPD or is prone to suffer from stable COPD if the level of RNA expression of at least 70% of the number of genes tested is altered in the sense that (i) the level of RNA expression of DMBT1, ELF5, AZGP1, PRRX1, AQP3, SFN, GPR110, GDF15, RASGRF2, RND1, FGG, CEACAM5, AHRR, CXCL3, CYP1A1, CYP1B1, CYP1A2, NTRK2 and/or COMP in the lung tissue sample from the human subject is at least 3-fold increased as compared to the control expression level of the gene(s) and (ii) the level of RNA expression of KIAA1199, TMSB15A, DPP6, SLC51B, NUDT11, PLA1A, HYAL2, CST6, ITGA10, CTHRC1, TAL1, FIBIN, BEX5, BEX1, ESM1 and/or GHRL in the lung tissue sample from the human subject is at least 3-fold decreased as compared to the control RNA expression level of the gene(s).

20. The method of claim 4, the level of RNA expression being determined using a quantitative reverse transcriptase polymerase chain reaction or a microarray.

* * * * *